US010686285B2

(12) United States Patent
Cai et al.

(10) Patent No.: US 10,686,285 B2
(45) Date of Patent: Jun. 16, 2020

(54) TRAVEL ADAPTER WITH INTEGRATED PLUGS MEETING DIFFERENT PLUG STANDARDS

(71) Applicant: GONGNIU GROUP CO., LTD., Zhejiang (CN)

(72) Inventors: Yingfeng Cai, Zhejiang (CN); Jie Yang, Zhejiang (CN); Huijiu Wang, Zhejiang (CN); Zhen Li, Zhejiang (CN); Honggen Liu, Zhejiang (CN)

(73) Assignee: GONGNIU GROUP CO., LTD., Zhejiang (CN)

( * ) Notice: Subject to any disclaimer, the term of this patent is extended or adjusted under 35 U.S.C. 154(b) by 0 days.

(21) Appl. No.: 15/774,939

(22) PCT Filed: Nov. 11, 2016

(86) PCT No.: PCT/CN2016/105465
§ 371 (c)(1),
(2) Date: May 9, 2018

(87) PCT Pub. No.: WO2017/080508
PCT Pub. Date: May 18, 2017

(65) Prior Publication Data

US 2018/0337501 A1 Nov. 22, 2018

(30) Foreign Application Priority Data

Nov. 11, 2015 (CN) ..... 2015 2 0893420 U

(51) Int. Cl.
*H01R 31/06* (2006.01)
*H01R 27/00* (2006.01)
(Continued)

(52) U.S. Cl.
CPC ..... *H01R 31/06* (2013.01); *H01R 13/447* (2013.01); *H01R 13/631* (2013.01);
(Continued)

(58) Field of Classification Search
CPC .... H01R 31/06; H01R 29/00; H01R 13/6485; H01R 13/447; H01R 13/631; H01R 27/00; H01R 13/645; H01R 13/6453
(Continued)

(56) References Cited

U.S. PATENT DOCUMENTS 7,060,897 B2 * 6/2006 Gorman ..... H01R 13/447 174/135
7,614,892 B2 * 11/2009 Klant ..... H01R 31/06 439/172
(Continued)

FOREIGN PATENT DOCUMENTS

CN 201234043 5/2009
CN 201508981 6/2010
(Continued)

OTHER PUBLICATIONS

Machine Translation CN201234043, [online], [retrieved on May 28, 2019], retrieved from http://translationportal.epo.org/emtp/translate/?ACTION=description-retrieval&COUNTRY=CN&ENGINE=google&FORMAT=docdb&KIND=Y&LOCALE=en_EP&NUMBER=201234043&OPS=ops.epo.org/3.2&SRCLANG=zh&TRGLANG=en (Year: 2019).*
(Continued)

*Primary Examiner* — Travis S Chambers
(74) *Attorney, Agent, or Firm* — IP & T Group LLP

(57) ABSTRACT

A travel adapter, belonging to the technical field of plugs. The travel adapter comprises a housing (10), a plug bush seat (11), a support frame (71) and a pin assembly (12), the plug bush seat (11) being provided in the housing (10), the support frame (71) being located under the plug bush seat (11) and connected to the plug bush seat (11), multiple sets of the plug assemblies (12) being provided on the support frame (71), respectively; the support frame (71) being fixedly connected on the plug bush seat (11) in a vertical
(Continued)

direction, and sliding along the plug bush seat (11) in a horizontal direction. The travel adapter can integrate plugs meeting the plug standards of different countries into one adapter and is easily to switch, solving the problem of the use of plugs during the travel in multiple countries.

20 Claims, 127 Drawing Sheets

(51) Int. Cl.
*H01R 13/447* (2006.01)
*H01R 13/631* (2006.01)
*H01R 13/648* (2006.01)
*H01R 29/00* (2006.01)

(52) U.S. Cl.
CPC ..... *H01R 13/6485* (2013.01); *H01R 27/00* (2013.01); *H01R 29/00* (2013.01)

(58) Field of Classification Search
USPC ..... 439/131, 161, 171, 174, 151, 170, 172, 439/173
See application file for complete search history.

(56) References Cited

U.S. PATENT DOCUMENTS

| | | | | |
|---|---|---|---|---|
| 7,950,938 | B1 | 5/2011 | Teoh | |
| 2013/0244457 | A1* | 9/2013 | Ruffner | H01R 27/00 439/105 |
| 2014/0199867 | A1* | 7/2014 | Rogers | H01R 27/00 439/173 |

FOREIGN PATENT DOCUMENTS

| | | |
|---|---|---|
| CN | 101872911 | 10/2010 |
| CN | 102074868 | 5/2011 |
| CN | 103378504 | 10/2013 |
| CN | 204424645 | 6/2015 |
| CN | 204424652 | 6/2015 |
| CN | 204558843 U | 8/2015 |
| CN | 105206993 | 12/2015 |
| CN | 105261907 | 1/2016 |
| CN | 105261908 | 1/2016 |
| CN | 204966838 | 1/2016 |
| CN | 204966860 | 1/2016 |
| CN | 204966896 | 1/2016 |
| CN | 204966897 | 1/2016 |
| CN | 204966898 | 1/2016 |
| CN | 204966913 | 1/2016 |
| CN | 205029094 | 2/2016 |
| CN | 205070021 | 3/2016 |
| CN | 205141261 | 4/2016 |
| CN | 205335482 | 6/2016 |
| DE | 10 2011 014 920 | 9/2012 |
| EP | 2822110 | 1/2015 |
| JP | 1989-143081 | 9/1989 |
| JP | 1992-131871 | 12/1992 |
| JP | 3086713 | 7/2002 |
| JP | 2004-335352 | 11/2004 |
| JP | 3130164 | 3/2007 |
| JP | 2008-176989 | 7/2008 |
| JP | 2008-198582 | 8/2008 |
| JP | 2011-524613 | 9/2011 |
| WO | WO 02/063722 | 8/2002 |

OTHER PUBLICATIONS

Machine Translation CN205335482,[online], [retrieved on May 28, 2019], retrieved from https://dialog.proquest.com/professional/patents/docview/1800683729/16A65F51375632C1289/1?accountid=161361 (Year: 2019).*

Machine Translation CN 204966898 [online], [retrieved on May 28, 2019], retrieved from http://translationportal.epo.org/emtp/translate/?ACTION=description-retrieval&COUNTRY=CN&ENGINE=google&FORMAT=docdb&KIND=U&LOCALE=en_EP&NUMBER=204966898&OPS=ops.epo.org/3.2&SRCLANG=zh&TRGLANG=en (Year: 2019).*

Extended Search Report Issued by European Patent office dated Oct. 9, 2018.

* cited by examiner

TRAVEL ADAPTER WITH INTEGRATED PLUGS MEETING DIFFERENT PLUG STANDARDS

This application is a national stage application of PCT/CN2016/105465 filed on Nov. 11, 2016, which claims priority of Chinese patent application number 201520893420.7 filed on Nov. 11, 2015. The disclosure of each of the foregoing applications is incorporated herein by reference in its entirety.

FIELD OF THE INVENTION

The present invention relates to the field of plugs, and in particular, to a travel adapter.

BACKGROUND OF THE INVENTION

Due to various reasons, different countries have different power plug standards (for example, GB (China Standard) plug, Europe Standard plug, US Standard plug and UK Standard plug, etc.), and the sizes of power plugs of different countries are different from each other (for example, two-pin plug and three-pin plug, etc.). As a result, the same plug is not applicable to different countries, which causes unnecessary troubles to people frequently travelling between different countries or regions for business negotiation, travel and visiting friends and relatives. In order to solve such a problem, some users may carry power plugs of different countries during global travel; however, this will put an increased burden on user during travel and cause inconvenience thereto, thereby causing a poor user experience.

SUMMARY OF THE INVENTION

In view of the problem in the prior art, the present invention put forward a travel adapter, which can integrate plugs meeting the plug standards of different countries into one adapter and be switched easily, thereby solving the problem of the use of plugs during the travel in multiple countries.

The technical solution specifically comprises:

A travel adapter, comprising: a housing, a plug bush seat, a support frame and a pin assembly, the plug bush seat being provided in the housing, the support frame being located under the plug bush seat and connected with the plug bush seat, and multiple sets of the plug assemblies being provided on the support frame respectively; wherein:

the support frame is fixedly connected on the plug bush seat in a vertical direction and slides along the plug bush seat in a horizontal direction.

Preferably, in the travel adapter, the plug bush seat comprises an upper positioning piece, which is provided on a bottom surface of the plug bush seat;

the upper positioning piece further comprises a downward-extending plate and a horizontal plate, the downward-extending plate extends downwardly from the upper positioning piece, the horizontal plate is provided on one end of the downward-extending plate that is not connected with the upper positioning piece and extends laterally, and a interspace is formed between the horizontal plate and the bottom surface of the plug bush seat;

the support frame further comprises a hollow part, which is provided on an upper end face of the support frame;

the hollow part is provided with a lower positioning piece, which is inserted into the interspace and is flush with the upper end face of the support frame; and a thickness of the lower positioning piece is less than that of the upper end face of the support frame.

Preferably, in the travel adapter, the plug bush seat is further provided with:

an elastic device, which is provided between the plug bush seat and the support frame and makes the support frame able to be restored after sliding, the elastic device being a spring;

a spring cavity, which is configured for receiving the elastic device; and a spring stopper for holding one end of the elastic device is provided on the upper end face of the support frame.

Preferably, in the travel adapter, the upper end face of the support frame is provided with a lower limit hasp, and the bottom surface of the plug bush seat is provided with an upper limit hasp matching the lower limit hasp.

Preferably, in the travel adapter, the pin assembly comprises a pin base and a pin, the pin being provided on the pin base;

the support frame is further provided with a positioning plate, the positioning plate is provided with an upper positioning step and a lower positioning step, the lower positioning step being located under the upper positioning step; and the pin base is positioned on the upper positioning step or on the lower positioning step.

Preferably, in the travel adapter, the housing is provided with an opening, the support frame is provided with a button, and the button protrudes from the opening for being pressed by a user to drive the support frame to slide relative to the plug bush seat.

Preferably, in the travel adapter, the plug bush seat is provided with an L plug, an N plug and a pin, and under the action of an external force, the plug bush seat can drive the L plug, the N plug and the pin to protrude from the housing or to retract into the housing;

the pin can be folded relative to the plug bush seat to make the pin able to be folded when protruding from the housing.

Preferably, in the travel adapter, the pin comprises: a ground base of which one end is fixed to the plug bush seat, and a ground folding part movably connected to the other end of the ground base, the ground folding part being able to be folded relative to the ground base.

Preferably, in the travel adapter, the ground base and the ground folding part are pivotally connected.

Preferably, in the travel adapter, the end of the ground folding part to be connected with the ground base is provided with a pair of pivot joint ears, the ground base is provided with a pivot joint tongue to be clamped in the pivot joint ears, the pivot joint ears and the pivot joint tongue being connected via a pivot shaft.

Preferably, in the travel adapter, the pin further comprises an elastic component and a movable copper column located inside the ground folding part, the elastic component applying an elastic force to the movable copper column to make the movable copper column electrically contact the pivot joint tongue.

Preferably, in the travel adapter, when the ground folding part is in an initial upright state, an end face of the movable copper column contacts an end face of the pivot joint tongue;

The pivot joint tongue further comprises an end point face at which the ground folding part contacts the end face of the movable copper column when folded to an end point location, a distance from the pivot shaft to the end face of the pivot joint tongue and a distance from the pivot shaft to the end point face being both less than a distance from the pivot shaft to a part between the end face of the pivot joint tongue and the end point face.

Preferably, in the travel adapter, one end of the ground folding part connected with the ground base is recessed inward to form a groove for receiving the elastic component and the movable copper column.

Preferably, the travel adapter further comprises:

a ground joint sleeve, to which the pin is electrically connected when protruding from the housing.

Preferably, in the travel adapter, a sidewall of the ground joint sleeve is provided with a boss contact surface, to which the pin contacts when sliding to realize electrical connection.

Preferably, in the travel adapter, the ground base is a ground clamp, one end of which is connected to the plug bush seat, the ground folding part being rotatably connected to the other end of the ground clamp, and the ground clamp being a semi-encircled accommodation cavity with at least one sidewall opened for accommodating the folded ground folding part.

Preferably, the travel adapter further comprises: a blade spring, which is mounted inside the ground clamp, for elastically support the ground folding part when it is folded and electrically connecting the ground folding part.

Preferably, the travel adapter further comprises:

a receiving groove, for receiving the folded pin.

Preferably, the travel adapter further comprises: a righting and guiding structure.

Preferably, the travel adapter further comprises:

a barrier mechanism configured for limiting the pin, which is provided on the housing.

Preferably, the travel adapter further comprises: a plug housing, the pin assembly being slidably provided in the plug housing, the pin assembly and the plug housing consisting a plug assembly, and the plug assembly being provided inside the housing and able to protrude from the lower end face of the housing;

a first locking component is provided between the pin assembly and the plug housing, which provides a locking or unlocking function when the pin assembly slides relative to the plug housing;

a second locking component is provided between the plug housing and the housing, which provides a locking or unlocking function when the plug housing slides relative to the housing;

During the sliding of the plug assembly, the first locking component and the second locking component will not be in a locking state simultaneously and will not be in an unlocking state simultaneously;

the pin assembly comprises a pin base and a pin, the pin being provided on the pin base.

Preferably, in the travel adapter:

the pin is provided with a concave clip groove, the tail of the pin is inserted into the pin base, and the pin base is provided with a clip ring for being clipped into the clip groove.

Preferably, in the travel adapter, the first locking component comprises:

a stopper, which is provided on an outerwall of the plug housing;

the lower end face of the housing, configured for blocking the stopper;

a barrier mechanism, which is provided in the housing for blocking the upper end face of the plug housing; and an inside of the lower end face of the housing is further provided with a positioning stage corresponding to the stopper.

Preferably, in the travel adapter, the second locking component comprises:

a blade spring, which is provided on the pin base and has a hook that clamps outwardly;

an upper locking part and a lower locking part, which are respectively provided on an inner wall of the plug housing;

the hook respectively can be movably clipped into the upper locking part and the lower locking part.

Preferably, in the travel adapter, the plug housing further comprises:

a locking bar, which protrudes from the plug housing and is provided on the inner wall of the plug housing and is arranged along an axial direction of the pin;

a locking notch, which is provided on the locking bar and configured for forming the upper locking part;

a locking notch slope, which is formed of a lower end face of the locking notch and provided facing the upper end face of the plug housing;

a locking bar slope, which is formed of a lower end face of the locking bar and provided facing the lower end face of the plug housing;

a hook slope, which is provided on a lower end face of the hook and matches the locking notch slope;

the hook has an upper slope facing the upper end face of the plug housing and a lower slope facing the lower end face of the plug housing.

Preferably, in the travel adapter, the plug housing further comprises:

a first locking hole, which is opened on the inner wall of the plug housing for forming the upper locking part; and a second locking hole, which is opened on the inner wall of the plug housing for forming the lower locking part.

Preferably, in the travel adapter, the first locking component comprises:

a stopper, which is provided on an outerwall of the plug housing;

the lower end face of the housing, configured for blocking the stopper;

a clip hole, which is opened on a tail of a wall surface of the plug housing;

a locking protrusion, which is provided on an inner wall of the housing;

the locking protrusion being movably clipped into the clip hole;

the second locking component comprises:

a blade spring, which is provided on the pin base and has a hook that clamps outwardly; and a locking hole, which is opened on an inner wall of the plug housing, the hook being movably clipped into the locking hole.

Preferably, the travel adapter further comprises:

a stop plate, which is fixedly provided on a lateral side of the housing and provided with a plurality of first slideways respectively, each of the first slideways being respectively vertical to the stop plate and extending upward and downward;

a plurality of plugs, which correspond to the first slideways one to one;

slidable interlocking sliding sheets, which are provided parallel to the stop plate and respectively provided with a second slideway corresponding to each of the first slideways one to one;

wherein each of the plugs is respectively provided with a slide button and a locking pillar, the slide button is provided passing through the first slideway corresponding to the plug, the locking pillar is stretched into the second slideway corresponding to the plug and may slide up and down along the second slideway and drive the interlocking sliding sheets to slide right and left when sliding;

the first slideways are all slideways with a linear guide slot, and the second slideways are all slideways with a polygonal-line guide slot.

Preferably, in the travel adapter, each of the second slideways respectively comprises:

a locking stage, which is located on an upper end of the corresponding second slideway;

a fold-down slideway, which is located under the corresponding locking stage, an upper end of the fold-down slideway extending upward and forming a pillar entrance in the middle of the locking stage;

the locking pillar corresponding to one of the plugs may be slided downward along the second slideway to push the interlocking sliding sheets to slide right and left to a position that is staggered from the locking pillar entrances corresponding to the locking pillars of other plugs.

Preferably, in the travel adapter, the interlocking sliding sheets comprises a first interlocking sliding sheet and a second interlocking sliding sheet;

the first interlocking sliding sheet is parallel to the second interlocking sliding sheet, and the first interlocking sliding sheet and the second interlocking sliding sheet may be mutually connected via a connection board; and the second interlocking sliding sheet is located between the first interlocking sliding sheet and the stop plate.

Preferably, in the travel adapter, all the second slideways only comprise one second slideway that is provided on the second interlocking sliding sheet, and all the rest second slideways except for the second slideway provided on the second interlocking sliding sheet are provided on the first interlocking sliding sheet.

Preferably, in the travel adapter, the plugs comprise a European Standard plug, an American Standard plug, a British Standard plug and an Australian Standard plug;

the British Standard plug surrounds the American Standard plug or the Australian Standard plug;

the locking pillar corresponding to the American Standard plug is stretched into the second slideway on the second interlocking sliding sheet, or the locking pillar corresponding to the Australian Standard plug is stretched into the second slideway on the second interlocking sliding sheet.

Preferably, in the travel adapter, an inclined slideway is provided between an upper end and a lower end of the second slideway;

extension lines of the inclined slideways on any two second slideways intersect with each other; or the inclined slideways on at least two of the second slideways are parallel to each other, and the lengths of any two inclined slideways parallel to each other are different.

Preferably, in the travel adapter, the housing is further provided with:

at least two plugs respectively corresponding to power plug standards of different countries, which are respectively provided inside the housing and respectively comprise a pin;

a protrusion surface provided on the housing, from which the plug may operably protrude and retract into the housing;

a cover plate provided on the housing, which covers the protrusion surface and is provided with a first through hole for different pins to stretch out and draw back; and a sliding baffle, which is slidably provided between the protrusion surface and the cover plate and makes at most one of the plugs in the housing protrude from the first through hole each time by interfering the pin of the plug during sliding.

Preferably, the travel adapter further comprises: a positioning structure, which comprises positioning points corresponding to the number of the plugs and operably positions the sliding baffle at the positioning points, the positioning points being respectively correlated to different plugs;

when the sliding baffle is positioned at the positioning point, the first through holes corresponding to the plugs uncorrelated to the positioning point are interfered.

Preferably, in the travel adapter, the sliding baffle is further provided with a second through hole, which corresponds to different plugs;

when the sliding baffle is positioned at the positioning point, the second through hole fits the first through hole to protrude the pin of the plug related to the positioning point.

Preferably, in the travel adapter, the positioning structure further comprises a protrusion provided on the sliding baffle and a plurality of grooves, the plurality of grooves being provided on the cover plate and corresponding to the position of the protrusion so as to restrict the movement of the sliding baffle, and each of the grooves corresponding to the positioning points one to one.

Preferably, in the travel adapter, the cover plate is further provided with an opening corresponding to the sliding baffle, the opening coincides with the first through hole corresponding to at least one of the plugs, and the groove is provided on the inner wall of the opening;

the sliding baffle further comprises an operating part for operating the sliding baffle to slide, which is provided on one side of the sliding baffle facing the cover plate and located in the opening.

Preferably, in the travel adapter, one side of the sliding baffle is provided with a protrusion part, the protrusion part protrudes from the protrusion surface and the cover plate along the extension direction of the protrusion surface, and one side of the protrusion part protruding from the protrusion surface and the cover plate is provided with a lug facing the cover plate, the protrusion is provided on one side of the lug facing the cover plate, and the groove is provided on one edge of the cover plate facing the lug.

Preferably, in the travel adapter, the sliding baffle comprises an operating part for operating the sliding baffle to slide, which is provided on the lug.

Preferably, in the travel adapter, the sliding baffle is slidably connected to the protrusion surface via a guide structure;

the guide structure further comprises:

a sliding slot, which is provided on the protrusion surface along a sliding direction of the sliding baffle; and a sliding protrusion, which is provided on one side of the sliding baffle facing the protrusion surface and slidably embedded in the sliding slot.

Preferably, in the travel adapter, the sliding baffle is slidably connected to the protrusion surface via a guide structure;

the guide structure further comprises:

a pair of limit slots provided opposite to each other, which correspond to the sliding direction of the sliding baffle and provided on the cover plate structure parallelly;

the two side edges of the sliding baffle are slidably embedded in the limit slot.

Preferably, the travel adapter further comprises:

a plurality of first slideways, which are respectively provided on the lateral side of the housing and extend upward and downward;

a plurality of plugs, which are respectively provided inside the housing and movably stretch out and draw back along the corresponding first slideways, the first slideways correspond to the plugs one to one, and each of the plugs is provided with a corresponding probe;

an anti-electricshock barrier, which is provided inside the housing and located between the plug and the corresponding first slideway for preventing the probe from entering from the first slideways.

Preferably, in the travel adapter, the anti-electricshock barrier further comprises:

a plurality of barrier pillars, which are respectively provided inside the housing and located between the plug and the corresponding first slideway, the barrier pillar correspond to the first slideways one to one and is configured for blocking the first slideways;

the barrier pillars extend along the first slideways.

Preferably, in the travel adapter, each of the plugs is respectively provided with a corresponding slide button, and the slide button passes through the first slideways and drives the plugs to move up and down along the first slideways;

the slide button is provided with a guide through hole corresponding to the barrier pillar, and the barrier pillar is provided in the guide through hole.

Preferably, in the travel adapter, the pin assembly comprises a pin base and a pin, the pin being provided between the pin base and the bottom surface of the housing;

the plurality of barrier pillars comprise at least one barrier pillar provided on the pin base, and the rest barrier pillars are provided on the inner bottom surface of the housing.

Preferably, in the travel adapter, the anti-electricshock barrier comprises:

a probe baffle, which is provided inside the housing and located between the plug and the corresponding first slideway;

a second slideway, which is provided corresponding to the probe baffle, the slide button provided on the plug successively passing through the second slideway and the first slideway corresponding to the plug.

Preferably, in the travel adapter, the anti-electricshock barrier further comprises:

at least one barrier pillar, which is respectively provided inside the housing and located between the plug and the corresponding first slideway, the barrier pillar correspond to the first slideways one to one and is configured for blocking the first slideways, and the barrier pillar extends along the first slideways;

at least one probe baffle, which is respectively provided inside the housing and respectively located between the plug and the corresponding first slideway;

the first slideways comprises first-type slideways and second-type slideways, the first-type slideways corresponding to the barrier pillars one to one, and the second-type slideways corresponding to at least one probe baffle one to one;

the at least one probe baffle is respectively provided inside the housing and respectively located between the plug and the corresponding first slideway;

each of the plugs is correspondingly provided with a slide button, which passes through the corresponding second slideway and slides up and down along the second slideway and drives the probe baffle to slide right and left at the same time.

Preferably, in the travel adapter, the housing has a plug distribution surface;

the housing is provided with a retractable plug, which can stretch out and draw back from the housing via the plug distribution surface;

the retractable plug further comprises a British Standard plug with a ground pin, and further comprises an American Standard plug with a ground pin or an Australian Standard plug with a ground pin;

the American Standard plug or the Australian Standard plug is overall distributed between the ground pin and the LN pins of the British Standard plug.

Preferably, in the travel adapter:

when the American Standard plug is overall distributed between the ground pin and the LN pins of the British Standard plug, the ground pin of the American Standard plug is provided facing away from the ground pin of the British Standard plug; or when the Australian Standard plug is overall distributed between the ground pin and the LN pins of the British Standard plug, the ground pin of the Australian Standard plug is provided facing away from the ground pin of the British Standard plug.

Preferably, in the travel adapter, the retractable plug further comprises a European Standard plug;

the European Standard plug is provided on one side on which the ground pin of the European Standard plug exists;

a plug pillar of the European Standard plug is provided with a first notch matching the ground pin of the British Standard plug, and the ground pin of the British Standard plug is at least partially embedded in the first notch.

Preferably, in the travel adapter, the retractable plug further comprises a European Standard plug;

the European Standard plug is provided on one side on which the LN pins of the British Standard plug exists;

a plug pillar of the European Standard plug is provided with a second notch matching the LN pins of the British Standard plug, and the LN pins of the British Standard plug are at least partially embedded in the second notch.

Preferably, in the travel adapter, when the American Standard plug is overall provided between the ground pin and the LN pins of the British Standard plug, the Australian Standard plug and the European Standard plug are relatively distributed on the two sides of the British Standard plug respectively.

Preferably, in the travel adapter, when the Australian Standard plug is overall provided between the ground pin and the LN pins of the British Standard plug, the American Standard plug and the European Standard plug are relatively distributed on the two sides of the British Standard plug respectively;

the ground pins of all the retractable plugs are all provided on the same straight line.

Preferably, in the travel adapter, the plug distribution surface is provided with a safety cover, and a safety element is provided in the safety cover;

the safety cover and the European Standard plug are relatively provided on the two sides of the British Standard plug respectively.

Preferably, the travel adapter further comprises:

a plurality of sliding slots, which are respectively provided on a lateral side of the housing respectively;

a plurality of USB sockets, which are provided on the same lateral side of the housing as the sliding slot; and a poker rod and a slide button connected with the corresponding retractable plug are respectively provided in each of the sliding slots.

Preferably, in the travel adapter, the pin assembly comprises a pin base and a pin, the pin being provided on the pin base;

the support frame is further provided with a ground sleeve and a plug containing the pin, the plug being slidably arranged along a plug and unplug direction;

the pin comprises a fixed part fixed to the ground sleeve and a pin head having a slidable socketing relation with the fixed part; and the pin head, the fixed part and the ground sleeve are electrically connected.

Preferably, in the travel adapter, the housing comprises a front cover and a back cover, the front cover and the back cover are buckled to form a cavity, and the cavity is provided with the ground sleeve;

the plug comprises an American Standard plug and/or a European Standard plug;

the pin adapting the American Standard plug and/or the European Standard plug is a retractable ground pin, and the fixed part forms a conductive pillar.

Preferably, in the travel adapter, the plug further comprises an Australian Standard plug and/or a British Standard plug;

the pin adapting the Australian Standard plug and/or the British Standard plug is a non-retractable ground pin, and the pin is held on and electrically connected with a conductive plate via a first connection leaf; and the conductive plate is electrically connected with the ground sleeve.

Preferably, in the travel adapter, the plug comprises an American Standard plug and/or a European Standard plug, and the pin adapting the American Standard plug and/or the European Standard plug is a retractable ground pin;

the plug further comprises an Australian Standard plug and/or a British Standard plug, and the pin adapting the Australian Standard plug and/or the British Standard plug is a non-retractable ground pin;

the non-retractable ground pin is held on and electrically connected with any one of the retractable ground pins via a second connection leaf; and the second connection leaf is fixed on a conductive plate.

Preferably, in the travel adapter, the pin assembly comprises a pin base and a pin, the pin being provided on the pin base, and the pin base is provided on an upper part inside the housing;

a pin base is provided inside the housing, and the pin base is provided under the pin base;

the pin comprises a pillar for fixing the pin onto the pin base, and the pin is sleeved on the pillar; and the pin base is provided with LN pins and a hasp matching the pin.

Preferably, in the travel adapter, an upper end of the pin is provided with an axle journal matching the hasp; and a lower end face of the axle journal is provided with a cone guide surface.

Preferably, in the travel adapter, an upper end of the pin is provided with a boss matching the hasp;

a lower end face of the boss is provided with a cone guide surface;

the hasp is provided with a concave part matching the boss.

Preferably, in the travel adapter, the pin base is provided with a limit blade spring, which is arranged in a blade spring seat.

Preferably, in the travel adapter, the housing is provided with a plug, and the plug comprises a ground module and an LN module that can be operated separately, the ground module comprises a ground base and a pin fixed on the ground base, the LN module comprises an LN base and an LN pin fixed on the LN base, and the ground base is overlapped above the LN base;

when the plug is in a first use state, the LN module independently protrudes from the housing;

when the plug is in a second use state, the ground module drives the LN module to slide out of the housing;

when the plug is in a received state, the LN module drives the ground module to slide back into the housing;

further comprised is:

a locking module, which is configured for:

locking the ground module at a retraction position and locking the LN module at a protrusion position respectively when the plug is in the first use state;

locking the ground module and the LN module at a protrusion position jointly when the plug is in the second use state; and locking the ground module and the LN module at a retraction position jointly when the plug is in the received state.

Preferably, in the travel adapter, the locking module comprises:

a movable support, which can move operably in a horizontal direction;

at least one elastic element, which is connected between the housing and the movable support, when the movable support moves along the horizontal direction under the action of a horizontal force, the at least one elastic element deforms elastically to make the locking module unlock the ground module and the LN module for the ground module and the LN module to switch between the first use state, the second use state and the received state; when the horizontal force is released, an elastic restoring force of the at least one elastic element pushes the movable support to restore the locking of the ground module and the LN module.

Preferably, in the travel adapter, the locking module comprises a first limit pillar, which is vertically connected to the movable support and configured for:

positioning the ground module at the retraction position when the movable support is at a lock position and the plug is in the first use state; and positioning the ground module and the LN module at the protrusion position when the movable support is at a lock position and the plug is in the second use state.

Preferably, in the travel adapter, the locking module comprises a second limit pillar, which is vertically connected to the movable support and configured for:

positioning the LN module at the protrusion position when the movable support is at a lock position and the plug is in the first use state; and positioning the LN module and the ground module at the retraction position when the movable support is at a lock position and the plug is in the received state.

Preferably, in the travel adapter, the first limit pillar comprises:

a first locking surface located on the top, which is pressed under the lower part of the ground base and is configured for positioning the ground module at the retraction position; and a second locking surface located on the bottom, which is pressed above the ground base and is configured for positioning the ground module at the protrusion position.

Preferably, in the travel adapter, the second limit pillar comprises: a first locking surface located on the top, which is pressed under the LN base and is configured for positioning the LN module at the retraction position; and a second locking surface located on the bottom, which is pressed above the LN base and is configured for positioning the LN module at the protrusion position.

Preferably, in the travel adapter, the ground module and/or the LN module are/is provided with a guide slot for fitting the first limit pillar and the second limit pillar;

when the movable support is located at an operating position, the positions of the first limit pillar and the second limit pillar correspond to that of the guide slot to guide the ground module and the LN module to slide up and down; and when the movable support is located at a lock position, the positions of the first limit pillar and the second limit pillar do not correspond to that of the guide slot to lock the ground module and the LN module.

Preferably, in the travel adapter, the ground module and the LN module are provided with a guide hole for the first limit pillar and the second limit pillar to pass through;

when the movable support is located at an operating position, the positions of the first limit pillar and the second limit pillar correspond to that of the guide hole to guide the ground module and the LN module to slide up and down; and when the movable support is located at a lock position, the positions of the first limit pillar and the second limit pillar do not correspond to that of the guide hole to lock the ground module and the LN module.

Preferably, in the travel adapter, the LN base is provided with a notch fitting the ground base, and the ground base is at least partially accommodated in the notch.

Preferably, in the travel adapter, the housing is further provided with:

at least one plug;

a protrusion surface, the plug being able to operably protrude from the protrusion surface and retract into the housing via a retractive structure;

the retractive structure further comprises a slide button protruding from the housing, and the housing is provided with a guide slot for the slide button to slide, the slide button can slide between a first position corresponding to the retracting of the plug into the housing and a second position corresponding to the protruding of the plug from the protrusion surface;

the housing is further provided with:

a first door, which is provided on the side on which the guide slot exists and is slidably provided in the housing for covering and opening the guide slot;

a second door, which is provided on the same side as the first door and is slidably provided inside the housing for covering and opening the guide slot;

a first elastic element, which is provided between the first door and the housing and configured for shielding a region of the first door corresponding to the guide slot by the first door when the slide button is at the second position; and a second elastic element, which is provided between the second door and the housing and configured for shielding the region of the second door corresponding to the guide slot by the second door when the slide button is at the first position.

Preferably, in the travel adapter, the housing further comprises:

an operating surface, on which the guide slot is provided;

a first limit structure, which is provided in the housing and located on an internal structure of the housing vertical to the operating surface to restrict the moving range of the first door and the second door in the sliding direction;

a second limit structure, which is provided in the housing and located on an internal structure of the housing vertical to the operating surface to prevent the first door and the second door from moving to a direction having an included angle with the direction of the operating surface larger than 0 degree.

Preferably, in the travel adapter, the first limit structure comprises two first protrusions respectively provided on the two sides of the guide slot;

the second limit structure comprises two second protrusions respectively provided vertical to the two first protrusions, a gap being provided between the two second protrusions for the slide button to protrude out.

Preferably, in the travel adapter, the first limit structure and the second limit structure are mainly formed of a pair of guiding slots respectively provided on the two sides of the guide slot, a gap being provided between said pair of guiding slots for the slide button to protrude out.

Preferably, in the travel adapter, the first door comprises a pair of first chamfers, which are respectively provided on the upper and lower ends of the first door and configured for guiding the first door to leave the position covering the guide slot when the operating part moves along the guide slot; and the second door comprise a pair of second chamfers, which are respectively provided on the upper and lower ends of the second door and configured for guiding the second door to leave the position covering the guide slot when the operating part moves along the guide slot.

Preferably, in the travel adapter, the first door and the second door are slidably spliced along a moving direction parallel to the first door and the second door via a connection structure.

Preferably, in the travel adapter, the connection structure comprises a third protrusion provided on the first door and a fourth protrusion provided on the second door and fitting the third protrusion, the first door and the second door being slidably spliced via the third protrusion and the fourth protrusion.

Preferably, in the travel adapter, the housing is provided with at least one plug, which can operably protrude from the housing and retract into the housing via a retractive structure, and the travel adapter further comprises:

a first conductive structure, which is provided with conductive structure groups with a number corresponding to that of the plug, each of the conductive structure groups respectively comprises an L conductive structure and an N conductive structure, all the L conductive structures being interconnected to a first L connection point, and all the N conductive structures being interconnected to a first N connection point;

a second conductive structure, which is provided with at least one output sleeve assembly, each of the output sleeve assemblies respectively comprises an L output sleeve and an N output sleeve, each of the L output sleeves being electrically connected with the first L connection point, and each of the N output sleeve being electrically connected with the first N connection point;

each of the plugs comprises multiple sets of pin assemblies, each pin assembly comprises an L pin and an N pin, and each pin assembly corresponds to the conductive structure group one to one;

when the plug protrudes from the housing, the L pin is electrically connected with the L conductive structure in the corresponding conductive structure group, and the N pin is electrically connected with the N conductive structure in the corresponding conductive structure group.

Preferably, in the travel adapter, the conductive structure groups are all conductive sleeve assemblies, the L conductive structures are all L conductive sleeves, and the N conductive structures are all N conductive sleeves; and each pin assembly respectively further comprises an L conductive insertion piece connected with the L pin correspondingly and an N conductive insertion piece connected with the N pin correspondingly;

when the plug protrudes from the housing, the L conductive insertion piece is inserted into the L conductive sleeve in the corresponding conductive sleeve assembly as the plug protrudes, and the N conductive insertion piece is inserted into the N conductive sleeve in the corresponding conductive sleeve assembly as the plug protrudes.

Preferably, in the travel adapter, the first conductive structure comprises:

a first conductive plate, on which the conductive structure group is provided, the first conductive plate further comprises a through hole for the pin of the corresponding conductive structure group to pass through;

a first L conductive line, which is provided on the first conductive plate and connected to the first L connection point, the L conductive structure in each of the conductive structure groups is electrically connected via the first L conductive line; and a first N conductive line, which is provided on the first conductive plate and connected to the first N connection point, the N conductive structure in each of the conductive structure groups is electrically connected via the first N conductive line.

Preferably, in the travel adapter, the first L conductive line is a patterned copper foil conductive layer; and/or the first N conductive line a patterned copper foil conductive layer.

Preferably, in the travel adapter, the plug bush seat in the housing is provided in the second conductive structure, and the output plug bush seat is provided on the plug bush seat;

the second conductive structure further comprises:

a second L conductive line, which is provided on the plug bush seat, the L output sleeve in the output sleeve assembly is connected to the second L conductive line, the second L conductive line is provided with a second L connection point, and the second L connection point is electrically connected with the first L connection point; and a second N conductive line, which is provided on the plug bush seat, the N output sleeve in the output sleeve assembly is connected to the second N conductive line, the second N conductive line is provided with a second N connection point, and the second N connection point is electrically connected with the first N connection point.

Preferably, in the travel adapter, the first L connection point is a first solder leg, and the second L connection point is a second solder leg, the first solder leg and the second solder leg being electrically connected via an L connection line;

the first N connection point is a third solder leg, and the second N connection point is a fourth solder leg, the third solder leg and the fourth solder leg being electrically connected via an N connection line.

Preferably, in the travel adapter, the L connection line is a patterned copper foil conductive layer provided on a second conductive plate, and the N connection line is a patterned copper foil conductive layer provided on the second conductive plate; or the L connection line and the N connection line are jumper wires.

Preferably, the travel adapter further comprises: a fourth conductive structure provided with a USB interface, which is electrically connected with the first conductive structure;

the first L connection point is a first sleeve, and the fourth conductive structure comprises a first pin, the first pin being inserted into the first sleeve to form electrical connection; and/or the first N connection point is a second sleeve, and the fourth conductive structure comprises a second pin, the second pin being inserted into the second sleeve to form electrical connection.

Preferably, in the travel adapter, the plug comprises a British Standard plug adapting the British Plug Standard, an Italian Standard plug adapting the Italian Plug Standard, an Australian Standard plug adapting the Australian Plug Standard and an American Standard plug adapting the American Plug Standard.

Preferably, in the travel adapter, the at least one output sleeve assembly comprises a set of two-hole output sleeve assembly and a set of three-hole output sleeve assembly, and an L output sleeve of the two-hole output sleeve assembly and an L output sleeve of the three-hole output sleeve assembly are formed integrally, an N output sleeve of the two-hole output sleeve assembly and an N output sleeve of the three-hole output sleeve assembly are formed integrally.

The technical solutions are advantageous in that they may provide a travel adapter, wherein plugs meeting plug standards of different countries can be integrate into one adapter and can be switched easily, thereby solving the plug usage problems during global travel.

BRIEF DESCRIPTION OF THE DRAWINGS

FIG. 120 is a stereoscopic view when a ground module and an LN module in an Italian Standard plug protrude at the same time according to a preferred embodiment of the invention;

FIG. 121 is a stereoscopic view when only an LN module in an Italian Standard plug protrudes according to a preferred embodiment of the invention;

FIG. 122 is a schematic diagram when a ground module and an LN module of an Italian Standard plug are provided separately according to a preferred embodiment of the invention;

FIG. 123 is a schematic diagram showing the assembling of a ground module and an LN module of a Italian Standard plug according to a preferred embodiment of the invention;

FIGS. 124-125 are perspective views of an Italian Standard plug according to a preferred embodiment of the invention;

FIG. 126 is a schematic diagram showing an American Standard plug according to a preferred embodiment of the invention;

FIG. 127 is a stereoscopic view when a ground module and an LN module in an American Standard plug protrude at the same time according to a preferred embodiment of the invention;

FIGS. 128-129 are stereoscopic views when only an LN module in an American Standard plug protrude according to a preferred embodiment of the invention;

FIG. 130 is a schematic diagram when a ground module and an LN module in an American Standard plug are provided separately according to a preferred embodiment of the invention;

FIG. 131 is a schematic diagram showing the assembling of a ground module and an LN module in an American Standard plug according to a preferred embodiment of the invention;

FIG. 132 is a perspective view of an American Standard plug according to a preferred embodiment of the invention;

FIG. 133 is an overall stereoscopic view of a door structure in a travel adapter according to a preferred embodiment of the invention;

Figure 134:
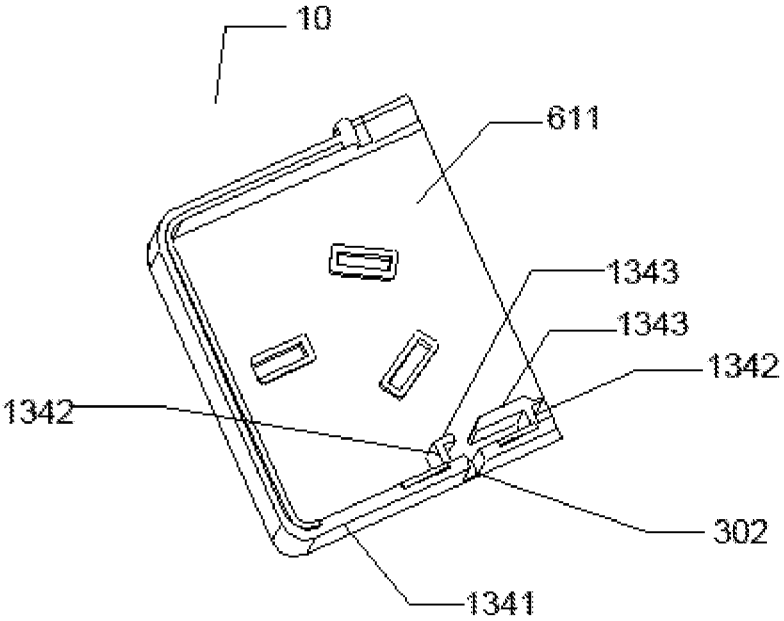
Figure 135:
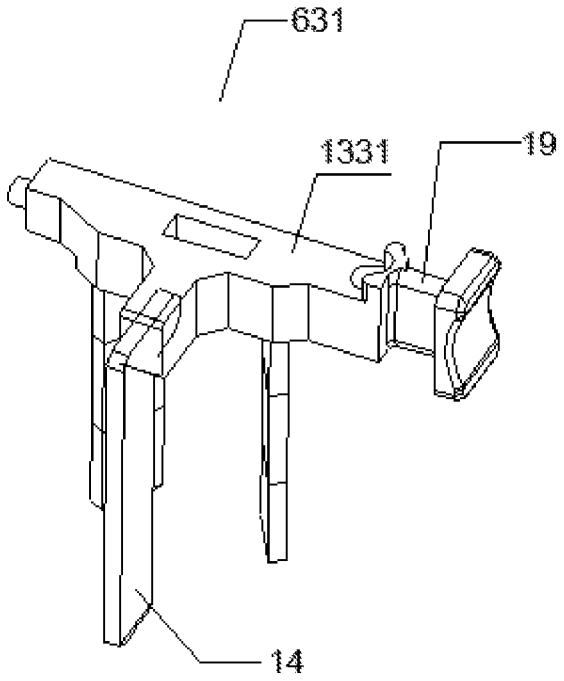
Figure 136:
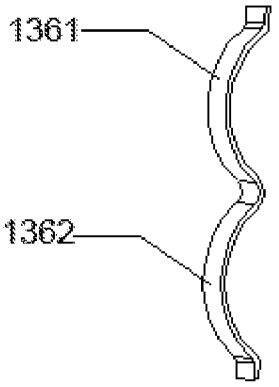
Figure 137:
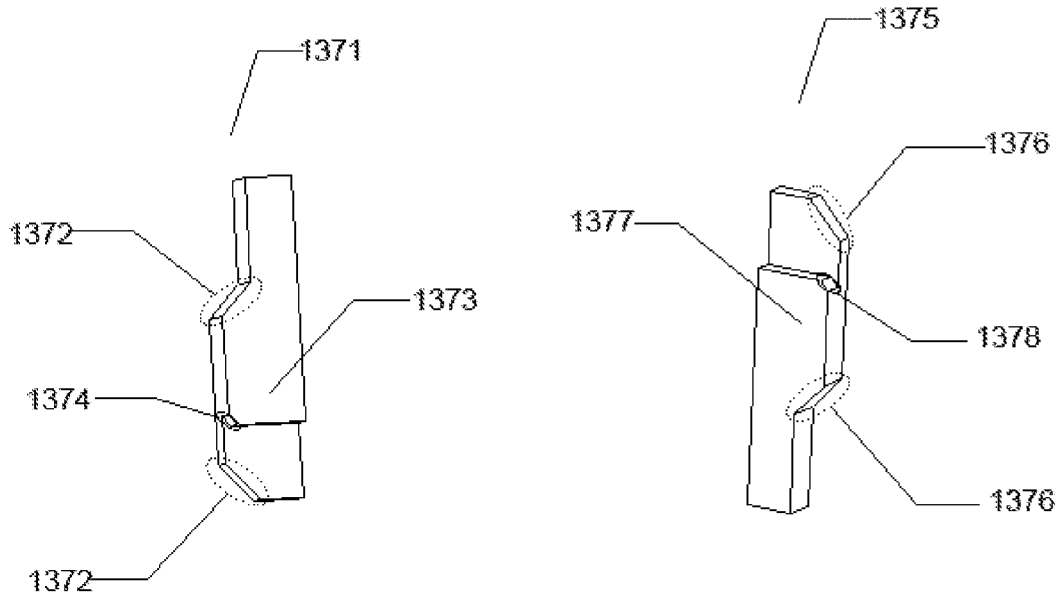
Figure 138:
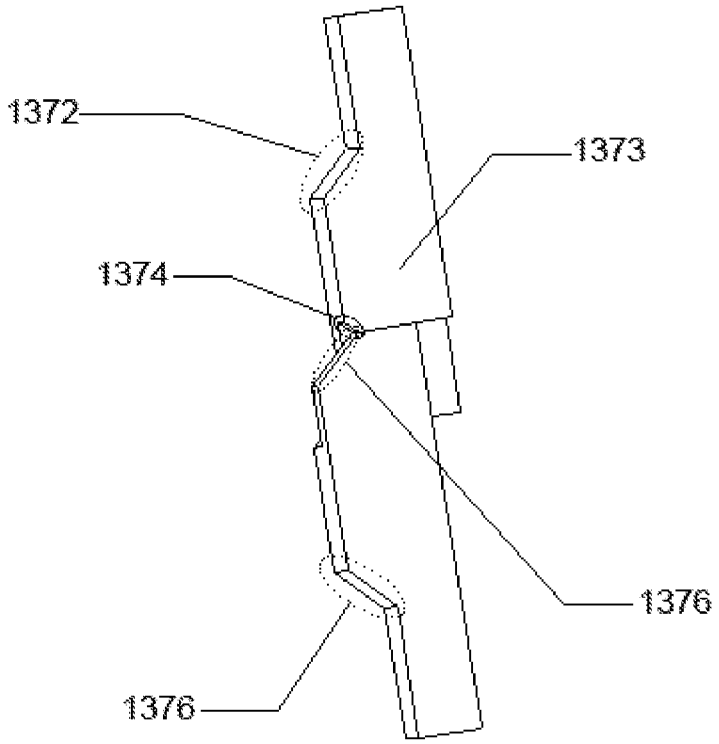
Figure 139:
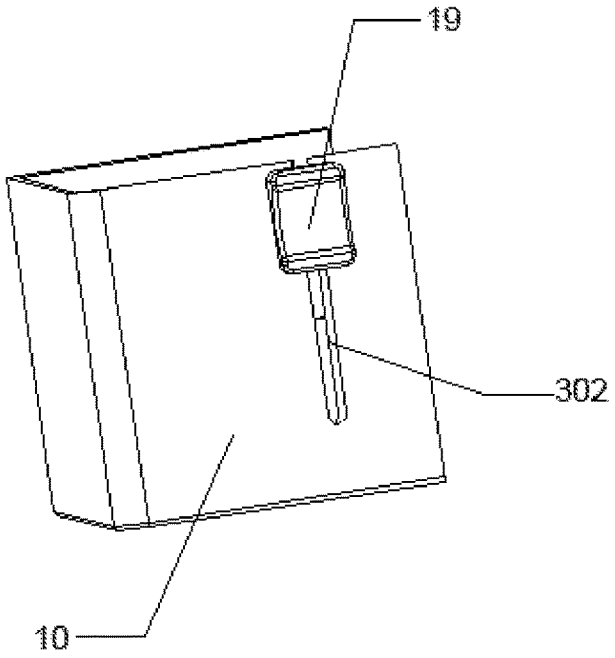
Figure 140:
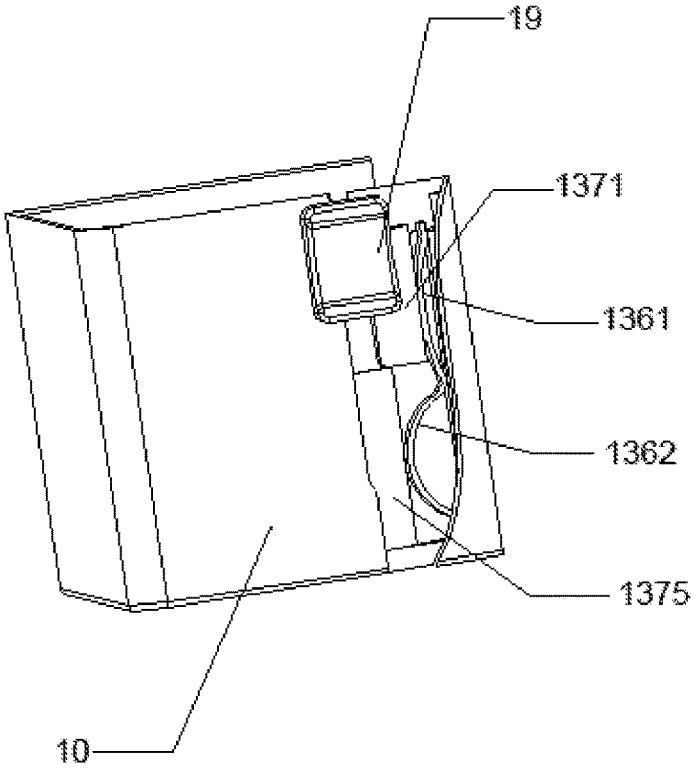
Figure 141:
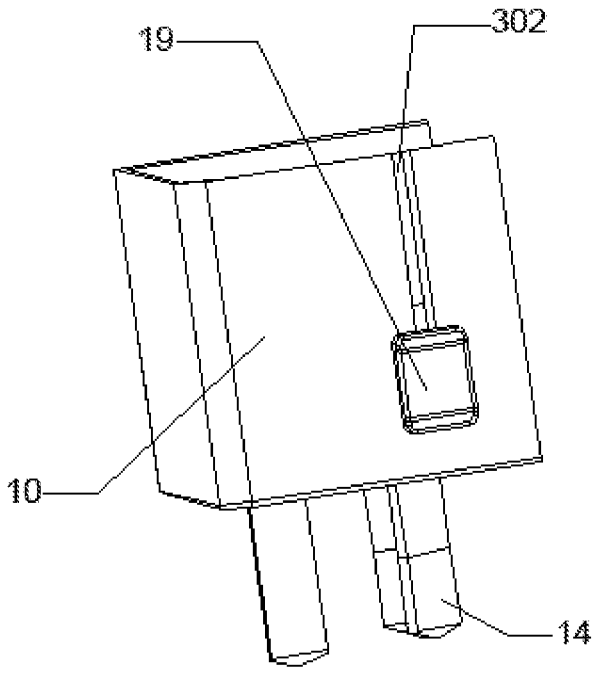
Figure 142:
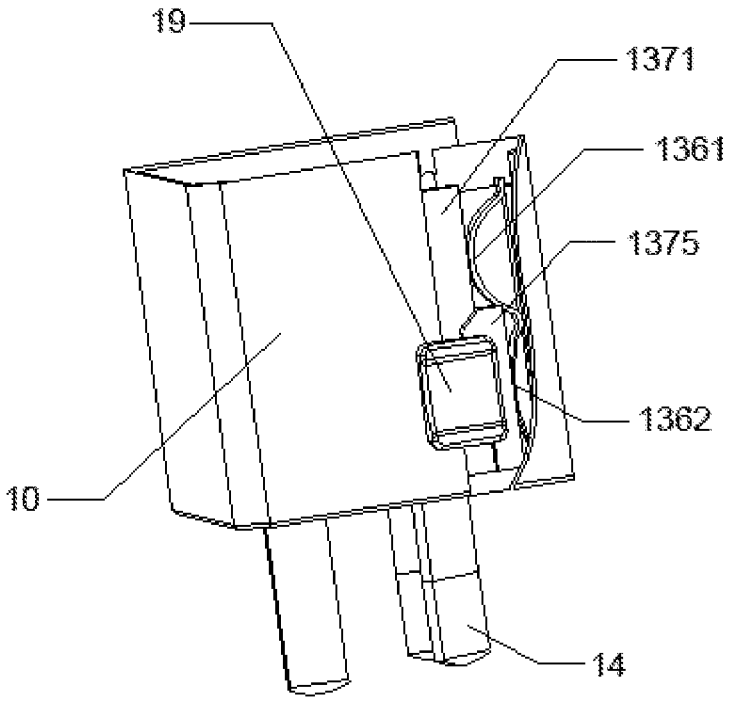
Figure 143:
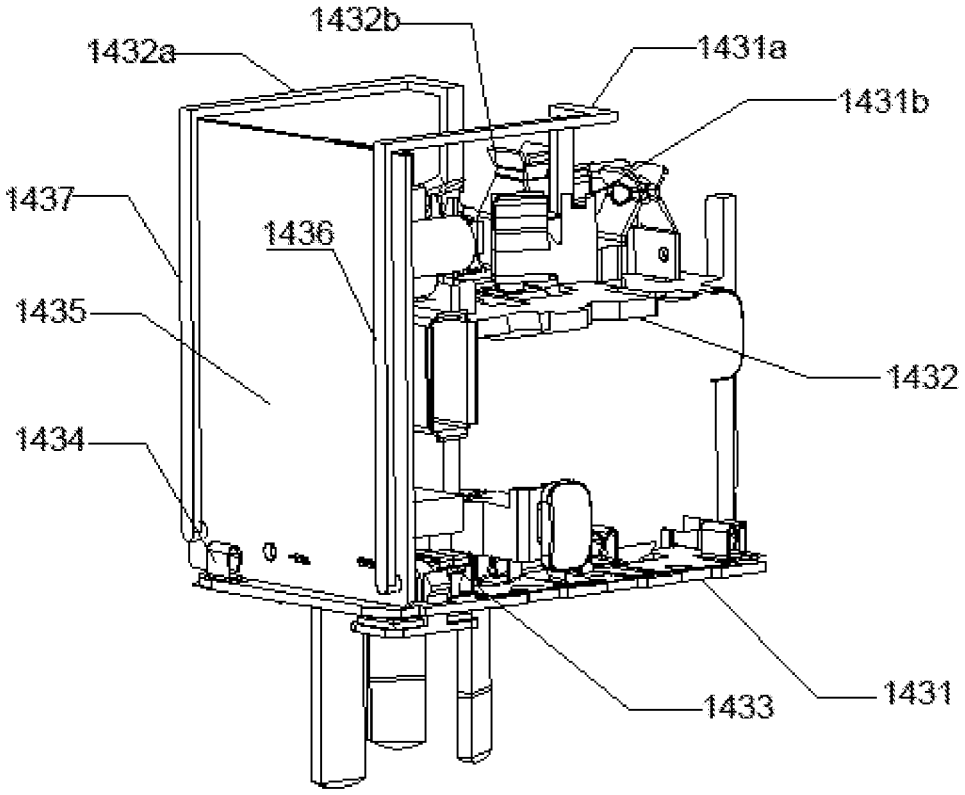
Figure 144:
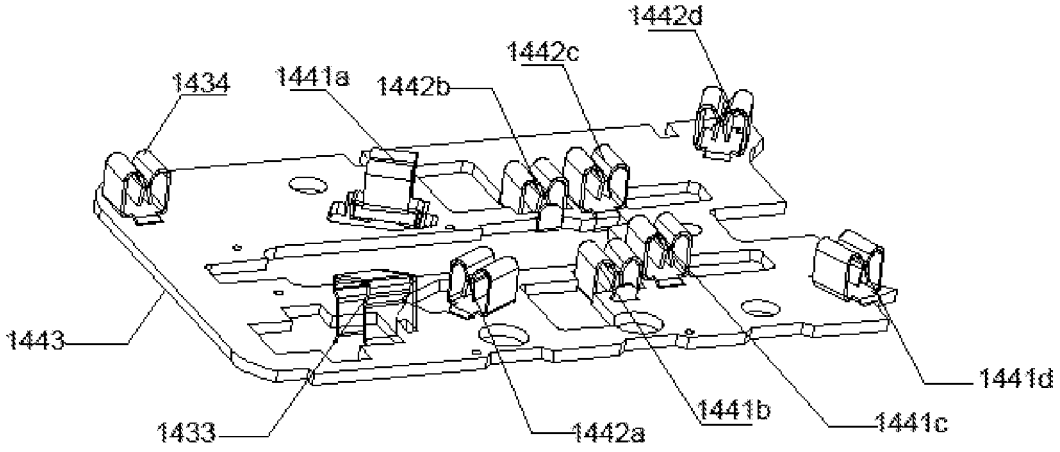
Figure 145:
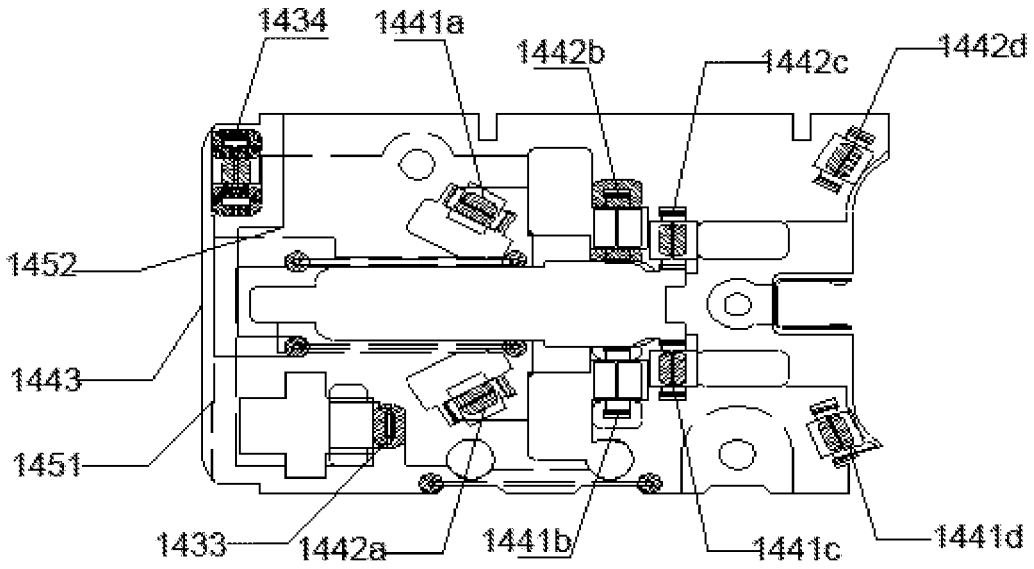
Figure 146:
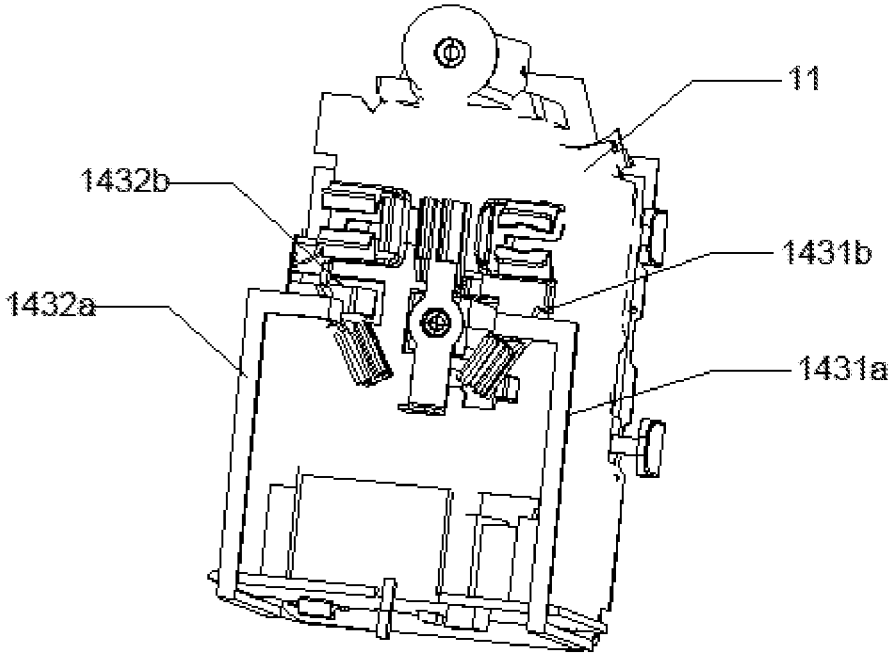
Figure 147:
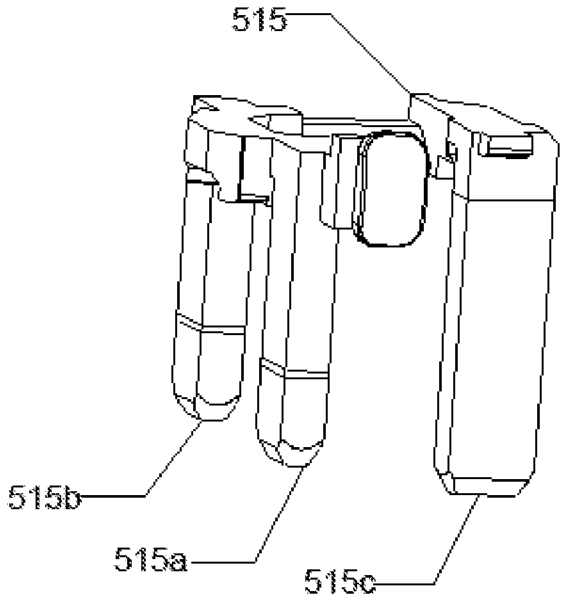
Figure 149:
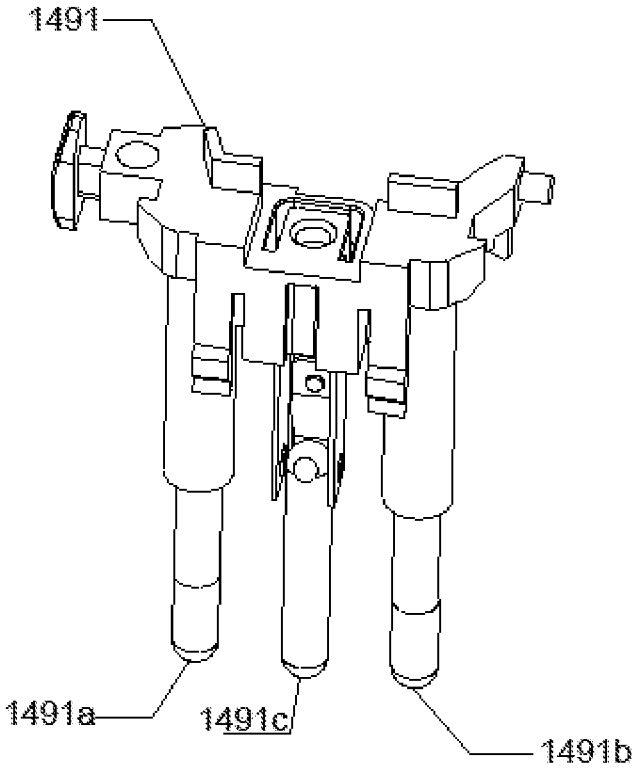
Figure 150:
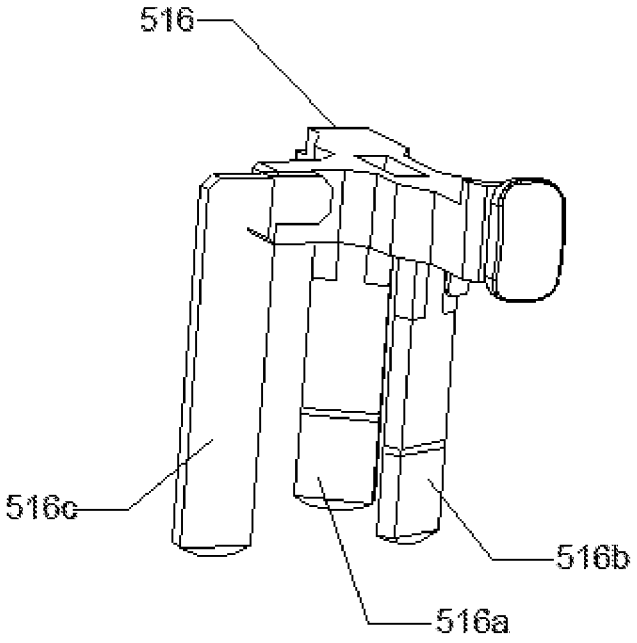
Figure 151:
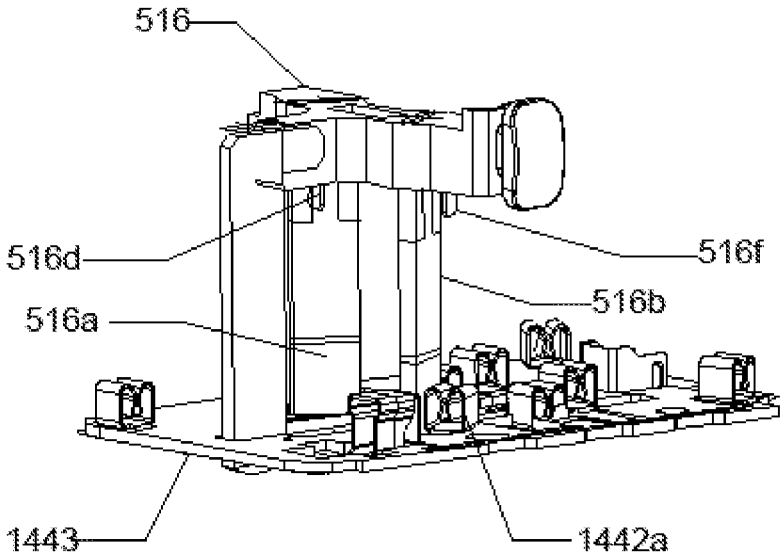
Figure 152:
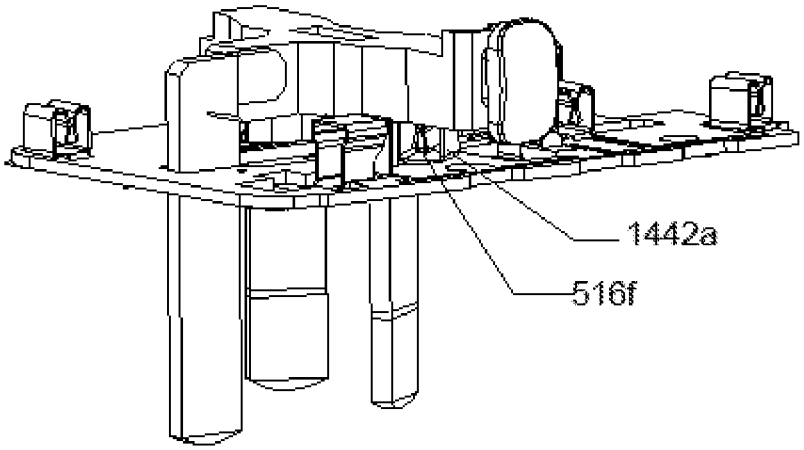

FIG. 134 is a schematic stereoscopic view showing a housing of a door structure according to a preferred embodiment of the invention;

FIG. 135 is a stereoscopic view of a plug module of a door structure according to a preferred embodiment of the invention;

FIG. 136 is a schematic stereoscopic view showing an elastic element in a door structure according to a preferred embodiment of the invention;

FIG. 137 is a schematic stereoscopic view showing a first door and second door in a door structure according to a preferred embodiment of the invention;

FIG. 138 is a stereoscopic view after a first door and a second door of a door structure are spliced according to a preferred embodiment of the invention;

FIGS. 139-140 are a stereoscopic view and a partial sectional view of a door structure when the plug module retracts into the housing according to a preferred embodiment of the invention;

FIGS. 141-142 are a stereoscopic view and a partial sectional view of a door structure when the plug module protrudes from the housing according to a preferred embodiment of the invention;

FIG. 143 is a stereoscopic view of a conductive structure in a travel adapter according to a preferred embodiment of the invention;

FIG. 144 is a stereoscopic view of a first conductive structure in a travel adapter according to a preferred embodiment of the invention;

FIG. 145 is a top view of a first conductive structure in a travel adapter according to a preferred embodiment of the invention;

FIG. 146 is a stereoscopic view of a second conductive structure in a travel adapter according to a preferred embodiment of the invention;

FIGS. 147-150 are respectively structural representations of plugs of standards of different countries corresponding to a plurality of plugs in the travel adapter according to a preferred embodiment of the invention; and FIGS. 151-152 are schematic diagrams showing the insertion of an Australian Standard plug into a first conductive structure based on FIG. 147 according to a preferred embodiment of the invention.

DETAILED DESCRIPTION OF THE EMBODIMENTS

The technical solutions in the embodiments of the invention will be described clearly and fully below in conjunction with the drawings in the embodiments of the invention. Apparently, the embodiments described herein only show some, rather than all embodiments of the invention. All other embodiments obtained by one of ordinary skills in the art based on the embodiments of the invention without creative work pertain to the protection scope of the invention.

It should be noted that, in case of no conflict, various embodiments and features in these embodiments may be combined.

The invention will be further illustrated below in conjunction with drawings and specific embodiments, which are not intended to limit the scope of the invention.

Embodiment 1

Figure 6:
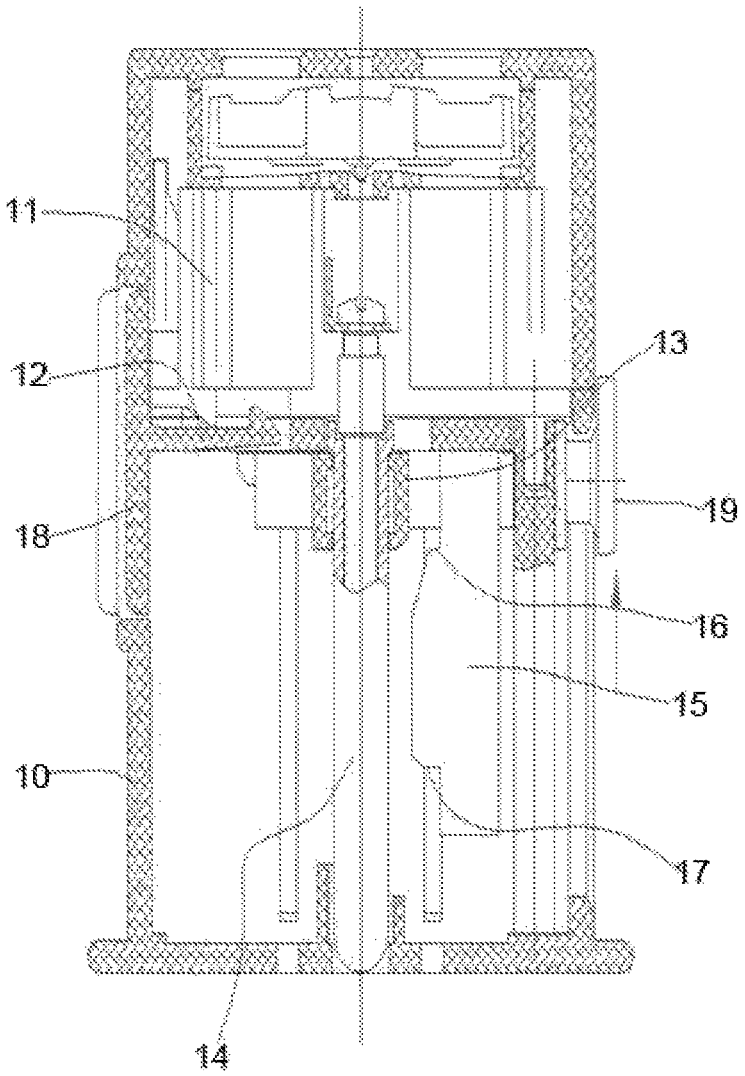
Figure 7:
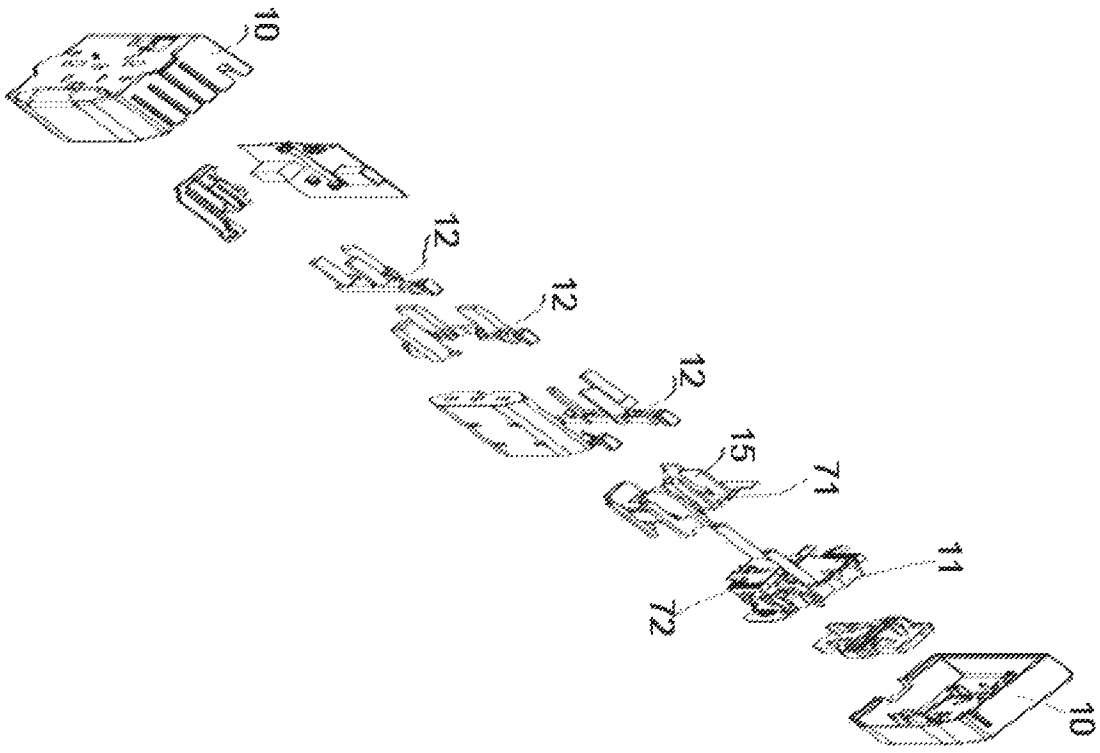
FIG. 7 is an exploded view of a travel adapter according to a preferred embodiment of the invention.
Figure 8:
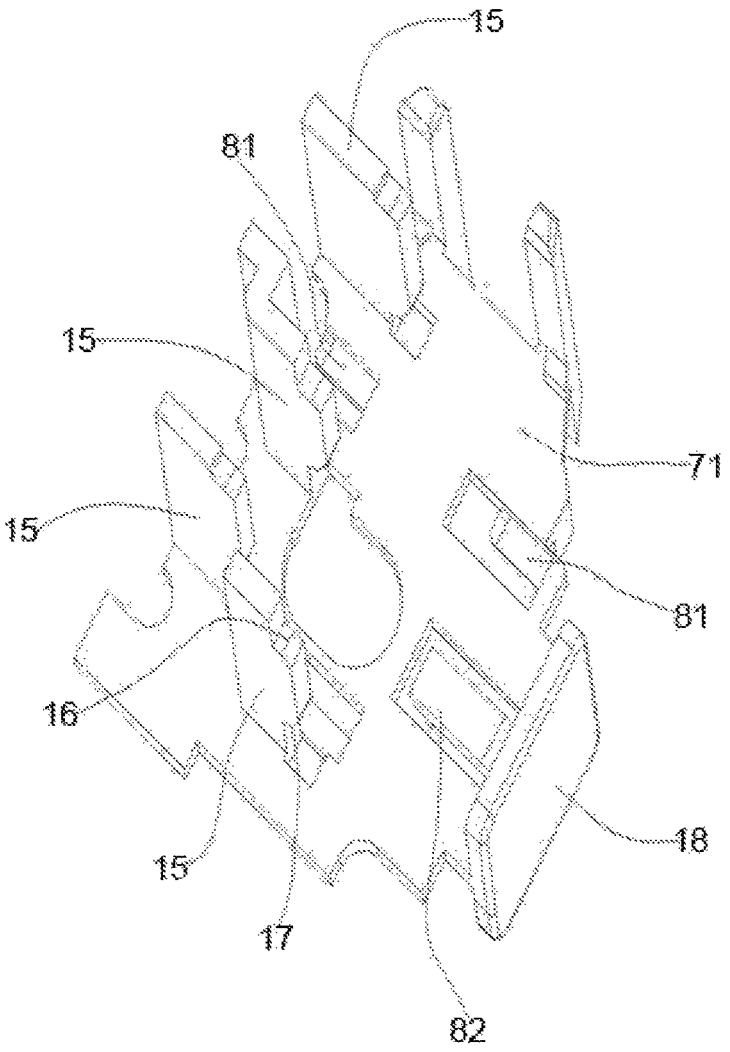
FIGS. 8-9 are structural representations of a support frame according to a preferred embodiment of the invention.

Referring to FIGS. 1-13, a travel adapter is provided, which includes a housing 10, a plug bush seat 11, a support frame 71 (as shown in FIGS. 7-8) and a pin assembly 12. Specifically, the plug bush seat 11 is provided in the housing 10, the support frame 71 is positioned beneath the plug bush seat 11 and is connected to the plug bush seat 11, multiple sets of pin assemblies 12 are respectively provided on the support frame 71.

Moreover, the support frame 71 is fixedly connected in the vertical direction on the plug bush seat 11, and is slidable in the horizontal direction along the plug bush seat 11.

Embodiment 2

Figure 9:
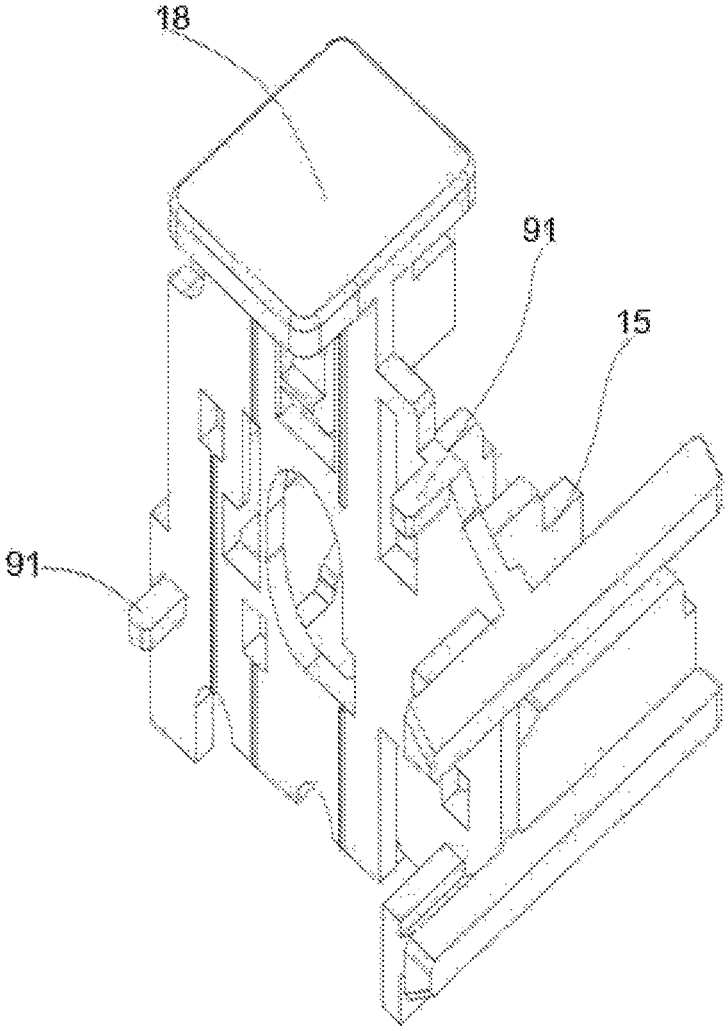

Based on the technical solutions, referring to FIG. 1-6, the pin assembly 12 includes a pin base 13 and pins 14 provided on the pin base 13. The support frame 71 is provided with a positioning plate 15 (as shown in FIGS. 8-9), and the positioning plate 15 is provided with an upper positioning step 16 and a lower positioning step 17 located under the upper positioning step 16. The pin base 13 is fitted onto the positioning plate 15, and may be positioned on the upper positioning step 16 or on the lower positioning step 17 so as to realize a positioning.

In the said embodiment, the plug bush seat 11 is connected with the support frame 71, and the connection between the plug bush seat 11 and the support frame 71 may realize an up/down positioning between the plug bush seat 11 and the support frame 71; and at the same time, the support frame 71 may also slide in the right direction or in the left direction.

Embodiment 2A

Based on the above technical solutions, the housing 10 is further provided with an opening, and a button 18 is provided at a corresponding position on the support frame 71 (as shown in FIGS. 8-9). The button 18 may pass through the opening and protrude from the opening. By pressing the button 18, a user may operate the support frame 71 such that it may slide with respect to the plug bush seat 11.

In this embodiment, the housing 10 is further provided with a slideway, and a slide button 19 is provided on the pin base 13 (as shown in FIGS. 1-6). The slide button 19 extends outwardly from the slideway; by operating the slide button 19, the user may drive the pin assembly 12 to slide.

Embodiment 3

Based on the above technical solutions, the up/down positioning and right/left sliding mechanism of the support frame 71 may be specifically implemented in a way as follows.

The plug bush seat 11 is provided with an upper positioning piece, and an interspace is formed between the upper positioning piece and the bottom surface of the plug bush seat 11. Correspondingly, the support frame 71 is provided with a lower positioning piece 81 (as shown in FIG. 8 and FIG. 13) that may be inserted into the interspace formed by the plug bush seat 11 and the upper positioning piece.

Figure 10:
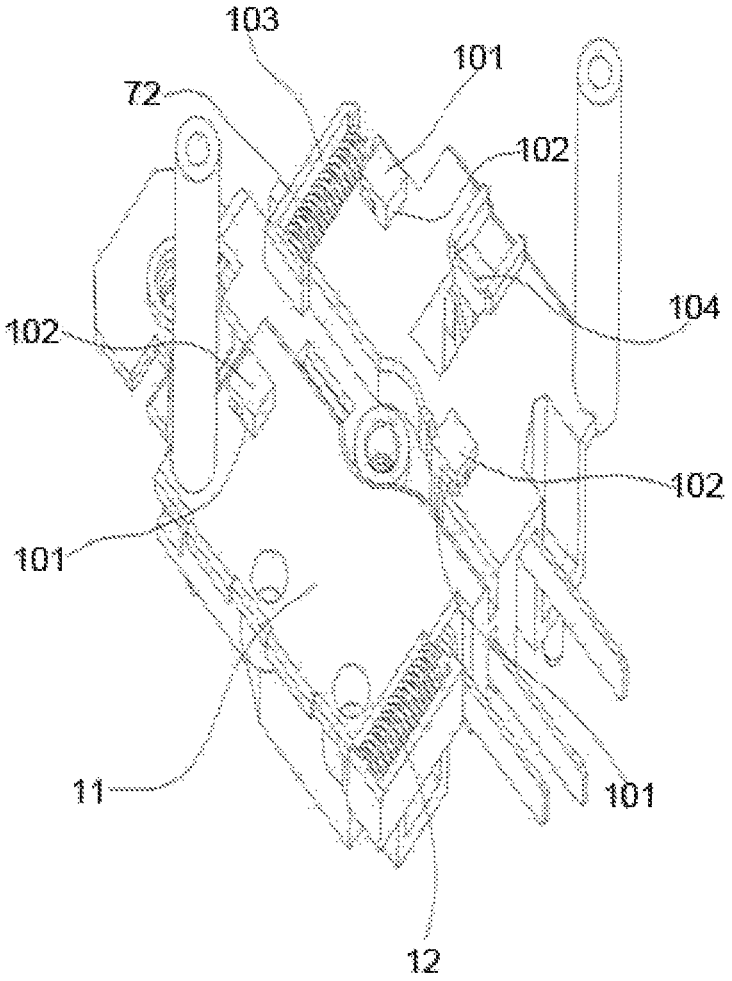
FIG. 10 is a structural representation of a plug bush seat according to a preferred embodiment of the invention.
Figure 11:
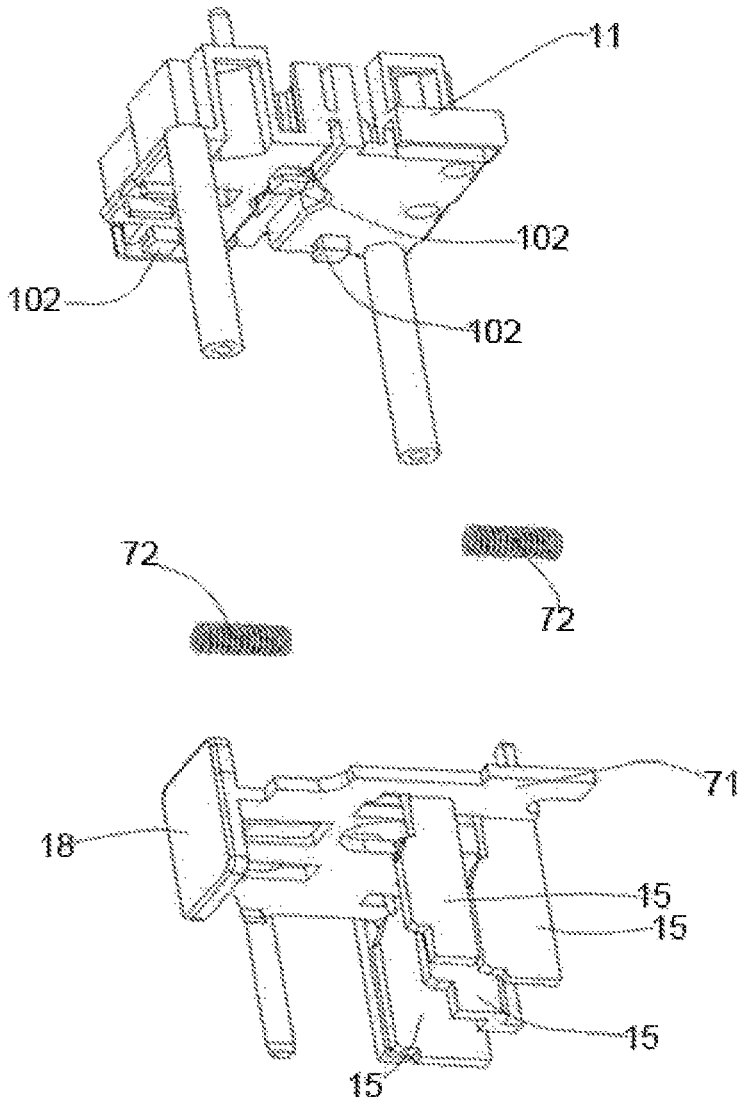
FIG. 11 is a schematic diagram showing the assembling of a plug bush seat and support frame according to a preferred embodiment of the invention.
Figure 12:
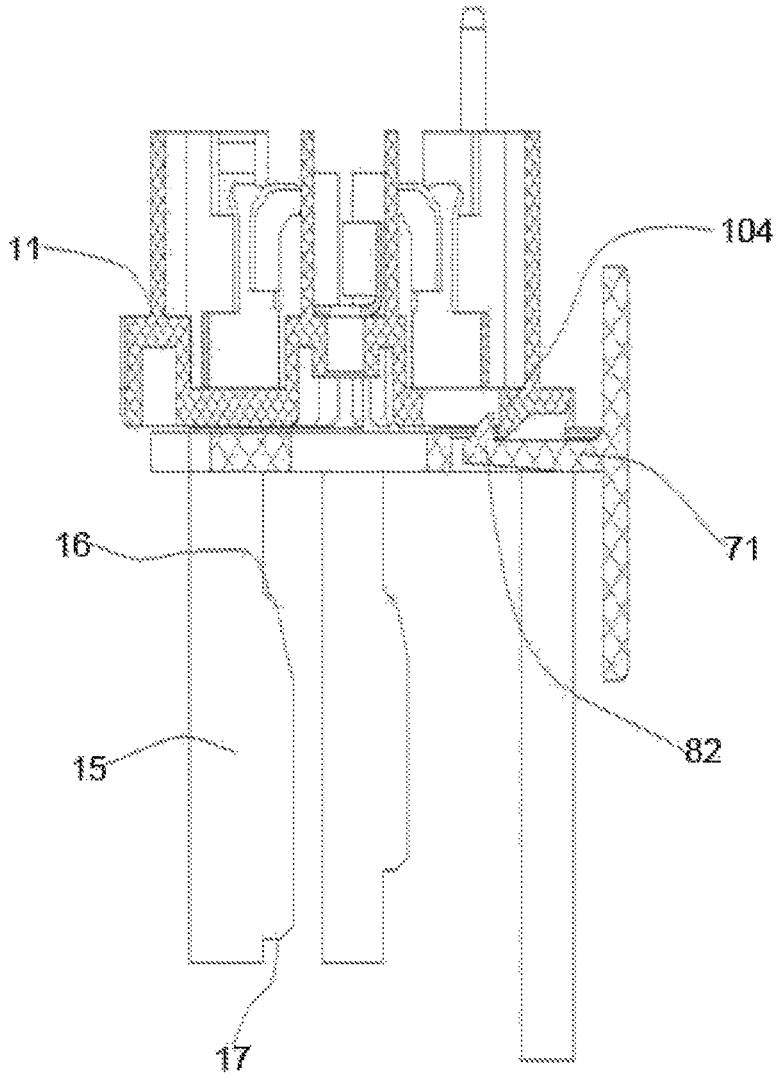
FIG. 12 is a sectional view showing an upper limit hasp and a lower limit hasp after a plug bush seat and a support frame are assembled according to a preferred embodiment of the invention.
Figure 13:
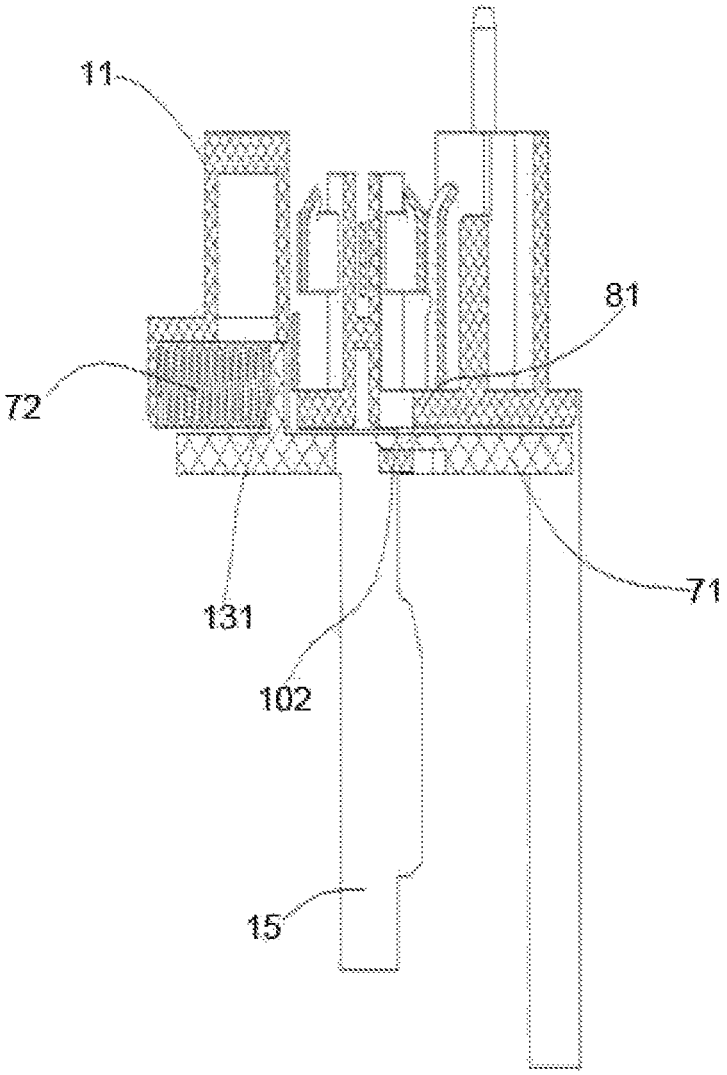
FIG. 13 is a sectional view showing an upper positioning piece and a lower positioning piece after a plug bush seat and a support frame are assembled according to a preferred embodiment of the invention.

Specifically, in this embodiment, the upper positioning piece is provided on the bottom surface of the plug bush seat 11, and as shown in FIGS. 10, 11 and 13, the upper positioning piece specifically includes a downward-extending plate 101 and a horizontal plate 102. The downward-extending plate 101 extends downwardly from the upper positioning piece, and the horizontal plate 102 is provided on one end of the downward-extending plate 101 that is not connected to the upper positioning piece; the horizontal plate 102 extends laterally, so that the upper positioning piece can be "L" shaped. The interspace is formed between the horizontal plate 102 and plug bush seat 11.

Correspondingly, in this embodiment, as shown in FIGS. 8 and 13, the lower positioning piece 81 is located on the lower end face of the support frame 71, and the upper end face of the support frame 71 is provided with a hollow part, the lower positioning piece 81 is provided in the hollow part, and the lower positioning piece 81 is flush with the upper end face of the support frame 71, that is, the upper surface of the lower positioning piece 81 is flush with the upper end face of the support frame 71.

In this embodiment, the thickness of the lower positioning piece 81 is less than that of the upper end face of the support frame 71, thus the lower positioning piece 81 may be easily inserted into the interspace.

Embodiment 4

Based on the technical solutions, an elastic device for restoring the support frame 71 after sliding is provided between the plug bush seat 11 and the support frame 71, so that the support frame 71 may be restored automatically after being operated. As shown in FIGS. 10-13, a spring 72 may be selected as the elastic device, then a spring cavity 103 is provided on the bottom surface of the plug bush seat 11, and the spring 72 may be located in the spring cavity 103. Correspondingly, the upper end face of the support frame 71 is provided with a spring stopper 131, and the spring 72 is pressed on the spring stopper 131.

In accordance with the description in the above, in a preferred embodiment of the invention, as shown in FIGS. 1-13, when the pin assembly 12 is hidden in the housing 10, the pin base 13 will be hung on the upper positioning step 16, so that the pin base 13 will be positioned in the housing 10; when the pin 14 needs to protrude, the button 18 is pressed first, so that the support frame 71 will slide inward, and at this moment, the pin base 13 is detached from the upper positioning step 16 of the support frame 71, and hence the slide button 19 may slide the pin assembly 12 downward, so that the pin 14 protrudes from the housing 10. After the pin 14 protrudes in place, the button 18 is released, and the support frame 71 will be restored under the action of the spring 72; and at this moment, the pin base 13 is pressed on the lower positioning step 17, so that the pin assembly 12 is blocked, and the pin 14 will not retract into the housing 10. When the pin 14 needs to be hidden into the housing 10 again, the button 18 will be pressed again, so that the support frame 71 will slide inward; and at this moment, the pin base 13 is detached from the lower positioning step 17 of the support frame 71, and hence the slide button 19 may slide the pin assembly 12 upward, till the pin 14 is completely hidden in the housing 10, and at this moment, the button 18 is released, and the support frame 71 will be restored under the action of the spring 72, and at this moment, the pin base 13 is hung on the upper positioning step 16 and is positioned again.

Embodiment 5

Based on the technical solutions, the upper end face of the support frame 71 is provided with a lower limit hasp 82, and the bottom surface of the plug bush seat 11 is provided with an upper limit hasp 104 adapting the lower limit hasp 82. After the button 18 is pressed, the support frame 71 will slide inward; and after the button 18 is released, the support frame 71 will be restored, and at this moment, the upper limit hasp 104 and the lower limit hasp 82 will be hooked to each other, thereby prevent the support frame 71 from being detached due to a too large sliding distance.

Embodiment 6

Figure 14:
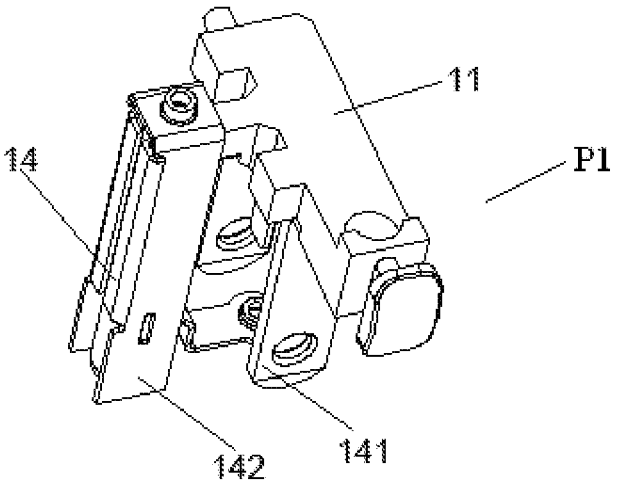
FIG. 14 is a schematic diagram showing an American Standard plug assembly according to a preferred embodiment of the invention.
Figure 119:
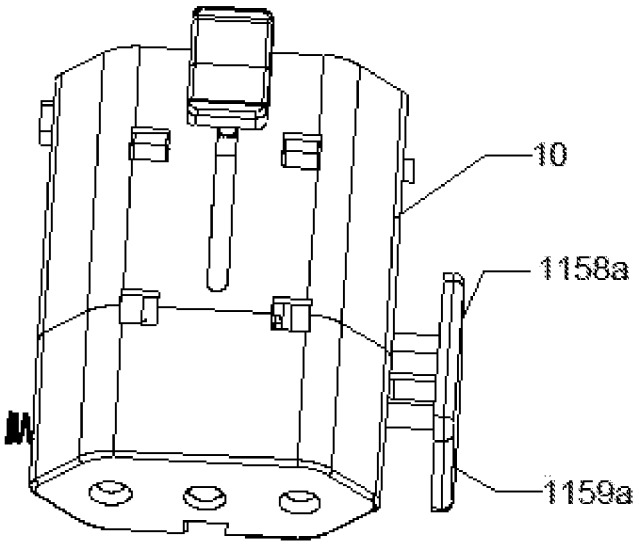
FIG. 119 is a schematic diagram showing an Italian Standard plug according to a preferred embodiment of the invention.

Based on the technical solutions, as shown in FIGS. 14-119*f*, the housing 10 (10') of the travel adapter is located outside the travel adapter, and the plug bush seat 11 (11') is provided with an L plug, an N plug and a pin, and under the action of an external force, the plug bush seat may drive the L plug 141 (141'), the N plug 161B (4') and the pin 14 (14') to protrude from the housing 10 (10') or retract into the housing 1'0 (10'); the pin 14 (14') may be folded relative to the plug bush seat 11 (11'), so that the pin 14 (14') may be folded when protruding from the housing.

In this embodiment, the travel adapter can not only drive the L plug and the N plug and the pin to protrude from the housing or retract into housing via the plug bush seat, but also fold the pin, thus it may be easily and conveniently used.

In this embodiment, the travel adapter further includes a ground joint sleeve 142 (142'), which is fixed in the adapter body. When the pin 14 (14') is in a received state, the ground joint sleeve 142 (142') will be sleeved on the pin 14 (14'), and the ground joint sleeve 142 (142') will be electrically connected with the pin 14 (14') when the pin 14 (14') protrudes out.

Figure 15:
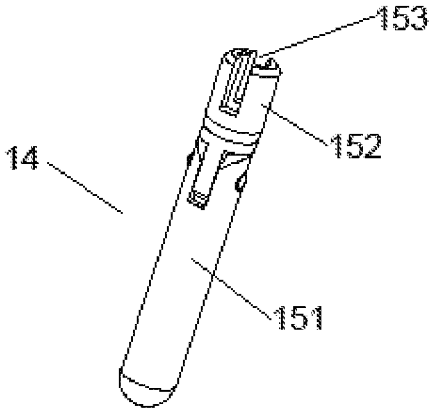
FIG. 15 is a structural representation of a pin according to a specific embodiment according to the invention.

As shown in FIGS. 15 and 8, the pin 14 (14') may include a ground base 152 (152') of which one end is fixed to the plug bush seat 11 (11') and a ground folding part 151 (151') movably connected to the other end of the ground base 152 (152'), and the ground folding part 151 (151') may be folded relative to the ground base 152 (152').

By providing the pin as two parts, when the pin is not required, it only needs to fold the pin protruding out of the housing, that is, it only needs to fold the ground folding part, rather than folding the ground base located inside the housing. With the design of the ground base, the manufacture difficulty of the plug bush seat may be reduce, so that the structure of the invention will be simple and easy to manufacture.

Embodiment 7

Figure 15A:
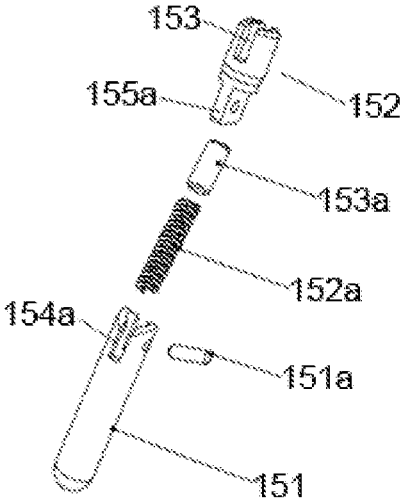
FIG. 15*a* is an exploded structural diagram of a pin based on FIG. 2 according to a preferred embodiment of the invention.
Figure 15B:
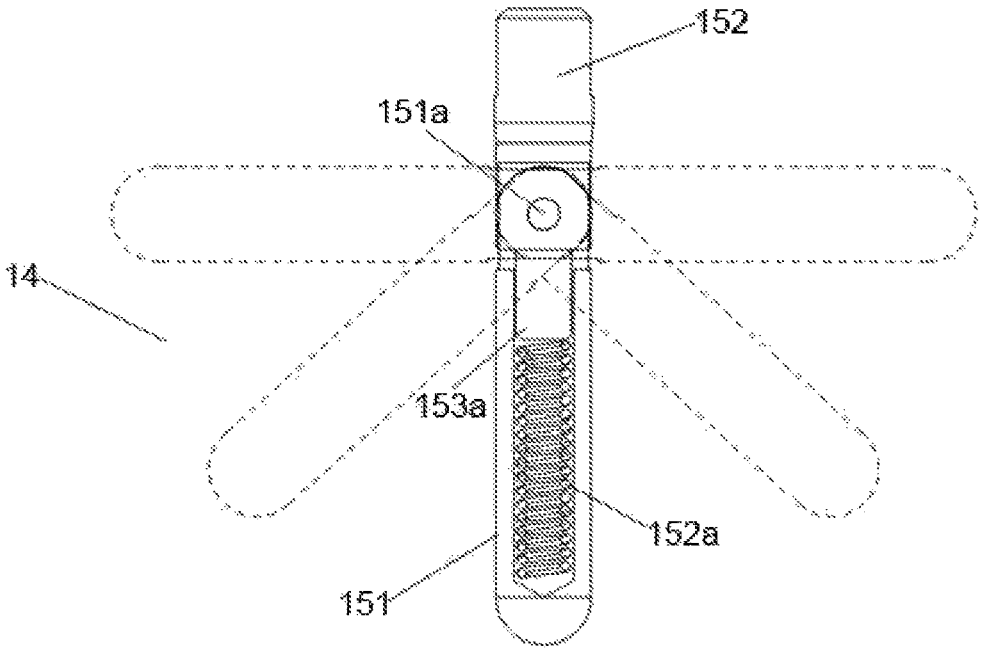
FIG. 15*b* is a schematic diagram showing a foldable pin according to a preferred embodiment of the invention.

Based on the technical solutions, as shown in FIGS. 15*a* and 15*b*, the ground base 152 and the ground folding part 151 are pivotally connected, the end of the ground folding part 151 connected with the ground base 152 is provided with a pair of pivot joint ears 154*a* provided opposite to each other, and the ground base 152 is provided with a pivot joint tongue 155*a* clamped in the pivot joint ears 154*a*. The pivot joint ears 154*a* and the pivot joint tongue 155*a* are connect with the via a pivot shaft 151*a*.

Specifically, in this embodiment, a pair of pivot joint ears 154*a* may be formed on one end of the ground folding part 151 connected with the ground base 152 via a longitudinal notch, and the shape of the pivot joint tongue 155*a* on the ground base 152 matches the shape of the pivot joint ears 154*a*. The pivot joint tongue 155*a* and the pivot joint ears 154*a* are connected via the pivot shaft 151*a* to make the ground base 152 and the ground folding part 151 pivotally connected, and thus, the ground folding part 151 may be rotatably folded around the pivot shaft 151*a* relative to the ground base 152.

The pin 14 further includes an elastic component 152*a* and a movable copper column 153*a* located inside the ground folding part 151, and the movable copper column 153*a* is located between the pivot joint tongue 155*a* and the elastic component 152*a*. By providing the elastic component 152*a*, the elastic component 152*a* applies an elastic force to the movable copper column 153*a*, and hence good electrical contact may be maintained between the movable copper column 153*a* and the pivot joint tongue 155*a*, so that good electrical contact may be maintained between the ground folding part 151 and the ground base 152. When the ground folding part 151 is in an initial upright state, one end face of the movable copper column 153*a* contact one end face of the pivot joint tongue 155*a*. The pivot joint tongue 155*a* further includes an end point face on which the ground folding part 151 contacts the end face of the movable copper column 153*a* when folded to an end point location. The distance from the pivot shaft 151*a* to the end face of the pivot joint tongue 155*a* and the distance from the pivot shaft 151*a* to the end point face are both less than the distance from the pivot shaft 151*a* to the part between the end face of the pivot joint tongue 155*a* and the end point face.

In this embodiment, the ground folding part 151 is a hollow cylindrical mechanism, and the end of the ground folding part 151 connected with the ground base 152 is recessed inward to form a groove for receiving the elastic component 152*a* and the movable copper column 153*a*, so that the ground folding part 151 forms a hollow cylindrical mechanism. The elastic component 152*a* may employ a spring, and the spring is located in the groove of the ground folding part 151 and pushes the movable copper column 153*a* to elastically contact the pivot joint tongue 155*a*. A hole for the pivot shaft 151*a* to pass through is provided at an approximately central position of the pivot joint tongue 155*a*.

When the plug structure operates, under the action of an external force, the ground folding part 151 may rotate around the pivot shaft 151*a*; under the action of the elastic compression of the spring, the movable copper column 153*a* contacts the pivot joint tongue 155*a*, and a certain friction force that retards the rotation of the ground folding part 151 is generated during rotation, so that good electrical connection may be maintained during the rotation of the ground folding part 151; at the same time, a certain hand feeling of revolving force may be felt when the ground folding part 151 is rotated. By the arrangement, the pin 14 may be automatically righted during retraction under the action of an elastic force, thereby avoiding the defect of manual righting in the prior art.

Embodiment 8

Figure 16A:
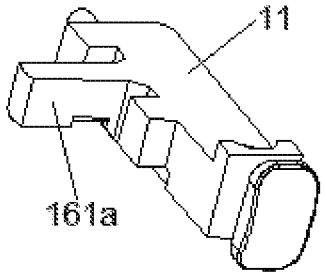
FIG. 16*a* is a schematic diagram showing a plug bush seat according to a specific embodiment according to the invention.
Figure 16B:
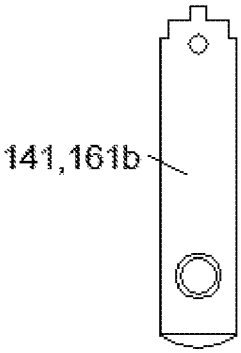
FIG. 16*b* is a schematic diagram showing an L plug and an N plug according to a specific embodiment of the invention.
Figure 17:
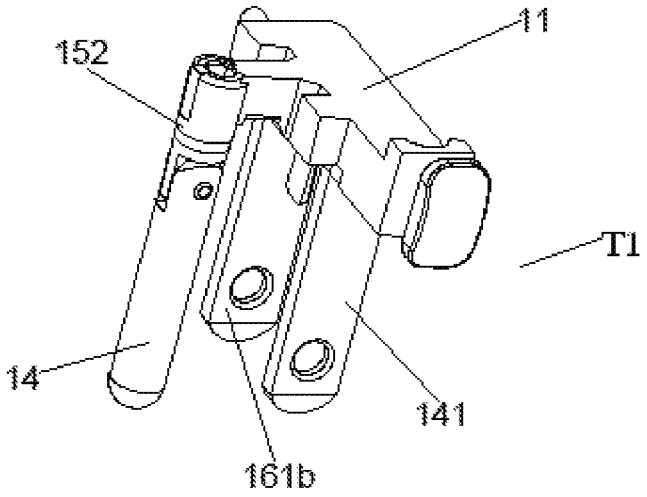
FIG. 17 is a schematic diagram showing an American Standard plug according to a preferred embodiment of the invention.

Based on the technical solutions, FIG. 16*a* shows a structure configured for fixing a plug bush seat 11 of a ground base 152 according to the invention, wherein the plug bush seat 11 is provided with a fixing end 161*a*, the ground base 152 of the pin 14 is fixed on the plug bush seat 11 via the fixing end 161*a*, and the plug bush seat 11 is further provided with a fixing end configured for fixing the L plug 141 and the N plug 161B (not shown). The structures of the L plug 141 and the N plug 161B are as shown in FIG. 16*b*. FIG. 17 shows a plug structure T1 after the pin 14, the L plug 141 and the N plug 161B are fixed to the plug bush seat 11.

In this embodiment, the top of the ground base 152 may be provided with a longitudinal groove 153, the ground base 152 is fixed to the fixing end of the plug bush seat 11 via the longitudinal groove 153. The L plug 141 and the N plug 161B are also fixed to a corresponding position of the plug bush seat 11, and the fold direction of the pin 14 is located on the center line between the L plug 141 and the N plug 161B.

Figure 18:
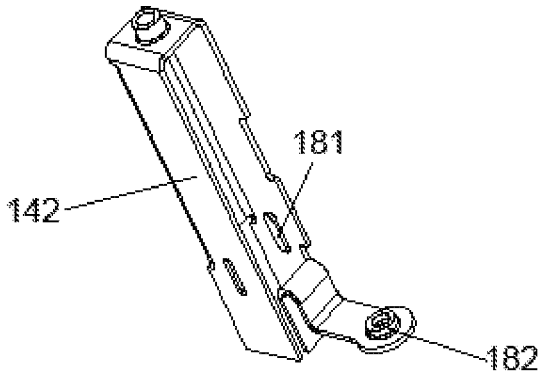
FIG. 18 is a schematic diagram showing a ground joint sleeve according to a specific embodiment of the invention.

In this embodiment, the structure of the ground joint sleeve 142 is as shown in FIG. 18. The sidewall of the ground joint sleeve 142 is provided with a boss contact surface 181, and the pin 14 contact the boss contact surface 181 during sliding to realize electrical connect.

By assembling the plug structure T1 of FIG. 17 and the ground joint sleeve 142 of FIG. 18, a plug structure assembly as shown in FIG. 14 may be obtained. The ground joint sleeve 142 is slidably contacted with the pin 14. The ground joint sleeve 142 has two sidewalls, and each sidewall is provided with a boss contact surface 181. The ground joint sleeve 142 is fixed on the adapter body via a mounting and positioning hole 182. When the plug bush seat 11 is pushed, the plug bush seat drives the pin 14 to slide in the ground joint sleeve 142, and the pin 14 contacts the boss contact surface of the ground joint sleeve 142 during sliding to realize electrical connect. The adapter body is provided with a receiving groove 191*a* configured for receiving the pin. Specifically, the receiving groove 191*a* is provided at a position of the adapter body corresponding to the folded ground folding part 151 for receiving the ground folding part 151 of the pin 14.

Embodiment 9

Figure 19A:
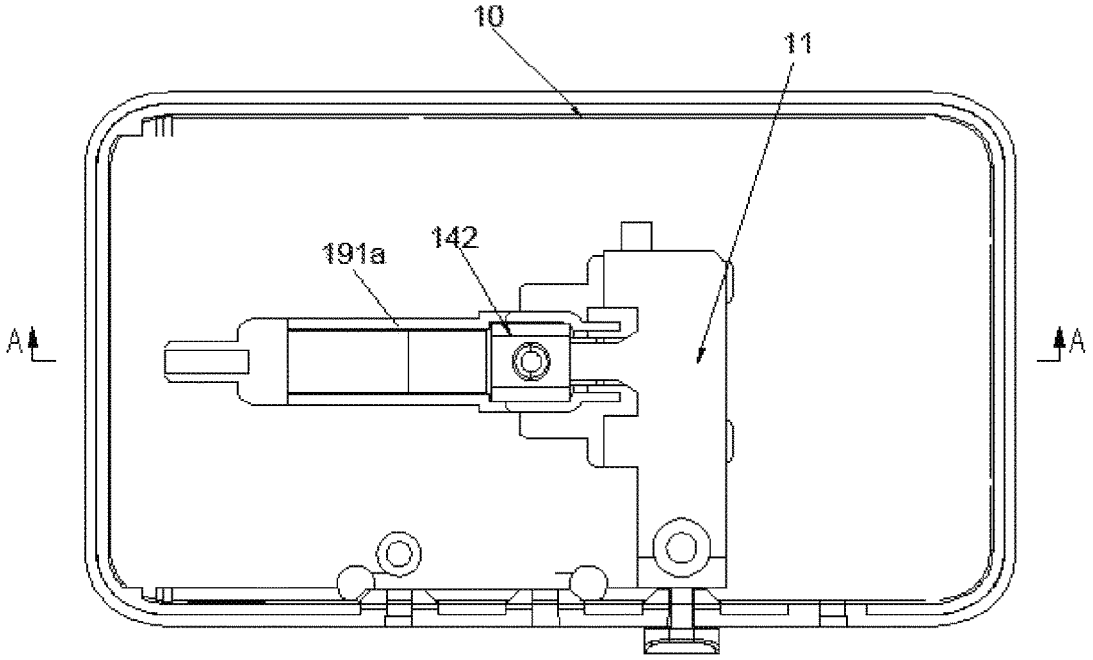
FIG. 19*a* is a schematic diagram showing an assembled travel adapter according to a preferred embodiment of the invention.

Based on the technical solutions, FIGS. 19*a*-19*g* show structural representations of a travel adapter of the invention. The travel adapter includes a lower housing 10, in which an American Standard plug structure assembly as shown in FIG. 14 is provided. In FIG. 19*a*, a plug bush seat 11, a ground joint sleeve 142 and a receiving groove 191*a* may be seen. The operating principles of the invention will be further illustrated below in conjunction with FIG. 19*b* to FIG. 19*g* that are sectional views along A-A of FIG. 19*a*.

Figure 19B:
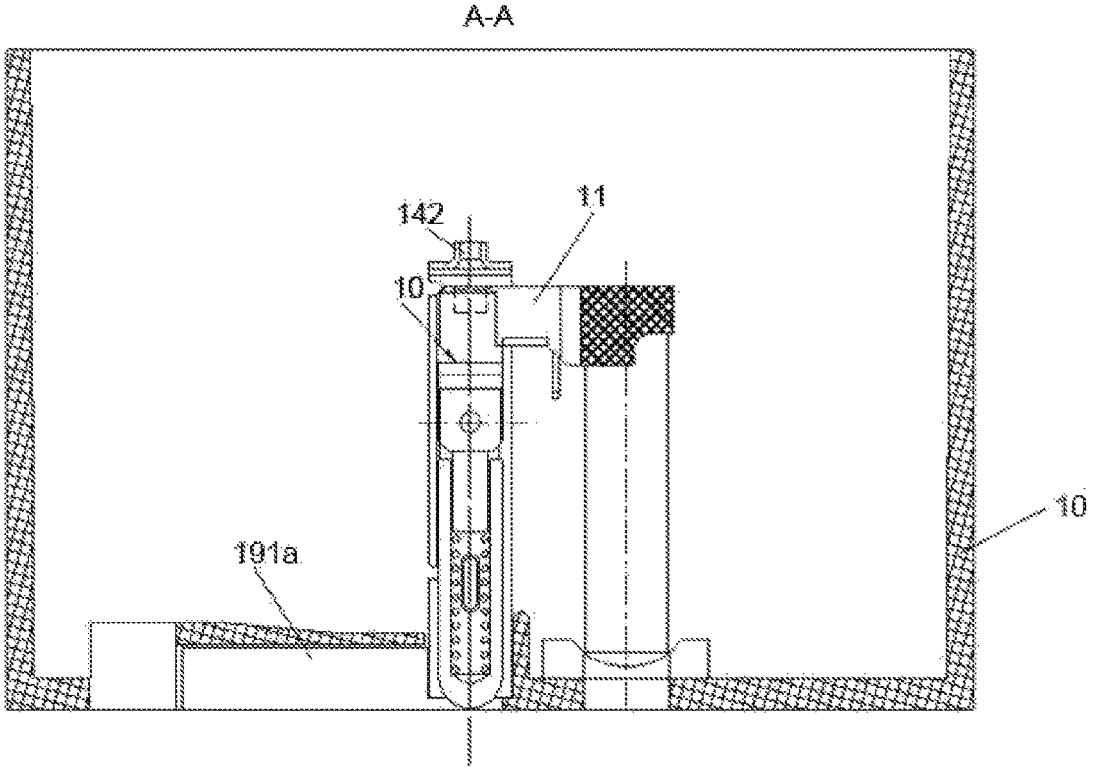
FIGS. 19*b*-19*g* are sectional views of FIG. 19*a* for illustrating the operating principle of the American Standard plug in the travel adapter.
Figure 19C:
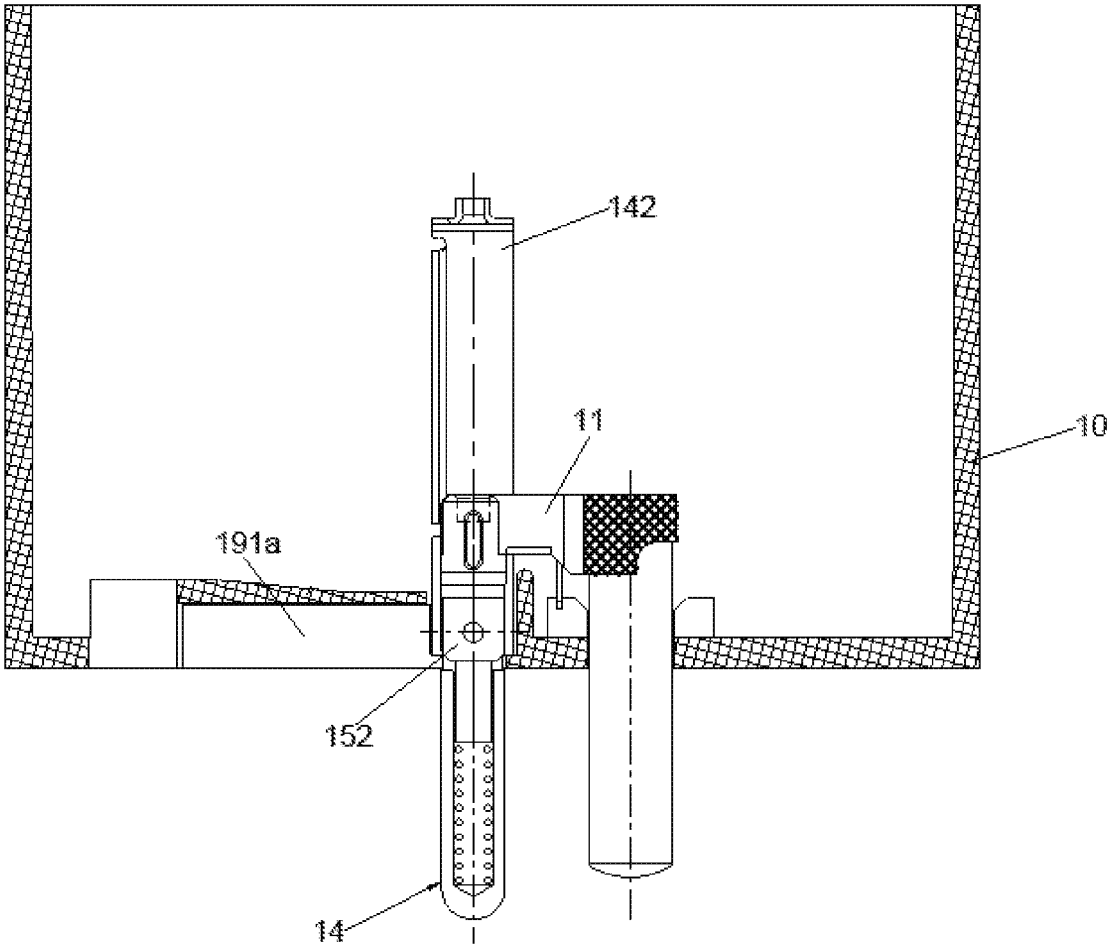

FIG. 19*b* is a schematic diagram in which the plug bush seat 11 overall retracts into the travel adapter. It may be seen that the pin 14 is located in the ground joint sleeve 142, which may be regarded as an initial state.

By pushing the plug bush seat 11, the plug bush seat 11 drives the pin 14 to slide in the ground joint sleeve 142. It may be seen from FIG. 19*c* that the pin 14, the L plug 141 and the N plug 161B are all pushed out of the surface of the travel adapter. When the pin 14 is not used, it may be received in the receiving groove 191*a* by folding, i.e., by rotating the ground folding part 151 relative to the ground base 152. The received state is as shown in FIG. 19*d*, and it may determine whether to fold the ground folding part 151 according to user requirement.

Embodiment 10

Figure 19D:
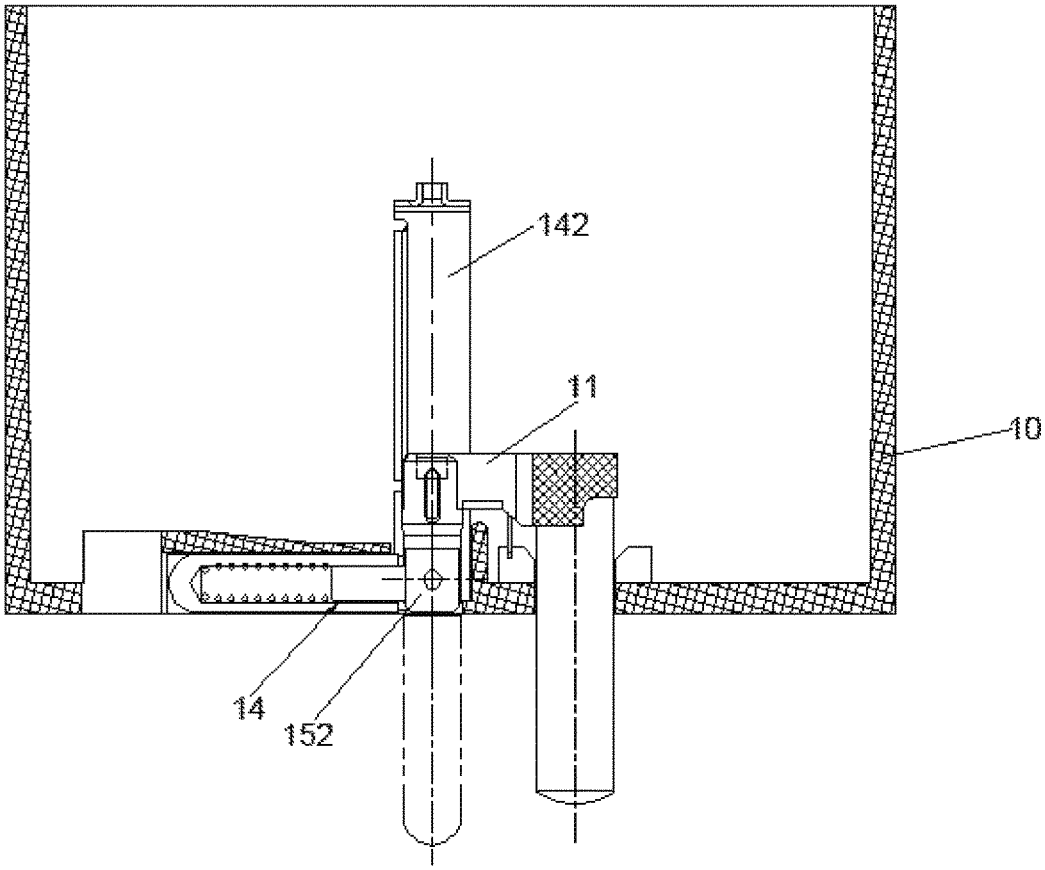
Figure 19E:
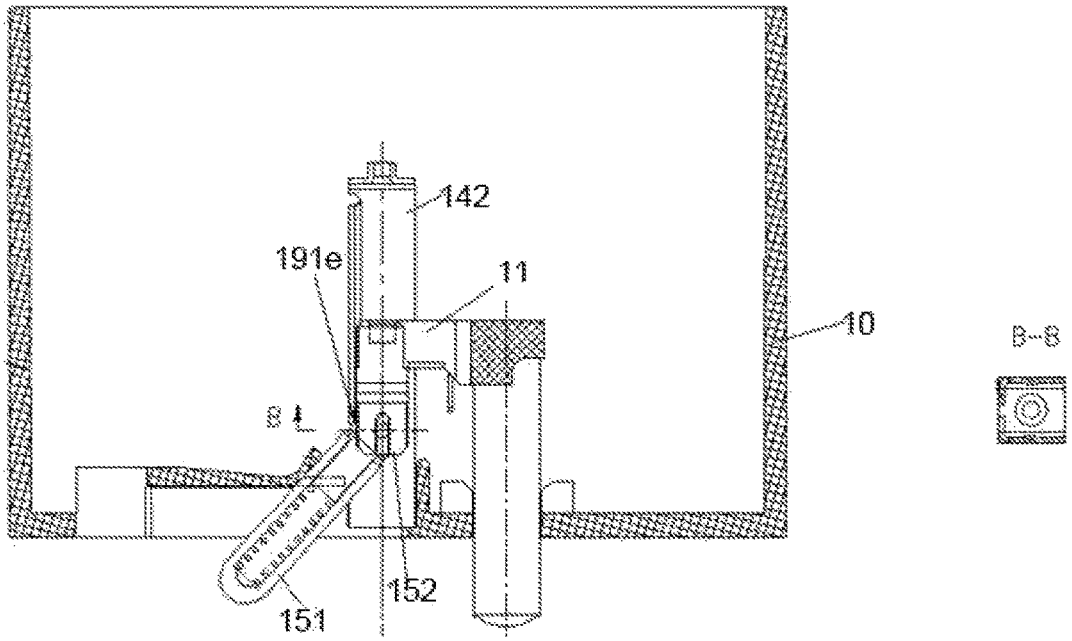
Figure 19F:
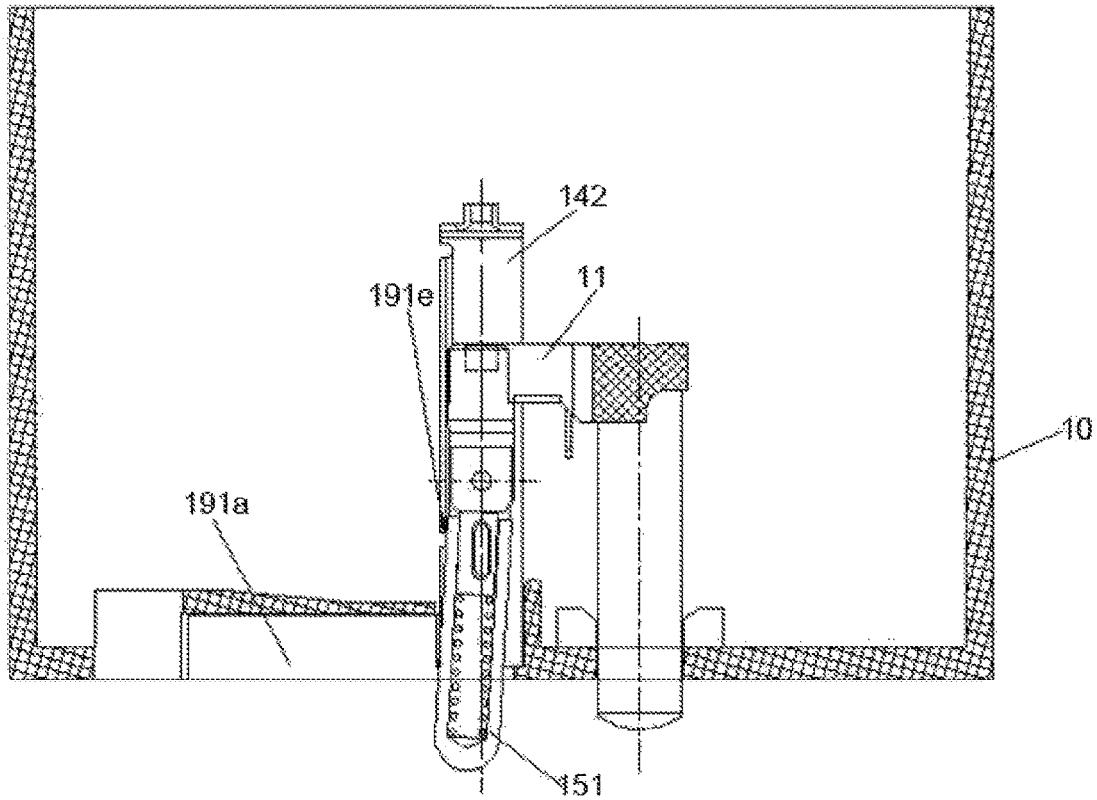
Figure 19G:
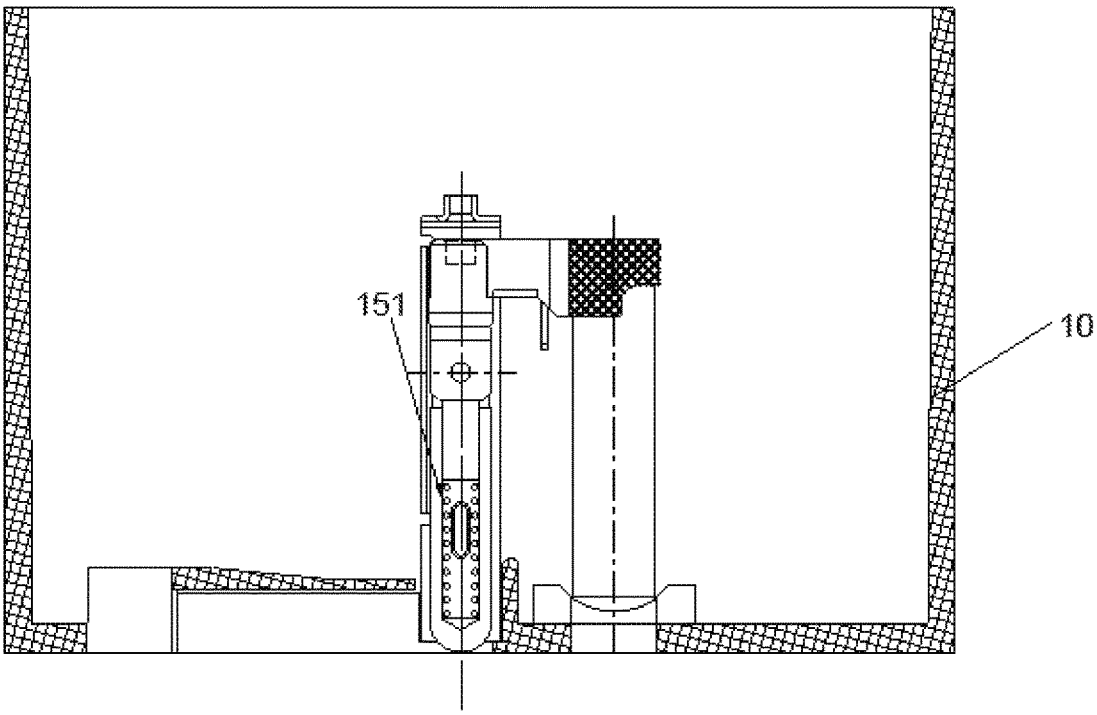

Based on the technical solutions, after being used in the state of FIG. 19*d*, it may be received referring to the steps of FIG. 19*e*-19*g*. The receiving groove 191*a* may be made of an elastoplastic structure or a spring leaf. The arrangement of the elastoplastic structure or the spring leaf will make the sliding of the pin 14 smoother when the pin 14 retracts into the travel adapter as driven by the plug base 2. Further, a righting and guiding structure 191*e* is provided at the position where the receiving groove 191*a* laps the ground joint sleeve 1425. The righting and guiding structure 191*e* may be provided as a baffle-like structure. During receiving, the pin 14 realizes an automatic guiding and righting function via the righting and guiding structure 191*e* in conjunction with the elastic force inside the pin 14. It may be seen from FIG. 19*g* that receiving is accomplished and the pin 141 is righted to the normal position.

Embodiment 11

Figure 21:
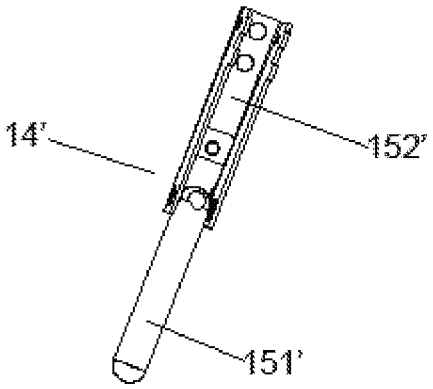
FIG. 21 is a structural representation of a pin according to a specific embodiment according to the invention.
Figure 21A:
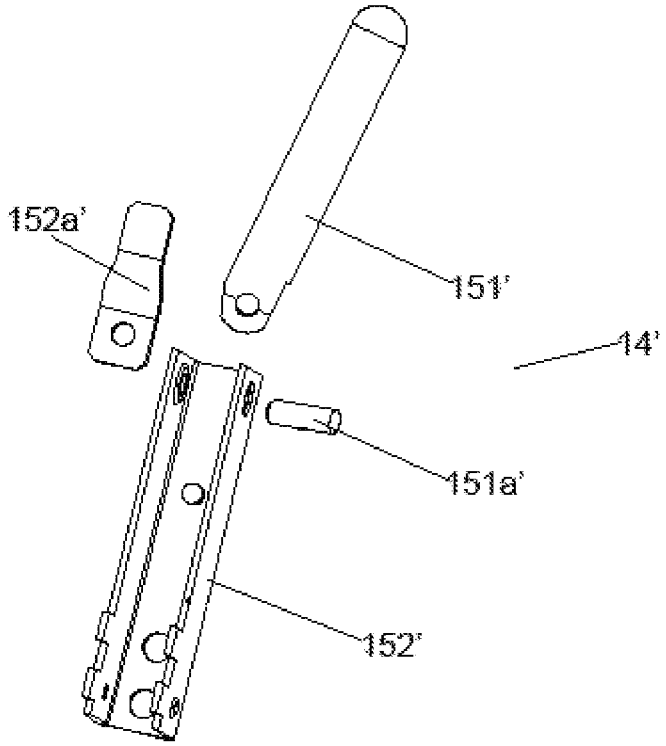
FIG. 21*a* is an exploded structural diagram of a pin based on FIG. 21 according to a preferred embodiment of the invention.
Figure 21B:
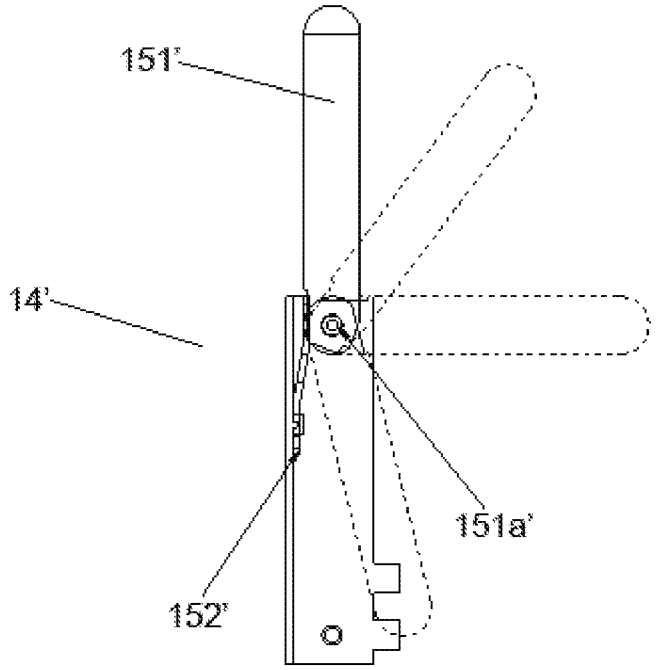
FIG. 21*b* is a schematic diagram showing a foldable pin according to a preferred embodiment of the invention.

Based on the technical solutions, FIGS. 21, 21*a* and 21*b* show a pin with another structure. The ground base 152 is a ground clamp 152', one end thereof is connect to the plug bush seat 11', and the ground folding part 151' may be rotatably connected to the other end of the ground clamp 152', and the ground clamp 152' is a semi-encircled accommodation cavity with at least one sidewall opened for accommodating the folded ground folding part 151'.

Further, in this embodiment, the pin 14' further includes a blade spring 152*a*', which is mounted inside the ground clamp 152' for elastically supporting the ground folding part 151' and electrically connecting the ground folding part 151' when the ground folding part 151' is folded.

The ground folding part 151' is connected with the ground clamp 152' via a connecting piece, for example, a positioning pin 151*a*'. The ground folding part 151' may rotate 180 degrees around the positioning pin 151*a*', and good electrical connection may be maintained during rotation.

Embodiment 12

Figure 22A:
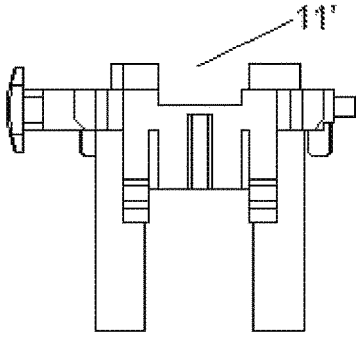
FIG. 22*a* is a structural representation of a plug bush seat according to a specific embodiment according to the invention.
Figure 22B:
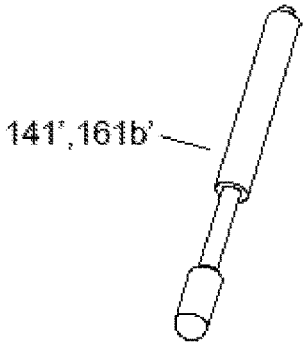
FIG. 22*b* is a schematic diagram showing an L plug and an N plug according to a specific embodiment according to the invention.

Based on the technical solutions, FIG. 22*a* shows another plug bush seat 11' of the invention. The pin 14' shown in FIG. 21 and the L plug 141' and the N plug 161B' shown in FIG. 22*b* are fixed to the corresponding positions of the plug bush seat 11' shown in FIG. 9*a*, thus an Italian Standard plug of this embodiment is obtained.

Figure 23:
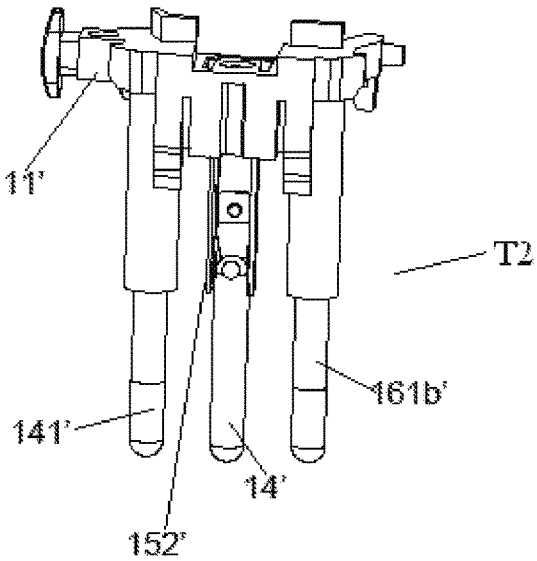
FIG. 23 is a schematic diagram showing an Italian Standard plug according to a preferred embodiment of the invention.
Figure 24:
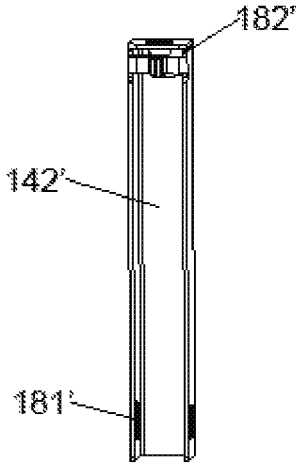
FIG. 24 is a schematic diagram showing a ground joint sleeve according to a specific embodiment according to the invention.

In this embodiment, an Italian Standard plug assembly shown in FIG. 7 is obtained by integrally assembling the Italian Standard plug T2 shown in FIG. 23 and the ground joint sleeve 142' shown in FIG. 24. By pushing the plug bush seat 11', the plug bush seat 11' can drive the pin 14' slide in the ground joint sleeve 142'.

In this embodiment, the top of the ground joint sleeve 142' is provided with a positioning mechanism 182', and the bottom sidewall of the ground joint sleeve 142' is provided with a boss contact surface 181. The ground joint sleeve 142' has a semi-open sliding slot structure to guarantee a good elasticity of the boss contact surface 181'.

In different embodiments of the invention, in order to guarantee a good elasticity of the ground joint sleeve 142, the sidewall thereof is preferably made of an elastic material.

Figure 20:
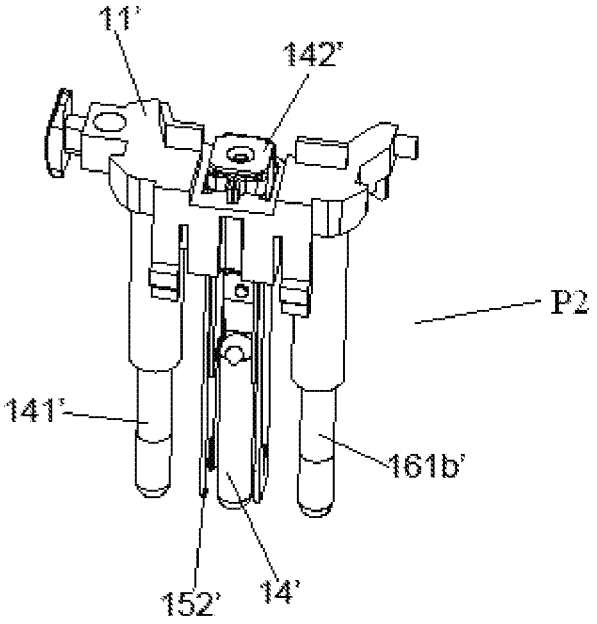
FIG. 20 is a schematic diagram showing an Italian Standard plug assembly according to a preferred embodiment of the invention.
Figure 25:
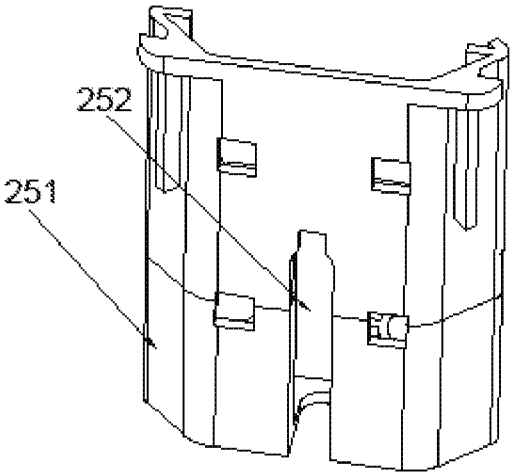
FIG. 25 is a schematic diagram showing of a plug cover according to a preferred embodiment of the invention.
Figure 26:
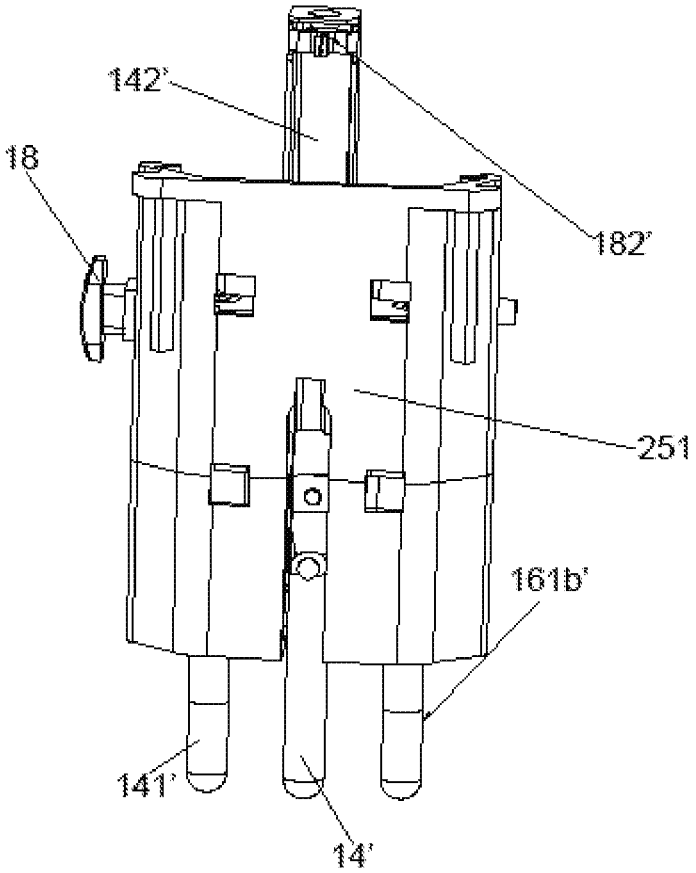
FIG. 26 is a schematic diagram showing the assembling of an Italian Standard plug assembly and a plug cover according to a preferred embodiment of the invention.
Figure 27:
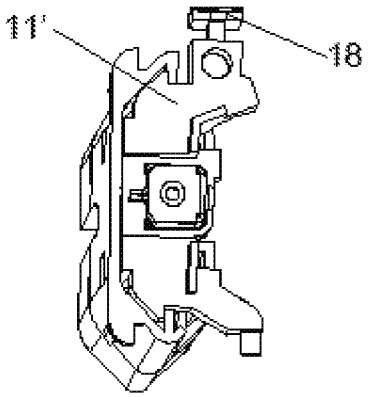
FIG. 27 is a top view of FIG. 26.
Figure 28:
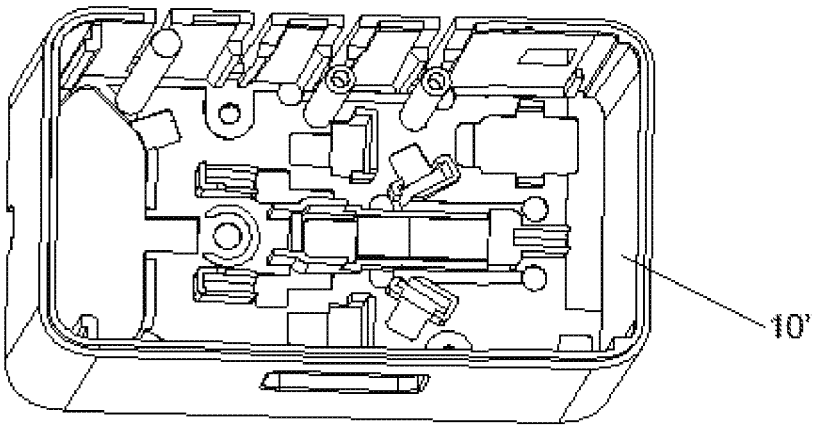
FIG. 28 is a schematic diagram showing a housing in a travel adapter according to a specific embodiment according to the invention.
Figure 29A:
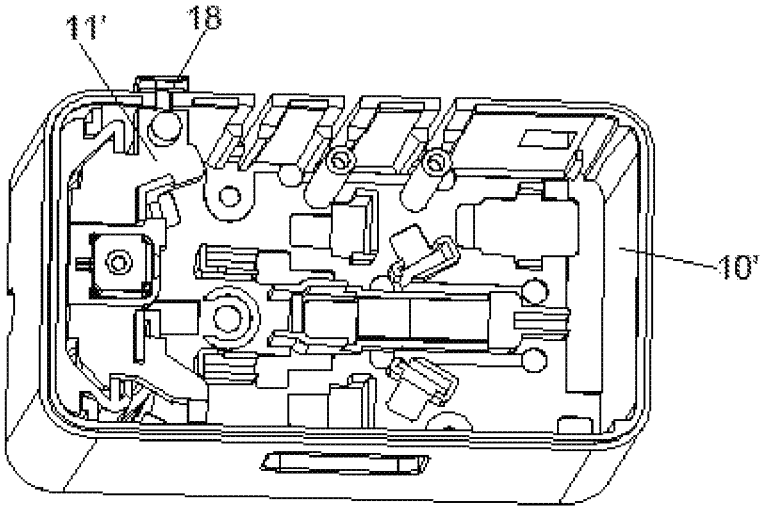
FIG. 29*a* is a schematic diagram showing an assembly after assembling the structure shown in FIG. 27 into a housing.
Figure 29B:
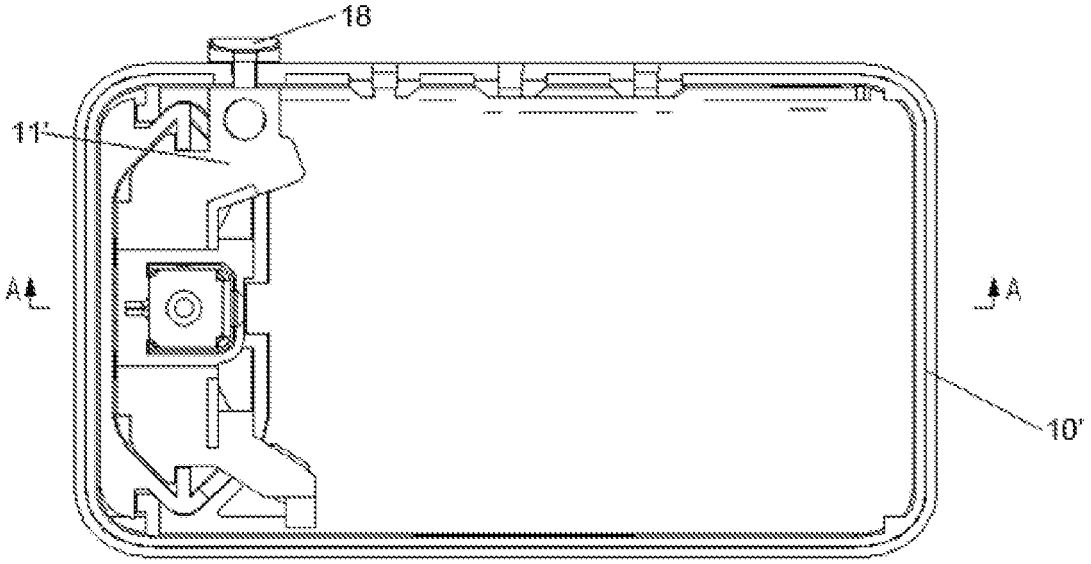
FIG. 29*b*-29*f* are schematic diagrams illustrating the operating principle of an Italian Standard plug in the travel adapter.

In this embodiment, FIG. 26 shows an assembly obtained by integrally assembling the Italian Standard plug assembly P2 shown in FIG. 20 and the plug cover 251 shown in FIG. 25. It may be seen that a button 18 on the plug bush seat 11' protrudes from the plug cover 251, and during operation, the plug bush seat 11' retracts under the action of an external force. The plug cover 251 is provided with a pin movement hole 252. Specifically, the positioning mechanism 182' on the top of the ground joint sleeve 142' may be fixed to the position shown in FIG. 26, and by pushing the button 18 of the plug bush seat 11', the Italian Standard plug may move up and down. FIG. 27 is a top view of FIG. 26, and as shown in FIG. 29*a*, the adapter body is obtained by assembling the FIG. 27 in the housing 10' of the adapter body shown in FIG. 28. When mounted in the housing 10', the button 18 of the plug bush seat 11' protrudes out of the housing 10' for easy operation.

Figure 29C:
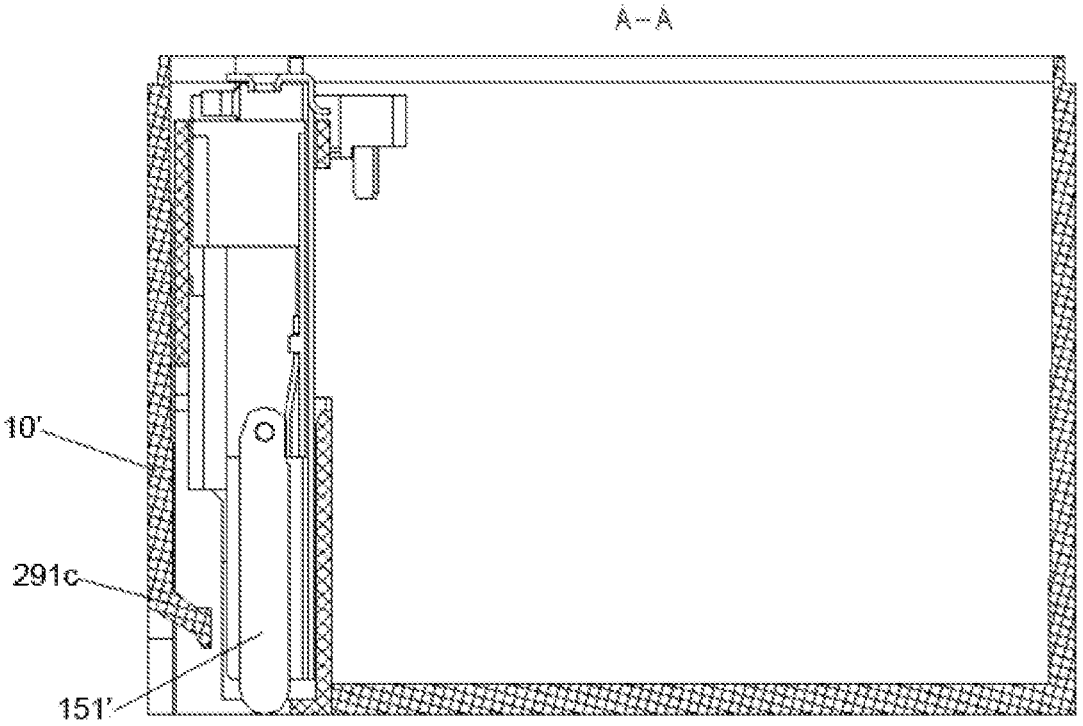
Figure 29D:
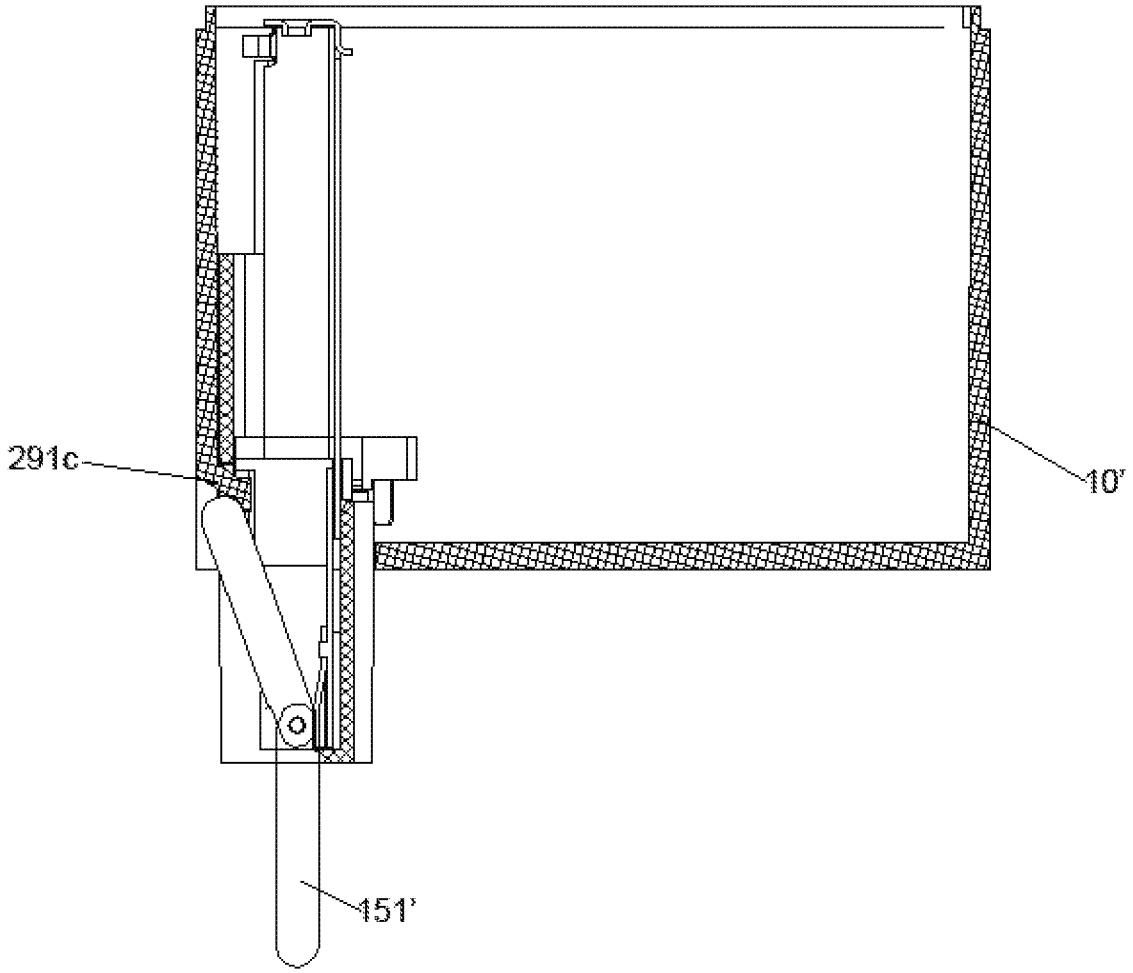
Figure 29E:
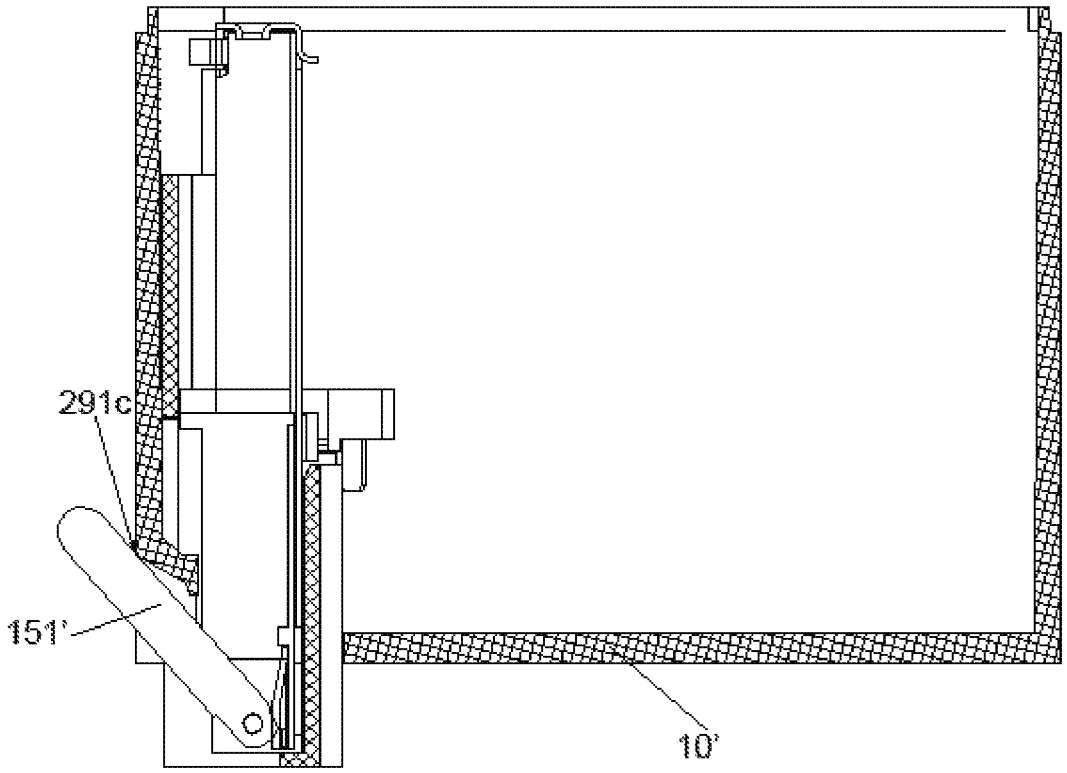
Figure 29F:
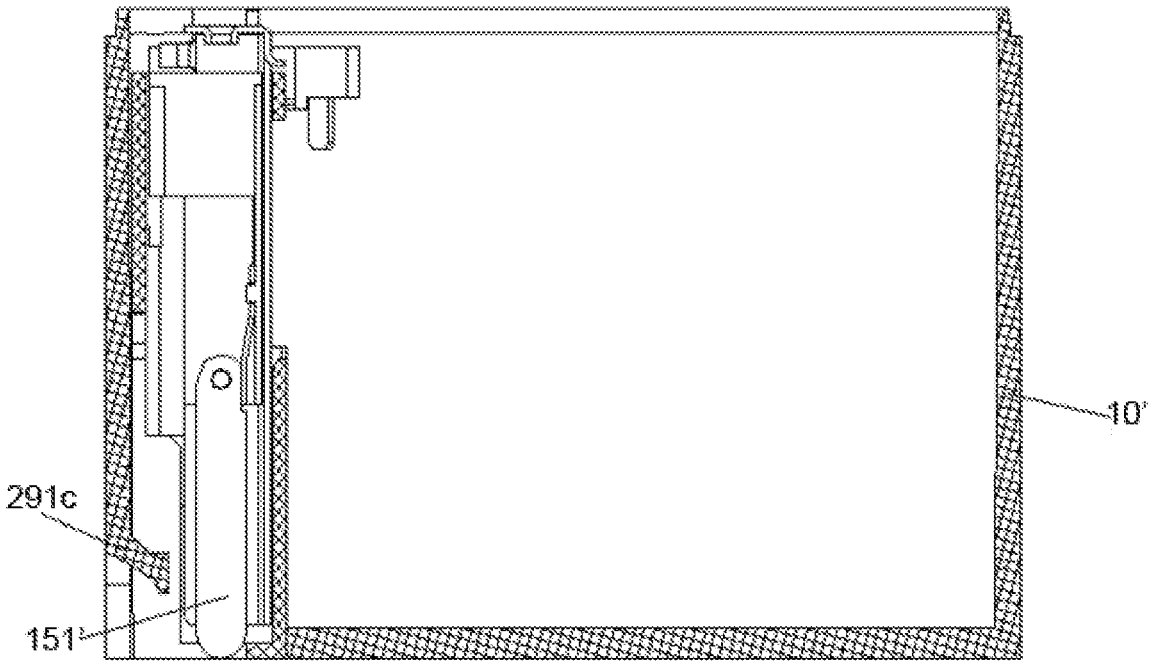
Figure 30:
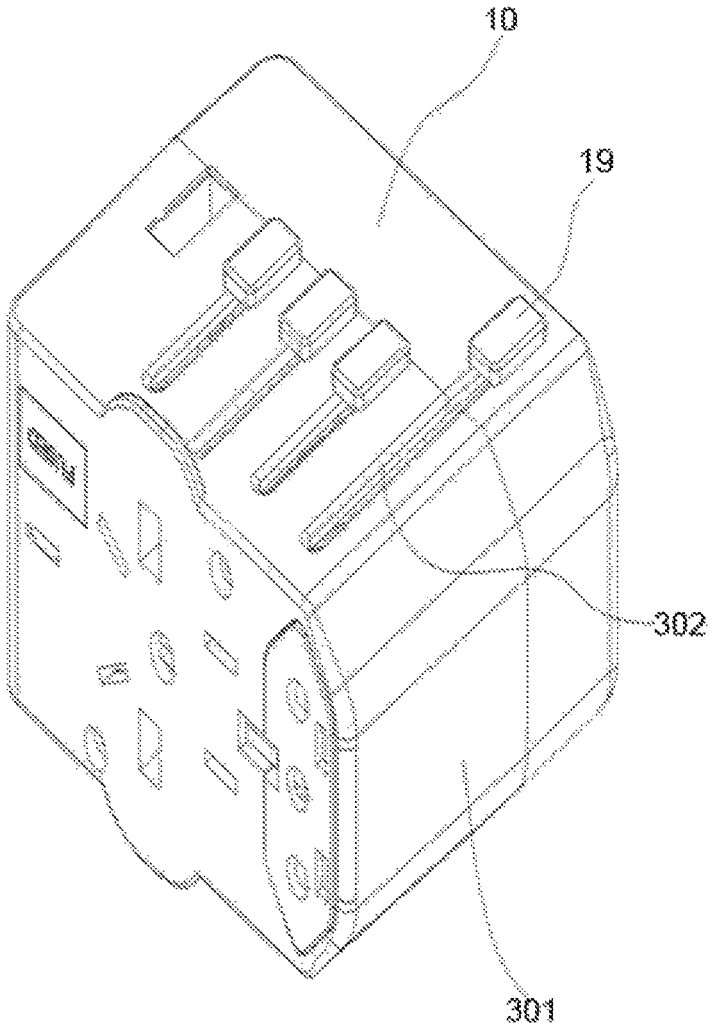
FIG. 30 is a structural representation of travel adapter according to a preferred embodiment of the invention.
Figure 31:
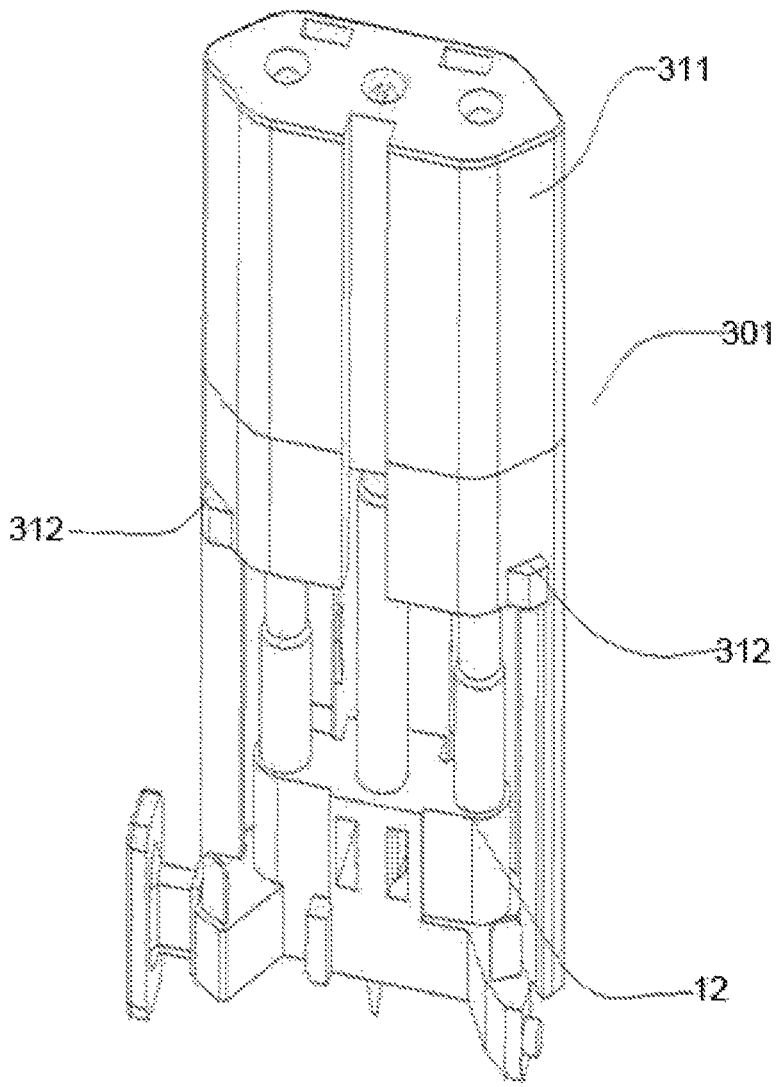
FIG. 31 is a structural representation of a plug assembly according to a preferred embodiment of the invention.
Figure 32:
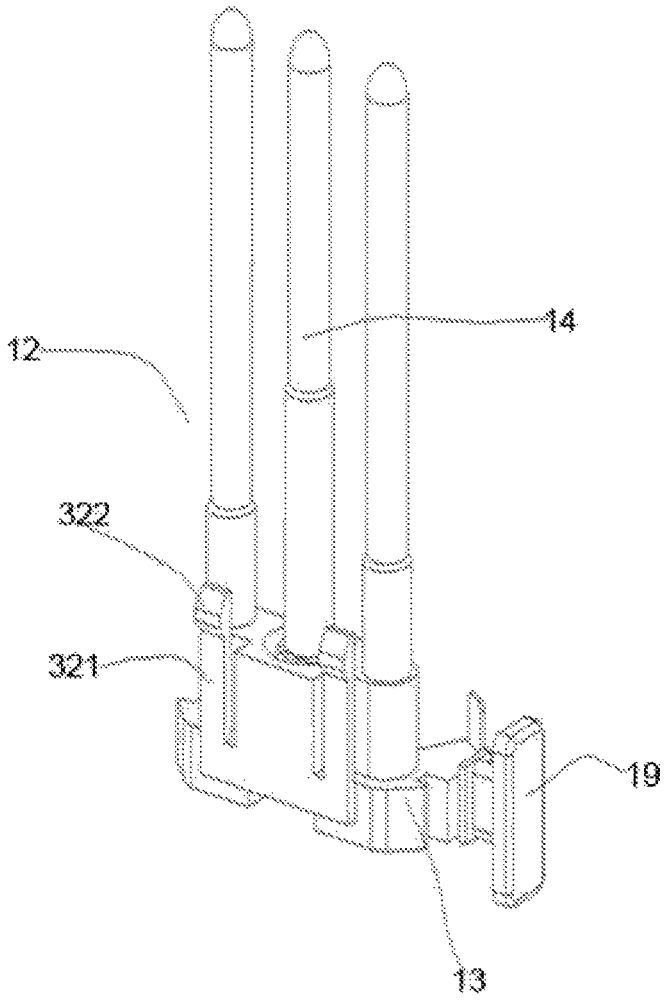
FIG. 32 is a structural representation of a pin assembly according to a preferred embodiment of the invention.

In conjunction with the sectional views along A-A of FIG. 29*b* and FIG. 29*b*, FIG. 29*c* to FIG. 29*f* below illustrate the operating principle of the Italian Standard plug assembly. FIG. 29*c* may be regarded as an initial state; by pushing the plug bush seat 11', as shown in FIG. 29*d*, the Italian Standard plug is pushed out normally, the plug bush seat 11' drives the pin 14' to slide in the ground joint sleeve 142'. It may be seen from FIG. 29*d* that the pin 14' is pushed out of the surface of the adapter body, that is, pushed out of the housing 10'. When the pin 14' is not used, it may be folded and received by folding, i.e., by relatively rotating the ground folding part 151'. The housing 10' is provided with a barrier mechanism 291*c*, and when the ground folding part 151' is in a folded state, the ground folding part 151' is pressed on the barrier mechanism 291*c*, so that the barrier mechanism 291*c* has a limit action on the ground folding part 151'. At the same time, during the receiving of the ground folding part 151', the barrier mechanism 291*c* has a righting action on the ground folding part 151', thus the receiving process will be smoother. It may be determined whether the ground pin 14' needs to be folded according to user requirements. When the Italian Standard plug needs to be received inward, it may be accomplished referring to FIG. 29*e* and FIG. 29*f*.

By the travel adapter in the embodiment, the pin may be folded relative to the plug bush seat, and switching may be realized by receiving the pin respectively in converters of various standards; at the same time, by driving the pin to slide via the plug bush seat, fast retraction may be realized, which is easy for receiving.

Embodiment 13

Based on the technical solutions, as shown in FIGS. 30-38, the travel adapter further includes a plug housing 311, the plug housing 311 is provided with the pin assembly 12, and the pin assembly 12 is slidably provided in the plug housing 311. The pin assembly 12 and the plug housing 311 consists a plug assembly 301, and the plug assembly 301 is provided in the housing 10 and may protrude from the lower end face of the housing 10.

A second locking component is provided between the pin assembly 12 and the plug housing 311, and the second locking component provides a locking or unlocking function when the pin assembly slides relative to the plug housing 311. Specifically, the pin assembly 12 and the plug housing 311 may be locked or unlocked during the sliding of the pin assembly 12 relative to the plug housing 311.

Correspondingly, a first locking component is provided between the plug housing 311 and the housing 10, and the first locking component may lock or unlock the plug housing 311 and the housing 10, that is, the first locking component may provide a locking or unlocking function during the sliding of the plug housing 311 relative to the housing 10.

During the sliding of the plug assembly 301, when the second locking component is in an unlock state, the first locking component will be in a lock state; correspondingly, when the second locking component in a lock state, the first locking component will be in an unlock state. That is, when the second locking component locks the pin assembly 12 to the plug housing 311, the first locking component will unlock the plug housing 311 from the housing 10; when the second locking component unlocks the pin assembly 12 from the plug housing 311, the first locking component locks the plug housing 311 to the housing 10. In other words, during the sliding of the plug assembly 301, the second locking component and the first locking component will not be in a locking state simultaneously and will not be in an unlocking state simultaneously.

In this embodiment, the pin assembly 12 is an European pin assembly, and the pin base 13 and the pin 14 in the pin assembly 12 are specifically mounted in the following mode: the pin 14 is provided with a concave clip groove, the tail of the pin 14 is inserted in the pin base 13, the pin base 13 is provided with a clip ring, and the clip ring is clipped into the clip groove. In this embodiment, the housing 10 is provided with a guiding pillar 331, and the guiding pillar 331 is inserted into a pin 14, thus the sliding of the plug assembly 301 may be guided.

In this embodiment, the first locking component specifically includes:

a stopper 312, which is provided on the outerwall of the plug housing 311;

a lower end face of the housing 10, which is configured for blocking the stopper 312; and a barrier mechanism, which is provided in the housing 10 and configured for blocking the upper end face of the plug housing 311.

The inside of the lower end face of the housing 10 is provided with a positioning stage 332 corresponding to the stopper 312, which is more favorable for limiting the stopper 312.

In this embodiment, the second locking component specifically includes:

a blade spring 321, which is provided on the pin base 13 and has a hook 322 that clamps outwardly;

an upper locking part, which is provided on the inner wall of the plug housing 311; and a lower locking part, which is also provided on the inner wall of the plug housing 311.

Then, the hook 322 can be movably clipped into the upper locking part and lower locking part respectively.

The plug housing 311 further includes:

a locking bar 334, which protrudes from the plug housing 311 and is provided on the inner wall of the plug housing 311 and is arranged along the axial direction of the pin 14;

a locking notch 351, which is provided on the locking bar 334 and configured for forming the upper locking part;

a locking notch slope 352, which is formed by the lower end face of the locking notch 351 and faces the upper end face of the plug housing 311;

a locking bar slope 335, which is formed by the lower end face of the locking bar 334 and faces the lower end face of the plug housing 311; and a slope of the hook 322, which is provided on the lower end face of the hook 322 and matches the locking notch slope.

The hook 322 has an upper slope 401 facing the upper end face of the plug housing 311 and a lower slope 402 facing the lower end face of the plug housing 311.

By the arrangement, the hook 322 may be clipped into the locking notch 351 or clipped on the lower end of the locking bar 334, and the hook 322 may also be released from the locking notch 351 or the lower end face of the locking bar 334 by force.

Then, in this embodiment, the housing 10 is provided with a sliding slot 302, and the pin base 13 is provided with a slide button 19 that protrudes from the sliding slot 302.

Figure 33:
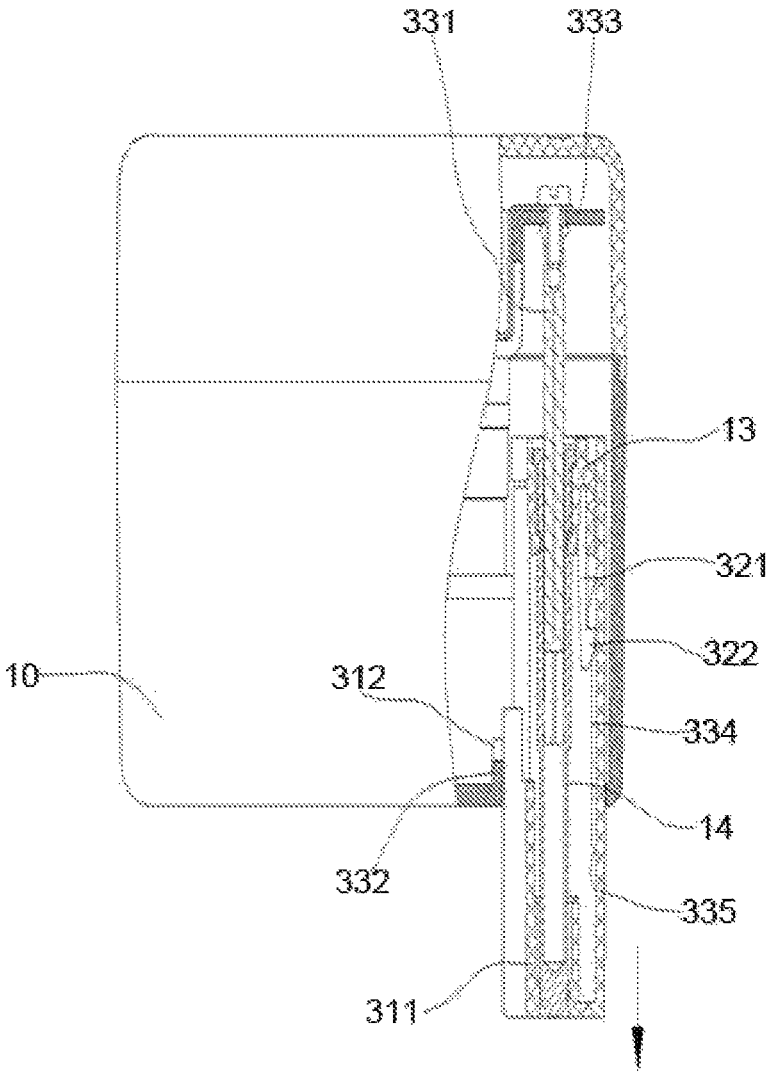
FIG. 33 is a state diagram when a plug assembly starts to slide outward according to a preferred embodiment of the invention.

As shown in FIG. 33, in the initial state, the hook 322 is clipped in the locking notch 351, and at this moment, the pin assembly 12 is locked to the plug housing 311. Then, the slide button 19 is slided downward, and the pin base 13 is driven to slide, so that the pin assembly 12 and the plug housing 311 are driven to move outward. At this moment, the stopper 312 does not work, and the plug housing 311 is not locked to the housing 10. After the pin assembly 12 and the plug housing 311 slide downward to a certain distance, the stopper 312 on the outerwall of the plug housing 311 is held on the inside of the lower end face of the housing 10 (the positioning stage 332 in this embodiment), and at this moment, the plug housing 311 is blocked and locked, and hence it cannot slide outward any more.

Figure 34:
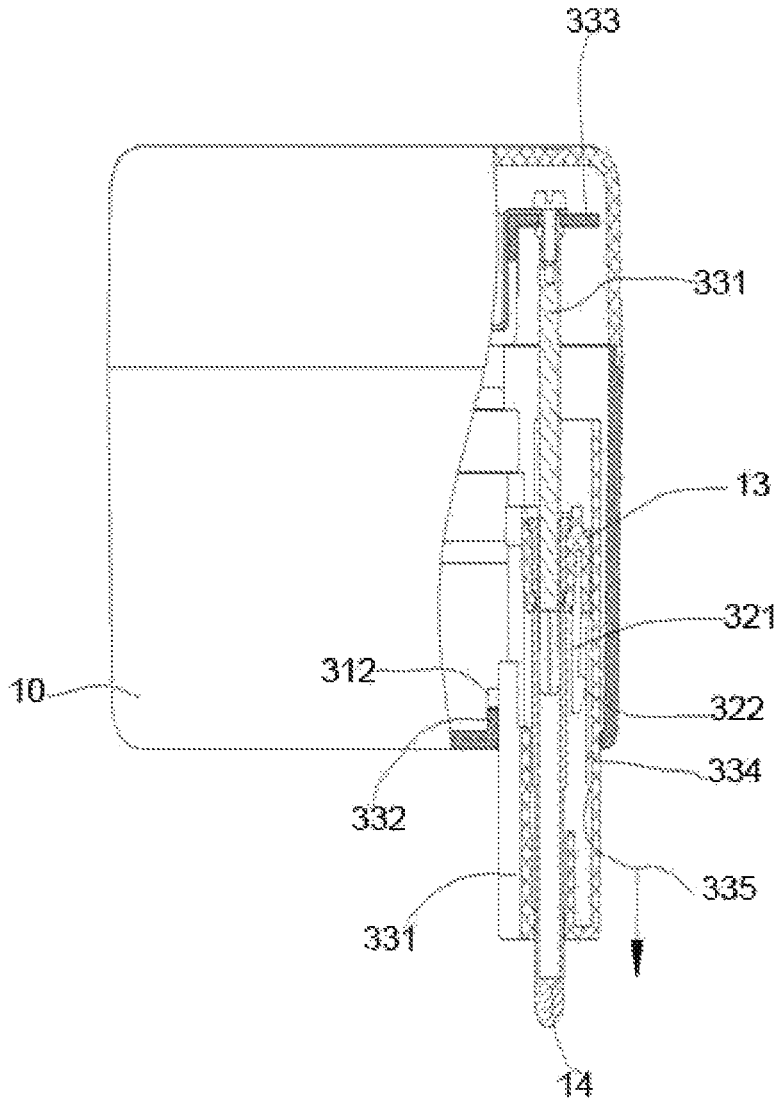
FIG. 34 is a state diagram when a pin assembly starts to slide outward after a plug housing slides outward in place according to Embodiment 1.

As shown in FIG. 34, at this moment, the slide button 19 slides continuously. Because the lower end face of the locking notch 351 is the locking notch slope 352 that faces upward, the blade spring 321 is deformed to a certain degree, and the blade spring 321 may be released from the locking notch 351 after deforming. The lower end face of the hook 322 has a slope of the hook 322 adapting the locking notch slope 352 of the locking notch 351, which is more favorable for the blade spring 321 to deform and for the hook 322 to be released by force. At this moment, the pin assembly 12 is unlocked from the plug housing 311, and the plug housing 311 is blocked and locked by the housing 10. Then, if the slide button 19 slides continuously, the pin base 13 will be driven to slide downward, that is, the pin 14 will be driven to slided downward.

Figure 35:
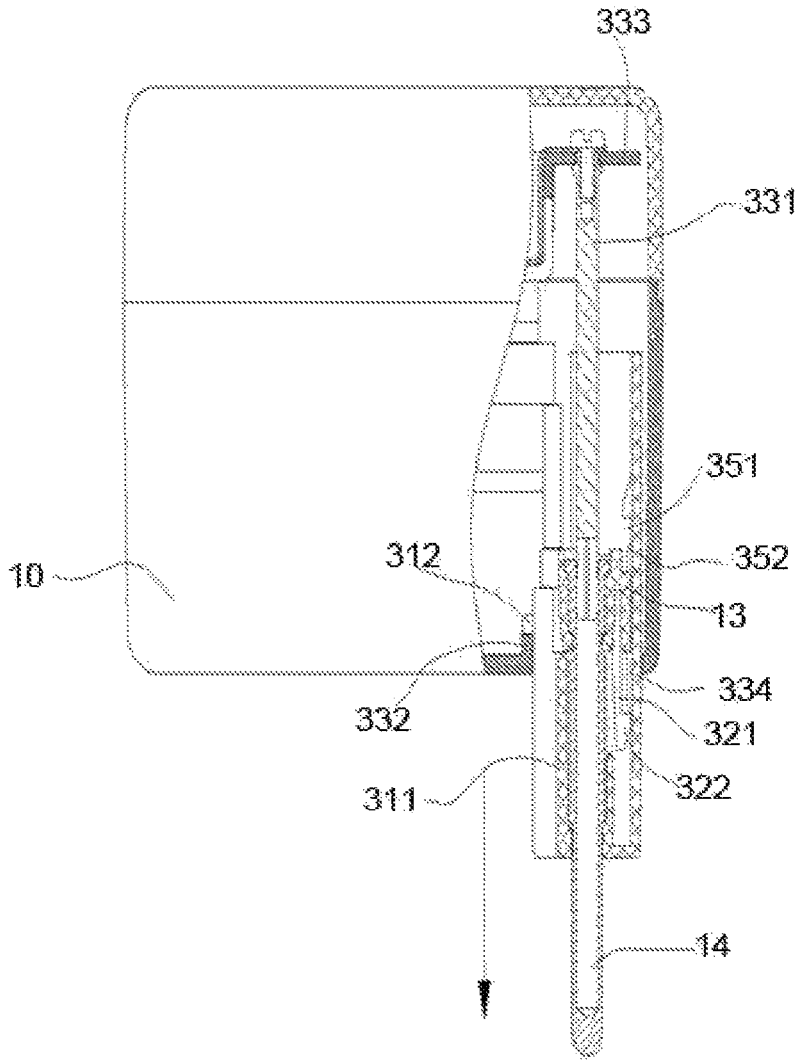
FIG. 35 is a state diagram after a pin assembly slides outward in place according to a preferred embodiment of the invention.

As shown in FIG. 35, after the pin assembly 12 slides for a certain distance again, the hook 322 is located under the lower end face of the locking bar 334, the blade spring 321 is restored at this moment, and the hook 322 is locked at the lower end face of the locking bar 334, and at this moment, the pin 14 protrudes in place.

Figure 36:
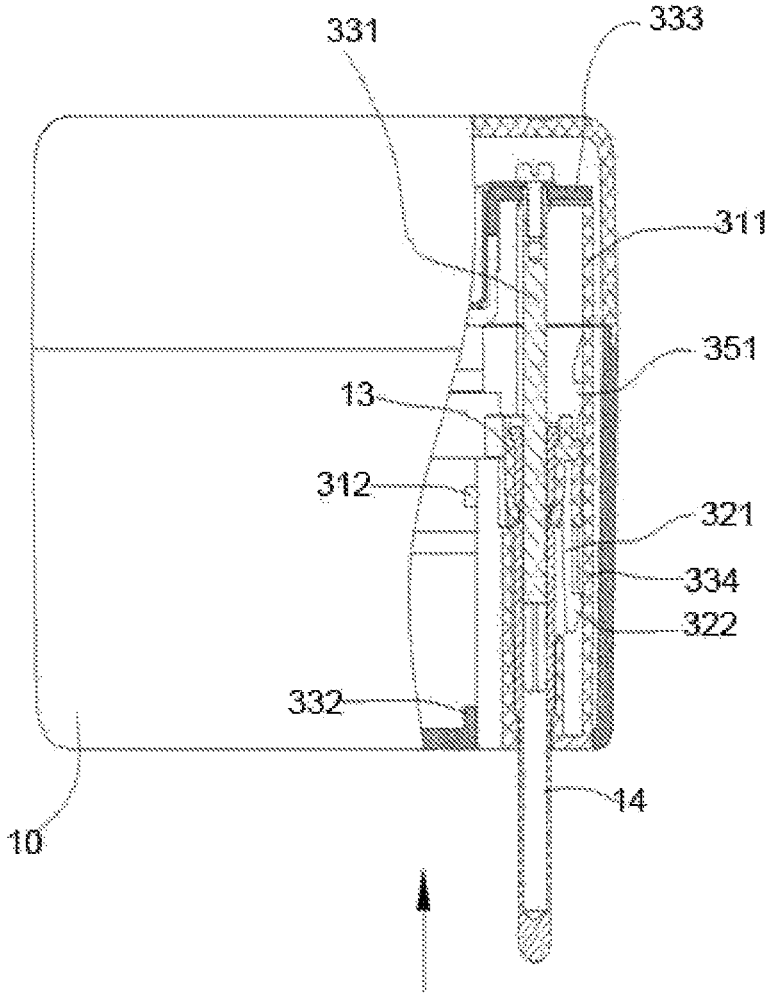
FIG. 36 is a state diagram after a plug housing retracts in place according to a preferred embodiment of the invention.

As shown in FIG. 36, the slide button 19 is pulled back. Because the hook 322 is locked at the lower end face of the locking bar 334, the pin assembly 12 and the plug housing 311 are locked, and the pin assembly 12 and the plug housing 311 are retracted by pulling the slide button 19 back. In this process, the stopper 312 on the outerwall of the plug housing 311 is detached from the lower end face of the housing 10, and the plug housing 311 is unlocked from the housing 10.

Figure 37:
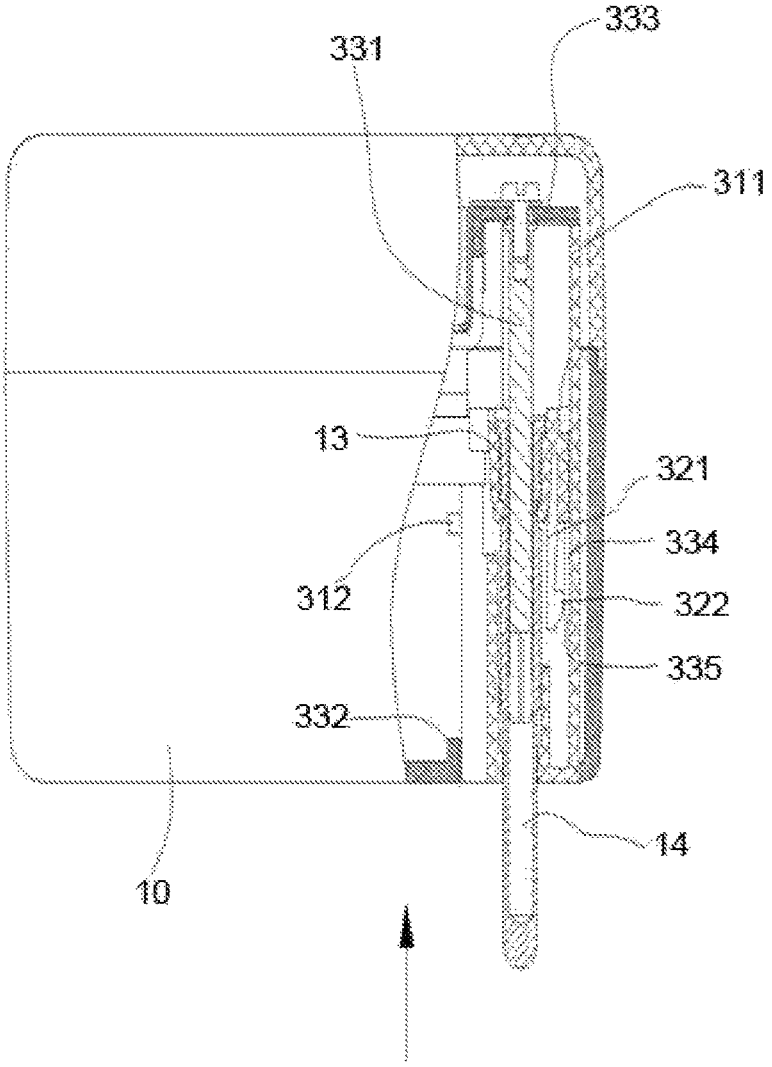
FIG. 37 is a state diagram when a pin assembly retracts inward according to a preferred embodiment of the invention.
Figure 38:
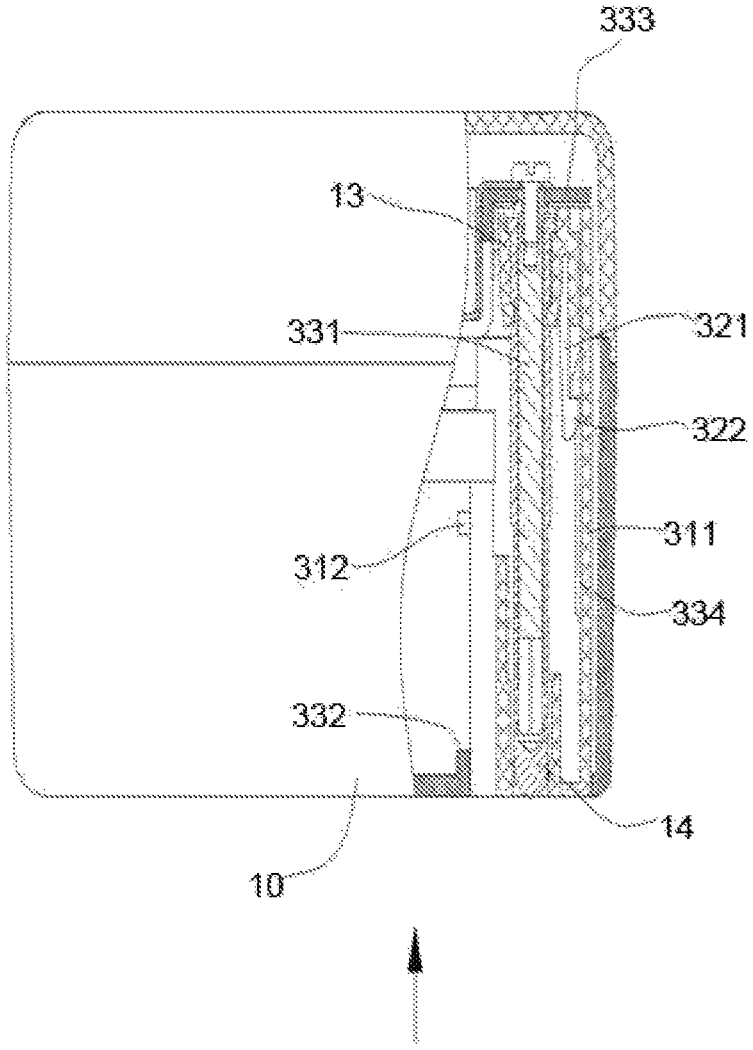
FIG. 38 is a state diagram after a pin assembly retracts in place according to a preferred embodiment of the invention.

As shown in FIG. 37, when the plug housing 311 retracts in place, the upper end face of the plug housing 311 is blocked by the barrier mechanism, and at this moment, the plug housing 311 and the housing 10 are blocked and locked by the barrier mechanism. When the slide button 19 is pulled back continuously, because the lower end face of the locking bar 334 is the locking bar slope 335 that faces downward, the blade spring 321 is deformed under the action of the elastic force of the blade spring 321 and the locking bar slope 335. The hook 322 leaves the lower end of the locking bar 334, so that the pin assembly 12 is unlocked from the plug housing 311, and the pin assembly 12 may be further retracted, until the hook 322 is again clipped into the locking notch 351 as shown in FIG. 38. In this embodiment, the barrier mechanism in the housing 10 is a mounting baffle 333, and the guiding pillar 331 is mounted on the mounting baffle 333 via a screw.

Embodiment 14

Based on the technical solutions, as shown in FIGS. 30-32 and FIGS. 39-44, the blade spring 321 is provided with a hook 322 that clamps outwardly. The inner wall of the plug housing 311 is provided with a first locking hole 391 and a second locking hole 392. The hook 322 may be clipped into the first locking hole 391 and the second locking hole 392 and may also be released from the first locking hole 391 and the second locking hole 392 by force. The first locking hole 391 forms an upper locking part, and the second locking hole 392 forms a lower locking part.

Figure 39:
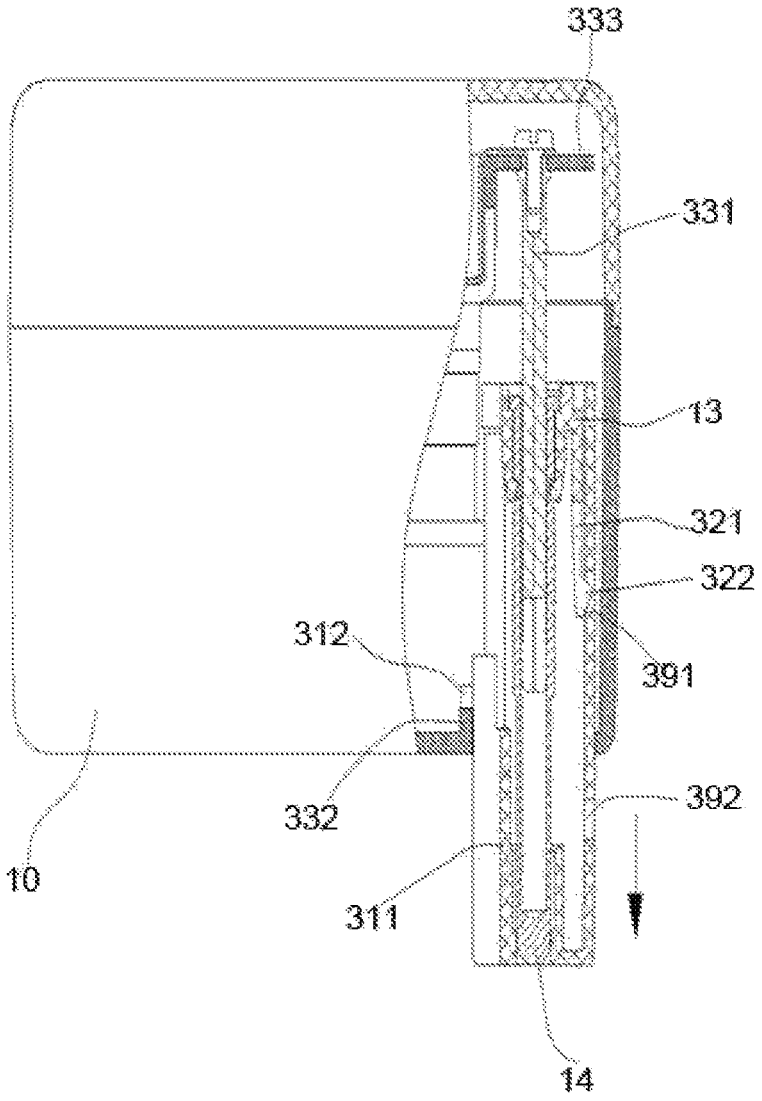
FIG. 39 is a state diagram when a plug assembly starts to slide outward according to a preferred embodiment of the invention.

Then, in this embodiment, as shown in FIG. 39, in the initial state, the hook 322 is clipped in the first locking hole 391, and at this moment, the pin assembly 12 is locked to the plug housing 311. The slide button 19 is slided downward, and the pin base 13 is driven to slide, so that the pin assembly 12 and the plug housing 311 are driven to move outward. At this moment, the stopper 312 does not work, and the plug housing 311 is not locked to the housing 10. After the pin assembly 12 and the plug housing 311 slide downward to a certain distance, the stopper 312 on the outerwall of the plug housing 311 is held on the inside of the lower end face of the housing 10 (that is, held on the positioning stage 332 in this embodiment), and at this moment, the plug housing 311 is blocked and locked, thus it cannot slide outward any more.

Figure 40:
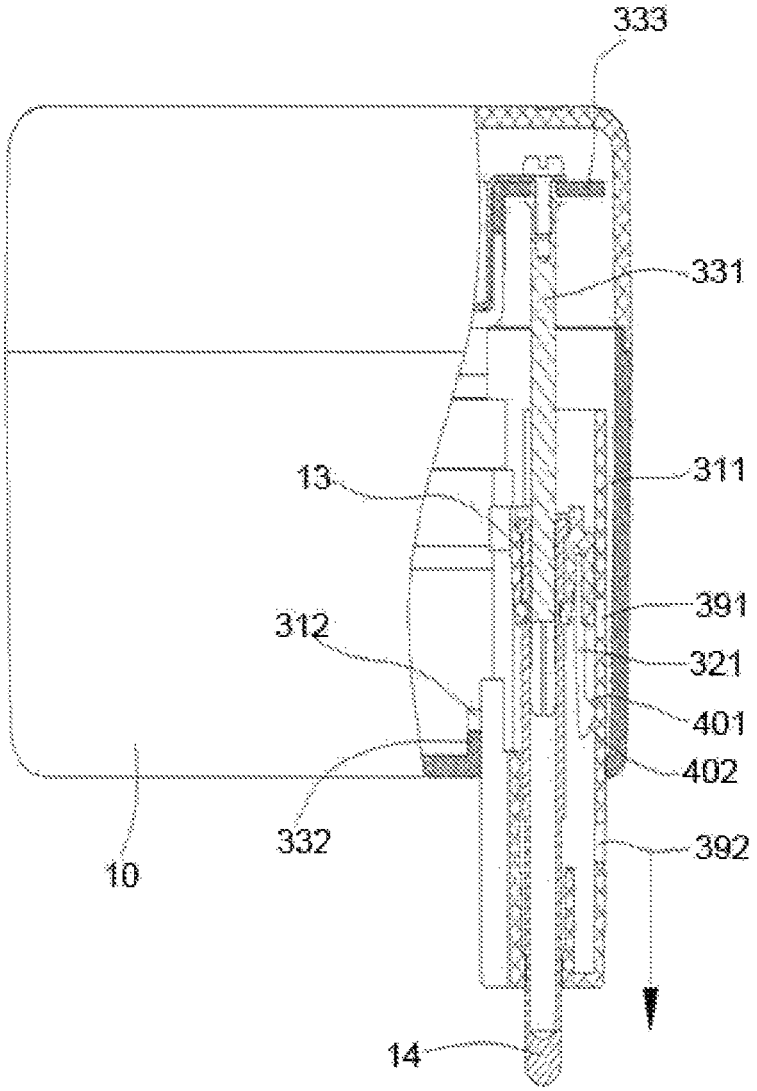
FIG. 40 is a state diagram when a pin assembly starts to slide outward after a plug housing slides outward in place according to a preferred embodiment of the invention.

As shown in FIG. 40, at this moment, the slide button slides downward continuously. Because the hook 322 has a lower slope 402 facing the lower end face of the housing 10, the blade spring 321 may be deformed to a certain degree, and the blade spring 321 may be released from the first locking hole 391 after deforming. At this moment, the pin assembly 12 is unlocked from the plug housing 311, and the plug housing 311 is blocked and locked by the housing 10. When the slide button 19 slides continuously, the pin base 13 will be driven to slide downward, that is, the pin 14 will be driven to slided downward.

Figure 41:
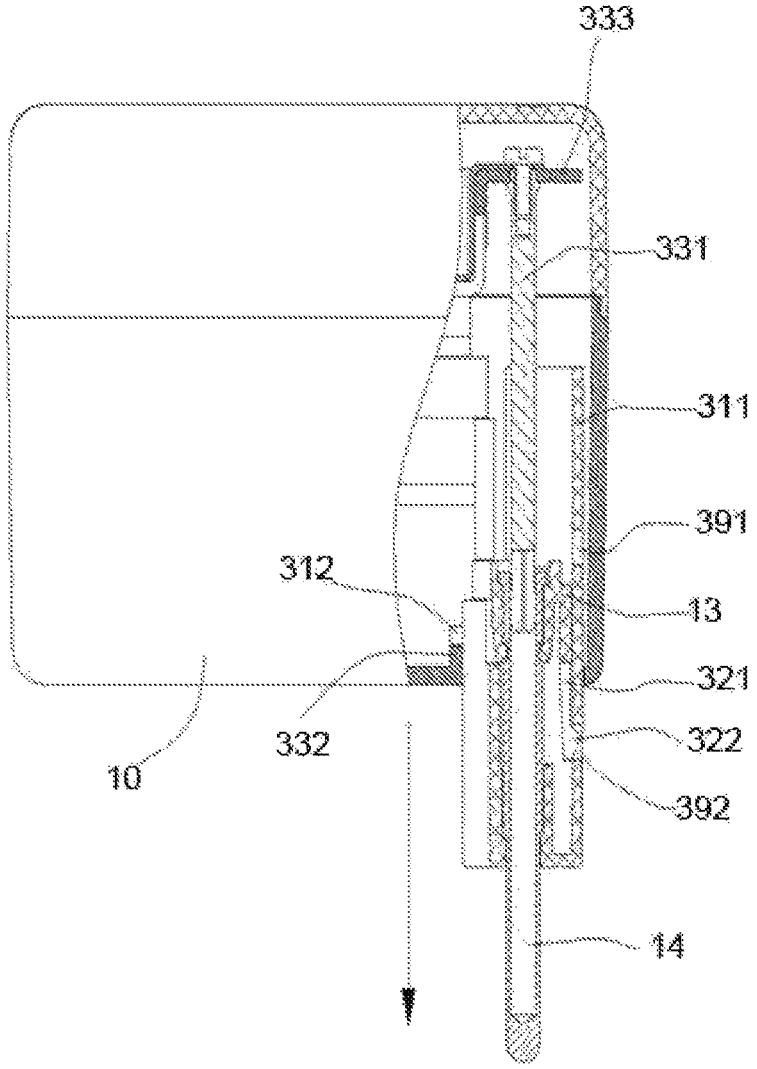
FIG. 41 is a state diagram after a pin assembly slides outward in place according to a preferred embodiment of the invention.

As shown in FIG. 41, after the pin assembly 12 slides for a certain distance again, the hook 322 is clipped into the second locking hole 392, the blade spring 321 is restored at this moment, and the pin 14 protrudes in place.

Figure 42:
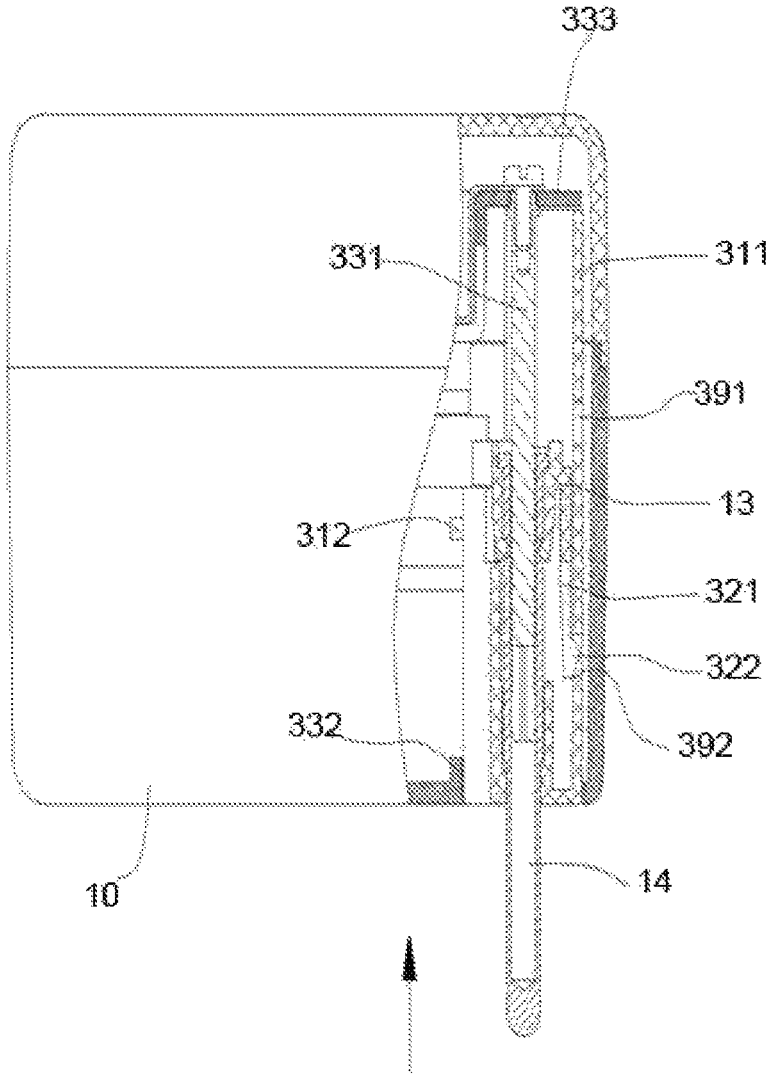
FIG. 42 is a state diagram after a plug housing retracts in place according to a preferred embodiment of the invention.

As shown in FIG. 42, the slide button 19 is pulled back. Because the hook 322 is clipped in the second locking hole 392, the pin assembly 12 and the plug housing 311 are locked, and the pin assembly 12 and the plug housing 311 are retracted by pulling the slide button 19 back. In this process, the stopper 312 on the outerwall of the plug housing 311 is detached from the lower end face of the housing 10, and the plug housing 311 is unlocked from the housing 10.

Figure 43:
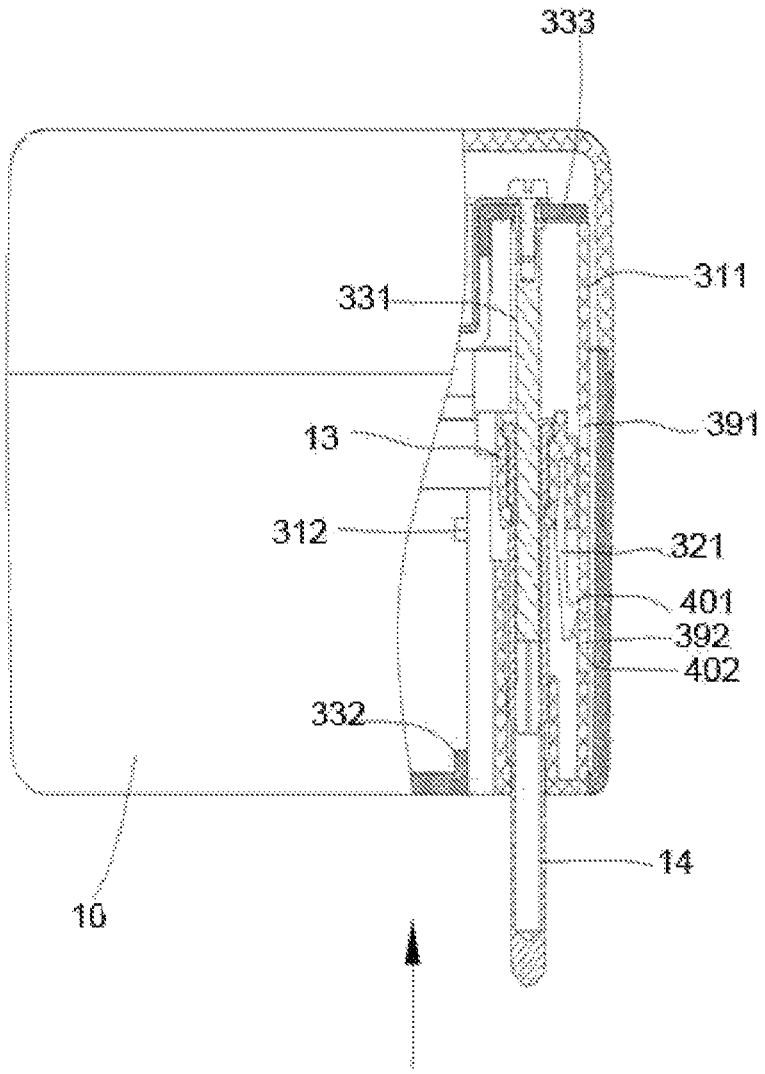
FIG. 43 is a state diagram when a pin assembly retracts inward according to a preferred embodiment of the invention.
Figure 44:
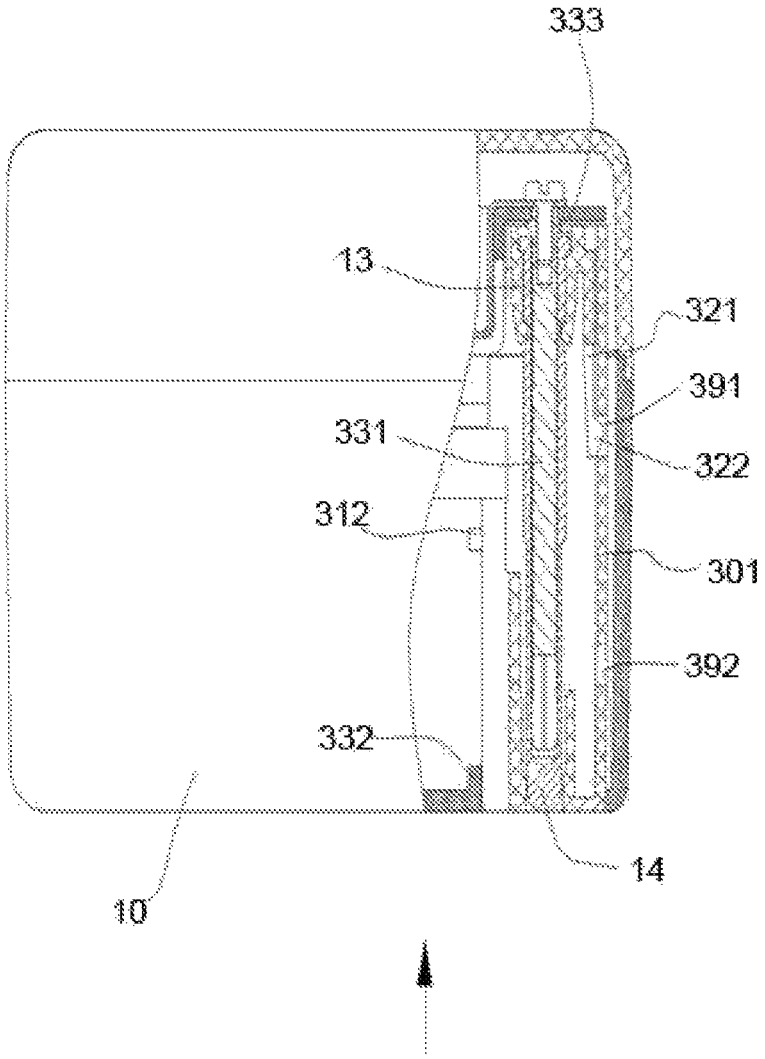
FIG. 44 is a state diagram after a pin assembly retracts in place according to a preferred embodiment of the invention.

As shown in FIG. 43, when the plug housing 311 retracts in place, the upper end face of the plug housing 311 is blocked by the barrier mechanism, and at this moment, the plug housing 311 and the housing 10 are blocked and locked by the barrier mechanism. The slide button 19 is pulled back continuously. Because the hook 322 has an upper slope 401 facing the upper end face of the housing 10, the blade spring 321 is deformed under the action of the elastic force of the blade spring 321 and the upper slope 401, and the hook 322 is detached from the second locking hole 392, so that the pin assembly 12 is unlocked from the plug housing 311. The pin assembly 12 may be further retracted, until the hook 322 is again clipped into the first locking hole 391 as shown in FIG. 44.

In this embodiment, the barrier mechanism in the housing 10 is a mounting baffle 333, and the guiding pillar 331 is mounted on the mounting baffle 333 via a screw.

Embodiment 15

Based on the technical solutions, as shown in FIGS. 30-32 and FIGS. 45-50, the first locking component further includes a clip hole 451 that is opened on the tail of the wall surface of the plug housing 311, and the inner wall of the housing 10 is provided with a locking protrusion 452. The locking protrusion 452 may be clipped into the clip hole 451, and the upper end face of the locking protrusion 452 is an upper inclined plane 471 that inclines downward, thus the locking protrusion 452 may also be released downward from the clip hole 451 by force. The lower end face of the locking protrusion 452 is a lower inclined plane 472 that inclines upward.

Figure 45:
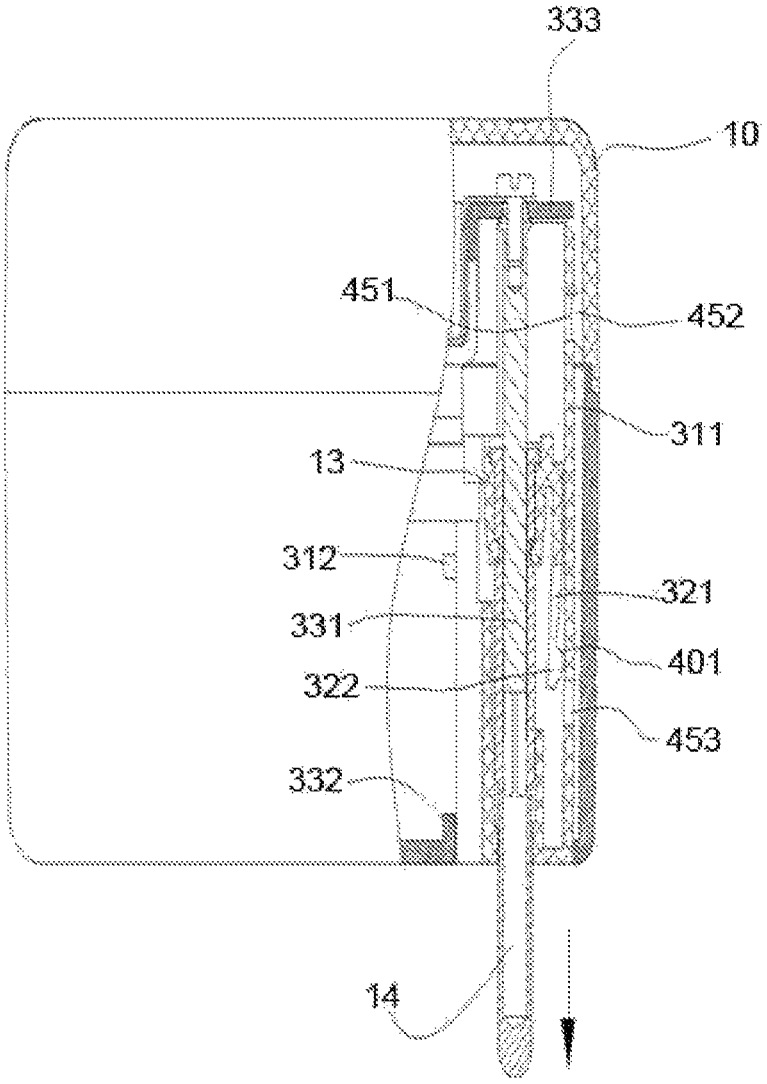
FIG. 45 is a state diagram when a pin assembly starts to slide outward according to a preferred embodiment of the invention.

Then, in this embodiment, as shown in FIG. 45, in the initial state, the locking protrusion 452 on the inner wall of the housing 10 is clipped into the clip hole 451 of the plug housing 311, and at this moment, the plug housing 311 and the housing 10 are locked. However, the hook 322 is located above the locking hole 453, and the plug housing 311 and the pin assembly 12 are in an unlock state. At this moment, when the slide button 19 is slided downward, the pin base 13 will slide to drive the pin assembly 12 to move outward.

Figure 46:
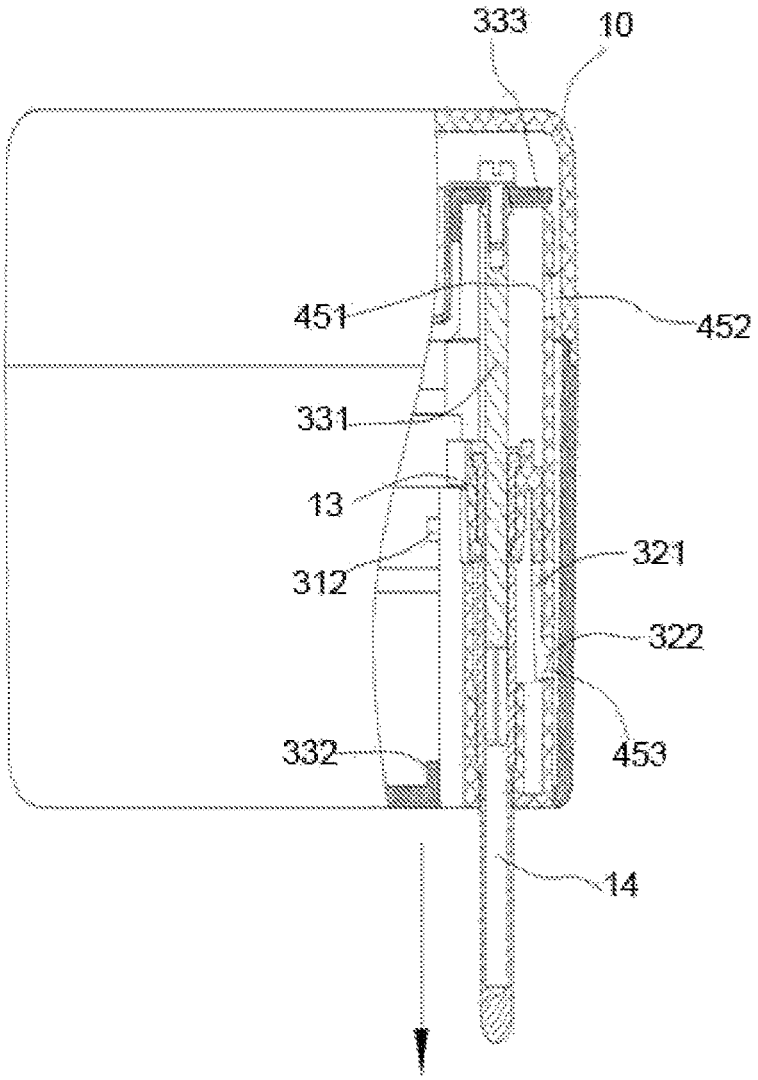
FIG. 46 is a state diagram after a pin assembly slides outward in place according to a preferred embodiment of the invention.

As shown in FIG. 46, after the hook 322 moves downward for a certain distance, the hook 322 is clipped into the locking hole 453, and at this moment, the plug housing 311 and the pin assembly 12 are in a lock state, and the plug housing 311 rests on the pin base 13 so as to block the pin base 13.

Figure 47:
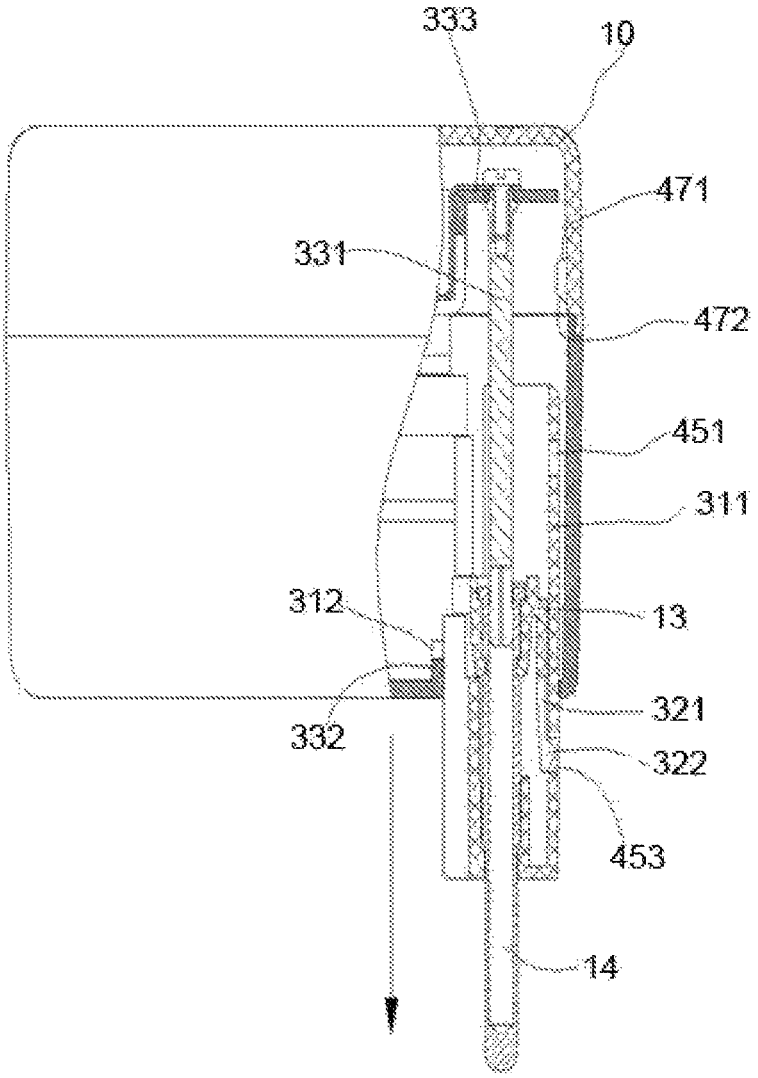
FIG. 47 is a state diagram when a plug housing starts to slide outward according to a preferred embodiment of the invention.

As shown in FIG. 47, the slide button slides downward continuously. Because the upper end face of the locking protrusion 452 is an upper inclined plane 471 that inclines downward, the clip hole 451 of the plug housing 311 is deformed to a certain degree under the action of a downward pulling force, and the locking protrusion 452 may be detached from the clip hole 451 by force. At this moment, the plug housing 311 and the housing 10 are in an unlock state, and the plug housing 311 and the pin assembly 12 are in a lock state. When the slide button 19 slides downward continuously, the plug housing 311 and the pin assembly 12 may overall be driven to go on moving downward, until the stopper 312 on the outerwall of the plug housing 311 is held on the inside of the lower end face of the housing 10. At this moment, the plug housing 311 is blocked and locked, and hence it cannot slide outward any more.

Figure 48:
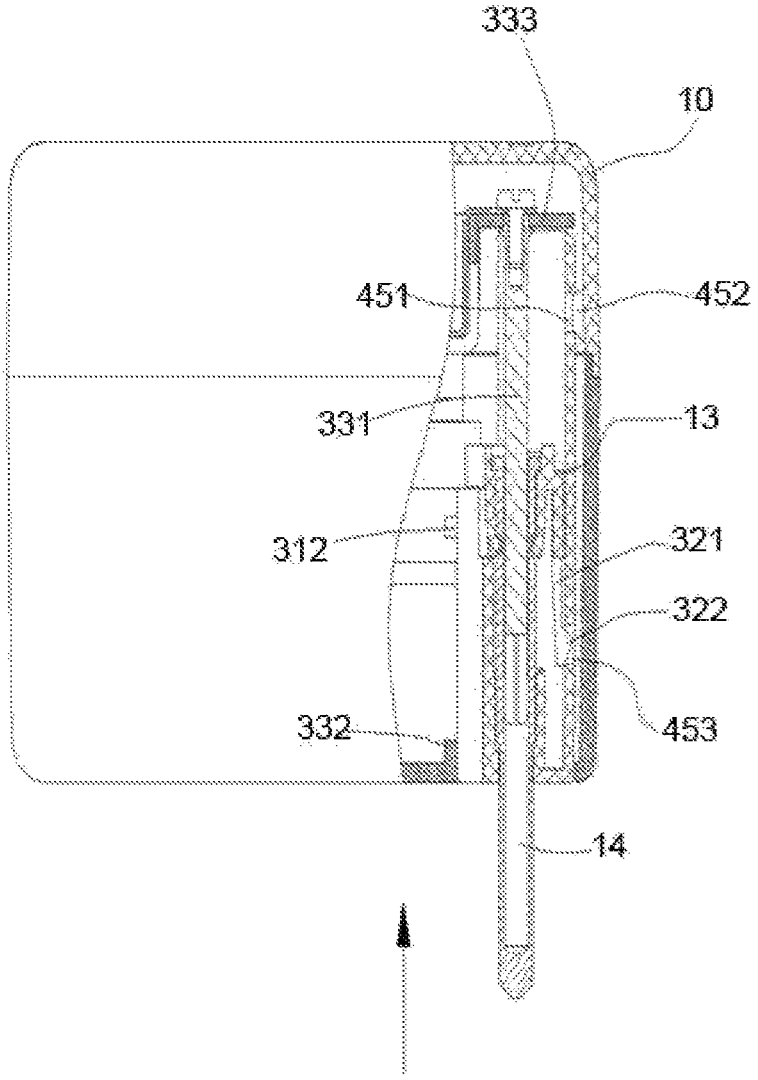
FIG. 48 is a state diagram after a plug housing retracts in place according to a preferred embodiment of the invention.

As shown in FIG. 48, the slide button 19 is pulled back. Because the hook 322 is clipped in the locking hole 453, the plug housing 311 and the pin assembly 12 are in a lock state. The slide button 19 drives the pin assembly 12, and at the same time drives the plug housing 311, to retract together, until the locking protrusion 452 is again clipped into the clip hole 451 of the plug housing 311 as shown in FIG. 48. At this moment, the plug housing 311 and the housing 10 are in a lock state. Because the lower end face of the locking protrusion 452 is a lower inclined plane that inclines upward, the clip hole 451 of the plug housing 311 is deformed to a certain degree. Therefore, the locking protrusion 452 may be again clipped into the clip hole 451 smoothly, and at this moment, the upper end face of the plug housing 311 is also pressed on the mounting baffle 333.

Figure 49:
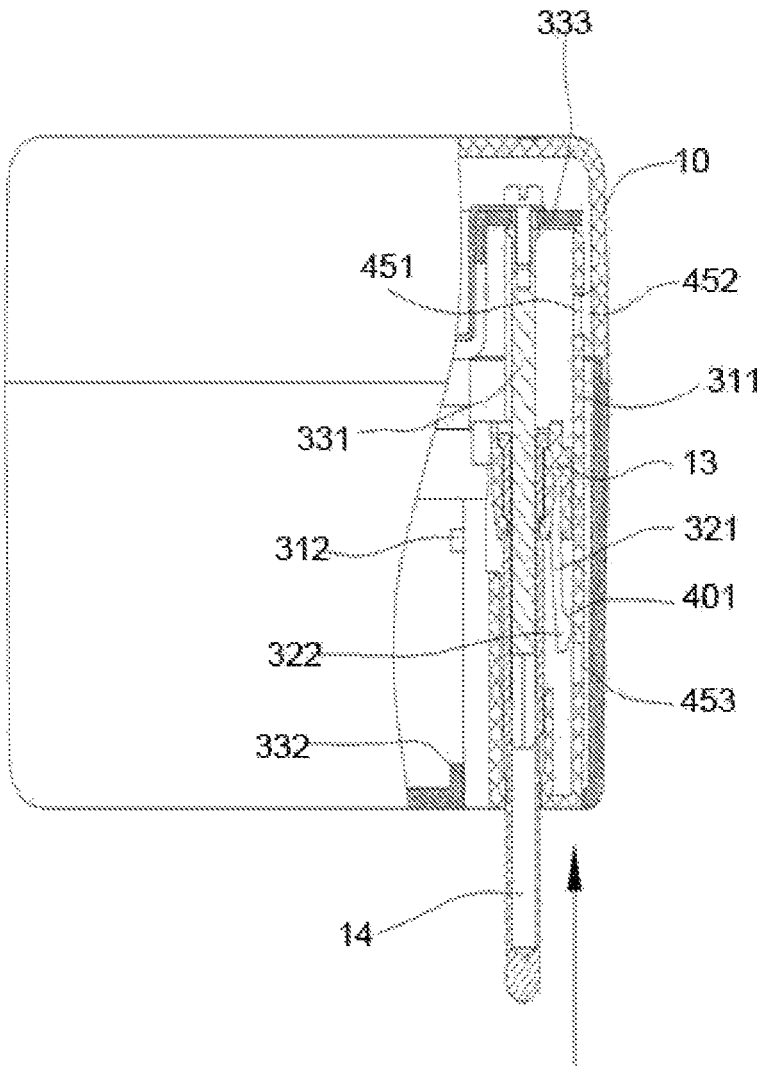
FIG. 49 is a state diagram when a pin assembly retracts inward according to a preferred embodiment of the invention.
Figure 50:
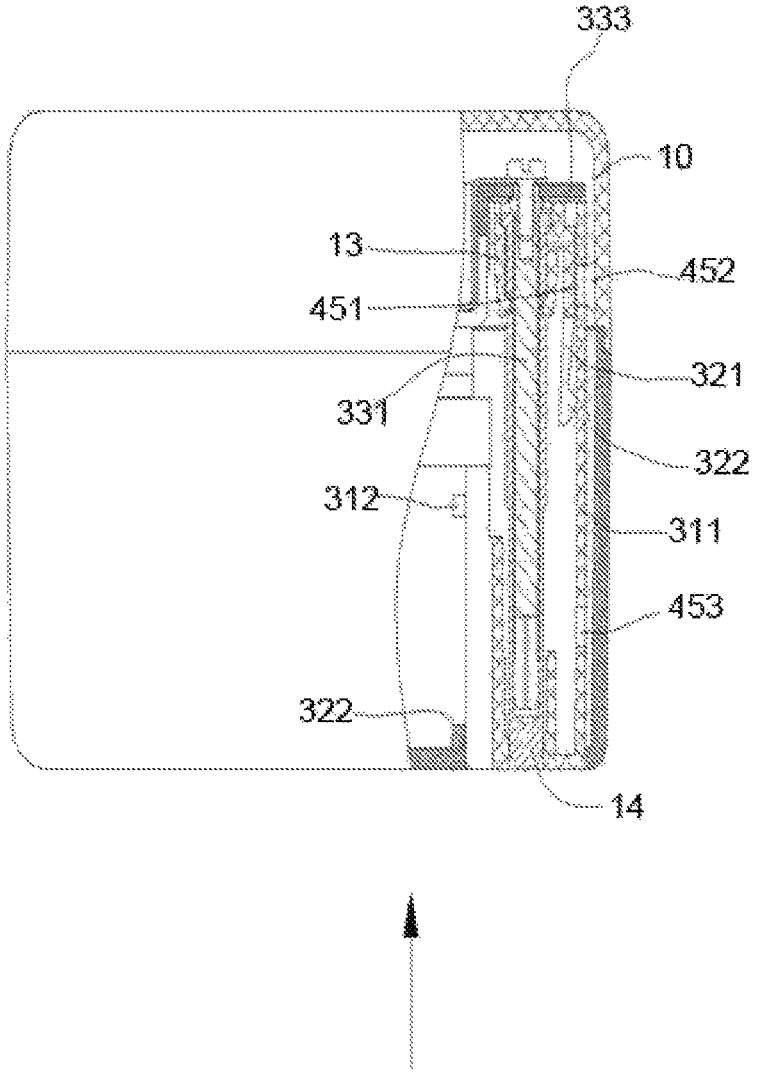
FIG. 50 is a state diagram after a pin assembly retracts in place according to a preferred embodiment of the invention.

As shown in FIG. 49, the slide button 19 is pulled back continuously. Because the hook 322 has an upper slope 401 facing the upper end face of the plug housing 311, the blade spring 321 is deformed under the action of the pulling force and the upper slope 401, so that the hook 322 is detached from the locking hole 453. At this moment, the plug housing 311 and the pin assembly 12 are an unlock state, and the pin assembly 12 may continue retracting by sliding, until the pin 14 is completely retracted as shown in FIG. 50.

Embodiment 16

Figure 51:
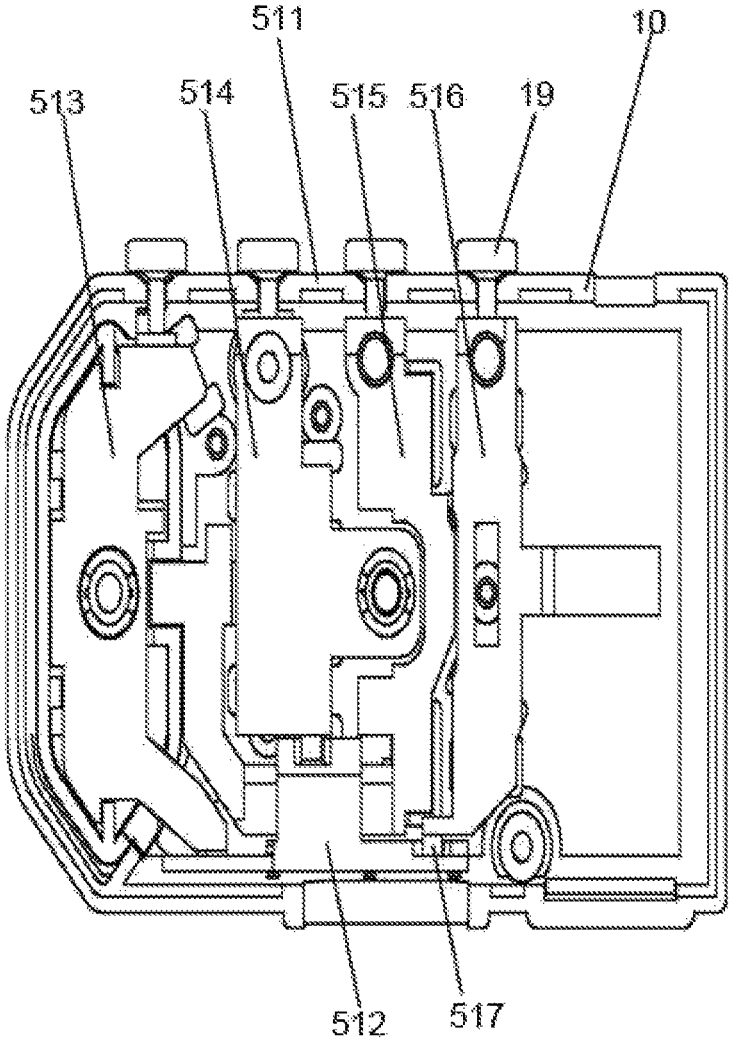
FIG. 51 is a schematic diagram showing a part of the internal structure of a travel adapter according to a preferred embodiment of the invention.
Figure 52:
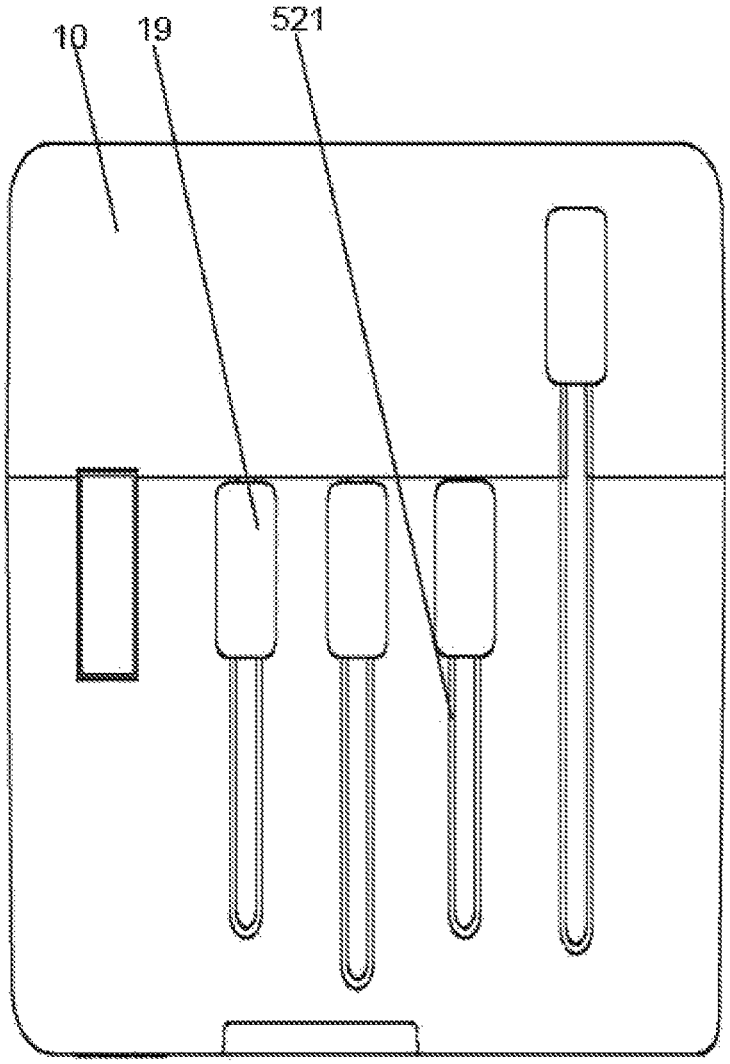
FIG. 52 is a side view showing a part of the structure of a travel adapter according to a preferred embodiment of the invention.

Based on the technical solutions, as shown in FIGS. 51-52, the travel adapter further includes:

a stop plate 511, which is fixedly provided on one lateral side of the housing 10 and respectively provided with a plurality of first slideways 521, each first slideway 521 being respectively vertical to the stop plate 511 and extending upward and downward;

a plurality of plugs, which correspond to the first slideway 521 one to one; and a slidable interlocking sliding sheet 512, which is provided parallel to the stop plate 511 and respectively provided with a second slideway 541 corresponding to each first slideway 521 one by one respectively.

Each plug is respectively provided with a slide button 19 and a locking pillar 517. The slide button 19 is provided passing through the first slideway 521 of the corresponding plug, and the locking pillar 517 is stretched into the second slideway 541 of the corresponding plug and slides up and down along the second slideway 541. The interlocking sliding sheet 512 is driven to slide in the right and left direction when the locking pillar 517 slides.

The first slideways 521 are all slideways with a linear guide slot, and the second slideways 541 are all slideways with a polygonal-line guide slot.

Figure 53:
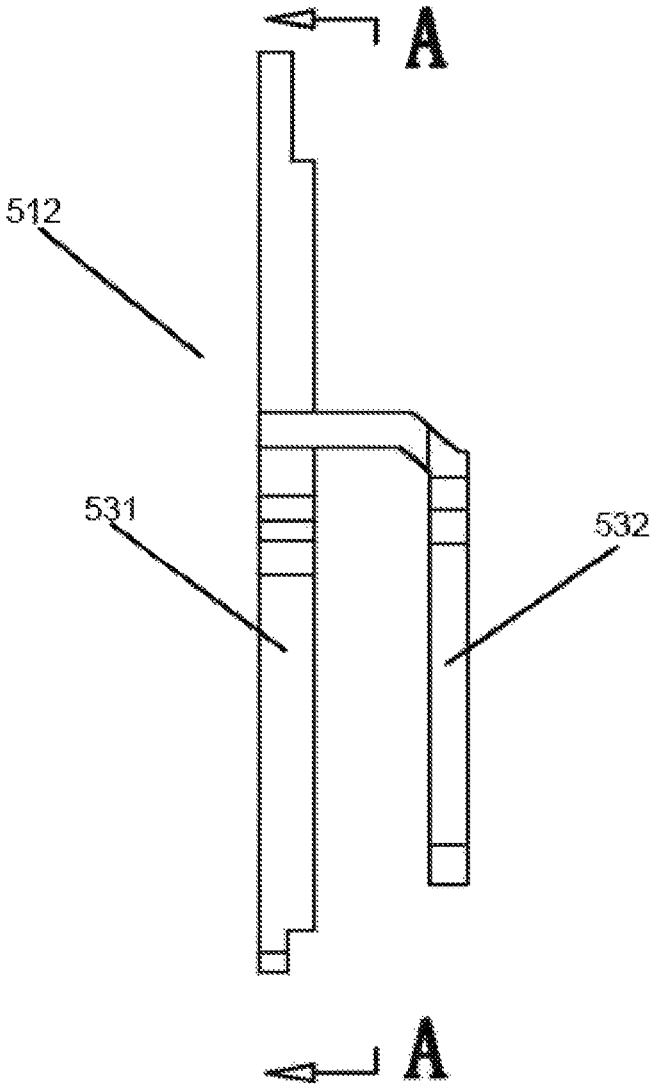
FIG. 53 is a structural representation of an interlocking sliding sheet according to a preferred embodiment of the invention.
Figure 54:
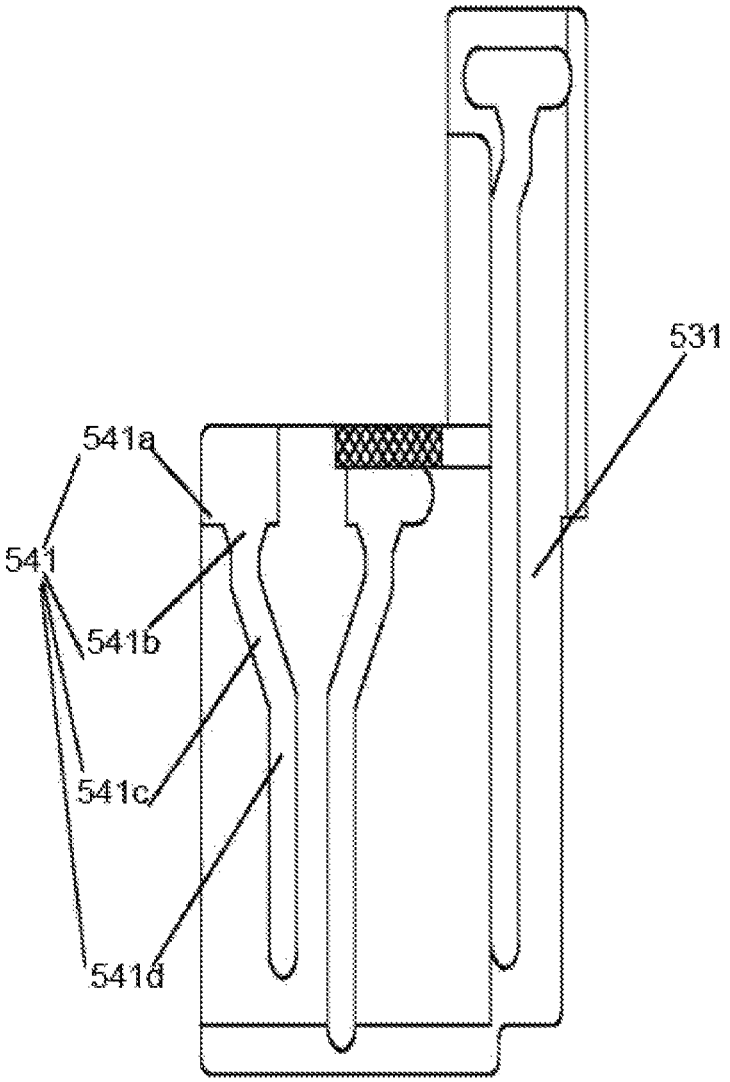
FIG. 54 is a schematic diagram showing a sectional structure along A-A of FIG. 53 according to a preferred embodiment of the invention.

As shown in FIGS. 52-54, the interlocking sliding sheet 512 is provided with several second slideways 541 corresponding to each first slideway 521 one to one. The interlocking sliding sheet 512 includes a first interlocking sliding sheet 531, a second interlocking sliding sheet 532 parallel to the first interlocking sliding sheet 531 and a connection board connecting the first interlocking sliding sheet 531 and the second interlocking sliding sheet 532, and the second interlocking sliding sheet 532 is located between the first interlocking sliding sheet 531 and the stop plate 511. Among the second slideways 541, one second slideway 541 is provided on the second interlocking sliding sheet 532, and the rest second slideways 541 are provided on the first interlocking sliding sheet 531.

The second slideway 541 includes a locking stage 541*a* located on the upper end of the second slideway 541 and slideways 541*b*, 541*c*, 541*d* located under the locking stage 541*a*. The upper end of the second slideway 541 extends upward and forms an entrance of the locking pillar 517 in the middle of the locking stage 541*a*. The entrance of the locking pillar 517 is in the form of V. An inclined slideway 541*c* exists between the upper and lower ends of the second slideway 541. In this embodiment, the inclined slideway 541*c* includes the following two arrangement modes.

Figure 55:
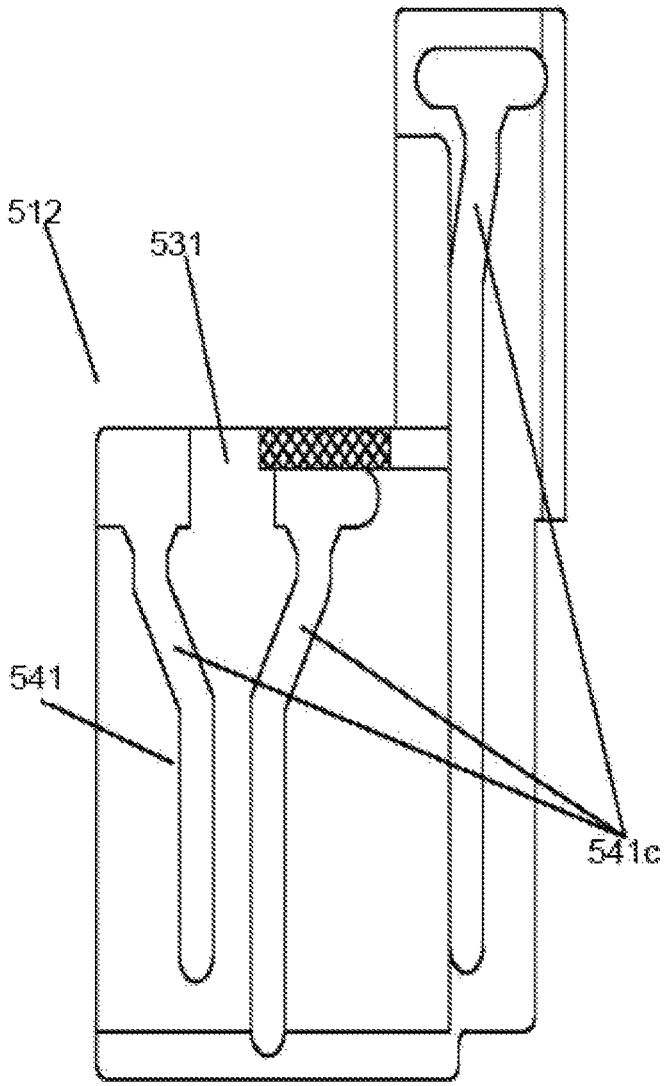
FIG. 55 is a structural representation of an interlocking sliding sheet according to a preferred embodiment of the invention.

In the first mode, as shown in FIG. 55, the extension lines of the inclined slideways 541*c* of any two second slideways 541 intersect with each other, that is, the inclined slideways 541*c* of any two second slideways 541 are not parallel to each other.

In the second mode, as shown in FIG. 54, each second slideway 541 at least has two second slideways 541 of which the inclined slideways 541*c* are parallel to each other, and the lengths of any two inclined slideways 541*c* in the inclined slideways 541*c* parallel to each other are different. In FIG. 54, the inclined slideway 541*c* on the left second slideway 541 in the interlocking sliding sheet 512 intersects with the inclined slideway 541*c* on the middle second slideway 541; the inclined slideway 541*c* on the right second slideway 541 is parallel to the inclined slideway 541*c* on the middle second slideway 541, but the lengths of the right second slideway 541 and the middle second slideway 541 are different.

Figure 56:
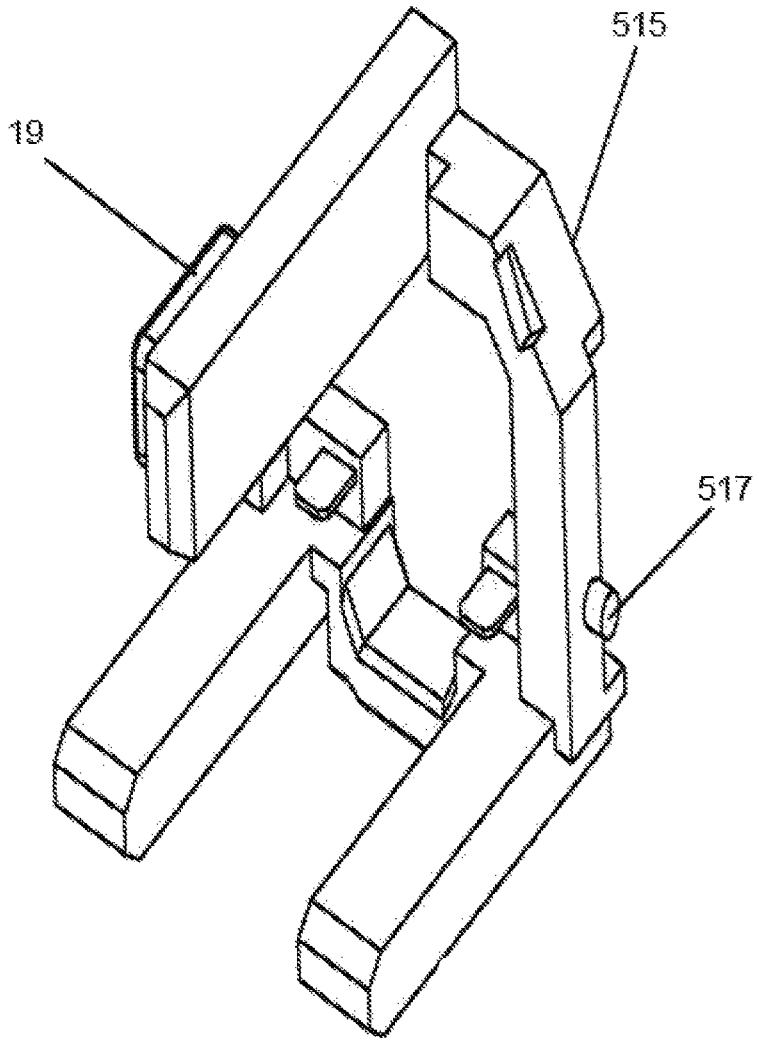
FIG. 56 is a structural representation of a British Standard plug according to a preferred embodiment of the invention.

As shown in FIG. 51 and FIG. 56, each plug is provided with a slide button 19 and a locking pillar 517. The slide button 19 of the plug passes through the corresponding first slideway 521. The locking pillar 517 is stretched into the corresponding second slideway 541. The locking pillar 517 may slide up and down along the second slideway 541 and drive the interlocking sliding sheet 512 to slide right and left at the same time.

In this embodiment, the plug is a European Standard plug 513, an American Standard plug 514, a British Standard plug 515 and an Australian Standard plug 516. The British Standard plug 515 is in the form of C and surrounds the American Standard plug 514 or the Australian Standard plug 516, and the locking pillar 517 of the American Standard plug 514 or the Australian Standard plug 516 surrounded by the British Standard plug 515 is stretched into the second slideway 541 on the second interlocking sliding sheet 532.

In this embodiment, the European Standard plug 513, the American Standard plug 514, the British Standard plug 515 and the Australian Standard plug 516 are distributed from left to right successively.

Figure 57:
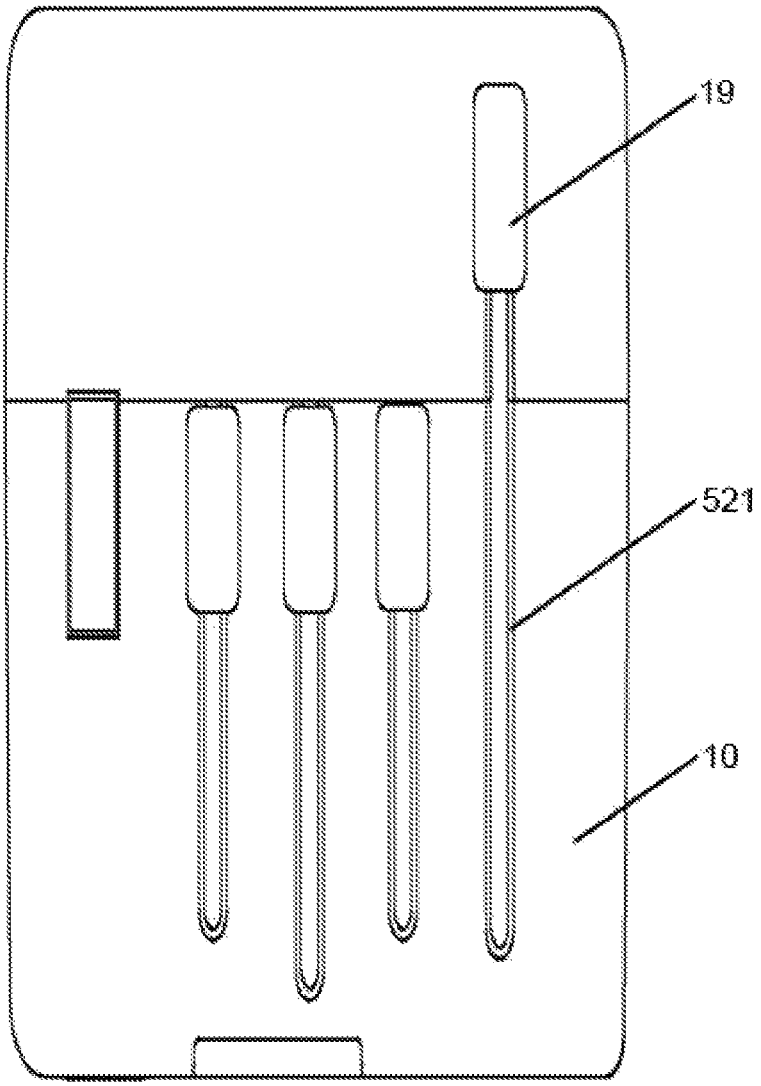
FIG. 57 is a side view when all plugs are hidden inside a housing according to a preferred embodiment of the invention.
Figure 58:
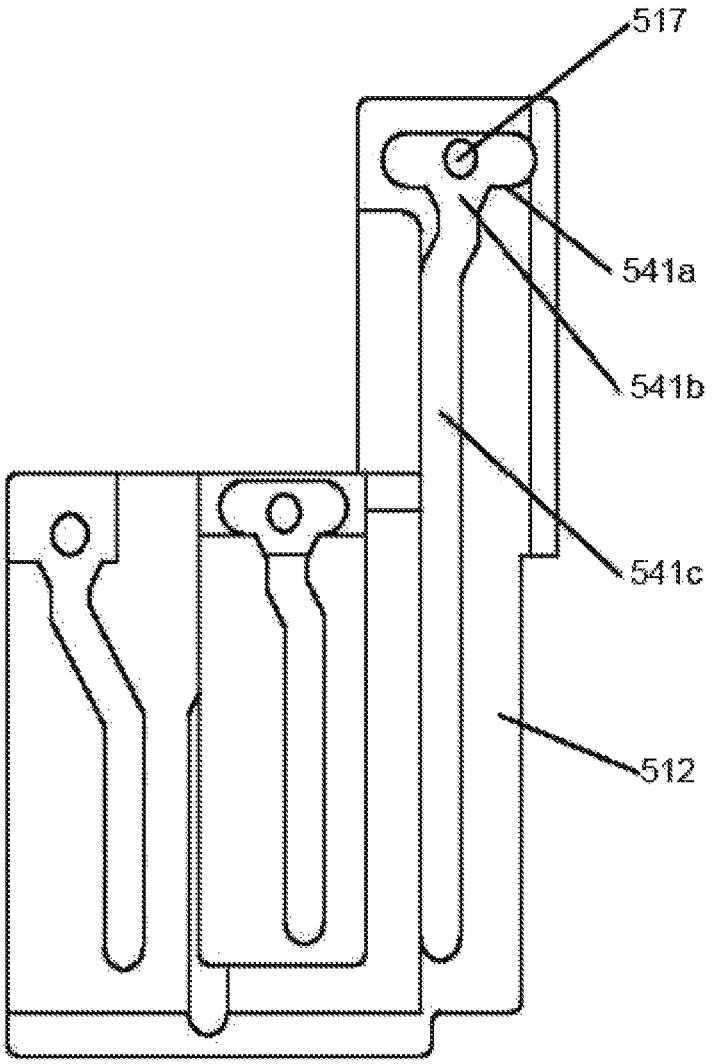
FIG. 58 is a structural representation showing the relative position state between an interlocking sliding sheet and each locking pillar based on FIG. 57 according to a preferred embodiment of the invention.

As shown in FIGS. 57-58, when the locking pillar 517 of each plug is located above the locking stage 541*a* of the corresponding second slideway 541, each locking pillar 517 will be located right above the entrance of the corresponding locking pillar 517.

Figure 59:
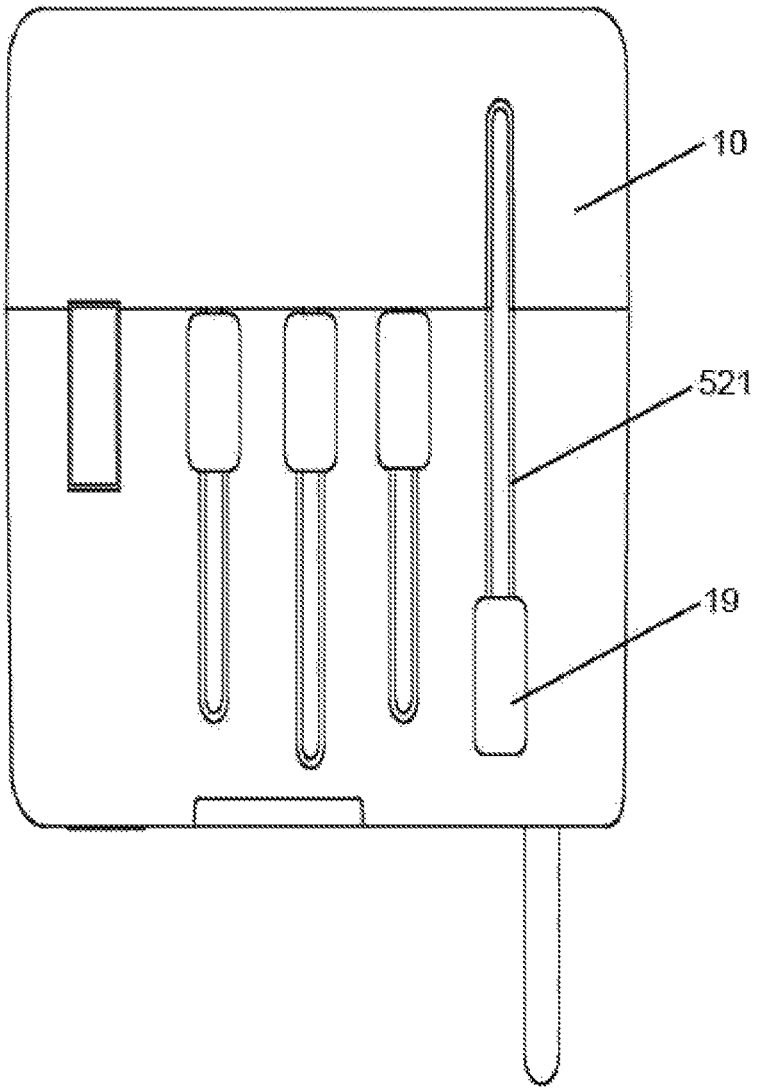
FIG. 59 is a side view after an Australian Standard plug protrudes according to a preferred embodiment of the invention.
Figure 60:
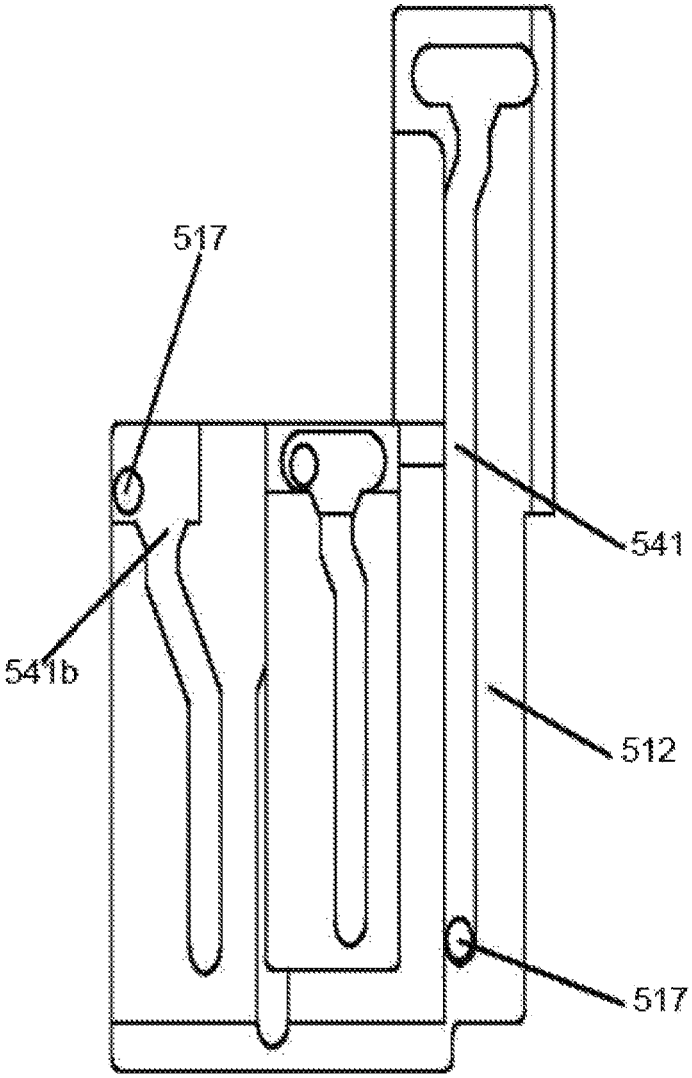
FIG. 60 is a structural representation showing the relative position state between an interlocking sliding sheet and each locking pillar based on FIG. 59 according to a preferred embodiment of the invention.

As shown in FIGS. 59-60, the locking pillar 517 of any one of the plugs is slided downward along the second slideway 541, and the interlocking sliding sheet 512 is pushed to slide right and left to a position where the locking pillar 517 of the rest plug is staggered from the entrance of the corresponding locking pillar 517.

In this embodiment, the specific operating process of the structure is as follows.

When each plug is hidden in the adapter (as shown in FIGS. 57-58), the slide button 19 of each plug is located on the upper end of the corresponding first slideway 521, the locking pillar 517 of each plug is located above the locking stage 541*a* of the corresponding second slideway 541, and each locking pillar 517 is located right above the entrance of the corresponding locking pillar 517.

When each plug is hidden in the adapter, because each locking pillar 517 is located right above the entrance of the corresponding locking pillar 517, the slide button 19 of any one of the plugs may drive the plug to move downward along the first slideway 521, thus the plug may protrude out for use.

The slide button 19 of a certain plug drives the plug to move downward along the first slideway 521 and protrude to an effective position. In this process, the locking pillar 517 of the plug slides downward along the second slideway 541 and drives the interlocking sliding sheet 512 to slide to the left or right, so that the locking pillar 517 of the rest plugs will be staggered from the entrance of the corresponding locking pillar 517. As a result, the locking pillar 517 is locked by the corresponding locking stage 541*a*, thereby realizing the object that the positions of the rest plugs are locked when one plug protrudes out (that is, when one plug is in operation).

As shown in FIGS. 59-60, the slide button 19 of the Australian Standard plug 516 drives the Australian Standard plug 516 to move downward along the first slideway 521 and protrude to an effective position. In this process, the locking pillar 517 of the Australian Standard plug 516 slides downward along the second slideway 541 and drives the interlocking sliding sheet 512 to slide to the right, so that the locking pillar 517 of the rest plugs will be staggered from the entrance of the corresponding locking pillar 517. As a result, the locking pillar 517 is locked by the corresponding locking stage 541*a*, thereby realizing the object that the positions of the rest plugs are locked when one plug protrudes out (that is, when one plug is in operation).

Embodiment 17

Based on the technical solutions, the plug in this embodiment is consisted of a European Standard plug 513, a British Standard plug 515 and an Australian Standard plug 516 that are distributed successively, or is consisted of a European Standard plug 513, a British Standard plug 515 and an American Standard plug 514 that are distributed successively.

In this embodiment, the interlocking sliding sheet 512 is consisted of the same flat plate, that is, only the first interlocking sliding sheet 531 in the interlocking sliding sheet 512 in the technical solution is employed.

Embodiment 18

Based on the technical solutions, as shown in FIGS. 61-73, the travel adapter further includes:

at least two plugs 631 respectively corresponding to the power plug standards of different countries, which are respectively provided inside a housing 10 and respectively include a pin;

a protrusion surface 611 provided on the housing 10, from which the plug 631 may operably protrude and retract into the housing 10;

a cover plate 612, which is provided on the housing 10 and covers the protrusion surface 611 and is provided with a first through hole 21 for different pins to stretch out and draw back; and a sliding baffle 613, which is slidably provided between the protrusion surface 611 and the cover plate 612 and interferes the pins of the plugs 631 during sliding to make at most one plug 631 in the housing 10 protrude from the first through hole 21 each time.

Figure 61:
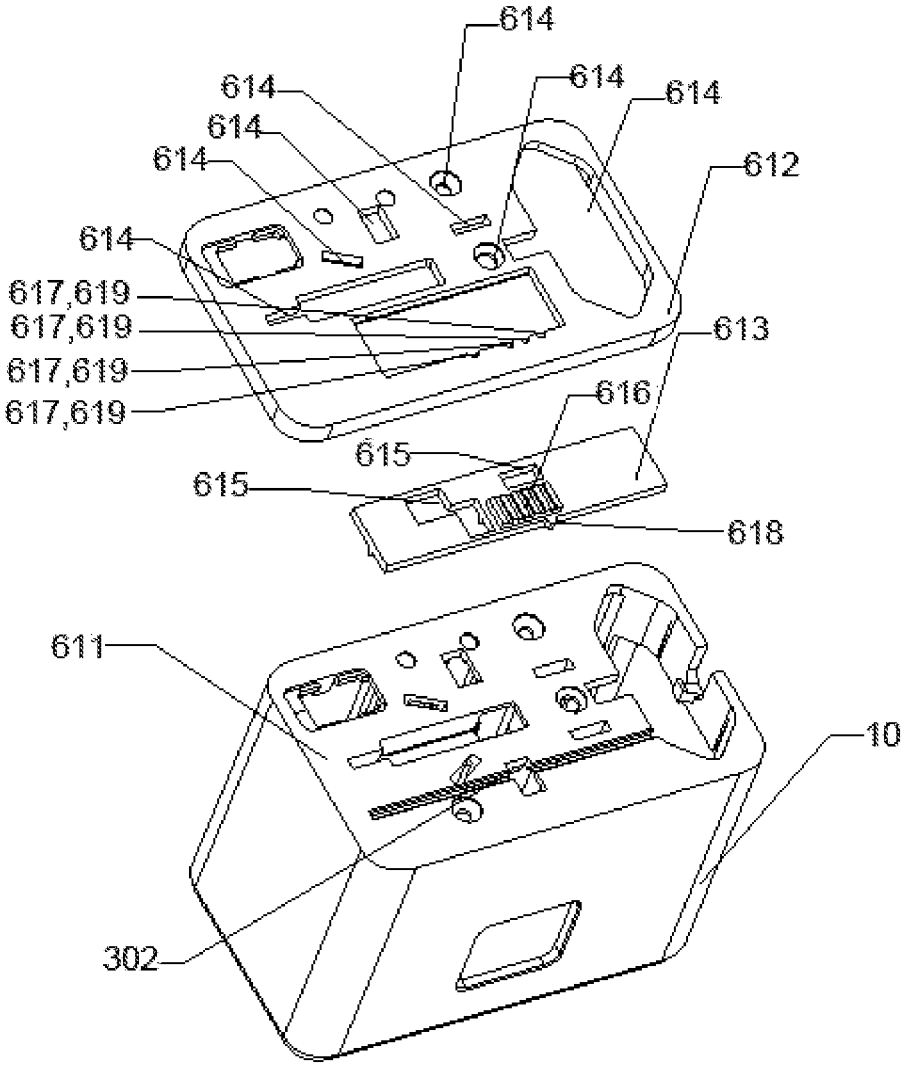
FIG. 61 is an exploded view showing the component parts when an operating part is provided in an opening according to a preferred embodiment of the invention.
Figure 62:
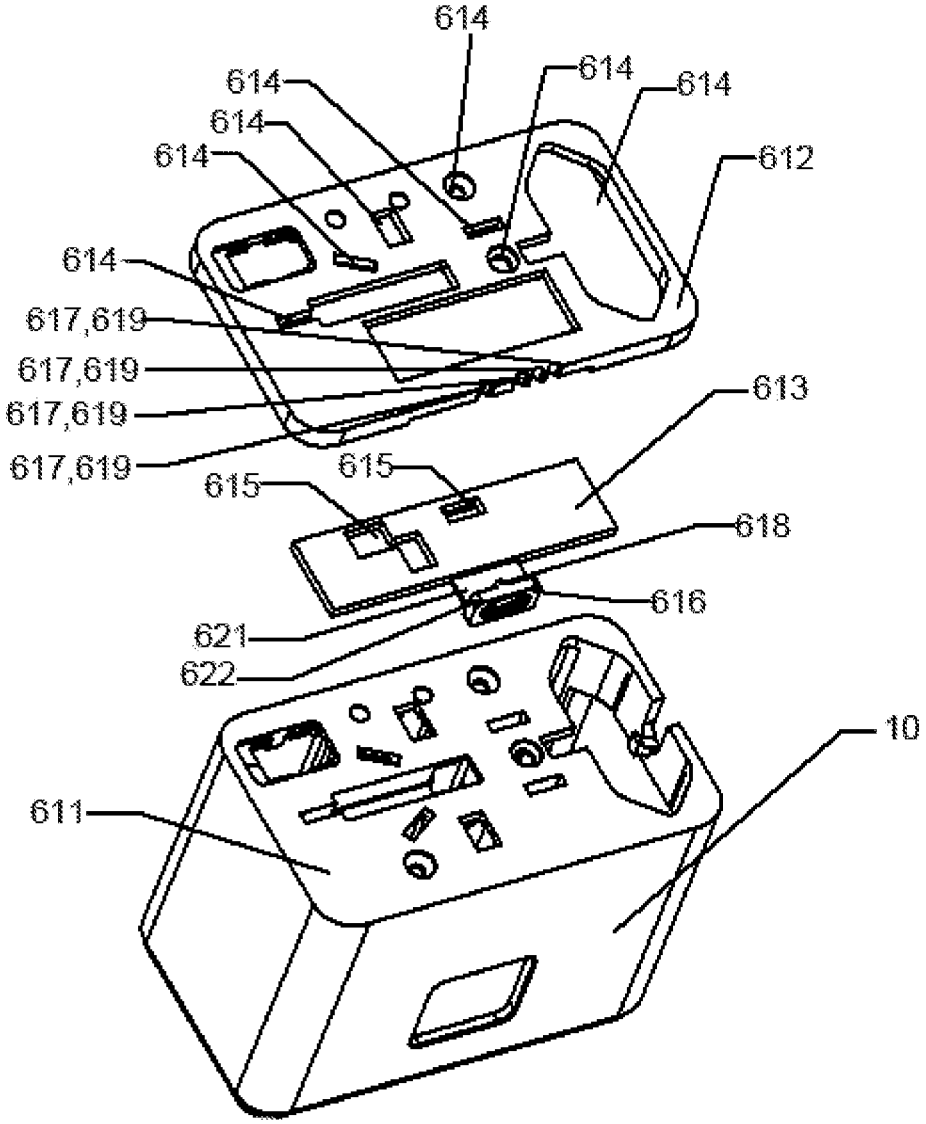
FIG. 62 is an exploded view showing the component parts when an operating part is provided between a housing and a cover plate according to a preferred embodiment of the invention.
Figure 74:
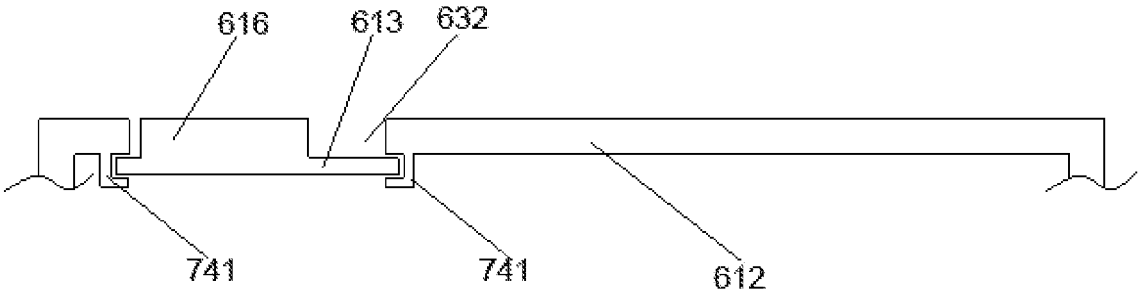
FIG. 74 is a schematic diagram when a guide structure is provided on a cover plate according to a preferred embodiment of the invention.
Figure 75:
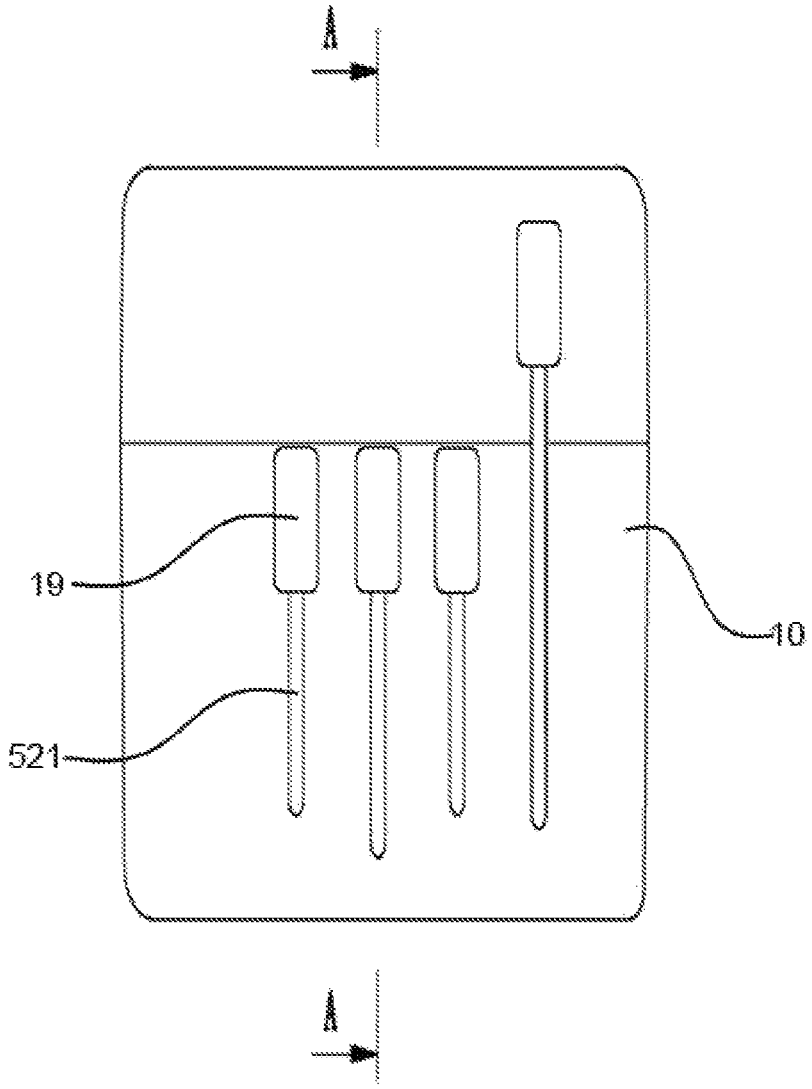
FIG. 75 is schematic diagram showing a part of the structure of a travel adapter according to a preferred embodiment of the invention.
Figure 76:
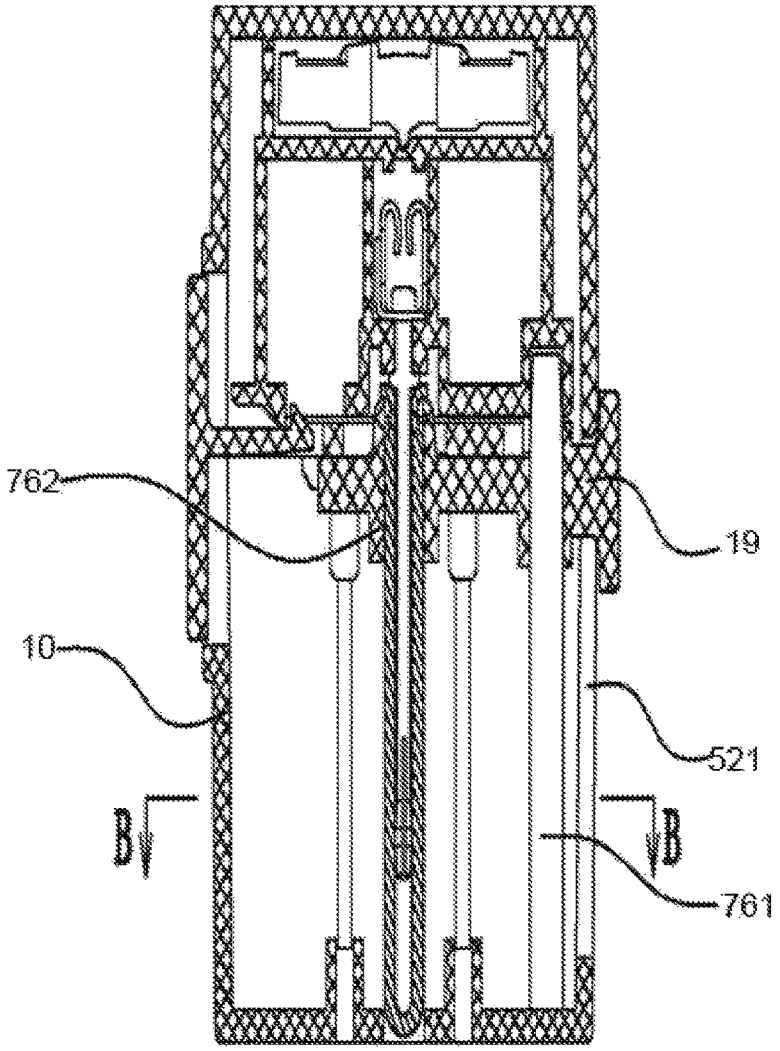
FIG. 76 is a schematic diagram showing a sectional structure along A-A in FIG. 75 according to a preferred embodiment of the invention.

In the technical solution, the housing 10 generally may be a housing structure 10, and the protrusion surface 611 may be the edge contour of the structure of the housing 10 or a virtual plane determined by logic lines artificially defined on the housing structure, as shown in FIG. 61 and FIG. 74. In the embodiment, the structure of the housing 10 consisting the housing 10 only includes a sidewall that surrounds to form the housing 10 and a bottom surface that faces away from the surface from which the plug 631 protrudes. The cover plate 612 covers the side of the housing 10 from which the plug 631 protrudes, that is, in the embodiment, the protrusion surface 611 is omitted, and the sliding baffle 613 may be slidably fixed to the cover plate 612. Or, it may be formed of a physical structure, as in the embodiment shown in FIGS. 61-73, the protrusion surface 611 is formed of a panel structure, which is provided with a through hole for the pins of the plugs 631 to pass through.

The plug 631 may protrude from the protrusion surface 611 and retract into the housing 10 via an independent retractive structure. The retractive structure may be implemented by a guide track vertical to the protrusion surface 611 and realize the protrusion and retraction of the plug 631 by fitting an operating handle (not shown) protruding from the housing 10. Because such a retractive structure belongs to the prior art, it will not be described again here.

By interfering the protrusion direction of the pins of the plugs 631 during sliding, the sliding baffle 613 makes the pins of only one plug 631 protrude from the cover plate 612 via the first through hole 21 each time, thereby realizing the interlocking between the plugs 631. Because the sliding baffle 613 is not linked to other structures of the adapter and is kept relatively independent on structure, it does not have the following defects in the prior art: i.e., easy to be worn, tending to block or damage the retractive structure. Because the sliding baffle 613 interferes the protrusion direction of the pins of the plugs 631 during sliding, a user may view by naked eyes that the first through hole 21 of the interfered plug 631 is fully or partially covered by the sliding baffle 613, so that the plug 631 currently interfered and the plug 631 that can protrude from the cover plate 612 may be determined.

Embodiment 19

Based on the technical solutions, the travel adapter may further include a positioning structure, which includes positioning points 617 corresponding to the number of the plugs 631 and may operably position the sliding baffle 613 at a positioning point 617.

The positioning points 617 are respectively correlated to different plugs 631. When the sliding baffle 613 is position at a positioning point 617, it may interfere the first through hole 21 corresponding to the plugs 631 that are not correlated with the positioning point 617.

In the technical solution, by providing a positioning structure and positioning points 617 corresponding to the number of the plug 631, a user may effectively operate the sliding baffle 613 when using the adapter to position the sliding baffle 613 at a positioning point 617 required via the positioning structure, so that the user does not need to determine, by viewing via naked eyes, the plug 631 currently interfered and the plug 631 that can protrude from the cover plate 612.

Further, an identification of the plug 631 corresponding to the positioning point 617 may be added at each positioning point 617 for a user to select and operate more easily.

Embodiment 20

Based on the technical solutions, the sliding baffle 613 may be provided with second through holes 615 corresponding to different plugs 631. When the sliding baffle 613 is position at a positioning point 617, the second through hole 615 may fit the first through hole 21 corresponding to the plug 631 correlated with the positioning point 617 for the pins of the plug 631 correlated with the positioning point 617 to protrude out.

Because the shape of the sliding baffle 613 is made too complex in order to, for example, fit the layout of the plugs 631, the sliding of the sliding baffle 613 may be affected, and hence a second through hole 615 may be provided while designing the shape of the sliding baffle 613 to simplify the shape of the sliding baffle 613, which may not only be favorable for the sliding of the sliding baffle 613, but also be favorable for reducing the size of the sliding baffle 613, so that the size of the interlocking structure of the whole plug 631 will not be too large to affect the carrying of the adapter.

Embodiment 21

Based on the technical solutions, the positioning structure includes: a protrusion 42, which is provided on the sliding baffle 613. The positioning structure further includes a plurality of grooves 619, which are respectively provided on the cover plate 612 and correspond to the position of the protrusion 42 for restricting the movement of the sliding baffle 613. Each groove 619 corresponds to the positioning point 617 one to one.

Further, the protrusion 42 may be a circular arc protrusion, and at the same time, the groove 619 may be a circular arc groove adapting the circular arc protrusion. By providing the protrusion 42 and the corresponding groove 619 as a circular arc, it is convenient for the protrusion 42 to be detached from the groove 619 under the action of a certain external force after the sliding baffle 613 is positioned at the positioning point 617, so that it is easy for a user to operate. In other embodiments of the invention, the protrusion 42 may also be provided as a triangular protrusion with a circular arc or a chamfer on the top, and correspondingly, the groove 619 may be provided as adaptive shape corresponding thereto.

Embodiment 22

As shown in FIG. 61 and FIGS. 63-67, the cover plate 612 may be provided with an opening 632 correspond to the sliding baffle 613, and the opening 632 coincides with the first through hole 21 corresponding to at least one plug 631, and a groove 619 is provided on the inner wall of the opening 632.

The sliding baffle 613 includes an operating part 616 for operating the sliding baffle 613 to slide, and the operating part 616 is provided on one side of the sliding baffle 613 facing the cover plate 612 and is located in the opening 632.

In the technical solution, by providing an opening 632 and providing an operating part 616 in the opening 632, it may be easy for a user to operate the sliding baffle 613. Moreover, by making the opening 632 coincide with at least one through hole corresponding to at least one plug 631 or coincide with at least one through hole corresponding to each of a plurality of plugs 631 according to the arrangement of the plugs 631, the sliding space of the sliding baffle 613 may be fully utilized, thus the area of the cover plate 612 may be reduced, and the volume of the whole adapter may be further reduced, so that it will be convenient for the adapter to be carried.

Further, the operating part 616 may be parallel bar teeth protruding from the sliding baffle 613.

Embodiment 23

Based on the technical solutions, as shown in FIG. 62 and FIGS. 68-73, one side of the sliding baffle 613 may be provided with a protrusion part 621, which protrudes from the protrusion surface 611 and the cover plate 612 along the extension direction of the protrusion surface 611. The side of the protrusion part 621 that protrudes from the protrusion surface 611 and the cover plate 612 is provided with a lug 622 facing the cover plate 612, the protrusion 42 is provided on one side of the lug 622 that faces the cover plate 612, and the groove 619 is provided on one edge of the cover plate 612 that faces the lug 622.

The sliding baffle 613 includes an operating part 616 for operating the sliding baffle 613 to slide, and the operating part 616 is provided on the lug 622.

In this embodiment, because the operating part 616 is provided on the lug 622 that protrudes from the protrusion surface 611 and the cover plate 612, no opening 632 needs to be provided.

Further, the operating part 616 may be an operating handle.

Embodiment 24

Figure 67:
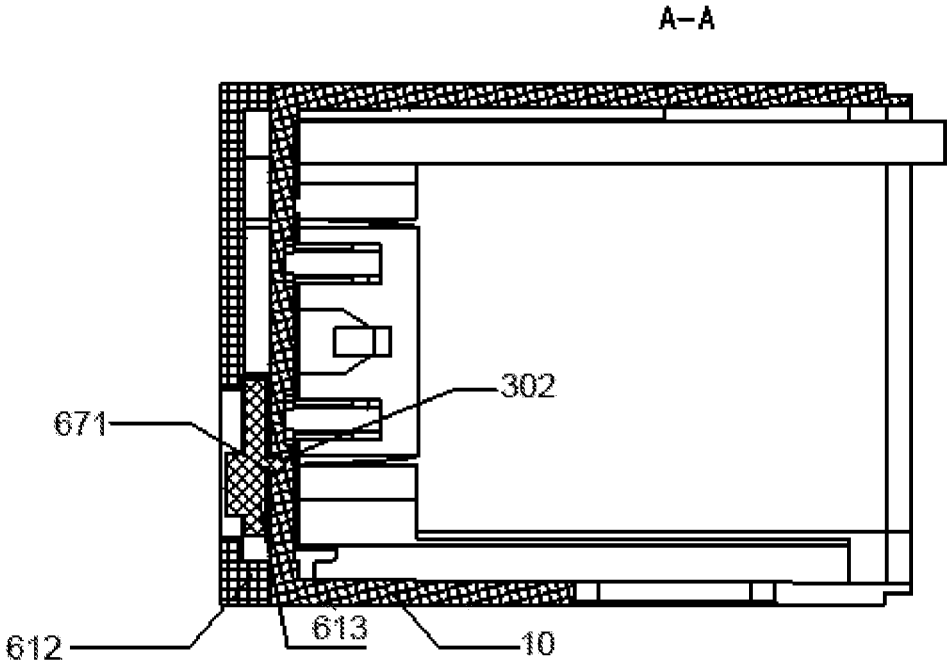
FIG. 67 is a schematic diagram showing a sectional structure along A-A of FIG. 63.

Based on the technical solutions, as shown in FIG. 67, when the protrusion surface 611 is formed of a physical structure, the sliding baffle 613 may be slidably connected to the protrusion surface 611 via a guide structure, and the guide structure may include:

a sliding slot 302, which is provided on the protrusion surface 611 along the sliding direction of the sliding baffle 613; and a sliding protrusion 671, which is provided on one side of the sliding baffle 613 that faces the protrusion surface 611 and is slidably embedded in the sliding slot 302.

In the technical solution, the sliding baffle 613 will not be detached from the sliding direction during sliding due to the guide structure. At the same time, sliding may be realized by the fitting of the sliding protrusion 671 simply provided on the protrusion surface 611 and the sliding slot 302, and hence the space in the interlocking structure of the whole plug 631 occupied by the guide structure may be reduced.

Embodiment 25

Based on the technical solutions, as shown in FIG. 74, when the protrusion surface 611 is the edge contour of the structure of the housing 10 that forms the housing 10 or a virtual plane determined by logic lines artificially defined on the housing 10 structure, the sliding baffle 613 may be slidably connected to the cover plate 612 via a guide structure. The guide structure includes a pair of limit slots 741. The pair of limit slots 741 provided opposite to each other correspond to the sliding direction of the sliding baffle 613 and are provided in parallel on the cover plate 612. The sliding baffle 613 is slidably embedded in the pair of limit slots 741 along the two side edges of the sliding direction.

It should be noted that, the technical solution may also be implemented when the protrusion surface 611 is a physical structure.

Embodiment 26

Based on the technical solutions, in an alternative embodiment, as shown in FIG. 13, when the operating part 616 is provided on the lug 622, the sliding baffle 613 may be slidably connected to the cover plate 612 via a guide structure, and the guide structure may be formed by a slot 721 provided on the cover plate 612.

Embodiment 27

Based on the technical solutions, the plugs 631 may include 4 power plugs 631 of power plug standards of different countries, including American power plug standard, British power plug standard, EU power plug standard and Australian power plug standard.

The operating principle of the interlocking of the plugs 631 in the travel adapter of the technical solution will be further described below by a specific embodiment. It should be noted that, the description below is merely used for explaining the practicability of the technical solutions of the invention, rather than limiting the protection scope of the invention.

Figure 63:
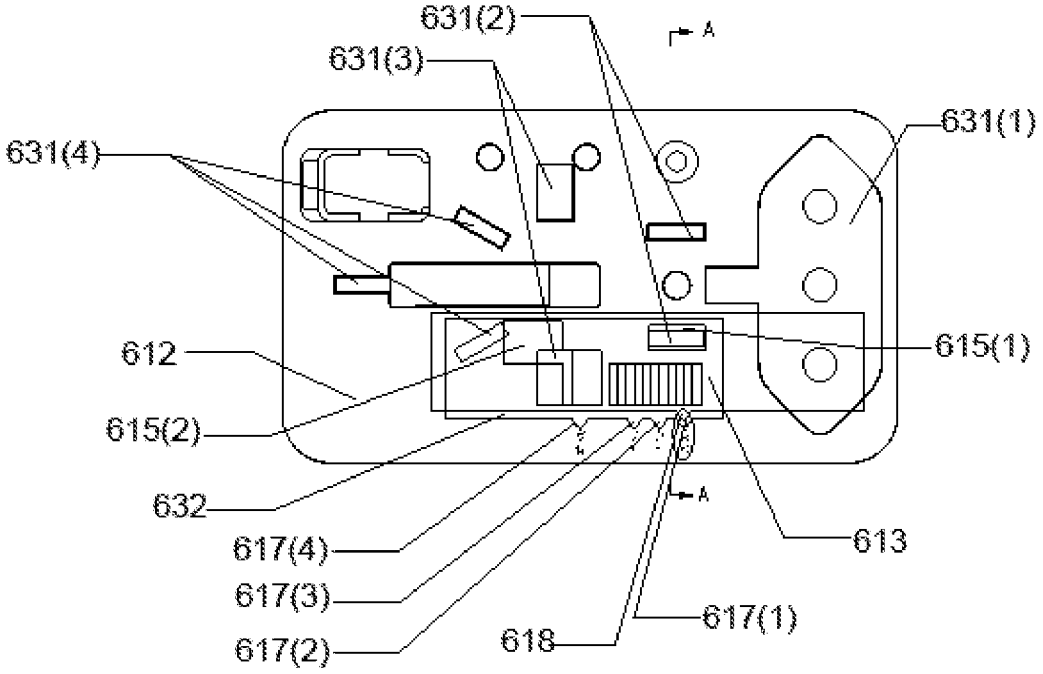
FIGS. 63-66 are schematic diagrams showing each state when an operating part is provided in an opening and used according to a preferred embodiment of the invention.
Figure 68:
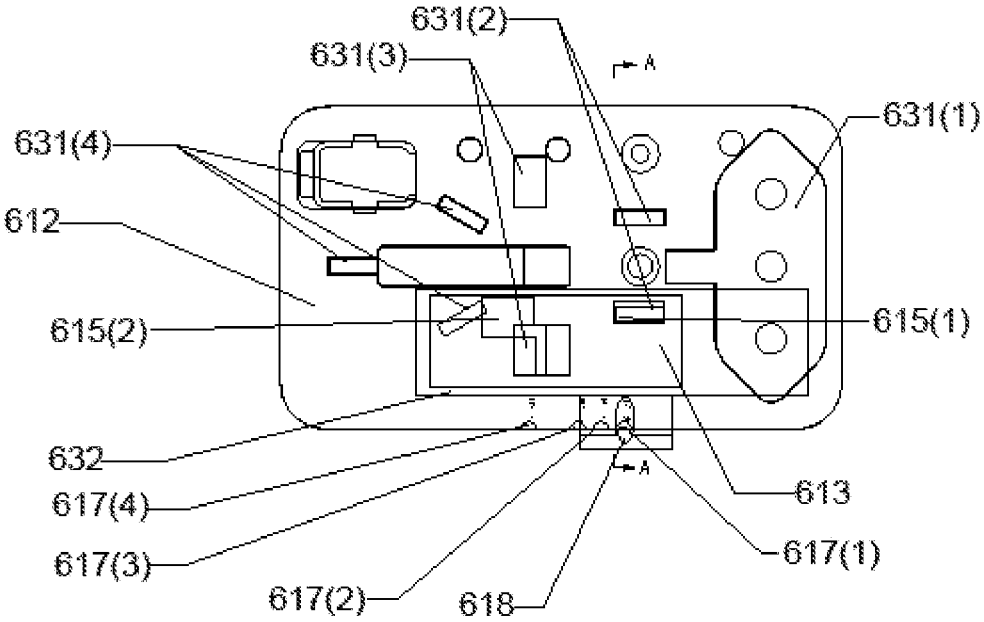
FIGS. 68-71 are schematic diagrams showing each state when an operating part is provided between a housing and a cover plate and used according to a preferred embodiment of the invention.

As shown in FIG. 63 and FIG. 68, the sliding baffle 613 is positioned at a positioning point 617 (1) via a protrusion 42. At this moment, the first through hole corresponding to the plug 631 (1) is partially covered by the right end of the sliding baffle 613, so that the pins of the plug 631 (1) cannot protrude out. Among the first through holes corresponding to the plug 631 (2), the first through hole coinciding with the opening 632 corresponds to the position of the second through hole 615 (1) on the sliding baffle 613, so that the pins of the plug 631 (2) may protrude out. Among the first through holes corresponding to the plug 631 (3), the first through hole coinciding with the opening 632 is partially covered by the sliding baffle 613, so that the pins of the plug 631 (3) cannot protrude out. Among the first through holes corresponding to the plug 631 (4), the first through hole coinciding with the opening 632 is partially covered by the left end of the sliding baffle 613, so that the pins of the plug 631 (4) cannot protrude out. Thus, at this moment, only the pins of the plug 631 (2) may protrude from the cover plate 612.

Figure 64:
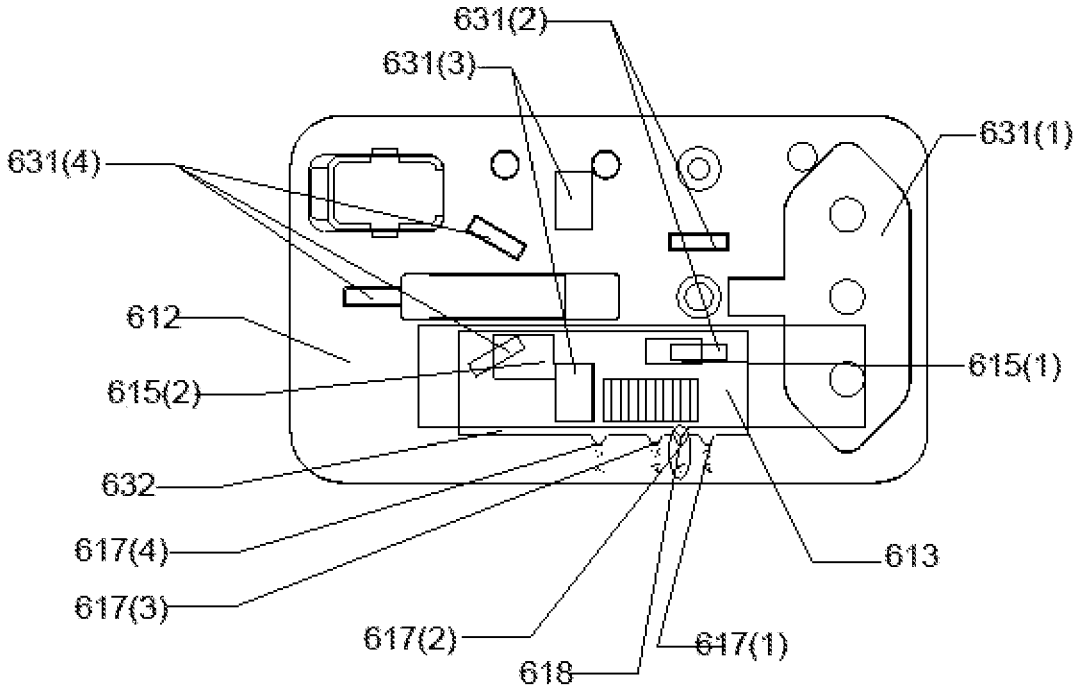
Figure 69:
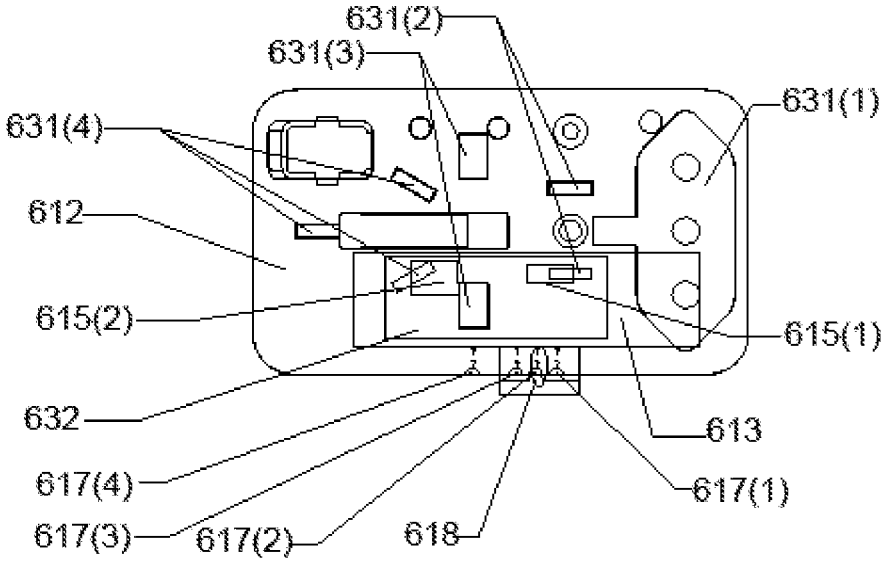

As shown in FIG. 64 and FIG. 69, the sliding baffle 613 is positioned at the positioning point 617 (2) via the protrusion 42. At this moment, the first through hole corresponding to the plug 631 (1) is partially covered by the right end of the sliding baffle 613, so that the pins of the plug 631 (1) cannot protrude out. Among the first through holes corresponding to the plug 631 (2), the first through hole coinciding with the opening 632 is partially covered by the sliding baffle 613, so that the pins of the plug 631 (2) cannot protrude out. Among the first through holes corresponding to the plug 631 (3), the first through hole coinciding with the opening 632 corresponds to the bottom right position of the second through hole 615 (2) on the sliding baffle 613, so that the pins of the plug 631 (3) may protrude out. Among the first through holes corresponding to the plug 631 (4), the first through hole coinciding with the opening 632 is partially covered by the left end of the sliding baffle 613, so that the pins of the plug 631 (4) cannot protrude out. Thus, at this moment, only the pins of the plug 631 (3) may protrude from the cover plate 612.

Figure 65:
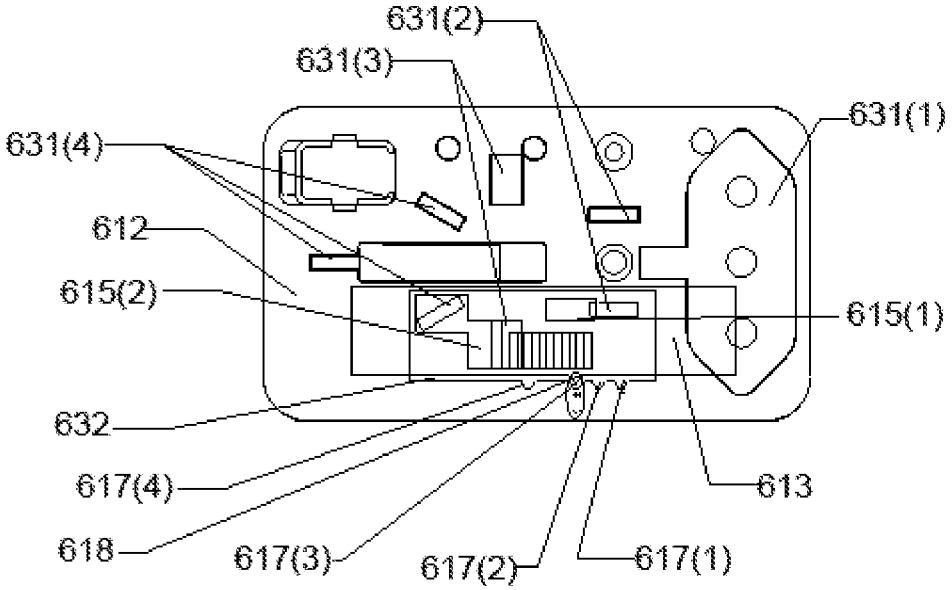
Figure 70:
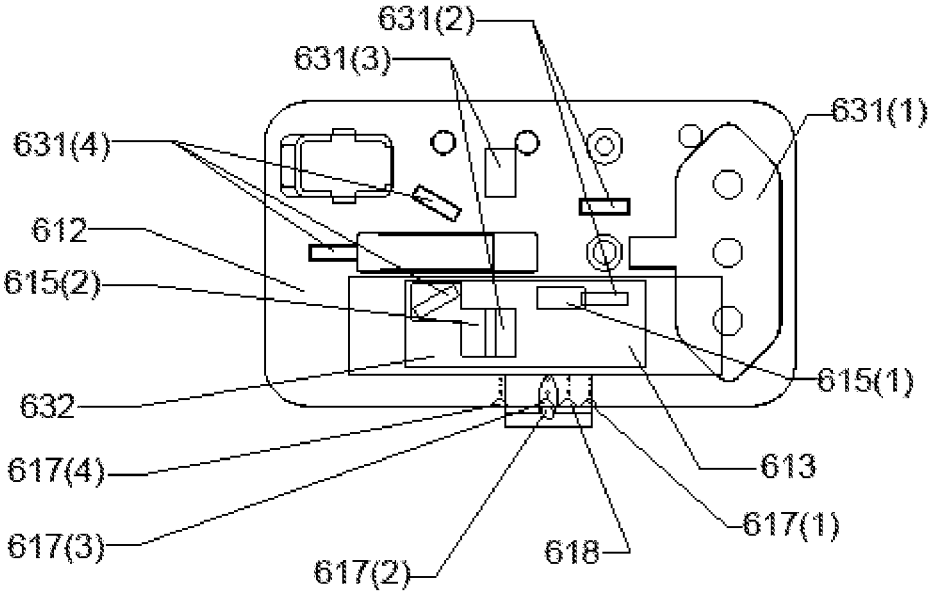

As shown in FIG. 65 and FIG. 70, the sliding baffle 613 is positioned at the positioning point 617 (3) via the protrusion 42. At this moment, the first through hole corresponding to the plug 631 (1) is partially covered by the right end of the sliding baffle 613, so that the pins of the plug 631 (1) cannot protrude out. Among the first through holes corresponding to the plug 631(2), the first through hole coinciding with the opening 632 is partially covered by the sliding baffle 613, so that the pins of the plug 631 (2) cannot protrude out. Among the first through holes corresponding to the plug 631 (3), the first through hole coinciding with the opening 632 is partially covered by the sliding baffle 613, so that the pins of the plug 631 (3) cannot protrude out. Among the first through holes corresponding to the plug 631 (4), the first through hole coinciding with the opening 632 corresponds to the top left position of the second through hole 615 (2) on the sliding baffle 613, so that the pins of the plug 631 (4) may protrude out. Thus, at this moment, only the pins of the plug 631 (4) may protrude from the cover plate 612.

Figure 66:
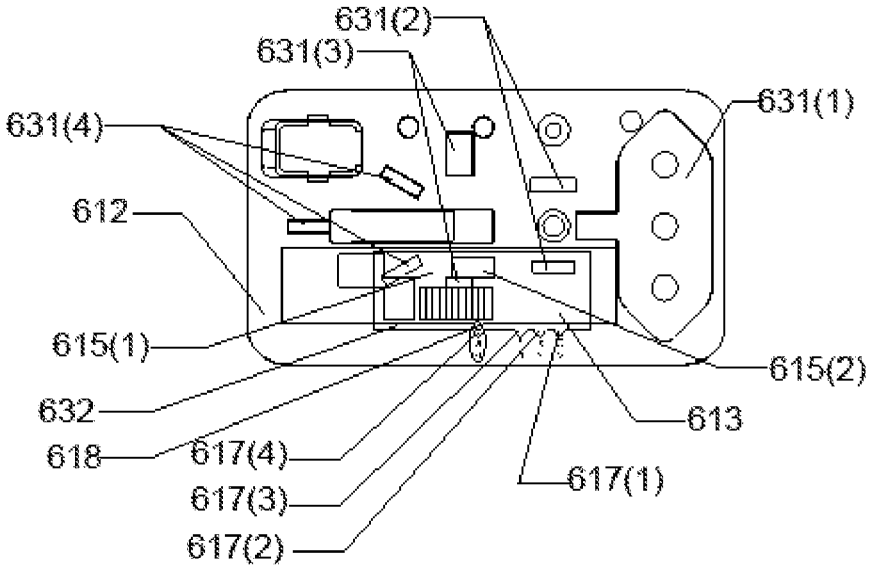
Figure 71:
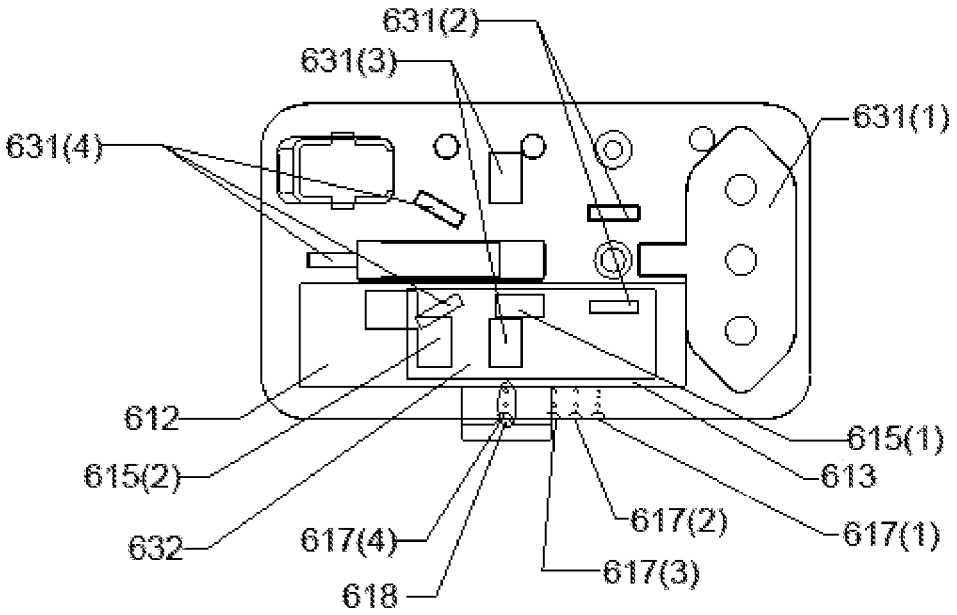
Figure 72:
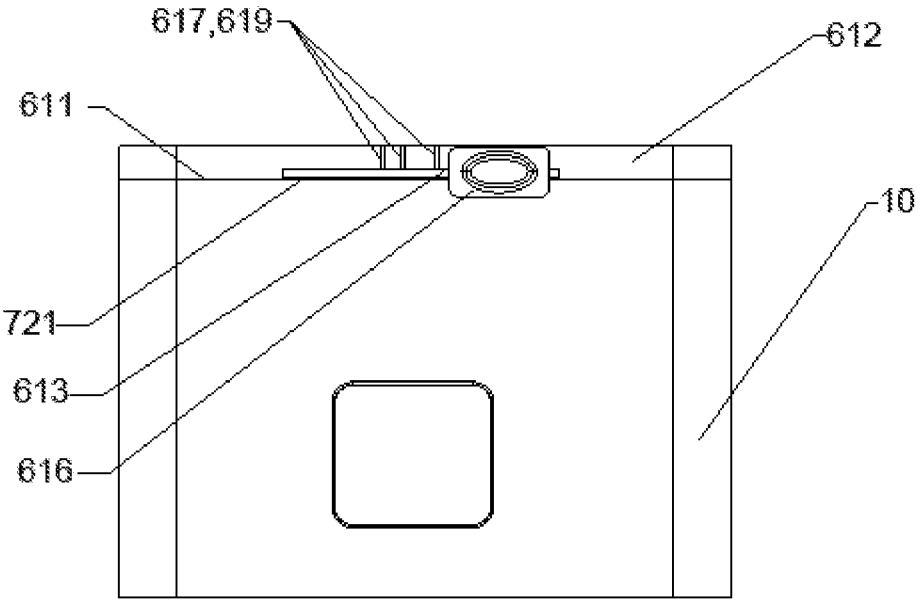
FIG. 72 is a side view when an operating part is provided between a housing and a cover plate and the position of the operating part is shown according to a preferred embodiment of the invention.
Figure 73:
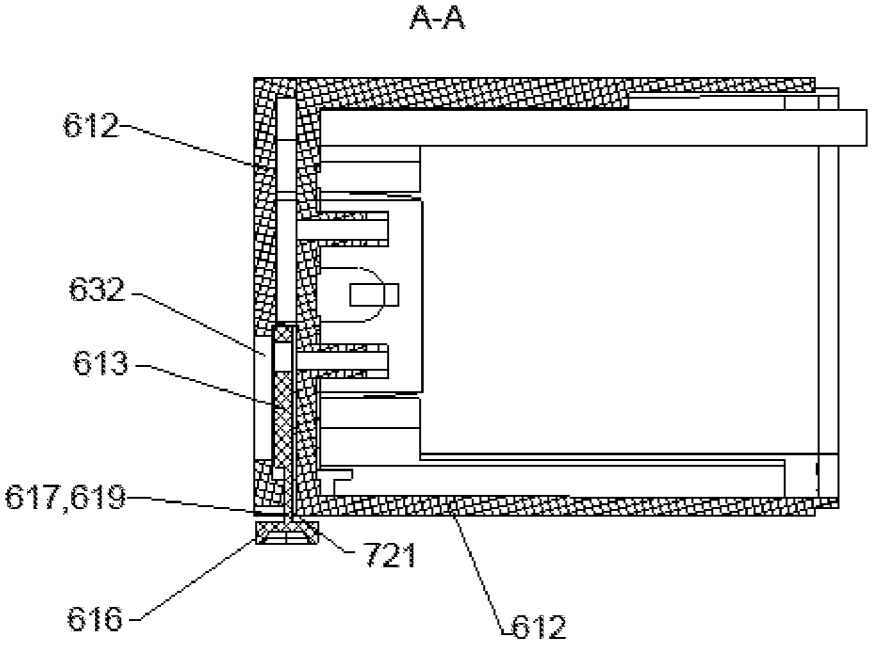
FIG. 73 is a schematic diagram showing a sectional structure along A-A of FIG. 68.

As shown in FIG. 66 and FIG. 71, the sliding baffle 613 is positioned at the positioning point 617 (4) via the protrusion 42. At this moment, the right end of the sliding baffle 613 no longer covers the first through hole corresponding to the plug 631 (1), so that the pins of the plug 631 (1) may protrude out. Among the first through holes corresponding to the plug 631 (2), the first through hole coinciding with the opening 632 is partially covered by the sliding baffle 613, so that the pins of the plug 631 (2) cannot protrude out. Among the first through holes corresponding to the plug 631 (3), the first through hole coinciding with the opening 632 is partially covered by the sliding baffle 613, so that the pins of the plug 631 (3) cannot protrude out. Among the first through holes corresponding to the plug 631 (4), the first through hole coinciding with the opening 632 is partially covered by the sliding baffle 613, so that the pins of the plug 631 (4) cannot protrude out. Thus, at this moment, only the pins of the plug 631 (1) may protrude from the cover plate 612.

Embodiment 28

Based on the technical solutions, as shown in FIGS. 75-78, the travel adapter further includes:

a plurality of first slideways 521, which are respectively provided on the lateral side of the housing 10 and extend upward and downward;

a plurality of plugs 762, which are respectively provided inside the housing 10 and can movably stretch out and draw back along the corresponding first slideway 521, the first slideways 521 correspond to the plugs 762 one to one, and each plug 762 is provided with a corresponding probe 771; and a anti-electric-shock barrier, which is provided inside the housing 10 and located between the plug 762 and the corresponding first slideway 521 and is configured for preventing the probe 771 from stretching via the first slideway 521.

In this embodiment, the number of the plugs 762 is four, and the number of the first slideways 521 is also four. Moreover, the first slideways 521 correspond to the plugs 762 one to one.

In this embodiment, the first slideway 521 preferably may be a straight slideway. The plug 762 is provided with a slide button 19. The slide button 19 passes through the first slideway 521, and the slide button 19 may drive the plug 762 to move along the first slideway 521.

The housing 10 is provided with an anti-electric-shock barrier structure, which corresponds to the first slideway 521 and is configured for preventing the probe 771 from stretching via the first slideway 521. The first anti-electric-shock barrier is located between the plug 762 and the first slideway 521. Specifically, the first anti-electric-shock barrier is located between the plug 762 and the lateral side of the housing 10 in which the first slideway 521 exists.

The anti-electric-shock barrier includes four barrier pillars 761 that are provided in the housing 10 and configured for blocking the slideway. The barrier pillar 761 is provided on the inner bottom surface of the housing 10 and corresponds to the first slideway 521 one to one. Moreover, the barrier pillar 761 is located between the corresponding plug 762 and the first slideway 521, and the barrier pillar 761 is adjacent to the first slideway 521 and extends along the first slideway 521. The slide button 19 is provided with a guide through hole fitting the barrier pillar 761, and the barrier pillar 761 is inserted in the guide through hole.

Figure 77:
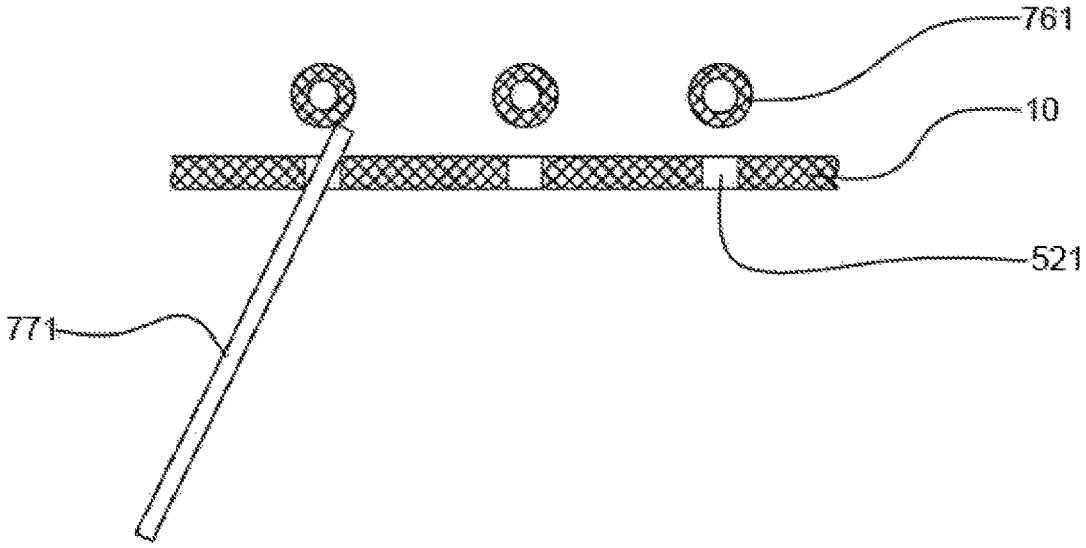
FIGS. 77-78 are schematic diagrams showing a partial sectional structure along B-B in FIG. 76 according to a preferred embodiment of the invention.

As shown in FIG. 77, the lateral side of the housing 10 in which the first slideway 521 exists is a flat surface.

Figure 78:
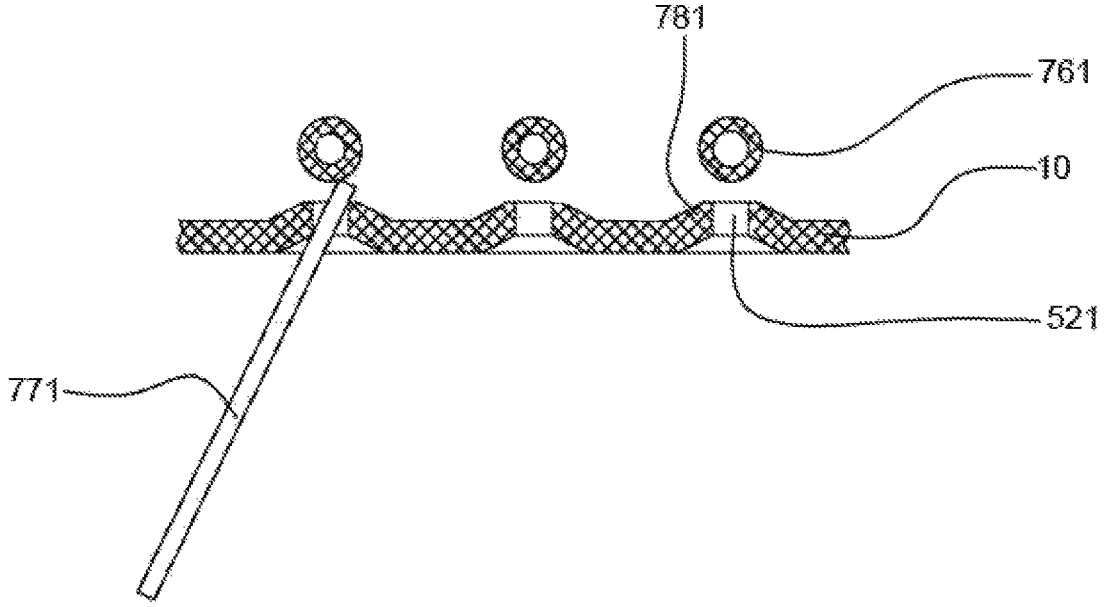

As shown in FIG. 78, the lateral side of the housing 10 is provided with bar protrusions 781 protruding to the inside of the housing 10. The number of the bar protrusions 781 is four. The bar protrusions 781 extend upward and downward and correspond to the first slideways 521 one to one. Further, the first slideways 521 are provided on the corresponding bar protrusions 781.

As shown in FIGS. 77-78, in this embodiment, the probe 771 is prevented from stretching into the travel adapter from the first slideway 521 by the barrier pillar 761 in the anti-electric-shock barrier, so that safety problems of electric shock and short circuit, etc., during the protrusion of the plug 762, which are caused by the stretching of the first slideway 521 into the adapter and the contacting of a live part, may be effectively solved.

Embodiment 29

Figure 79:
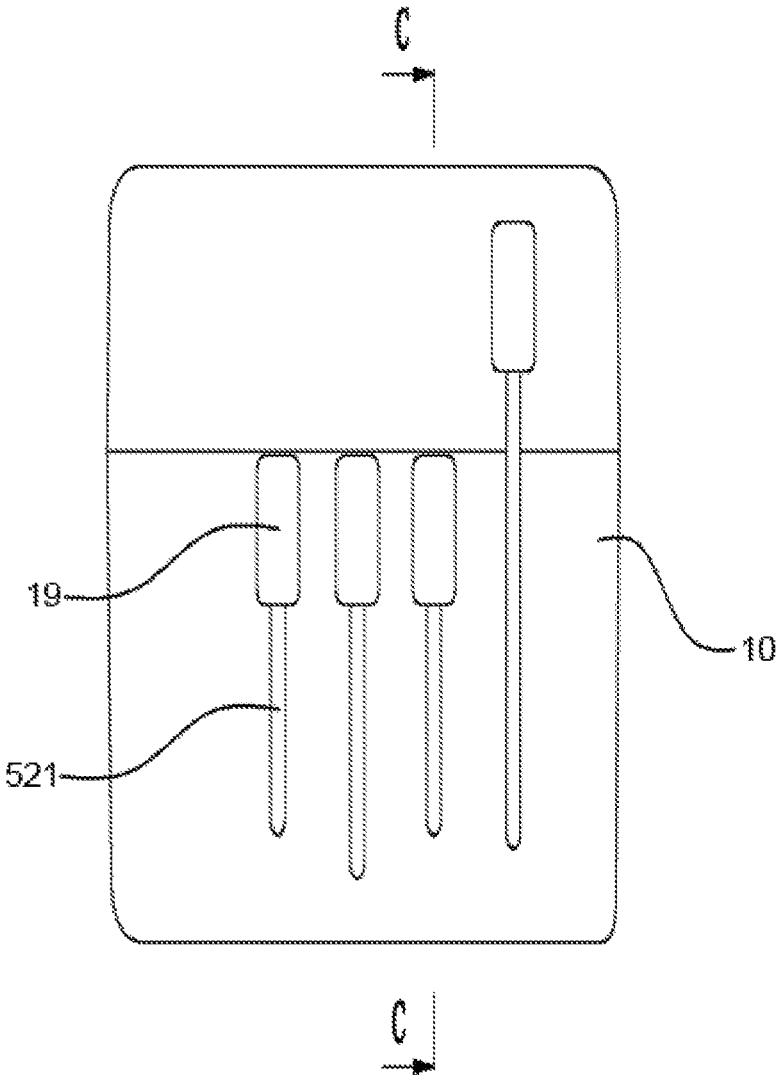
FIG. 79 is schematic diagram showing a part of the structure of a travel adapter according to a preferred embodiment of the invention.
Figure 80:
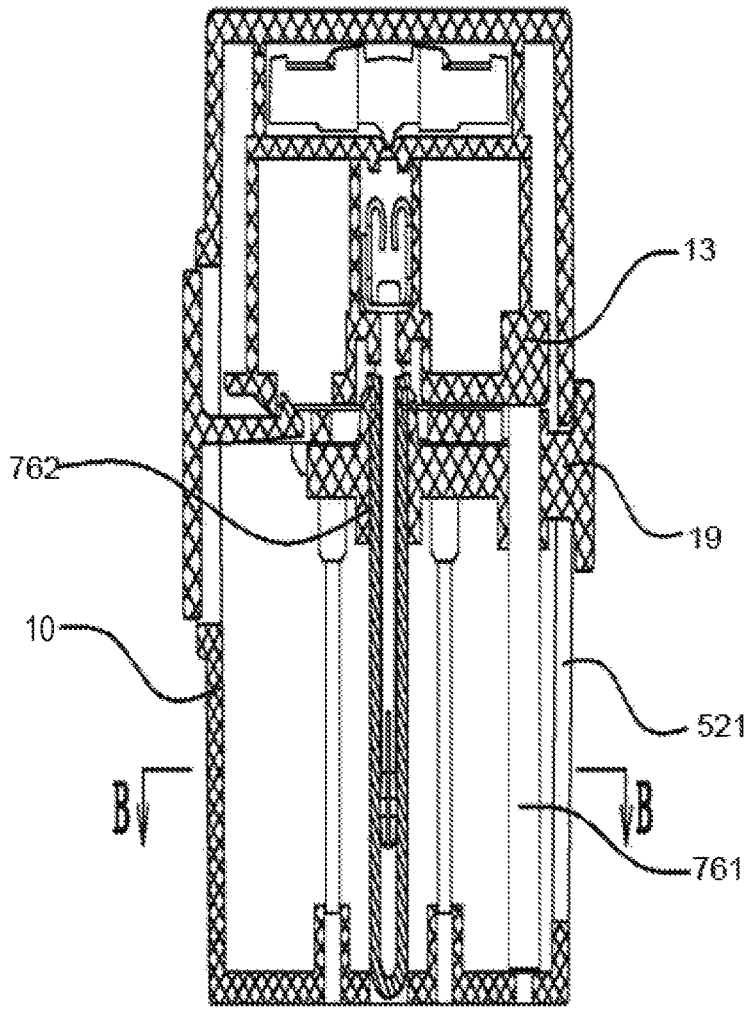
FIG. 80 is a schematic diagram showing a sectional structure along C-C in FIG. 79 according to a preferred embodiment of the invention.

Based on the technical solutions, as shown in FIGS. 79-80, the pin assembly in the travel adapter also includes a pin base 13 and a pin. The pin is provided between the pin base 13 and the bottom surface of the housing 10. The barrier pillar 761 is located between the pin base 13 and the bottom surface of the housing 10. In this embodiment, among the plurality of barrier pillars 761, one barrier pillar 761 is provided on the pin base 13, and the rest barrier pillars 761 are all provided on the inner bottom surface of the housing 10.

In this embodiment, an end part of the barrier pillar 761 provided on the pin base 13 is provided with a bolt hole, and the barrier pillar 761 may function as a bolt column connecting the pin base 13 and the bottom surface of the housing 10.

Embodiment 30

Figure 81:
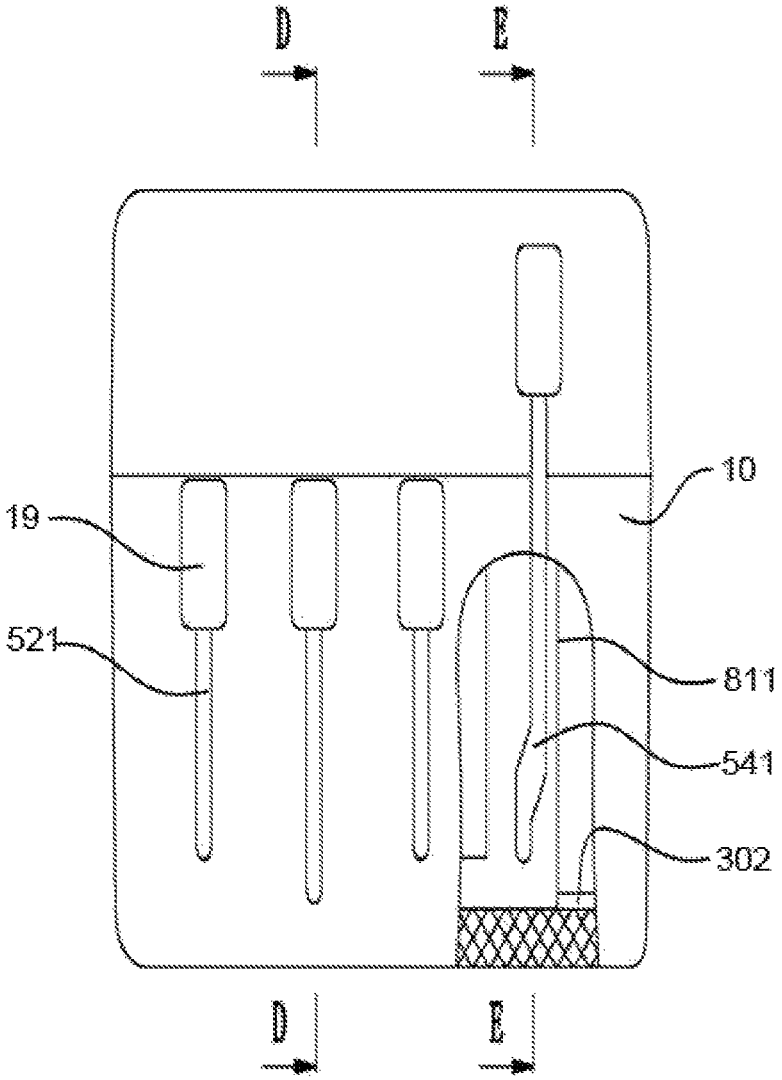
FIG. 81 is a structural representation of a hidden plug part in a travel adapter according to a preferred embodiment of the invention.
Figure 82:
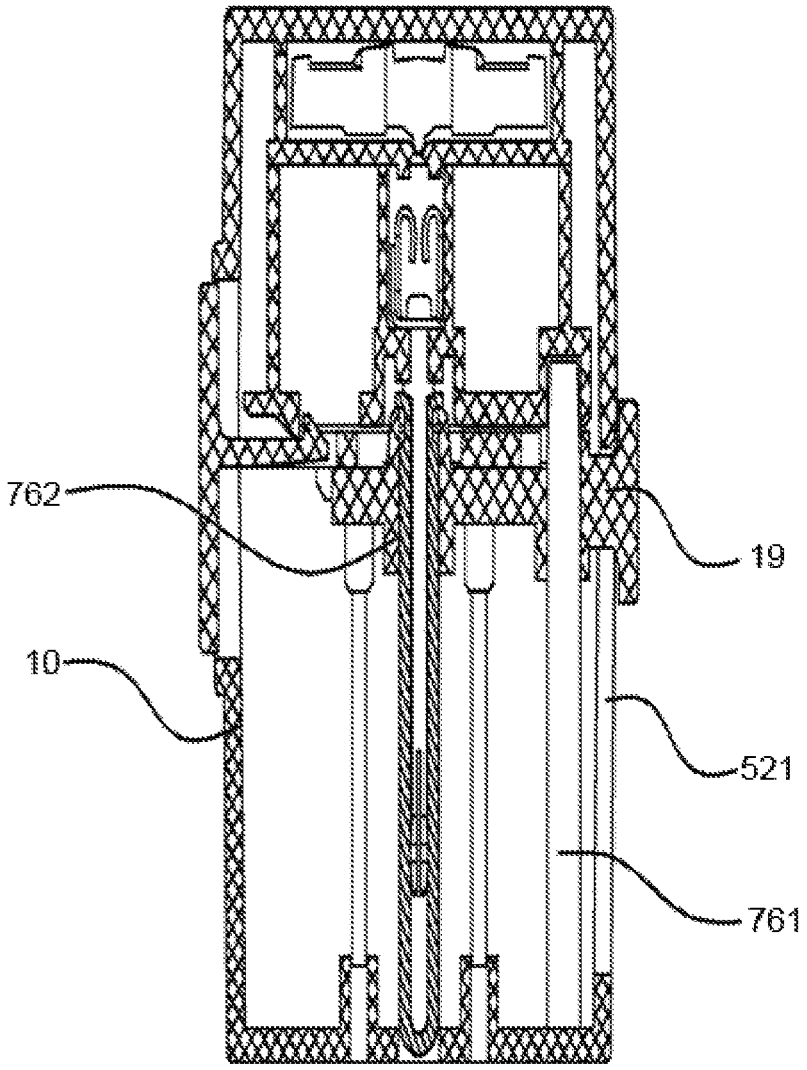
FIG. 82 is a schematic diagram showing a sectional structure along D-D in FIG. 81 according to a preferred embodiment of the invention.

Based on the technical solutions, as shown in FIGS. 81-82, the anti-electric-shock barrier includes three barrier pillars 761 provided in the housing 10 for blocking the first slideway 521 and one baffle for the probe 771 provided in the housing 10. Among the four first slideways 521, three first slideways 521 correspond to the barrier pillars 761 one to one, and the rest first slideway 521 corresponds to the baffle for the probe 771.

The barrier pillar 761 is located between the corresponding plug 762 and the first slideway 521, and the barrier pillar 761 is adjacent to the first slideway 521 and extends along the first slideway 521. The slide button 19 on the first slideway 521 corresponding to the barrier pillar 761 one to one is provided with a guide through hole fitting the barrier pillar 761, and the barrier pillar 761 is inserted in the corresponding guide through hole.

Figure 83:
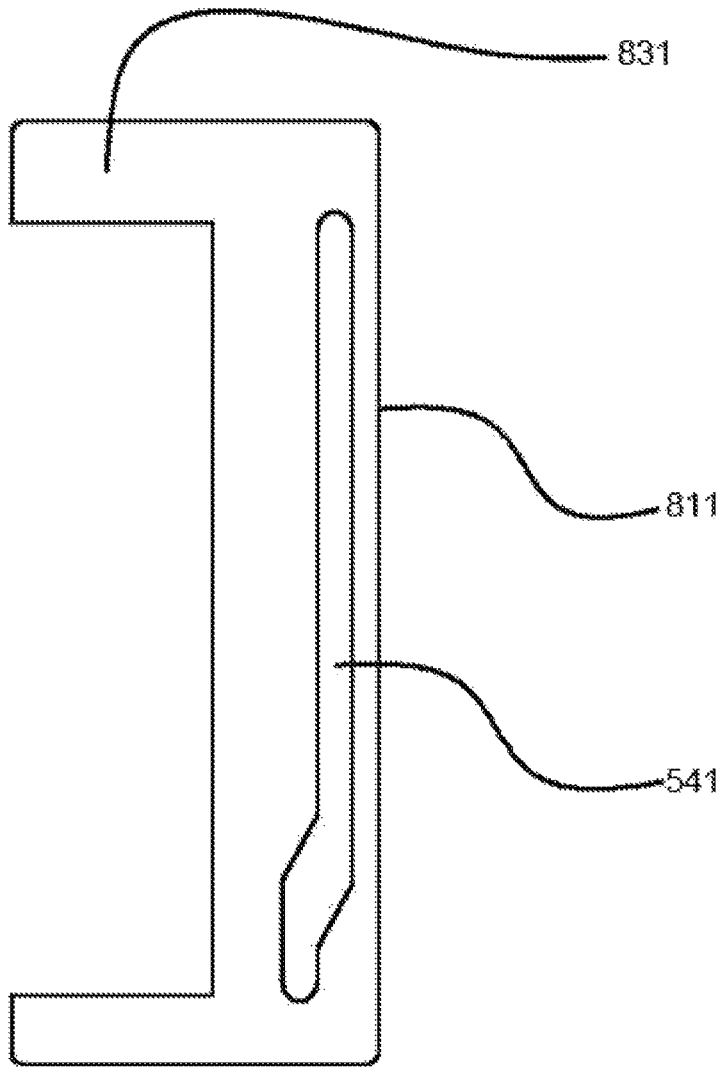
FIG. 83 is a structural representation of a probe baffle according to a preferred embodiment of the invention.
Figure 84:
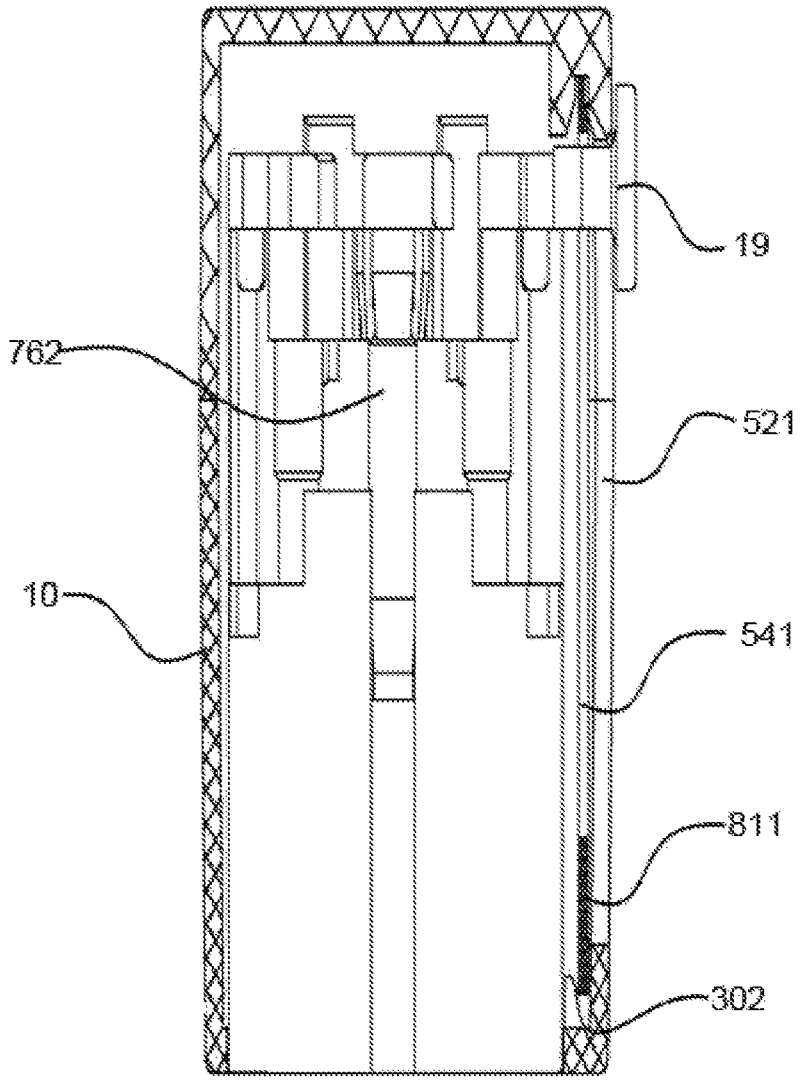
FIG. 84 is a schematic diagram showing a sectional structure along E-E in FIG. 81 according to a preferred embodiment of the invention.

As shown in FIG. 81 and FIGS. 83-84, the baffle for the probe 771 is located between the corresponding plug 762 and the first slideway 521 and is adjacent to the first slideway 521. The housing 10 is provided with a sliding slot 302 vertical to the first slideway 521.

In this embodiment, the sliding slot 302 is preferably a straight sliding slot 302. The sliding slot 302 is parallel to the lateral side of the housing 10 in which the first slideway 521 exists, and extends along a left-right direction. The baffle for the probe 771 is provided in the sliding slot 302 and can move along the sliding slot 302. The baffle for the probe 771 is further provided with a slide centering arm 831 fitting the sliding slot 302. The baffle for the probe 771 is provided with a second slideway 541 corresponding to the first slideway 521. The second slideway 541 successively includes, from top to bottom, an upper slideway, an inclined slideway and a lower slideway. The upper slideway and the lower slideway are parallel to the slideway. The inclined slideway intersects the first slideway 521. The slide button 19 on the first slideway 521 corresponding to the baffle for the probe 771 passes through the corresponding second slideway 541, and the slide button 19 passing through the corresponding second slideway 541 may slide up and down along the second slideway 541 and drive the baffle for the probe 771 to slide right and left at the same time With the support of the structure, the specific operating process of the baffle for the probe 771 of the anti-electric-shock barrier in this embodiment is as follows.

The slide button 19 corresponding to the baffle for the probe 771 drives the plug 762 to protrude downward along the first slideway 521 to an effective position. In this process, the slide button 19 slides downward along the second slideway 541 and drives the baffle for the probe 771 to slide to the right at the same time. The second slideway 541 is staggered from the corresponding first slideway 521, so that the baffle for the probe 771 blocks the first slideway 521 and prevents the probe 771 from stretching into the adapter via the first slideway 521, thereby avoiding the safety problems of electric shock and short circuit, etc., caused by the contacting of an electrified part.

Embodiment 31

Figure 85:
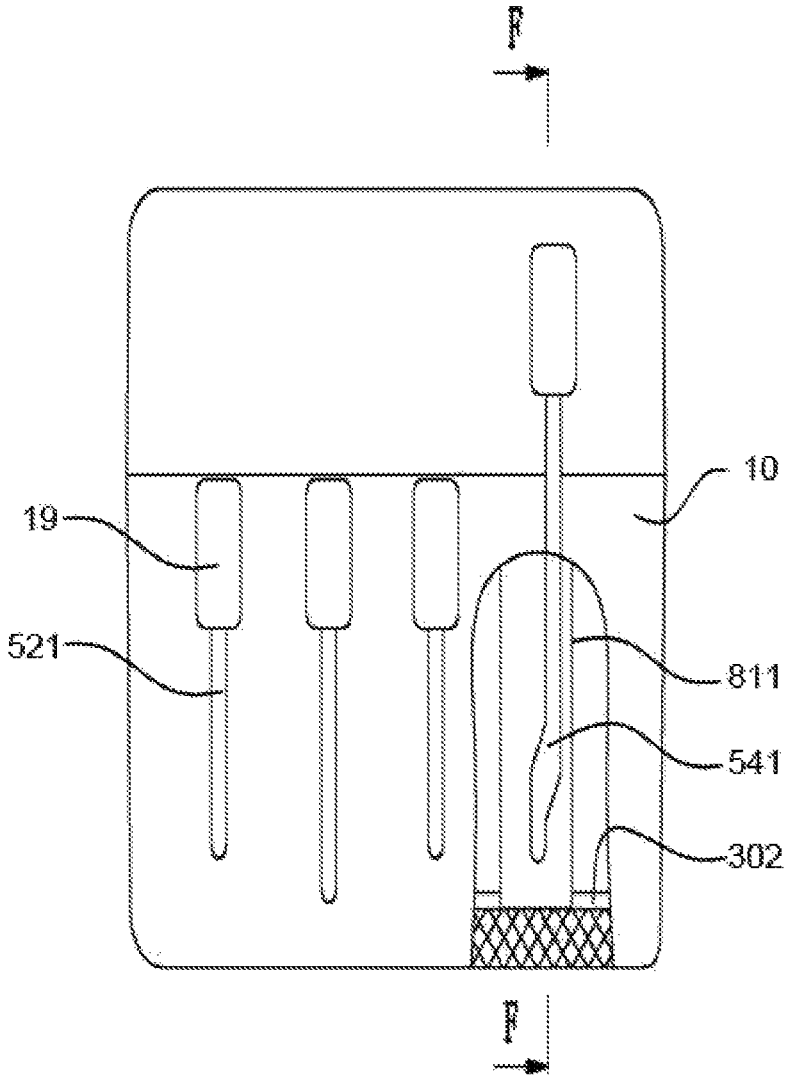
FIG. 85 is schematic diagram showing a part of the structure of a travel adapter according to a preferred embodiment of the invention.
Figure 86:
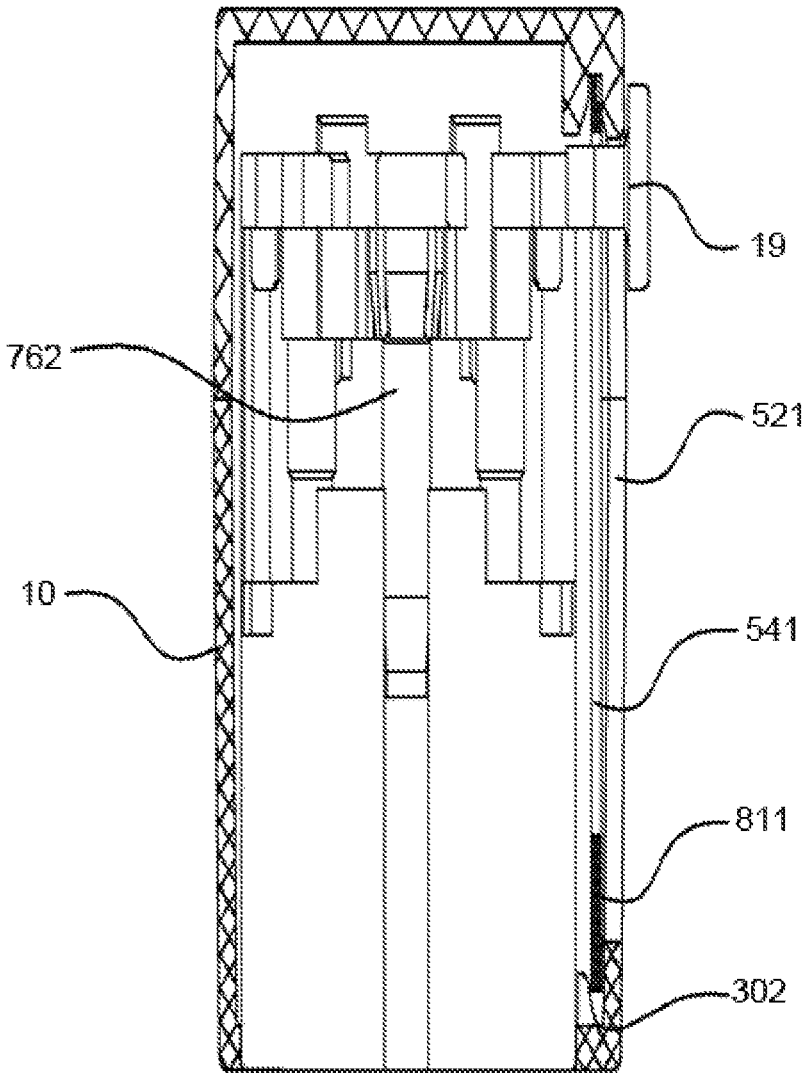
FIG. 86 is a schematic diagram showing a sectional structure along F-F in FIG. 85 according to a preferred embodiment of the invention.
Figure 87:
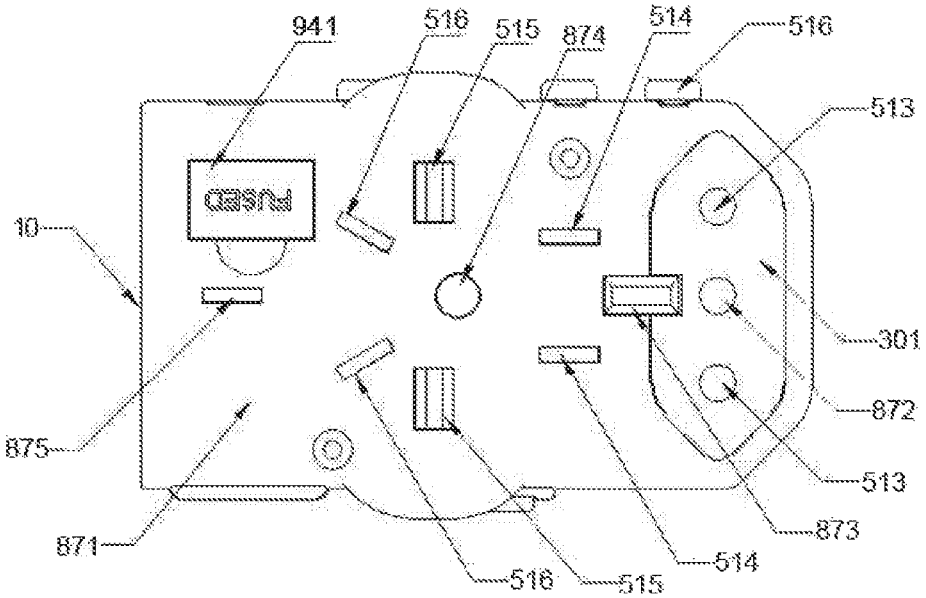
FIG. 87 is a schematic diagram showing a structure for switching the plugs in a travel adapter according to a preferred embodiment of the invention.
Figure 88:
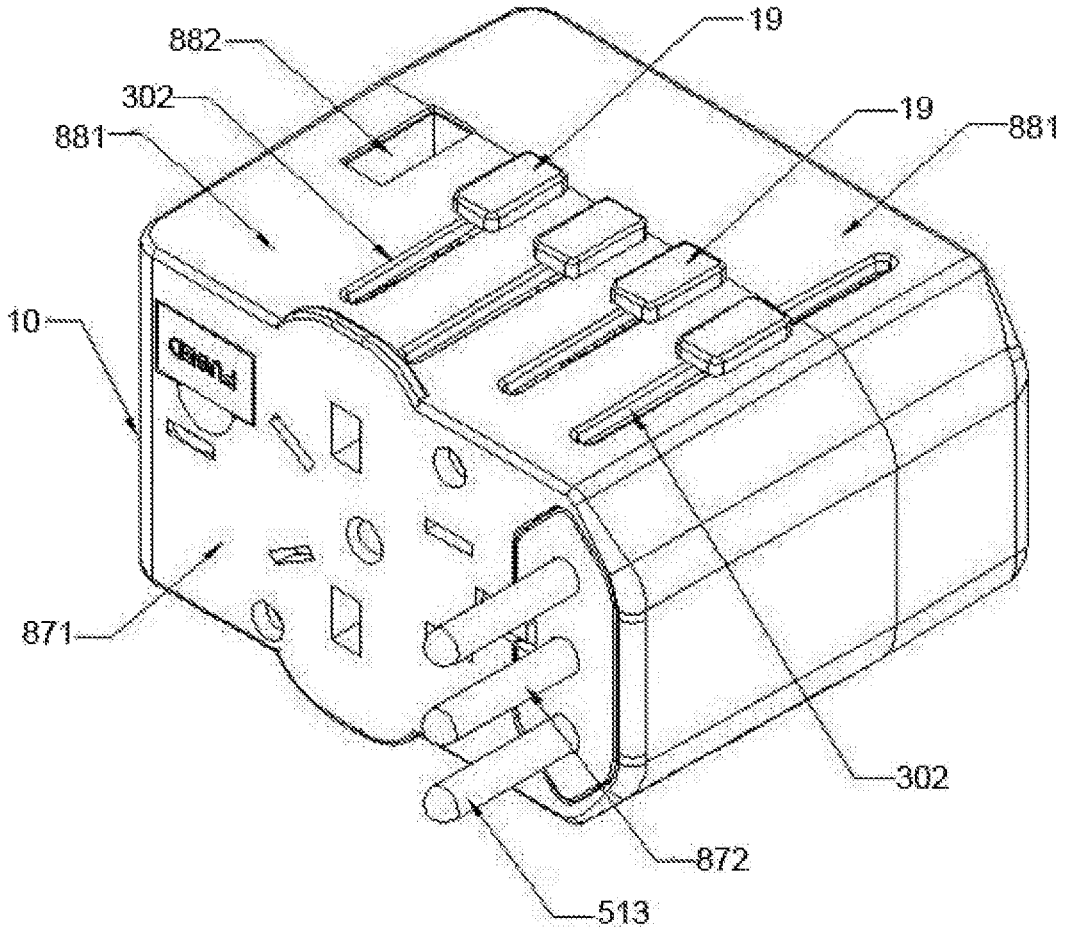
FIG. 88 is a schematic stereoscopic view based on FIG. 87 according to a preferred embodiment of the invention.
Figure 89:
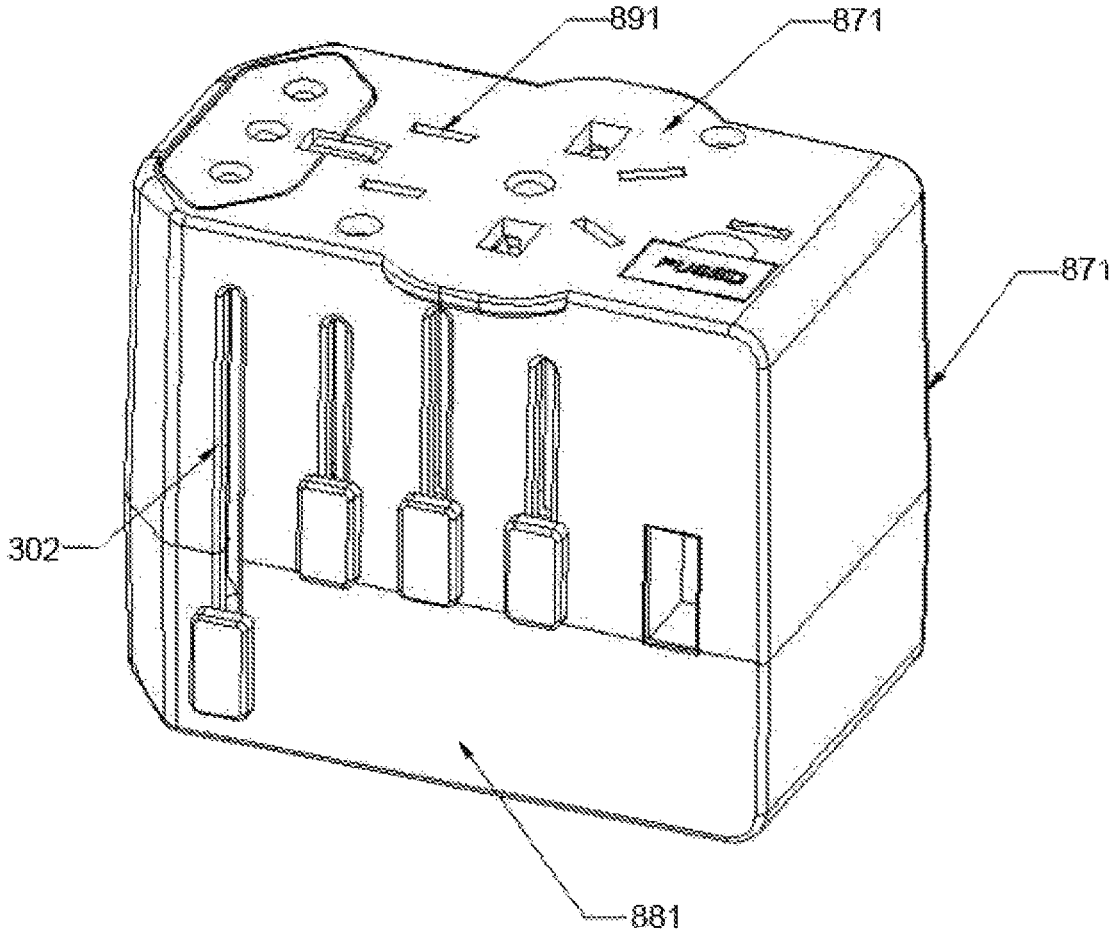
FIG. 89 is a schematic stereoscopic view when plugs of multiple countries are hidden in a plug distribution plane according to a preferred embodiment of the invention.
Figure 90:
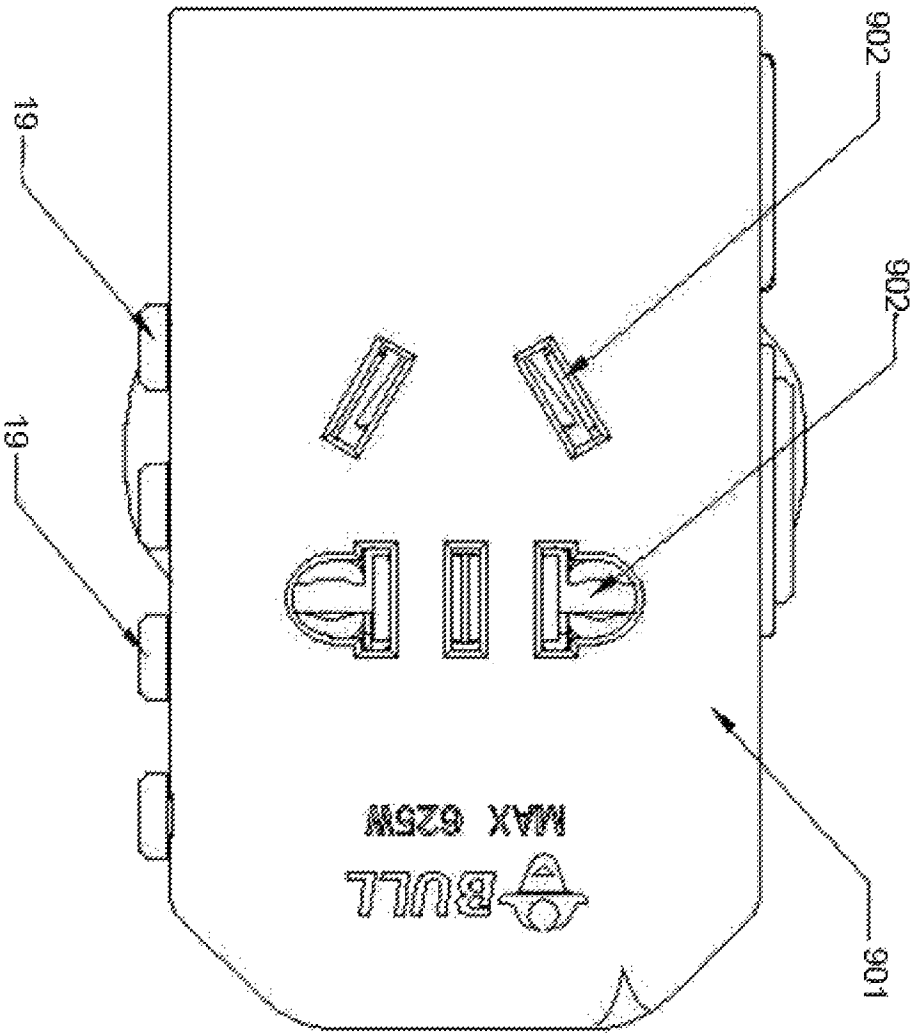
FIG. 90 is a structural representation of a travel adapter viewed from a bottom plane according to a preferred embodiment of the invention.
Figure 91:
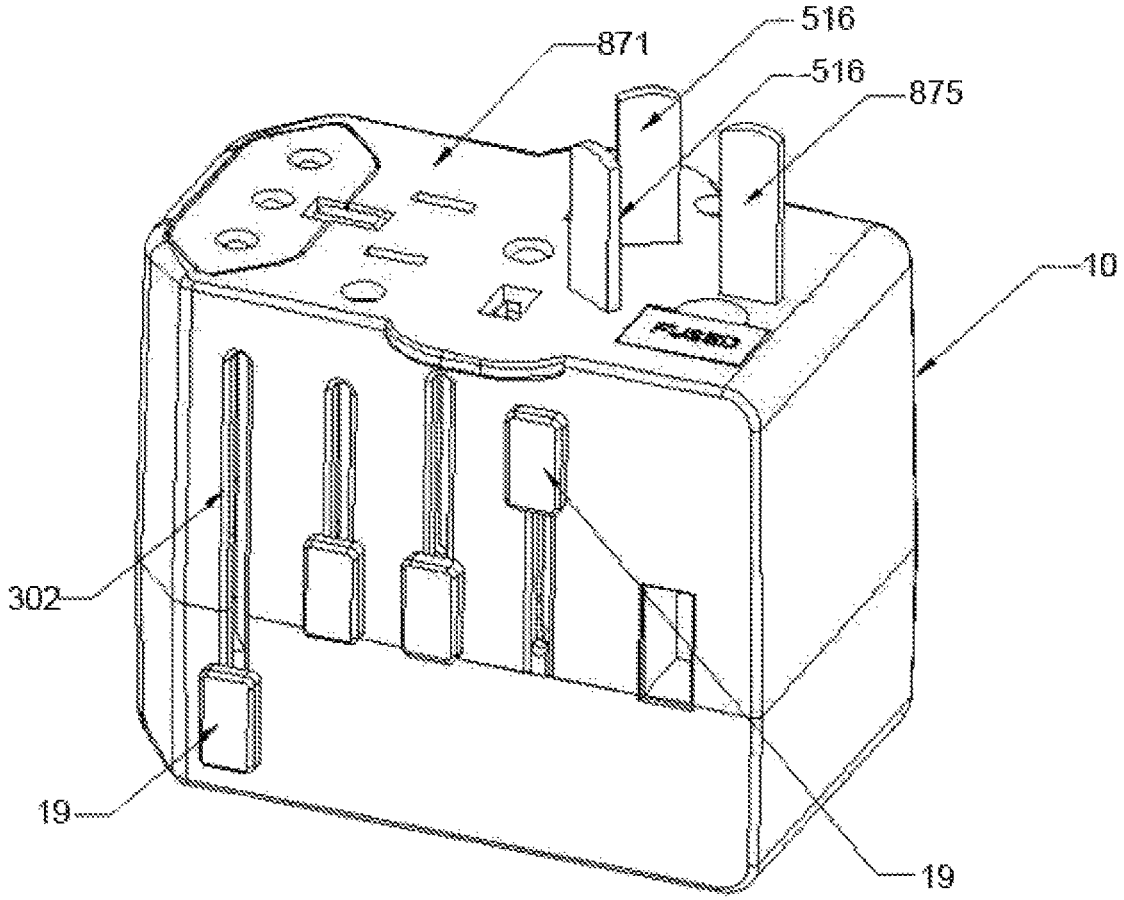
FIG. 91 is structural representation viewed after an Australian Standard plug protrudes from a plug distribution plane according to a preferred embodiment of the invention.
Figure 92:
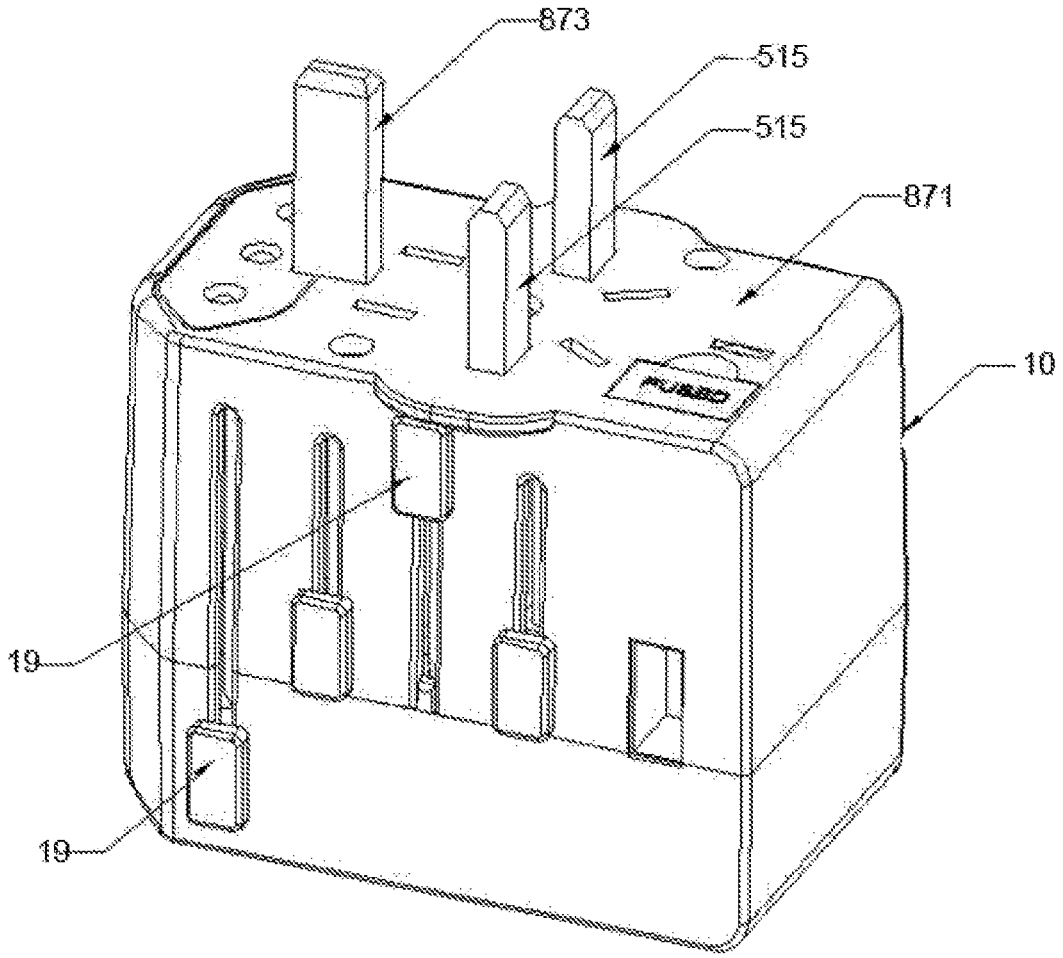
FIG. 92 is structural representation viewed after a British Standard plug protrudes from a plug distribution plane according to a preferred embodiment of the invention.
Figure 93:
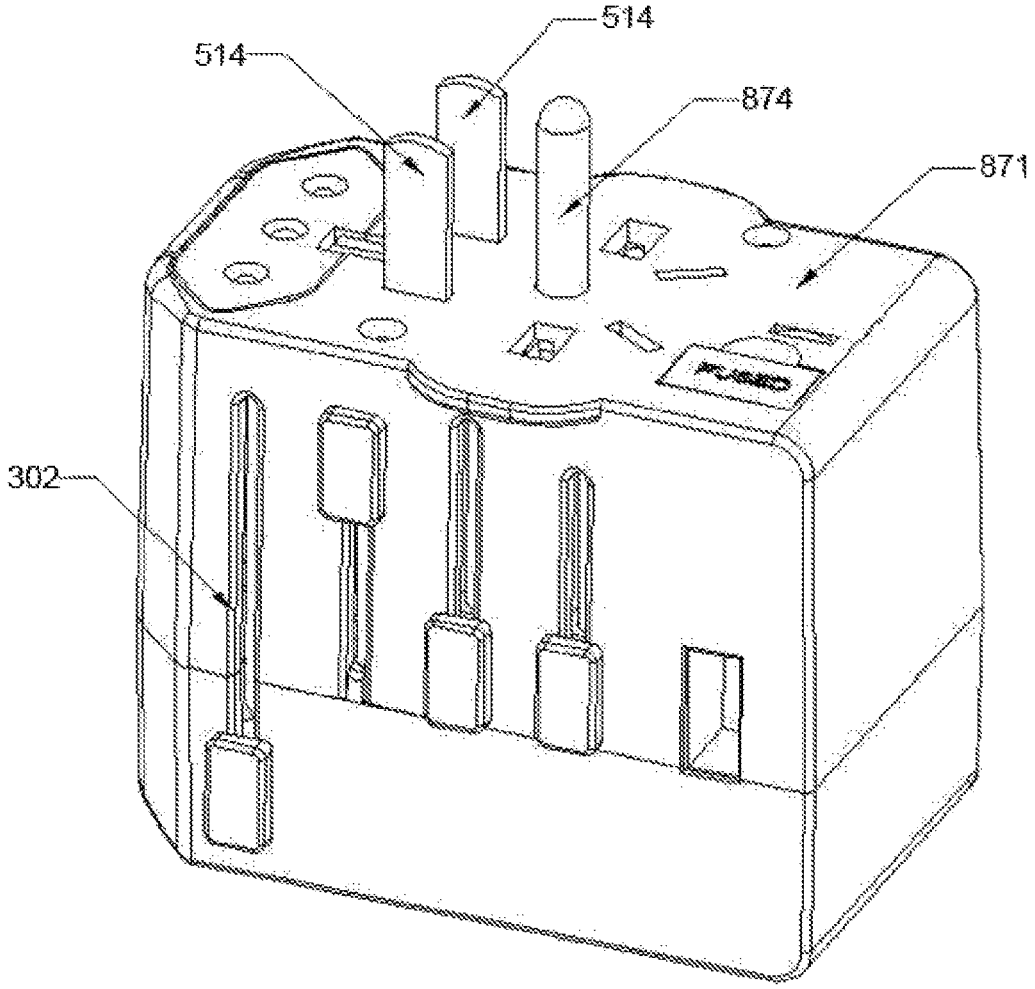
FIG. 93 is structural representation viewed after an American Standard plug protrudes from a plug distribution plane according to a preferred embodiment of the invention.
Figure 94:
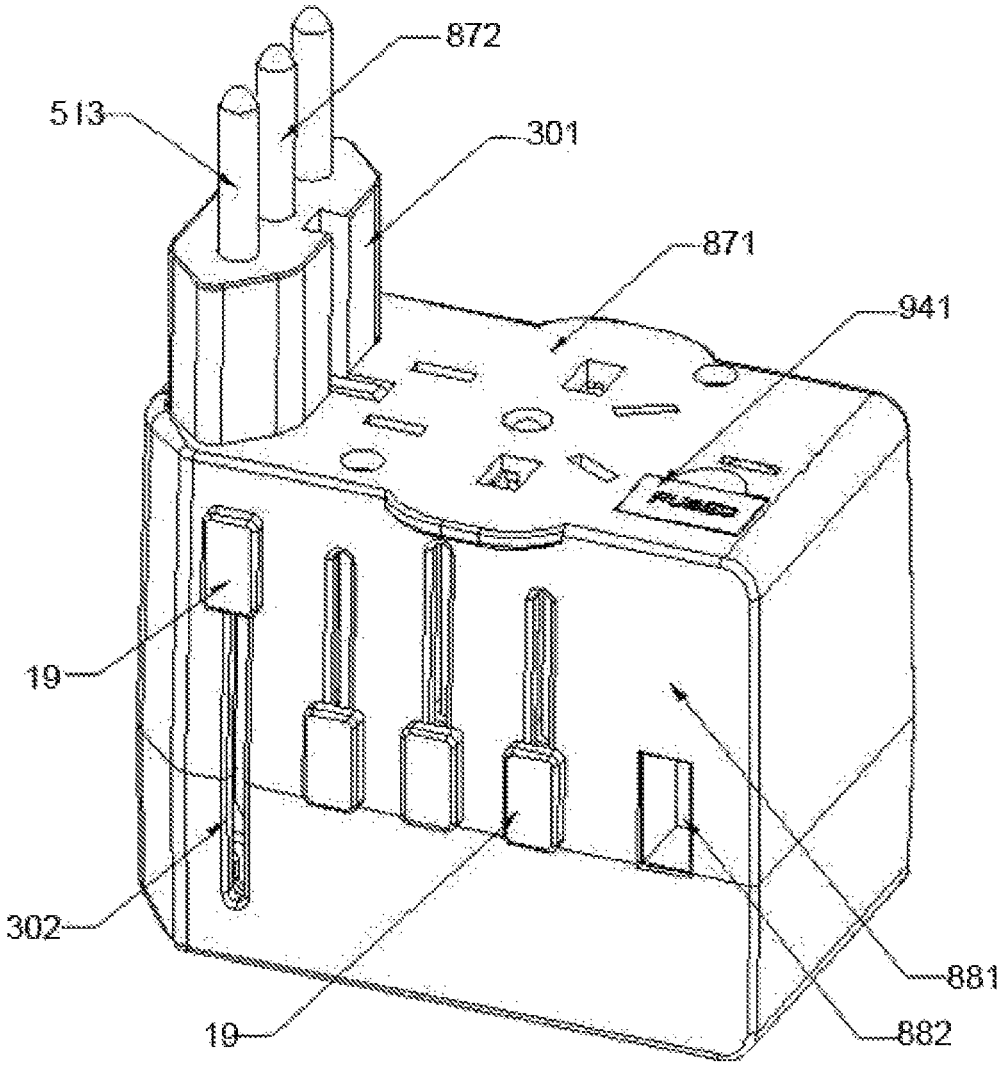
FIG. 94 is structural representation viewed after a European Standard plug protrudes from a plug distribution plane according to a preferred embodiment of the invention.

Based on the technical solutions, as shown in FIGS. 85-86, the anti-electric-shock barrier includes four baffles for the probe 771 provided in the housing 10. The baffles for the probe 771 correspond to the first slideways 521 one to one. The baffle for the probe 771 is located between the corresponding plug 762 and the first slideway 521 and is adjacent to the first slideway 521. The housing 10 is provided with a sliding slot 302 vertical to the first slideway 521. The sliding slot 302 of this embodiment is preferably a straight sliding slot 302. The sliding slot 302 is parallel to the lateral side of the housing 10 in which the first slideway 521 exists. The sliding slot 302 extends along a left-right direction. The baffle for the probe 771 is provided in the sliding slot 302, and the baffle for the probe 771 may move along the sliding slot 302. The baffle for the probe 771 is provided with a second slideway 541 corresponding to the first slideway 521. The second slideway 541 successively includes, from top to bottom, an upper slideway, an inclined slideway and a lower slideway. The upper slideway and the lower slideway are parallel to the first slideway 521. The inclined slideway intersects the first slideway 521. The slide button 19 passes through the second slideway 541 corresponding to the baffle for the probe 771. The slide button 19 may slide up and down along the second slideway 541 and drive the baffle for the probe 771 to slide right and left at the same time. Reference may be made to FIG. 84 for the specific structure of this embodiment.

Embodiment 32

Based on the technical solutions, as shown in FIGS. 87-93, the housing 10 of the travel adapter further has a plug distribution surface, and a retractable plug is provided inside the housing 10. The retractable plug may stretch out of and draw back into the housing 10 via the plug distribution surface, that is, it may protrude from the housing 10 via the plug distribution surface or retract into the housing 10.

In this embodiment, the retractable plug specifically includes a British Standard plug 515 with a ground pin 873, and it further includes an American Standard plug 514 with a ground pin 874 or an Australian Standard plug 516 with a ground pin 875, and the American Standard plug 514 or the Australian Standard plug 516 are overall distributed between the ground pin 873 and the LN pins of the British Standard plug 515.

In this embodiment:

When the American Standard plug 514 is overall distributed between the ground pin 873 and the LN pins of the British Standard plug 515, the ground pin 874 of the American Standard plug 514 is provided facing away from the ground pin 873 of the British Standard plug 515.

When the Australian Standard plug 516 is overall distributed between the ground pin 873 and the LN pins of the British Standard plug 515, the ground pin 875 of the Australian Standard plug 516 is provided facing away from the ground pin 873 of the British Standard plug 515.

Correspondingly, the ground pin of the American Standard plug 514 or the Australian Standard plug 516 is distributed in an opposite direction facing away from the ground pin 873 of the British Standard plug 515.

The housing 10 in this embodiment overall has a rectangular column structure. The Australian Standard plug 516, the British Standard plug 515, the American Standard plug 514 and the European Standard plug 513 are successively arranged in parallel in the same plug distribution plane 871 of the housing 10. In the plug distribution plane 871, when the American Standard plug 514 is overall distributed between the ground pin 873 and the LN pins of the British Standard plug 515, the Australian Standard plug 516 and the European Standard plug 513 will be respectively distributed on the two opposite sides of the British Standard plug 515, the British Standard plug 515 will be mounted on the inside closely adjacent to the Australian Standard plug 516, and the ground pin 873 of the British Standard plug 515 will be provided facing away from the ground pin 875 of the Australian Standard plug 516, and the ground pin 873 of the British Standard plug 515 will be arranged at a position facing away from the Australian Standard plug 516 and facing the European Standard plug 513. A vertically-distributed structure is formed between the ground pin 873 of the British Standard plug 515 and the L\N connection line. The ground pin 874 of the American Standard plug 514 is provided facing the Australian Standard plug 516, and the Australian Standard plug 516, the British Standard plug 515, the American Standard plug 514 and the ground pins thereof are provided at positions on the same straight line, which is on the length-direction central position line of the plug distribution plane 871, that is, the ground pins of various plugs, i.e., the Australian Standard ground pin 875, the British Standard ground pin 873 and the American Standard ground pin 874, are provided at positions on the same straight line. The plug distribution plane 871 is provided with guide holes 891 for various plugs. Four sliding slots 302 are distributed on the same lateral side 881 of the housing 10, and each sliding slot 302 is respectively provided with a sliding bar connected to the respective plug correspondingly. The tail end of the sliding bar is provided with a slide button 19. Each sliding bar is connected to control the protruding and hiding of the pins of one plug. The slide button 19 protrudes out of the sliding slot 302 on the lateral side 881 of the housing 10. When the slide button 19 is slided to the direction facing the plug distribution plane 871, the pins of the corresponding hidden plug protrude from the plug distribution plane 871 (as shown in FIGS. 91-94). The bottom plane 901 of the adapter opposite to the plug distribution plane 871 is provided with a socket pin hole 902 (see FIG. 90), and the socket pin hole 902 may be switched to connect with the four plugs inside the housing 10 electrically.

In this embodiment, the plug distribution plane 871 is provided with a safety cover 941, and the safety cover 941 is provided with a protector tube or a fuse as a safety element for the operating power of the travel adapter. The safety cover 941 is provided at a side edge position of the ground pin 875 of the Australian Standard plug 516 for improving the security in use and the accessibility of user maintenance, thereby improving the life time and lowering the cost of use.

In this embodiment, the lateral side 881 of the housing 10 is provided with a USB socket 882, which is distributed vertical to the retractable plug. When the American Standard plug 514 is overall distributed between the ground pin 873 and the LN pins of the British Standard plug 515 and the ground pin 874 of the American Standard plug 514 is distributed opposite to the ground pin 873 of the British Standard plug 515, the USB socket 882 is provided on the lateral side 881 of the housing 10 that is adjacent to the side of the ground pin 875 of the Australian Standard plug 516, and is distributed vertical to the ground pin 875 of the Australian Standard plug 516.

Further, the USB socket 882 is jointly distributed with three sliding slots 302 on the same lateral side 881 of the housing 10 to improve the convenience in operation. The ground pins of various plugs are distributed at positions on the same straight line, which is more favorable for mounting and arranging the internal electric connection and electric switching structure, thereby improving the safety, reliability and stability during the switching of the plug. At the same time, it is more reasonable to distribute and mount various plugs at the positions on the same plug distribution plane 871.

Embodiment 33

Based on the technical solutions, the retractable plug further includes an European Standard plug 513, which is located on the side on which the ground pin 873 of the British Standard plug 515 exists. Moreover, the plug assembly 301 of the European Standard plug 513 is provided with a groove notch corresponding to the ground pin 873 of the British Standard plug 515, and the ground pin 873 of the British Standard plug 515 is at least partially embedded in the groove notch. Moreover, the Australian Standard plug 516, the British Standard plug 515, the American Standard plug 514 and the ground pins of the four plugs are provided at positions on the same straight line, that is, the ground pins of the four plugs, i.e., the Australian Standard ground pin 875, the British Standard ground pin 873, the American Standard ground pin 874 and the European Standard ground pin 872 are distributed at positions on the same straight line.

In this embodiment, in the plug distribution plane 871 when the American Standard plug 514 is overall distributed between the ground pin 873 and the LN pins of the British Standard plug 515, the Australian Standard plug 516 and the European Standard plug 513 will be respectively distributed on the two opposite sides of the British Standard plug 515, and the ground pin 875 of the Australian Standard plug 516 will be mounted on the outmost edge. The ground pin 875 of the Australian Standard plug 516 and the European Standard plug 513 are distributed at two outer edge positions that is nearest to the plug distribution plane 871. The European Standard plug 513 is provided with a plug assembly 301, the plug pins are provided on the same plug assembly 301, and the plug assembly 301 is connected with the sliding bar, thus the overall compatibility, stability and reliability in use of the European Standard plug 513 may be improved.

In this embodiment, the plug assembly 301 on the European Standard plug 513 is provided with a vertical groove notch, the opening of the groove notch faces the British Standard plug 515, and the ground pin 873 of the British Standard plug 515 is partially embedded in the vertical groove, thus a mounting structure in which the ground pin 873 of the British Standard plug 515 partially intersects the plug assembly 301 on the European Standard plug 513 spatially is formed.

In this embodiment, the length of the sliding slot 302 corresponding to the European Standard plug 513 is larger than the lengths of the other three sliding slots 302. When the slide button 19 on the sliding bar thereof is moved to the lowest part of the sliding slot 302, the head of the plug pin of the European Standard plug 513 and the plug assembly 301 are both hidden in the plug distribution plane 871, thus the reliability and accessibility of the adjustment operation on the European Standard plug 513 may be improved.

In this embodiment, the bottom of the sliding slot 302 corresponding to the European Standard plug 513 is lower than the bottoms of the other three sliding slots 302, thus the structural compactibility between the plugs of multiple countries in the travel adapter may be improve greatly, the overall size of the whole plugs of multiple countries may be lowered, and the carriability may be improved.

Embodiment 34

Based on the technical solutions, the retractable plug further includes an European Standard plug 513. The European Standard plug 513 is located on one side on which the LN pins of the British Standard plug 515 exist. The plug assembly 301 of the European Standard plug 513 is provided with a groove notch corresponding to the British Standard LN pins, and the British Standard LN pins are at least partially embedded in the groove notch.

As a preferred embodiment, the Australian Standard plug 516 may also be overall distributed between the ground pin 873 and the LN pins of the British Standard plug 515, and the American Standard plug 514 and the European Standard plug 513 may be respectively distributed on the two opposite sides of the British Standard plug 515. The American Standard plug 514 and the safety cover 941 are provided on the same side.

Embodiment 35

Based on the technical solutions, the European Standard plug 513 may be located on the side on which the LN pins of the British Standard plug 515 exist. The plug assembly 301 of the European Standard plug 513 is provided with a groove notch corresponding to the British Standard LN pins, and the British Standard LN pins are at least partially embedded in the groove notch.

Embodiment 36

Figure 104:
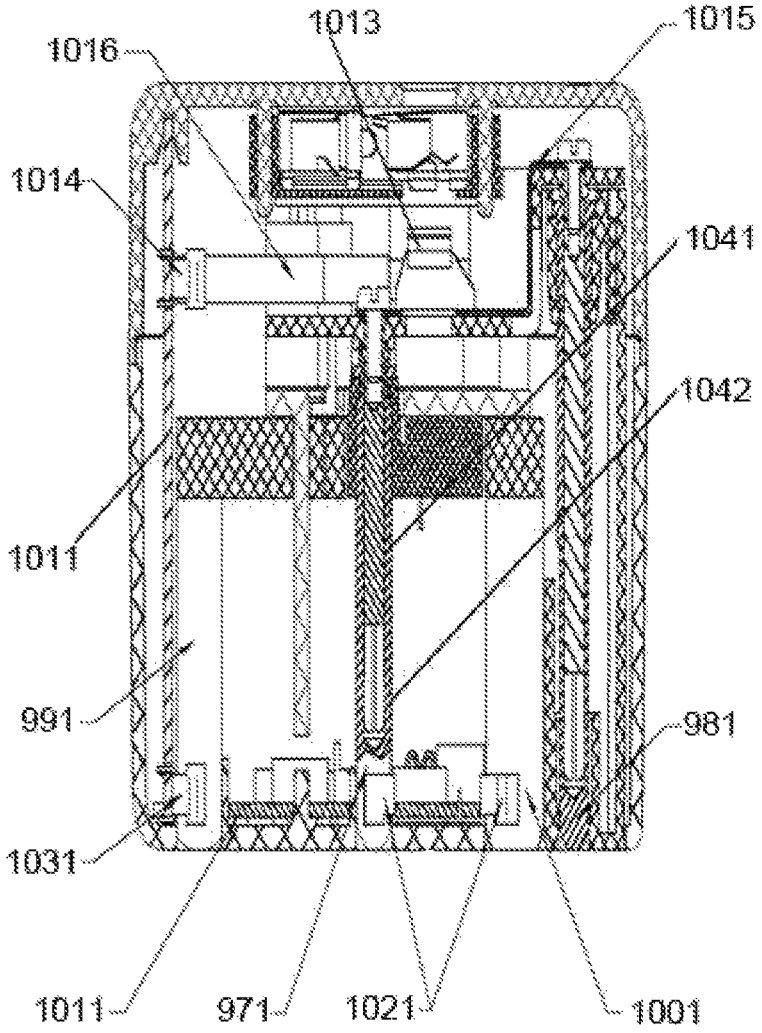
FIGS. 104-105 are schematic sectional views based on FIG. 95 according to different embodiments of the invention.

Based on the technical solutions, as shown in FIG. 104, the pin assembly included in the travel adapter specifically includes a pin base and a pin, and the pin is provided on pin base.

Then, the travel adapter further includes an American Standard plug 514 and a European Standard plug 513 that are slidably provided along the plug and unplug direction. The ground part of the American Standard plug 514 includes a retractable American Standard ground pin 971, the ground part of the European Standard plug 513 includes a retractable European Standard ground pin 981, and the American Standard ground pin 971 and European Standard ground pin 981 are both the pins included in the pin assembly.

The two retractable ground pins both include a conductive pillar 1041 (a fixed part fixed to the ground sleeve 1013) and a retractable pin head 1042. The conductive pillar 1041 is physically fixed and electrically connected with the ground sleeve 1013 via a screw. Interference fitting is realized between the conductive pillar 1041 and the inner wall of the pin head 1042 by providing an elastic convex ring on the conductive pillar 1041, and the pin head 1042 is electrically connected with the ground sleeve 1013 via the conductive pillar 1041.

In this embodiment, by designing a retractable ground pin, the ground pins of the American Standard plug 514 and the European Standard plug 513 may be adjusted between a protrusion state and a retraction state at any moment, thus it can be respectively adapted to two different sockets with or without a ground jack 961.

Embodiment 37

Figure 105:
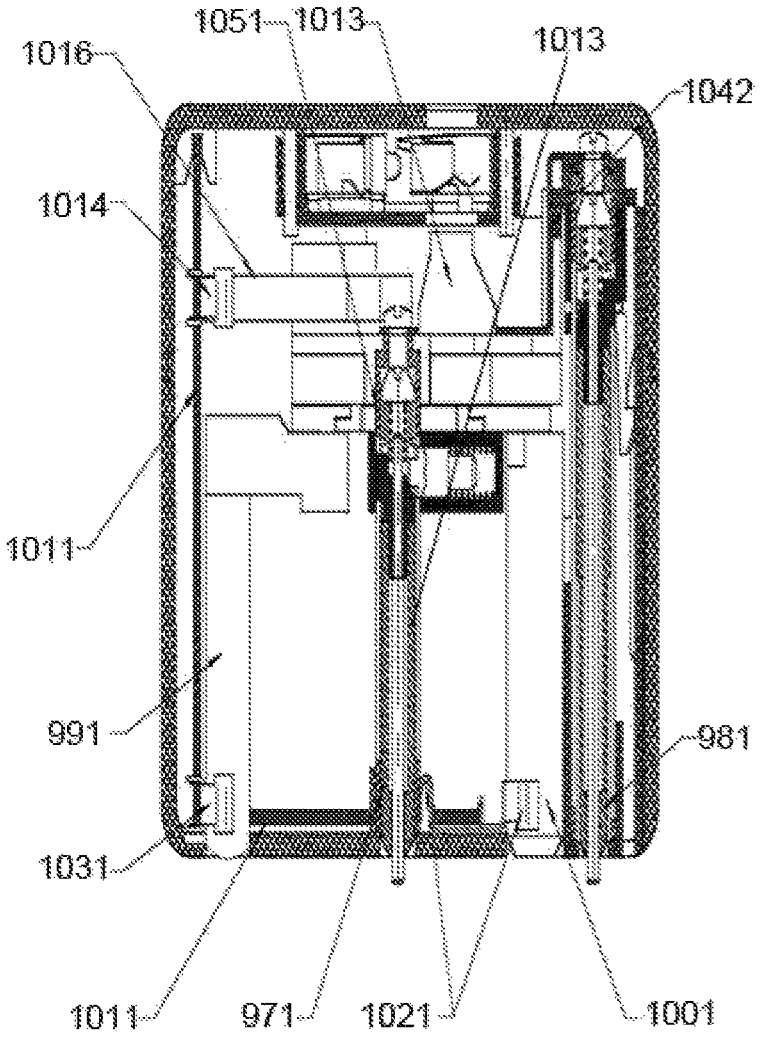

Based on the technical solutions, as shown in FIG. 105, the fixed parts of the American Standard ground pin 971 and the European Standard ground pin 981 in the travel adapter fixedly connected to the ground sleeve 1013 respectively are conductive tubes 1051. The pin head 1042 is socketed in the conductive tube 1051, and the conductive tube 1051 is fixed to the ground sleeve 1013 via a screw. In this embodiment, the outerwall of the pin head 1042 is also provided with an elastic convex ring, and interference fitting is realized between the outerwall of the pin head 1042 and the inner wall of the conductive tube 1051, so that the pin head 1042 can be electrically connected with the ground sleeve 1013 via the conductive tube 1051. In this embodiment, an elastic limit structure may also be provided on the American Standard ground pin 971 or the European Standard ground pin 981 to realize that the American Standard ground pin 971 or the European Standard ground pin 981 can have a strength large enough to be inserted into the jack 961 of the power socket while having an independent retractility.

Embodiment 38

Figure 95:
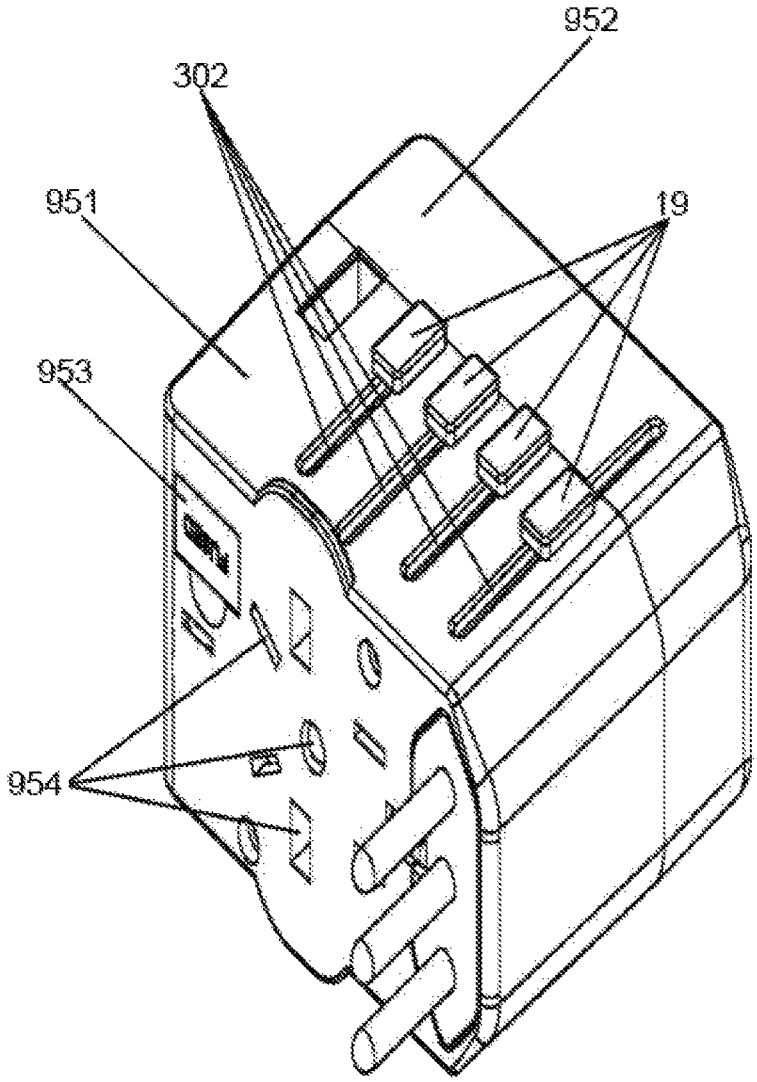
FIG. 95 is a structural representation showing the switching of plugs in a travel adapter according to a preferred embodiment of the invention.
Figure 96:
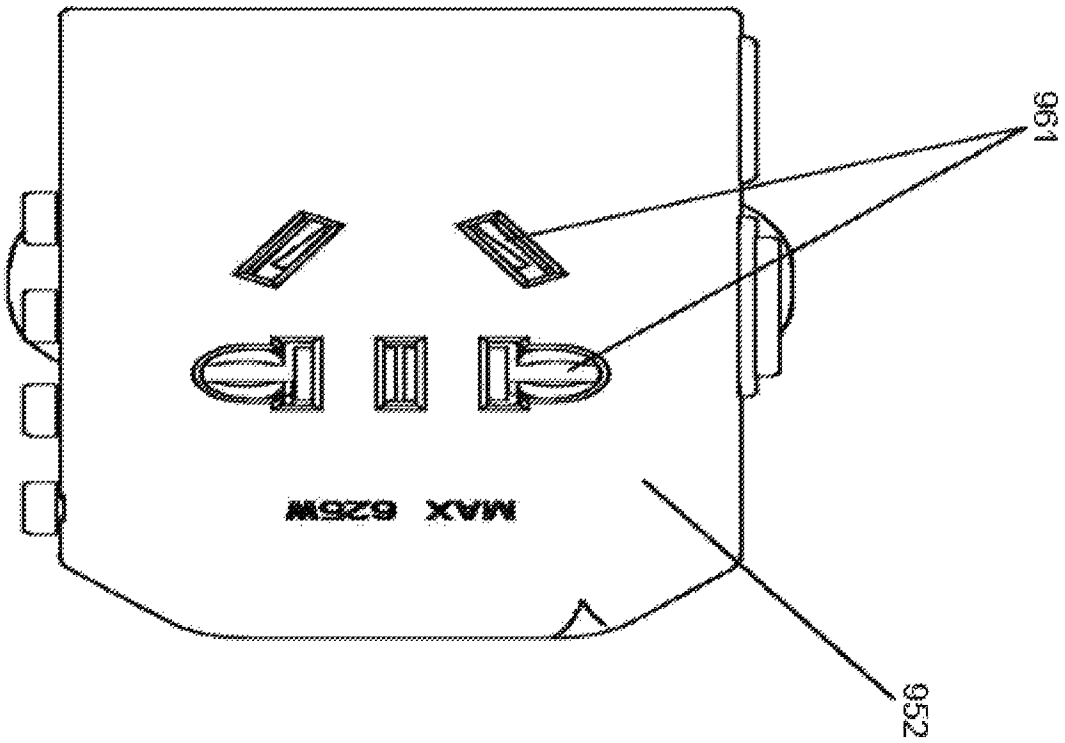
FIG. 96 is a side view based on FIG. 95 according to a preferred embodiment of the invention.
Figure 97:
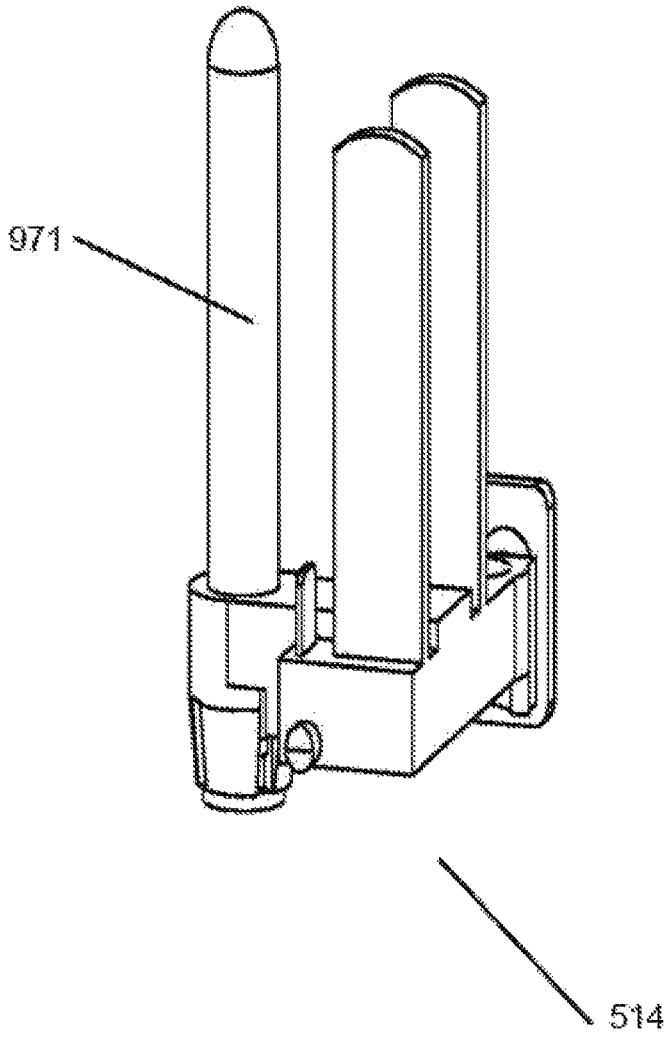
FIG. 97 is a structural representation of an American Standard plug during the plug switching according to a preferred embodiment of the invention.
Figure 98:
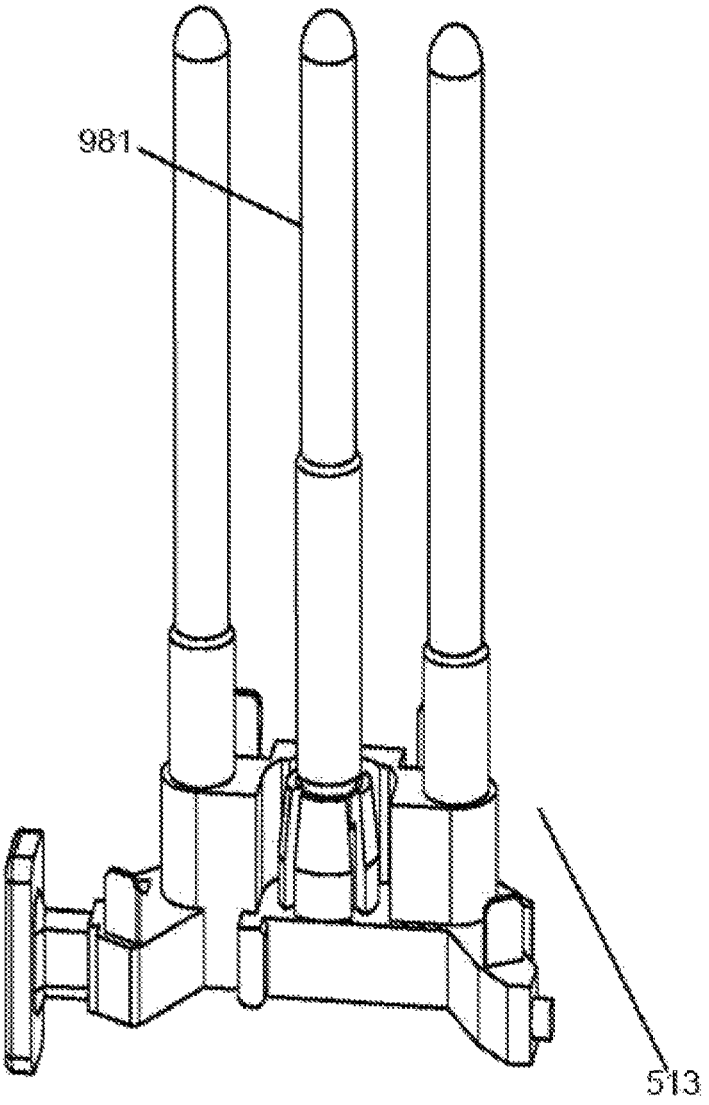
FIG. 98 is a structural representation of a European Standard plug during the plug switching according to a preferred embodiment of the invention.
Figure 99:
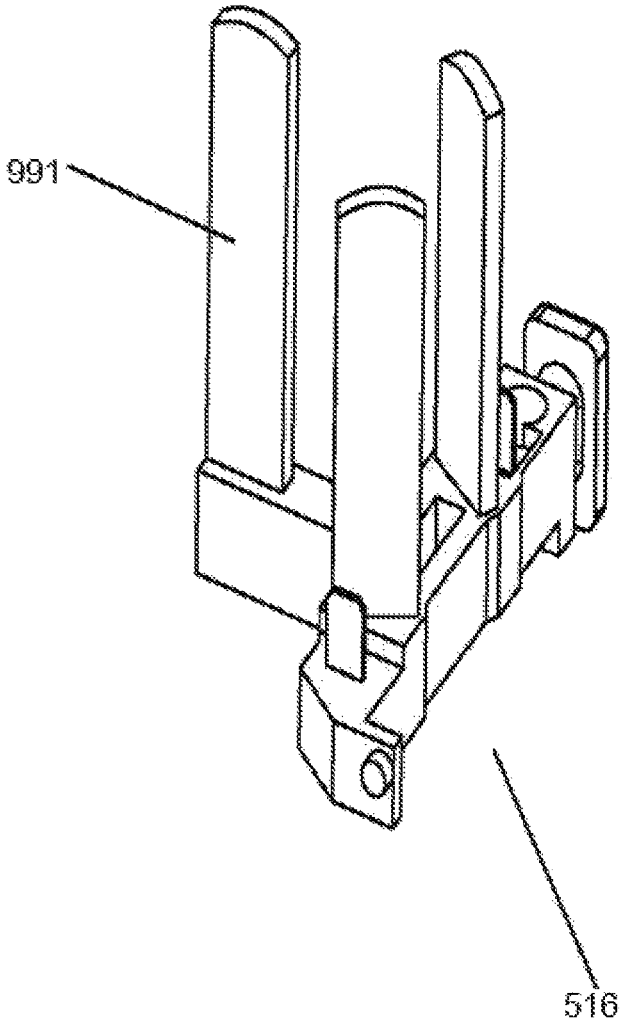
FIG. 99 is a structural representation of an Australian Standard plug during the plug switching according to a preferred embodiment of the invention.
Figure 100:
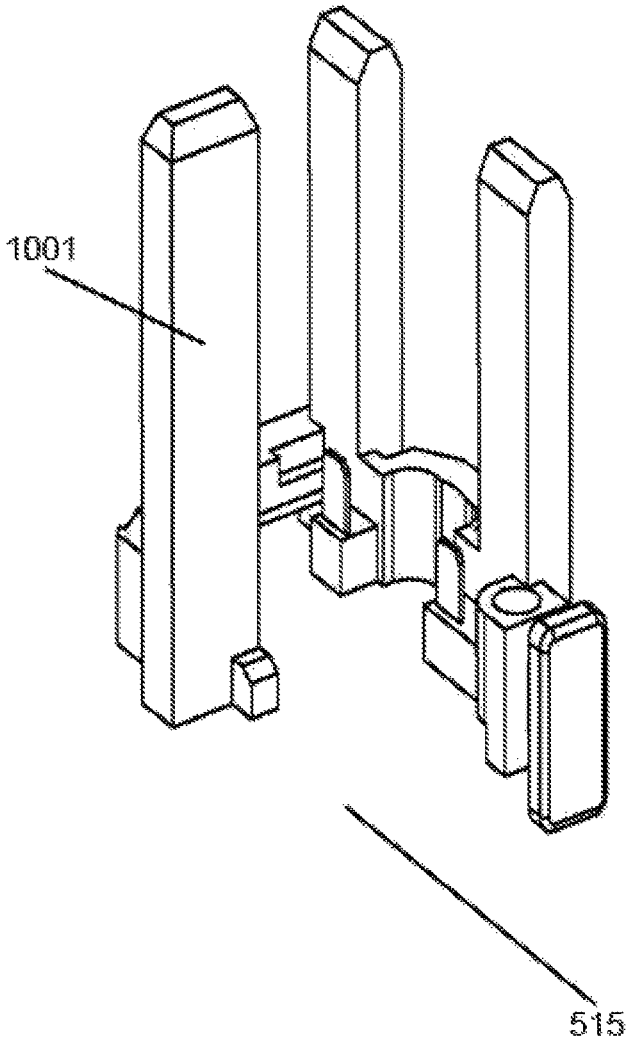
FIG. 100 is a structural representation of a British Standard plug during the plug switching according to a preferred embodiment of the invention.

Based on the technical solutions, as shown in FIGS. 95-96, the housing of the travel adapter specifically includes a front cover 951 and a back cover 952. The back cover 952 is provided with a jack 961 meeting the Chinese Standard. The front cover 951 and the back cover 952 are buckled to form a cavity, in which an American Standard plug 514 (as shown in FIG. 97), a European Standard plug 513 (as shown in FIG. 98), an Australian Standard plug 516 (as shown in FIG. 99) and a British Standard plug 515 (as shown in FIG. 100) are slidably provided respectively.

In this embodiment, the front cover 951 is provided with plug through holes 954 adapting the plugs of the four different standards, and is provided with four sliding slots 302 parallel to the plug and unplug direction of each plug respectively. Each plug is connected via a connecting part to a slide button 19 provided outside the sliding slot 302, and the connecting handle of the slide button 19 is slidably connected with the sliding slot 302, wherein the connecting handle of the slide button 19 of the European Standard plug 513 on the topmost is long, and correspondingly, the sliding slot 302 adapting the European Standard plug 513 extends backward to the back cover 952.

In this embodiment, the travel adapter is further provided with a fuse 953, which is connected in the middle of the L output circuit.

In this embodiment, as shown in FIG. 104, the ground part of the American Standard plug 514 includes a retractable American Standard ground pin 971, the ground part of the European Standard plug 513 includes a retractable European Standard ground pin 981, and the American Standard ground pin 971 and European Standard ground pin 981 are both the pins included in the pin assembly.

The two retractable ground pins both include a conductive pillar 1041 and a retractable pin head 1042. The ground sleeve 1013 is provided with a first extension arm 1015. The conductive pillar 1041 of the American Standard ground pin 971 is physically fixed and electrically connected with the ground sleeve 1013 via a screw (thus, a fixed part fixedly connected with the ground sleeve 1013 is formed). The conductive pillar 1041 of the European Standard ground pin 981 is physically fixed and electrically connected with the first extension arm 1015 via a screw (thus, a fixed part fixedly connected with the ground sleeve 1013 is also formed).

The conductive pillar 1041 is provided with an elastic convex ring for realizing interference fitting with the inner wall of the pin head 1042, and the pin head 1042 is electrically connected with the ground sleeve 1013 via the conductive pillar 1041.

Figure 101:
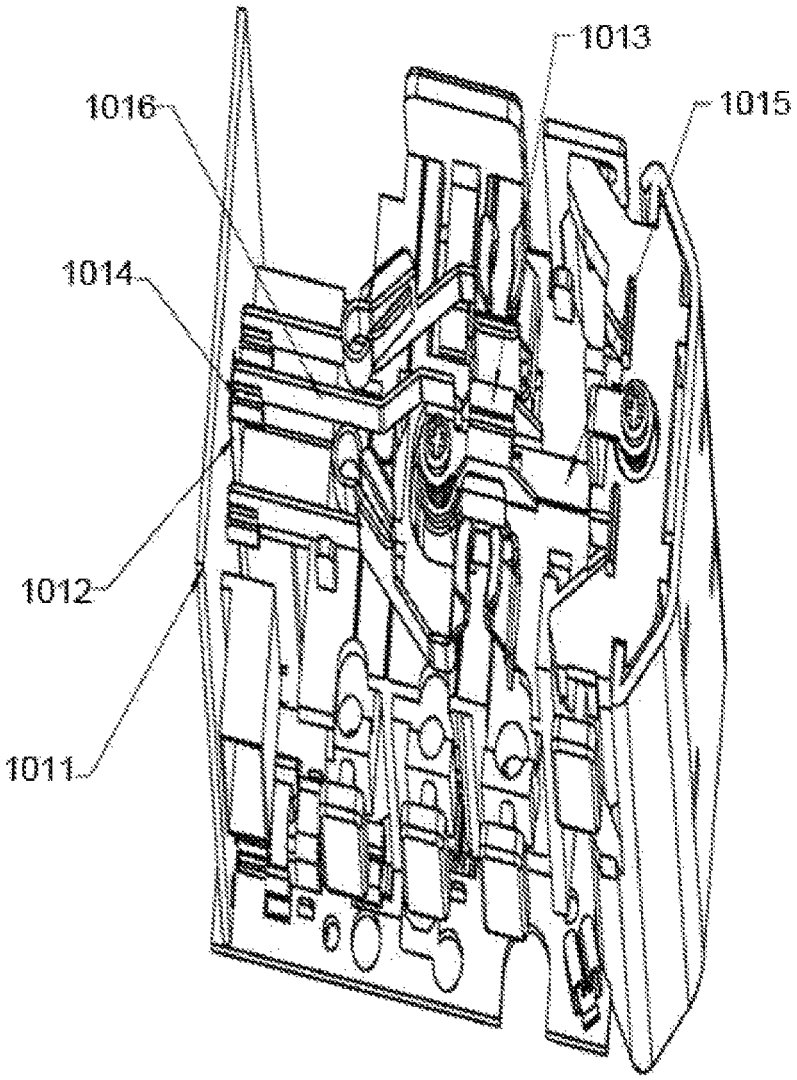
FIG. 101 is a schematic diagram showing a connection relation between a ground sleeve and a conductive plate according to a preferred embodiment of the invention.

In this embodiment, as shown in FIG. 101, a conductive plate 1011 is further fixed in the cavity. In this embodiment, a conductive PCB board is selected, and the conductive plate 1011 is provided with a connecting copper foil 1012, on which a ground sleeve connection spring leaf 1014 is elastically held. The ground sleeve 1013 is further provided with a second extension arm 1016, and the ground sleeve connection spring leaf 1014 is provided on the end part of the second extension arm 1016, so that the ground sleeve 1013 can be electrically connected with the conductive plate 1011.

Figure 102:
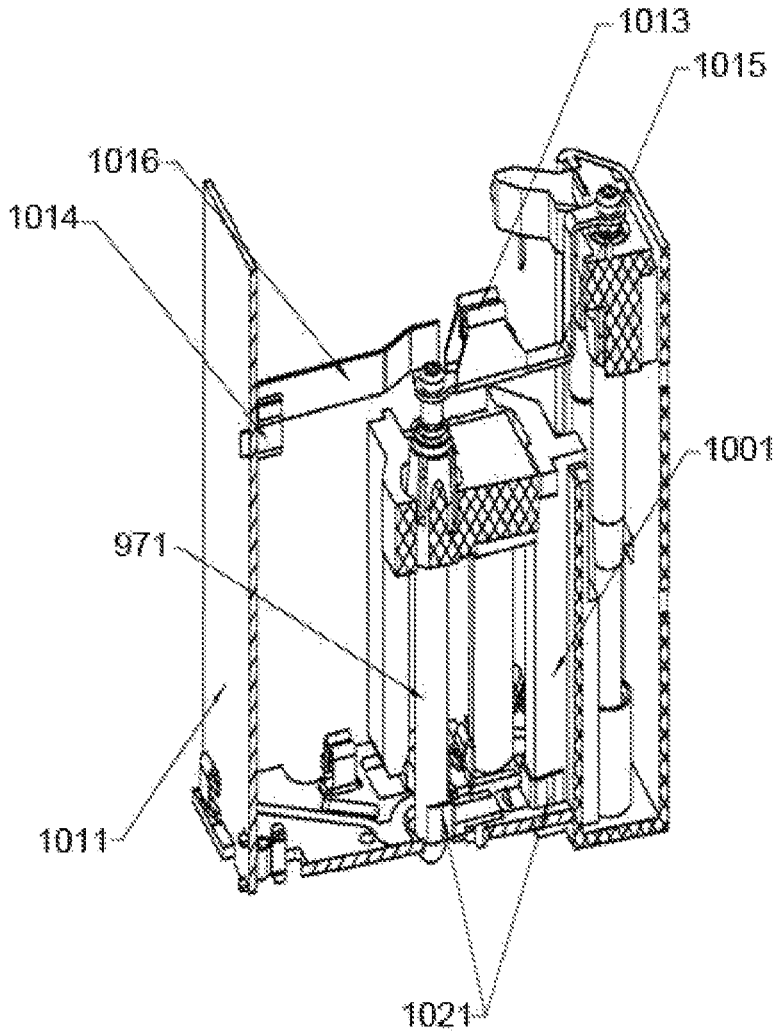
FIG. 102 is a schematic diagram showing a connection relation between an American Standard plug, a British Standard plug, a ground sleeve and a conductive plate according to a preferred embodiment of the invention.

As shown in FIG. 102, the ground part of the British Standard plug 515 includes a British Standard ground pin 1001. The British Standard ground pin 1001 is a non-retractable ground pin, which is connected with the American Standard ground pin 971 via a second connection spring leaf 1021 made of copper, so that ground interconnection with the American Standard ground pin 971 may be realized, and the American Standard ground pin 971 has already been electrically connected on the ground sleeve 1013 via a screw. The second connection spring leaf 1021 is fixed on the conductive plate 1011 to avoid displacement.

Figure 103:
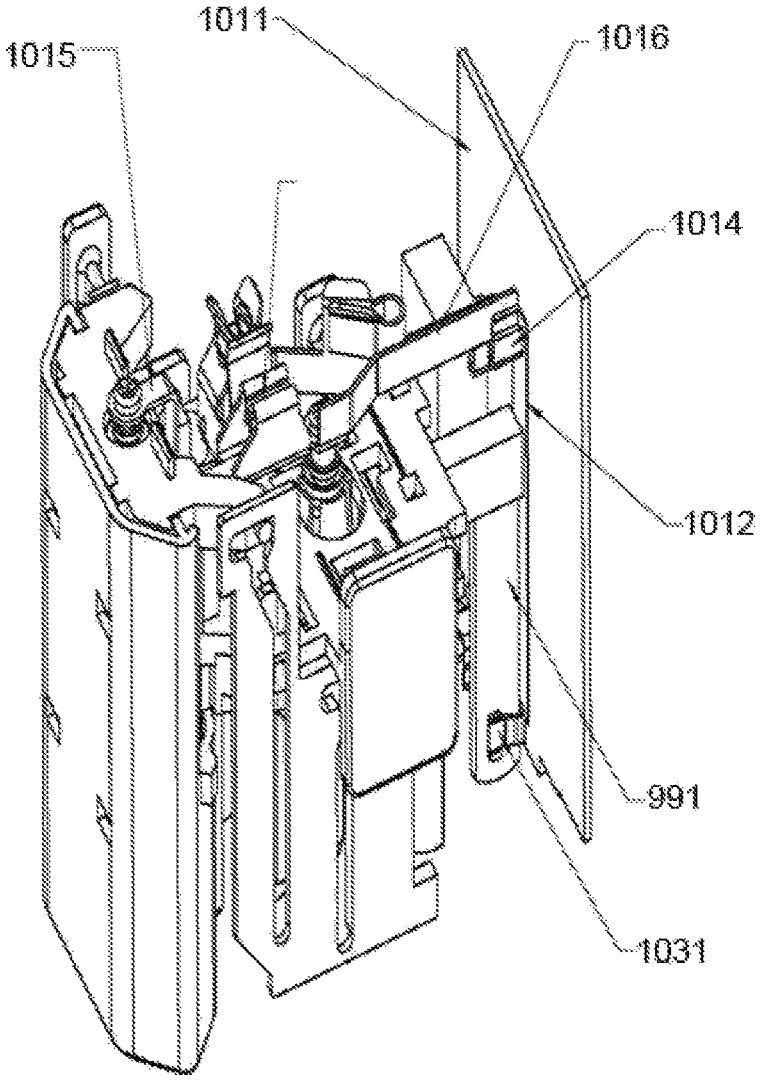
FIG. 103 is a schematic diagram showing a connection relation between an Australian Standard plug, a ground sleeve and a conductive plate.

As shown in FIG. 103, the ground part of the Australian Standard plug 516 includes an Australian Standard ground pin 991. The Australian Standard ground pin 991 is a non-retractable ground pin, which is elastically held on the connecting copper foil 1012 of the conductive plate 1011 via a first connection spring leaf 1031 made of copper, so that ground interconnection with the ground sleeve 1013 can be realized. The first connection spring leaf 1031 is also fixed on the conductive plate 1011 to avoid displacement.

Then, based on the embodiment, when the travel adapter including a plurality of plugs respectively corresponding to standards of different countries is to be used, it should be determined firstly which national standard the socket belongs to and whether it has a ground jack, then the corresponding plug is slided from the travel adapter by moving the slide button 19 corresponding to the plug as required to adapt the power socket. If the power socket has the corresponding ground jack, the travel adapter may provide reliable ground protection via the corresponding ground pin. If it is a socket without ground jacks (for example, a socket of Japanese standard, French standard or German standard), the corresponding retractable ground pin may be slided to retract the ground pin into the adapter and leave only the L pin and the N pin for adaption, and hence powering and switching may be realized successfully.

The travel adapter is provided with four sets of plugs, which can directly adapt grounded sockets of American Standard, European Standard, Australian Standard and British Standard. By retracting the ground pin, ungrounded sockets of Japanese Standard, French Standard and German Standard, etc., may be adapted, and hence socket standards of major countries in the world may be covered. Moreover, the travel adapter can provides ground protection to electrical appliances connected thereto so long as the socket provides a ground jack.

Embodiment 39

Figure 106:
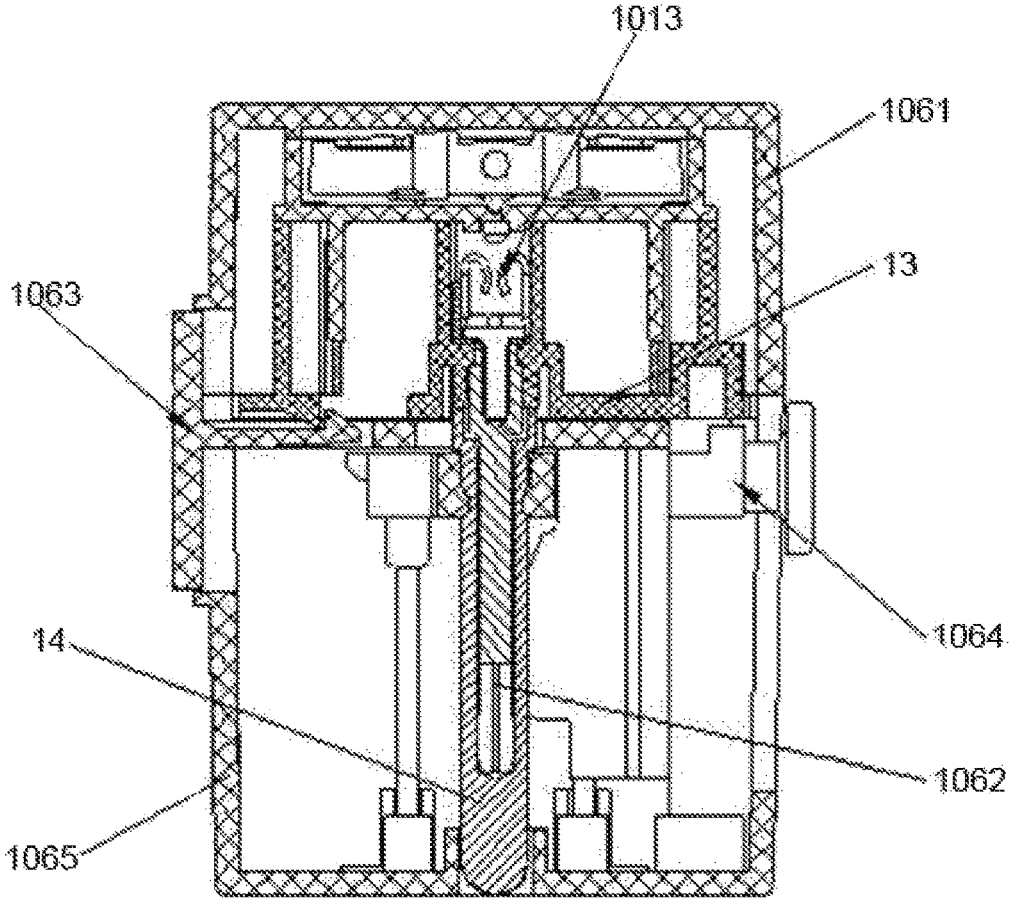
FIG. 106 is a structural representation of a pin in a travel adapter according to a preferred embodiment of the invention.

Based on the technical solutions, as shown in FIG. 106, the housing is consisted of an upper housing 1061 and a lower housing 1065 buckled to each other. The external surfaces of the upper housing 1061 and the lower housing 1065 are respectively provided with sockets corresponding to each pin, and one edge of the sidewall of the lower housing 1065 is provided with a button notch fitting a control button 1063 on the travel adapter, and the other side is provided with a sliding slot fitting the slide button 19 provided on the plug base 1064 inside the housing. The plug base 1064 is provided under the ground base.

Figure 109:
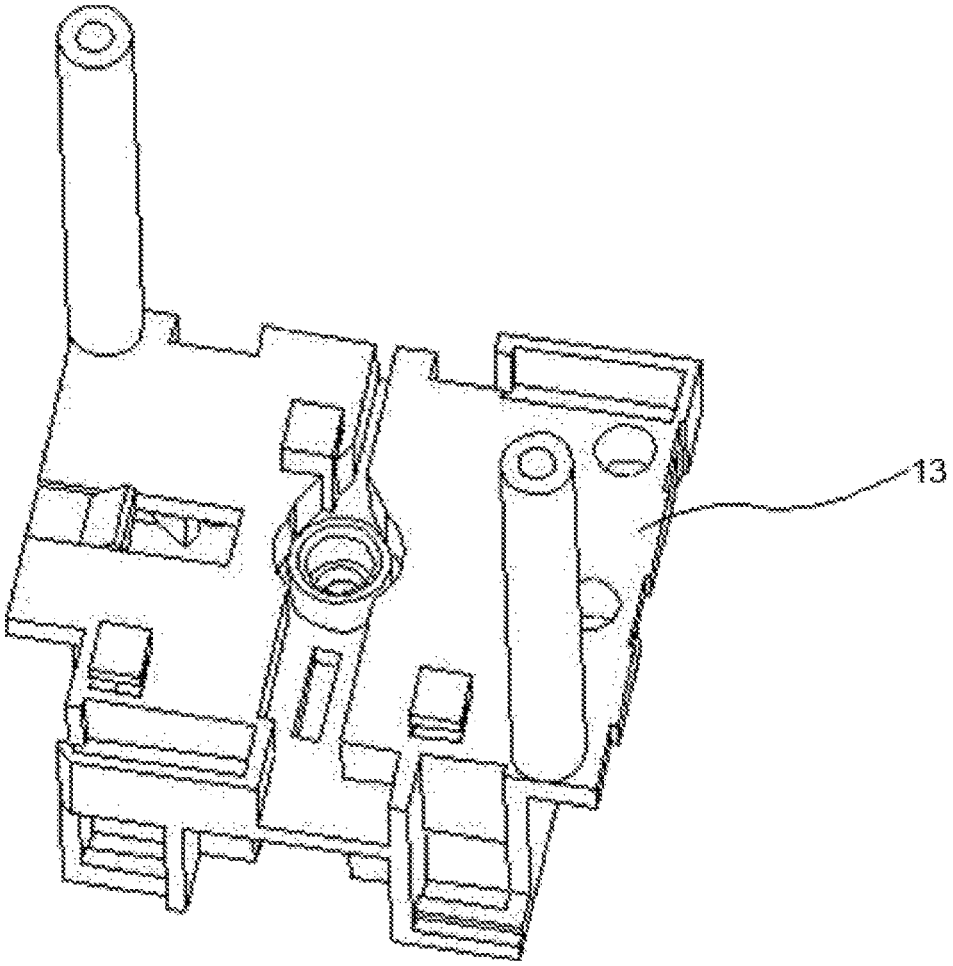
FIG. 109 is a structural representation of a pin base in a travel adapter according to a preferred embodiment of the invention.

One end of the upper housing 1061 is provided with a pin base 13. As shown in FIG. 109, the pin base 13 is mounted with a pin, and is provided with a pillar 1062.

Figure 110:
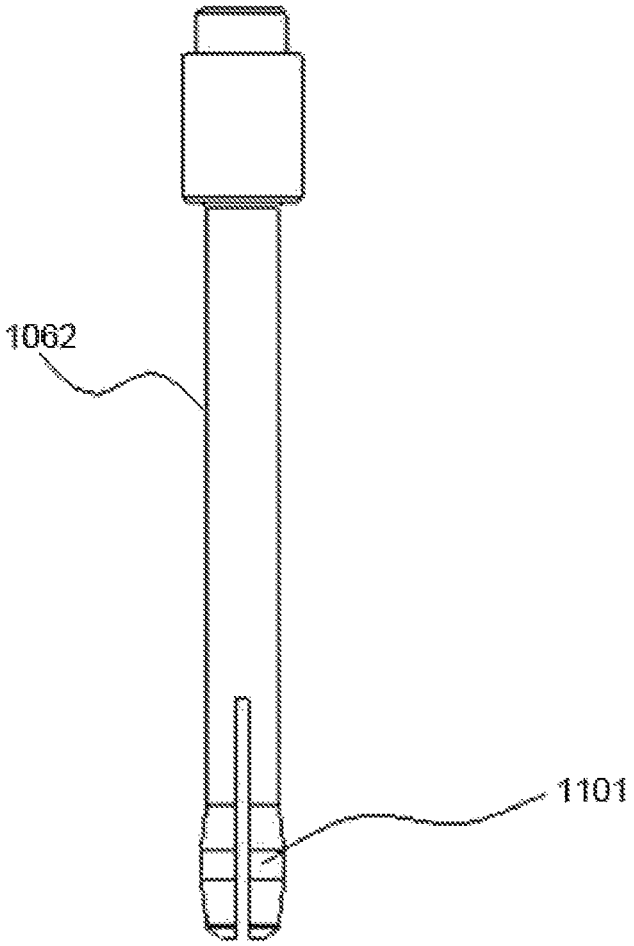
FIG. 110 is a structural representation of a pillar in a travel adapter according to a preferred embodiment of the invention.
Figure 111:
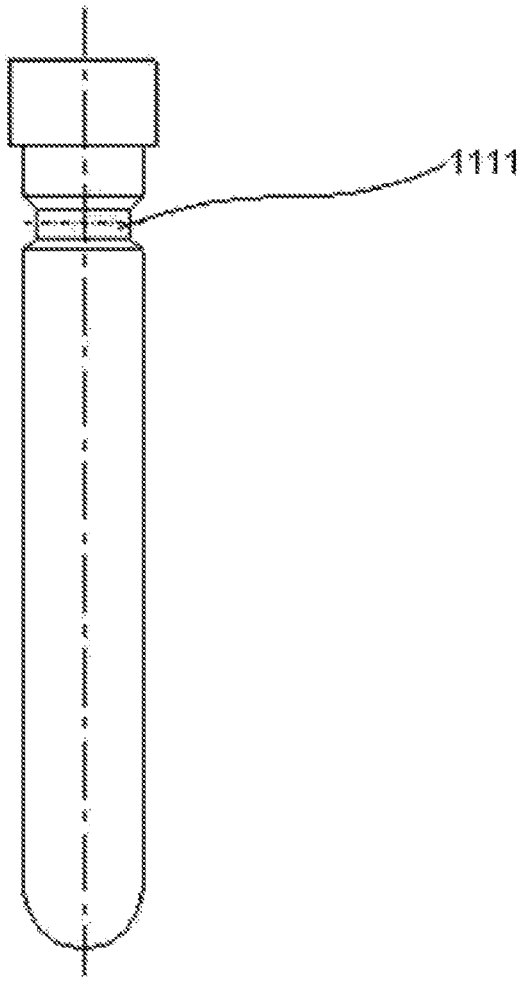
FIG. 111 is a structural representation of a sleeved pin in a travel adapter according to a preferred embodiment of the invention.

In this embodiment, specifically, the pin base 13 is provided with a plug bush seat, and the plug bush seat is provided with a ground sleeve 1013. The bolt hole at the center of the upper end of the pillar 1062 is fixed by a screw located in the ground sleeve 1013. The bottom end of the pillar 1062 is provided with an elastic salient point 1101 (as shown in FIG. 110). The pin 14 is provided with a center hole, and the aperture of the center hole is larger than the cylinder diameter of the pillar 1062. The upper end of the pin 14 is provided with an axle journal 1111 fitting the hasp on the plug base 1064 (as shown in FIG. 111). The lower end of the axle journal 1111 (that is, the connecting part of the axle journal 1111 connected with the cylinder of the pin 14) is provided with a cone guide surface, and the angle of the cone guide surface is preferably set as 45 degrees. The pin 14 is sleeved on the pillar 1062.

Then, in this embodiment, the angle of the cone guide surface refers to an angle of the cone guide surface relative to the pin 14, with the range of the angle generally between 30 degrees to 60 degrees. Specifically, if the angle is smaller than 30 degrees, the force pressing the pin 14 will be too small, thus the pin 14 cannot be normally inserted into the socket; however, if the angle is larger than 60 degrees, it will be difficult for a user to press the pin 14 into the socket, which may cause inconvenience in use.

In this embodiment, the plug base 1064 is located under the pin base 13, and LN pins 1081 are fixed thereon. The maximum distance pulled apart between the plug base 1064 and the pin base 13 is about the length of one pin so as to guarantee that the pin can completely retract into the housing.

Embodiment 40

Figure 112:
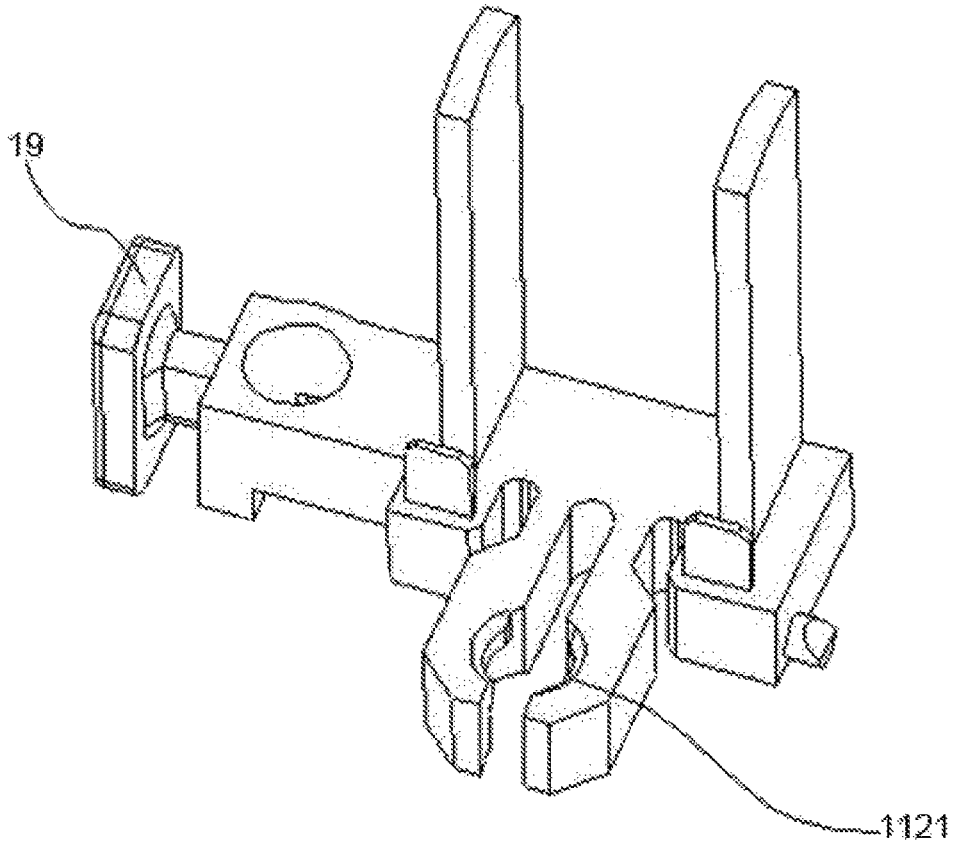
FIGS. 112-113 are structural representations of a plug base in a travel adapter according to different embodiments of the invention.

Based on the technical solutions, as shown in FIG. 112, the plug base 1064 is provided with a hasp fitting the pin 14. The hasp is an encircling elastic hasp 1131. The encircling elastic hasp 1131 includes two shroud rings that can be combined to form a shape surrounding the pin 14, and the upper end face thereof is provided with a cone guide surface. When the plug base 1064 is restored from bottom to top, the cone guide surface can make the pin 14 be restored smoothly.

Embodiment 41

Figure 113:
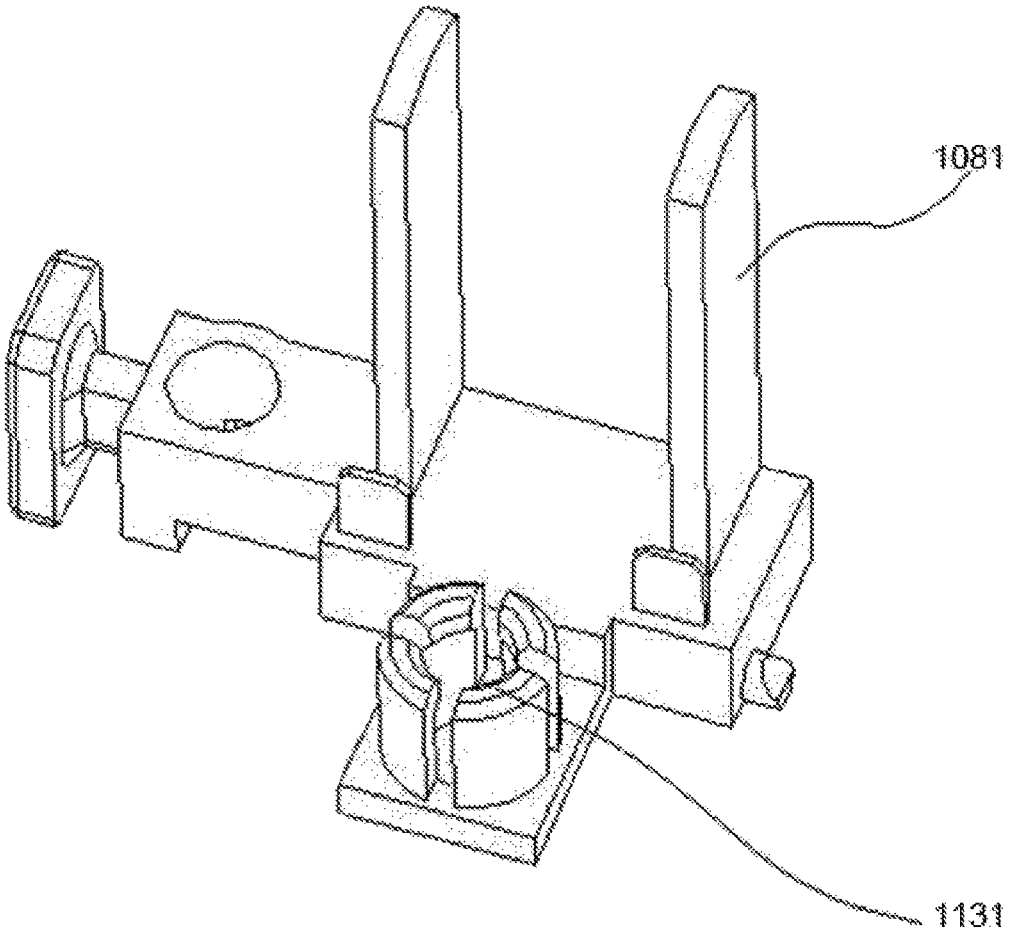

Based on the technical solutions, as shown in FIG. 113, the plug base 1064 is provided with a hasp fitting the pin 14, and the hasp is an encircling elastic hasp 1131, and the encircling elastic hasp 1131 includes four arc plates with a gap there-between that can be combined to form a cylindrical notch structure, wherein an elastic body is formed via the "notch". The upper end face of the encircling elastic hasp 1131 is also provided with a cone guide surface.

Embodiment 42

Figure 114:
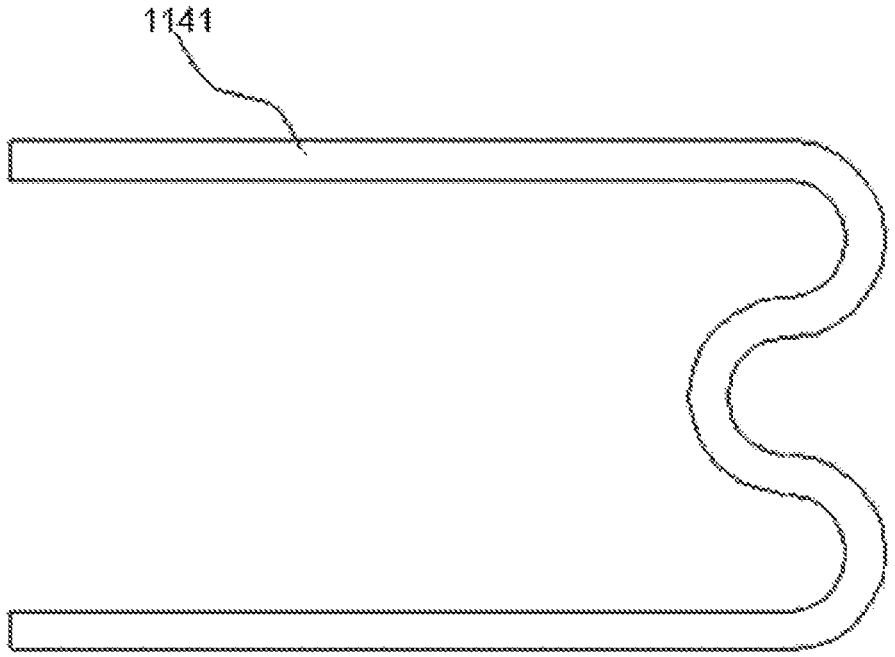
FIG. 114 is a structural representation of a positioning blade spring in a travel adapter according to a preferred embodiment of the invention.

Based on the technical solutions, as shown in FIG. 114, the part of the plug base 1064 fitting the pin 14 is provided with a blade spring seat, and a U-shaped limit blade spring 1141 is mounted in the blade spring seat. The limit blade spring 1141 has two symmetrical operation elastic plates that are connected integrally by a multi-flex body to attain sufficient structural strength.

Embodiment 43

Based on the technical solutions, the structure formed by buckling the plug base 1064 and the pin 14 may be as follows: the axle journal 1111 is made into a boss, and the lower end of the boss is provided with a 45-degree cone guide surface. Correspondingly, the hasp on the plug base 1064 is provided with a concave part matching the boss, and a buckled positioning structure is formed by fitting the boss and the concave part.

Figure 107:
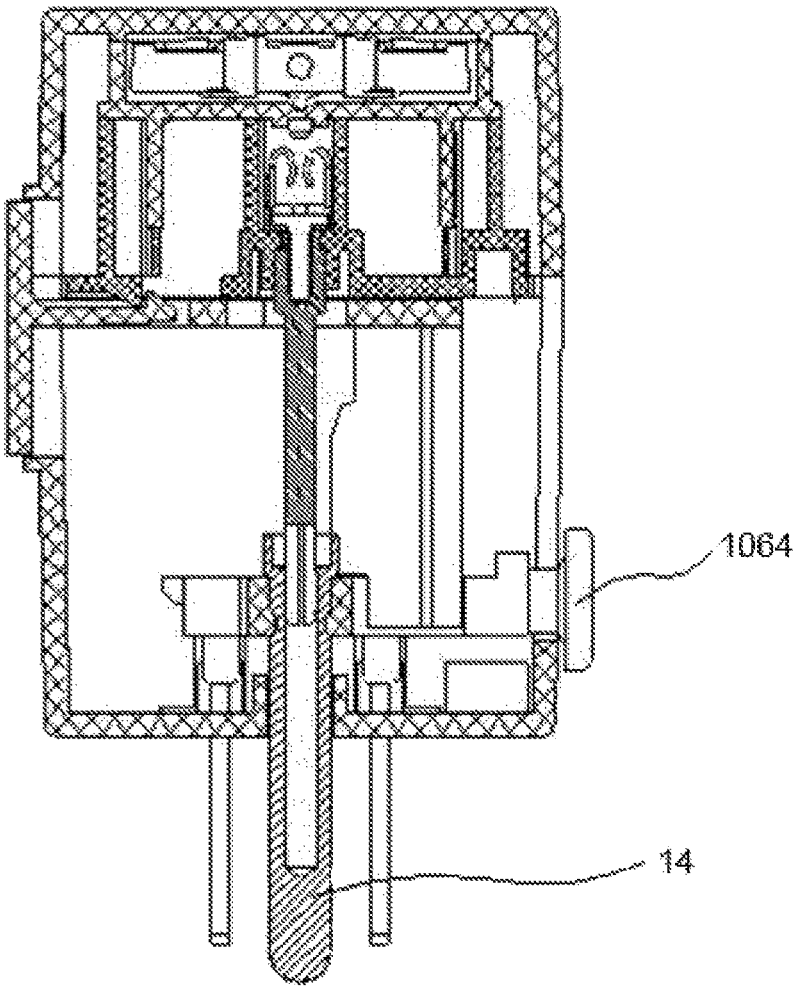
FIG. 107 is a structural representation when the pin is in a use state according to a preferred embodiment of the invention.

In a preferred embodiment of the invention, based on the embodiment, when the travel adapter is in use:

the plug base 1064 is slided out from the adapter, and the LN pins 1081 and the pin are pushed out and fixed in place for being used as a socket with a ground jack (as shown in FIG. 107).

Figure 108:
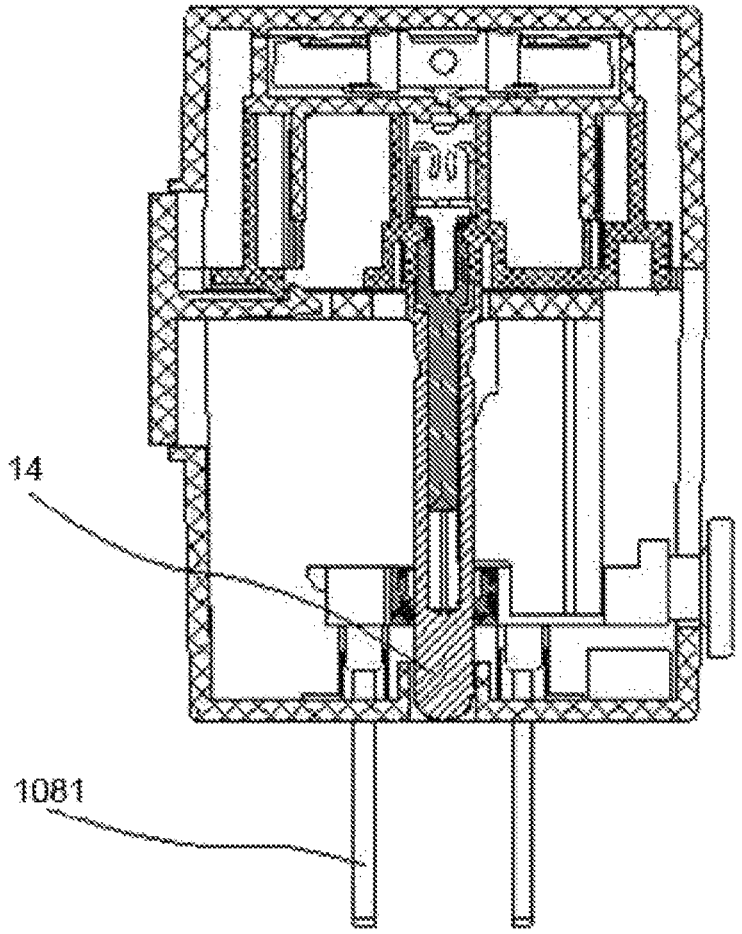
FIG. 108 is a structural representation when a pin with LN pins is in a use state according to a preferred embodiment of the invention.

When the pin is not in use, the hasp on the axle journal 1111 and the plug base 1064 may be released by pressing the pin 14, so that the pin 14 can retract into the adapter, and at this moment, it may function as a two-pole plug and be adapted to the corresponding national standard (as shown in FIG. 108).

When the plug base 1064 slides back into the adapter, the hasp in the pin 14 is again buckled to the hasp on the plug base 1064, so that the pin is fixed on the plug base 1064. As a result, when the plug base 1064 is again slided out from the adapter, the pin may appear without repeated operation.

By repeating the process, the adapter can work normally.

Embodiment 44

Based on the technical solutions, the housing is provided with an upper accommodation space and a lower accommodation space. The upper accommodation space of the housing is provided with a socket assembly, and the lower accommodation space is provided with plug assemblies corresponding to a plurality of standards of different countries.

Wherein, the socket assembly includes a plug bush seat and a sleeve provided in the plug bush seat, and a jack corresponding to the sleeve is provided on the housing for inserting the plug. The plug assembly includes a plug base

1064, and LN pins 1081 and a slide button 19 are fixed on the plug base 1064. A jack corresponding to the plug assembly is also provided on the housing for the pin on the plug assembly to protrude out, and the slide button 19 is provided for a user to move the plug base 1064 and drive the pin to protrude out.

Then, based on the embodiment, the pin base 13 may be provided independently, or the plug bush seat may be employed as a pin base 13.

Specifically, in use, the plug assembly is at first completely accommodated in the lower accommodation space inside the housing, and when the plug assembly is to be used, it may be driven to move downward by moving the slide button 19 via a user, so that the pin can protrude out together with the LN pins 1081 and the pin.

When the pin is not needed, the hasp on the axle journal 1111 of the pin 14 and the plug base 1064 may be released by pressing the pin, so that the pin 14 will retract into the plug, that is, it will become a two-pole plug.

If a plug with a pin is needed, it only needs to move the slide button 19 and retract the plug assembly into the housing, so that the axle journal 1111 is limitedly connected to the hasp, then the slide button 19 is again moved downward to push out the plug assembly so as to make the pin and the LN pins 1081 protrude out at the same time, thus the LN pins 1081 and the pin may appear at the same time.

Embodiment 45

Based on the technical solutions, as shown in FIG. 115*a*, FIG. 116*a*, FIG. 117*a* and FIGS. 120-121 and FIGS. 127-129, the housing 10 of the travel adapter is provided with a plug.

The plug includes a ground module 1150*a* and an LN module 1151A that can be operated separately. The ground module includes a ground base 1152*a* and a pin 14 fixed to ground base 1152*a*, and the LN module 1151*a* includes an LN base 1153*a* and an LN pin 1155*a* fixed to the LN base 1153*a* (specifically, an L pin 1154*a* and an N pin 1155*a*), and the ground base 1152*a* is overlapped on the LN base 1153*a*; wherein, in the state in which the ground base is overlapped on the LN base 1153*a* (as shown in FIGS. 122-123 and FIGS. 130-131), the LN base 1153*a* may be provided with a notch fitting the ground base 1152*a*, and the ground base 1152*a* is at least partially accommodated in the notch to overlap the ground base 1152*a* on the LN base 1153*a*, so that associated protrusion and associated retraction may be realized. The principles of associated protrusion and associated retraction will be illustrated in detail below.

When the plug is in a first use state, the LN module 1151*a* independently protrudes from the housing 10.

When the plug is in a second use state, the ground module 1150*a* drives the LN module 1151*a* to slide out of the housing 10. Wherein, because associated movement is realized by overlapping the ground base 1152*a* on the LN base 1153*a*, when the ground module 1150*a* slides downward and protrudes from the housing 10, the LN module 1151*a* will be driven to slide out of the housing 10 together, so that associated protrusion can be realized.

When the plug is in a received state, the LN module 1151*a* drives the ground module to slide and retract into the housing 10. Wherein, because associated movement is realized by overlapping the ground base on the LN base 1153*a*, when the LN module 1151*a* slides upward and retracts into the housing 10, the ground module 1150*a* will be driven to slide and retract into the housing 10 together, so that associated retraction can be realized.

Figure 118:
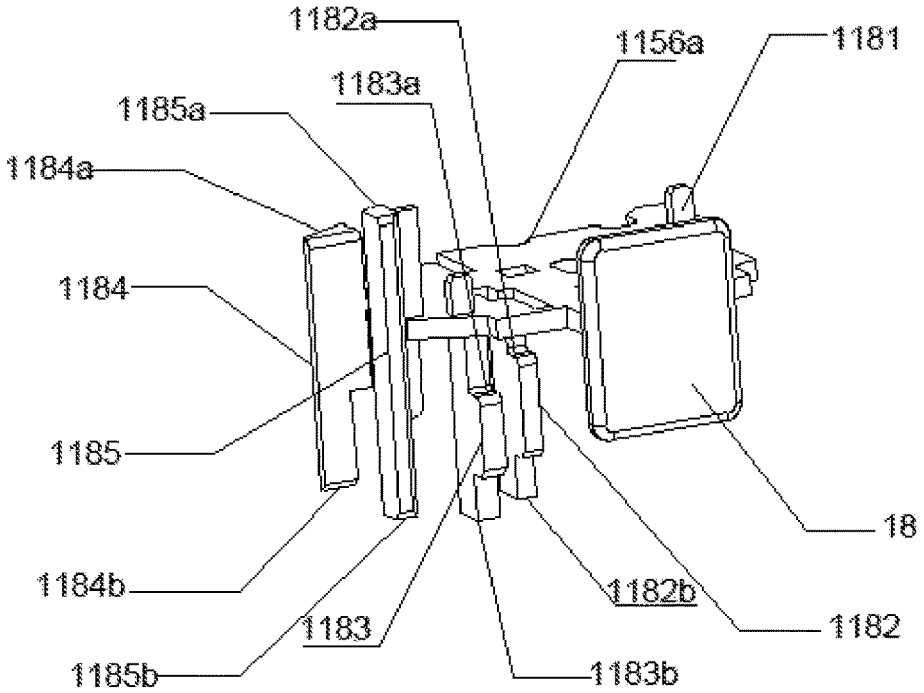
FIG. 118 is a stereoscopic view of a locking module according to a preferred embodiment of the invention.

In this embodiment, the travel adapter further includes a locking module 1150*b* as shown in FIG. 118. The locking module 1150*b* is configured for: when the plug is in a first use state, locking the ground module 1150*a* to a retraction position (which refers to a position at which the ground module 1150*a* is retracted in the housing 10) and locking the LN module 1151*a* to a protrusion position (which refers to a position at which the LN module 1151*a* is protruded from the housing 10) respectively; when the plug is in a second use state, jointly locking the ground module 1150*a* and the LN module 1151*a* to the protrusion position; and when the plug is in a received state, jointly locking the ground module 1150*a* and the LN module 1151*a* to the retraction position.

In this embodiment, the ground module 1150*a* and the LN module 1151*a* of the plug are separately provided as two modules that are slidably connected and separately operated, and specifically, the ground base 1152*a* is overlapped on the LN base 1153*a* to realize associated protrusion and associated retraction, so that three different states of the plug may be realized.

In the first use state, the LN module 1151*a* independently protrudes from the housing 10, and at this moment, the ground module 1150*a* is locked to a retraction position and the LN module 1151*a* is locked to a protrusion position by means of the locking module 1150*b* respectively.

In the second use state, the ground module 1150*a* drives the LN module 1151*a* to slide out of the housing 10, and at this moment, the ground module 1150*a* and the LN module 1151*a* are jointly locked to the protrusion position by means of the locking module 1150*b*.

In the received state, the LN module 1151*a* drives the ground module to slide and retract into the housing 10, and at this moment, the ground module 1150*a* and the LN module 1151*a* are jointly locked to the retraction position by means of the locking module 1150*b*. In this way, the ground module 1150*a* and the LN module 1151*a* may be used at the same time in the same plug structure in the travel adapter, or only the LN module 1151*a* is used.

Embodiment 46

Based on the technical solutions, as shown in FIG. 118, the locking module 1150*b* may specifically include:

a movable support 1156*a*, which can move operably in the horizontal direction;

at least one elastic element, which is connected between the housing 10 and the movable support 1156*a*, and when the movable support 1156*a* moves along the horizontal direction under the action of a horizontal force, the elastic element deforms elastically to make the locking module 1150*b* release the lock of the ground module 1150*a* and the LN module 1151*a* for the ground module 1150*a* and the LN module 1151*a* to switch between the first use state, the second use state and the received state; and when the horizontal force is released, the movable support 1156*a* is pushed by the elastic restoring force of the elastic element to make the locking module 1150*b* restore the lock of the ground module 1150*a* and the LN module 1151*a*.

As a preferred embodiment, the elastic element includes at least one spring 1157*a*, which is connected with the housing 10 via at least one protrusion 1181 provided on the movable support 1156*a*.

In this embodiment, the locking module 1150*b* includes a first limit pillar 1184, which is vertically connected to the movable support 1156*a* and configured for positioning the ground module 1150*a* at the retraction position when the movable support 1156*a* is at the lock position and the plug is in the first use state and positioning the ground module 1150*a* and the LN module 1151*a* at the protrusion position when the movable support 1156*a* is at the lock position and the plug is in the second use state.

Further, the first limit pillar 1184 includes a first locking surface 1184*a* located on the top, which is pressed against the bottom of the ground base and configured for positioning the ground module 1150*a* at the retraction position.

The first limit pillar 1184 further includes a second locking surface 1184*b* located on the bottom, which is pressed against the top of the ground base 1152*a* and configured for positioning the ground module 1150*a* at the protrusion position.

In this embodiment, the locking module 1150*b* further includes a second limit pillar 1185, which is vertically connected to the movable support 1156*a* and configured for positioning the LN module 1151*a* at the protrusion position when the movable support 1156*a* is at the lock position and the plug is in the first use state and positioning the LN module 1151*a* and the ground module 1150*a* at the retraction position when the movable support 1156*a* is at the lock position and the plug is in the received state.

Further, the second limit pillar 1185 includes: a first locking surface 1185*a* located on the top, which is pressed against the bottom of the LN base 1153*a* and configured for positioning the LN module 1151*a* at the retraction position; and a second locking surface 1184*b* located on the bottom, which is pressed against the top of the LN base 1153*a* and configured for positioning the LN module 1151*a* at the protrusion position. The lock position of the locking module 1150*b* will be illustrated below.

Figure 121:
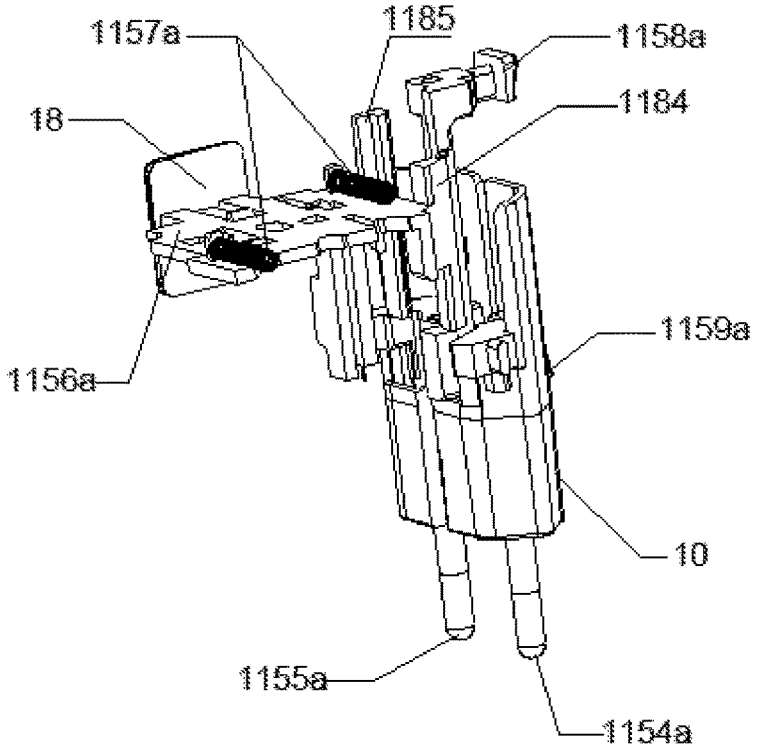

In this embodiment, as shown in FIG. 121, when the plug is in the first use state, the first locking surface 1184*a* of the first limit pillar 1184 may independently position the ground module 1150*a* at the retraction position, and at this moment, the second locking surface 1185*b* of the second limit pillar 1185 independently positions the LN module 1151*a* at the protrusion position. When the plug is in the second use state, the second locking surface 1184*b* of the first limit pillar 1184 positions the ground module 1150*a* (together with the LN module 1151*a*, because the LN module 1151*a* will protrude out as the ground module 1150*a* protrudes out) at the protrusion position, and at the same time, the second locking surface 1185*b* of the second limit pillar 1185 also positions the LN module 1151*a* at the protrusion position.

Figure 120:
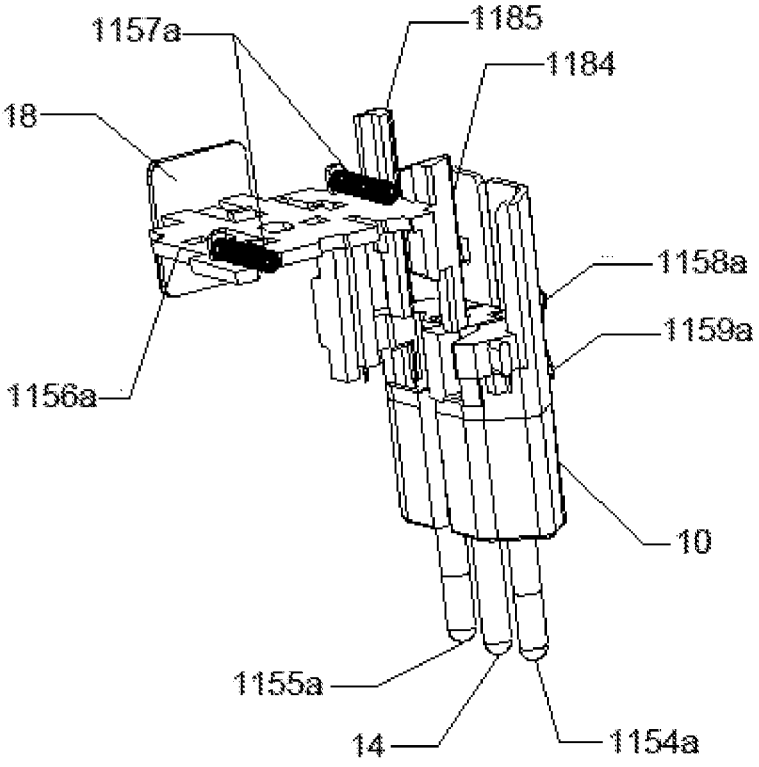

As shown in FIG. 120, when the plug is in the received state, the first locking surface 1185*a* of the second limit pillar 1185 positions the LN module 1151*a* (together with the ground module 1150*a*, because the ground module 1150*a* will retract as the LN module 1151*a* retracts) at the retraction position, and at the same time, the first locking surface 1184*a* of the first limit pillar 1184 also positions the ground module 1150*a* at the retraction position.

Embodiment 47

Based on the technical solutions, as an embodiment coexisting with the Embodiment 46, still as shown in FIG. 118, the locking module 1150*b* includes another first limit pillar 1182 that is different from the first limit pillar 1184. The first limit pillar 1182 is vertically connected to the movable support 1156*a* and configured for positioning the ground module 1150*a* at the retraction position when the movable support 1156*a* is at the lock position and the plug is in the first use state and positioning the ground module 1150*a* and the LN module 1151*a* at the protrusion position when the movable support 1156*a* is at the lock position and the plug is in the second use state.

Further, the first limit pillar 1182 includes: a first notch 1182*a* located on one lateral side on the top, which is pressed against the bottom of the ground base 1152*a* and configured for positioning the ground module 1150*a* at the retraction position; and a second notch 1182*b* located on the bottom and on the same lateral side as the first notch 1182*a*, which is pressed against the top of the ground base 1152*a* and configured for positioning the ground module 1150*a* at the protrusion position.

Based on the technical solutions, the locking module 1150*b* further includes another second limit pillar 1183 different from the second limit pillar, which is vertically connected to the movable support 1156*a* and configured for positioning the LN module 1151*a* at the protrusion position when the movable support 1156*a* is at the lock position and the plug is in the first use state and positioning the LN module 1151*a* and the ground module 1150*a* at the retraction position when the movable support 1156*a* is at the lock position and the plug is in the received state.

Further, the second limit pillar 1183 includes: a first notch 1183*a* located on one lateral side on the top, which is pressed against the bottom of the LN base 1153*a* and configured for positioning the LN module 1151*a* at the retraction position; and a second notch 1183*b* located on the bottom and on the same lateral side as the first notch 1183*a*, which is pressed against the top of the LN base 1153*a* and configured for positioning the LN module 1151*a* at the protrusion position.

In this embodiment, when the plug is in the first use state, the first notch 1182*a* of the first limit pillar 1182 may independently position the ground module 1150*a* at the retraction position, and at this moment, the second notch 1183*b* of the second limit pillar 1183 independently positions the LN module 1151*a* at the protrusion position. When the plug is in the second use state, the second notch 1182*b* of the first limit pillar 1182 positions the ground module 1150*a* (together with the LN module 1151*a*, because the LN module 1151*a* will protrude out as the ground module 1150*a* protrudes out) at the protrusion position, and at the same time, the second notch 1183*b* of the second limit pillar 1183 also positions the LN module 1151*a* at the protrusion position. When the plug is in the received state, the first notch 1183*a* of the second limit pillar 1183 positions the LN module 1151*a* (together with the ground module 1150*a*, because the ground module 1150*a* will retract as the LN module 1151*a* retracts) at the retraction position, and at the same time, the first notch 1182*a* of the first limit pillar 1182 may position the ground module 1150*a* at the retraction position.

It should be noted that, the component (notch) for locking on the limit pillar in this embodiment is provided as different from the locking surface of Embodiment 2, and this is designed according to plugs of different standards. The locking surface of Embodiment 2 may be configured for, for example, locking the Italian Standard plug as shown in FIGS. 119-125, while the notch of this embodiment may be configured for, for example, locking the American Standard plug as shown in FIGS. 126-132.

Embodiment 48

Figure 122:
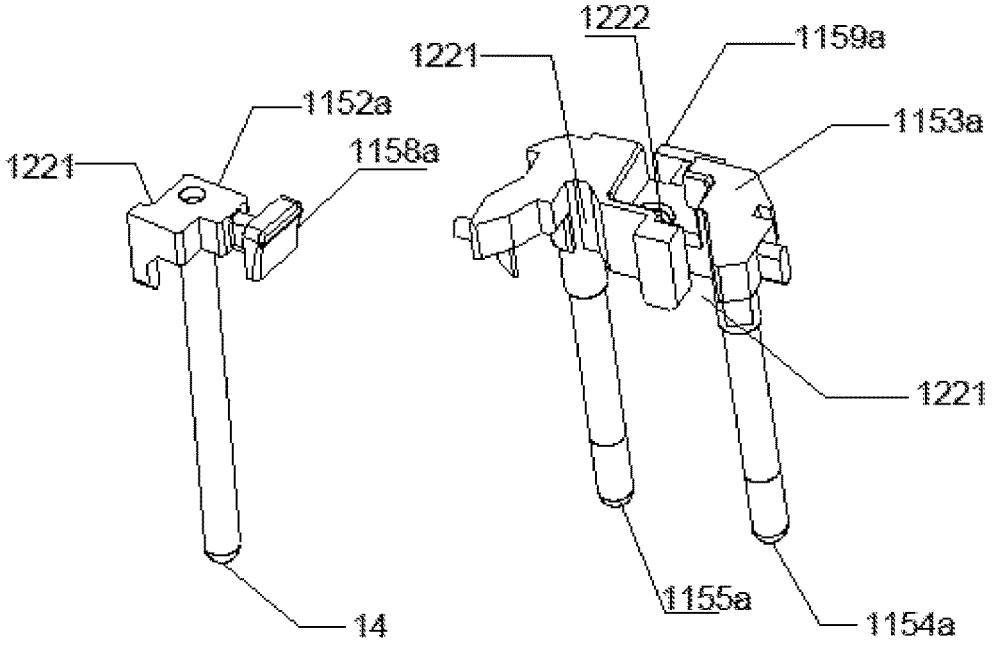
Figure 123:
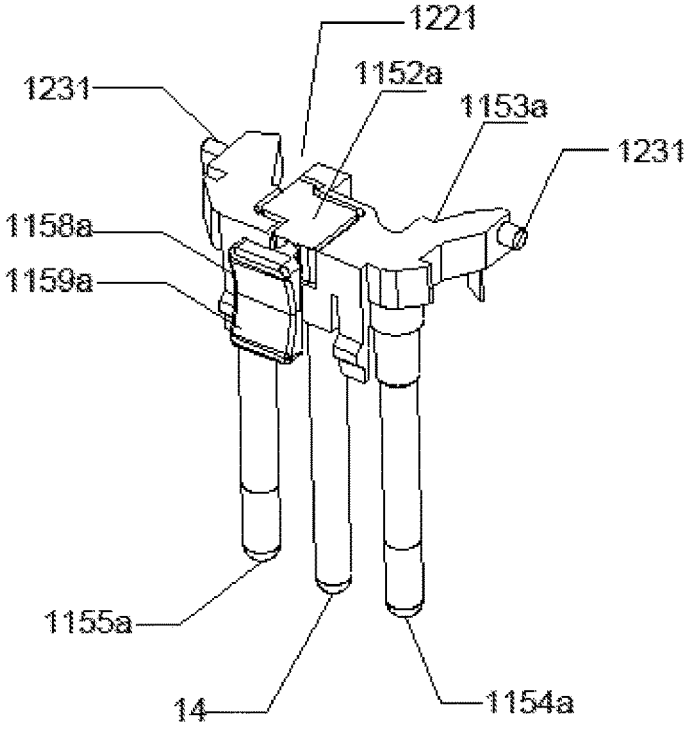

Based on the technical solutions, as shown in FIGS. 122-123, the ground module 1150*a* and/or LN module 1151*a* are/is provided with a guide slot 1221 configured for fitting the first limit pillar 1184 and the second limit pillar 1185. When the movable support 1156*a* is located at the operating position, the positions of the first limit pillar 1184 and the second limit pillar 1185 will correspond to that the position of the guide slot 1221, so that the ground module 1150*a* and the LN module 1151*a* may be guided to slide up and down, thereby switching between the first use state, the second use state and the received state. When the movable support 1156*a* is located at the lock position, the positions of the first limit pillar 1184 and the second limit pillar 1185 do not correspond to that the position of the guide slot 1221, so that the ground module 1150*a* and the LN module 1151*a* may be prevented from sliding, thereby realizing locking.

Figure 130:
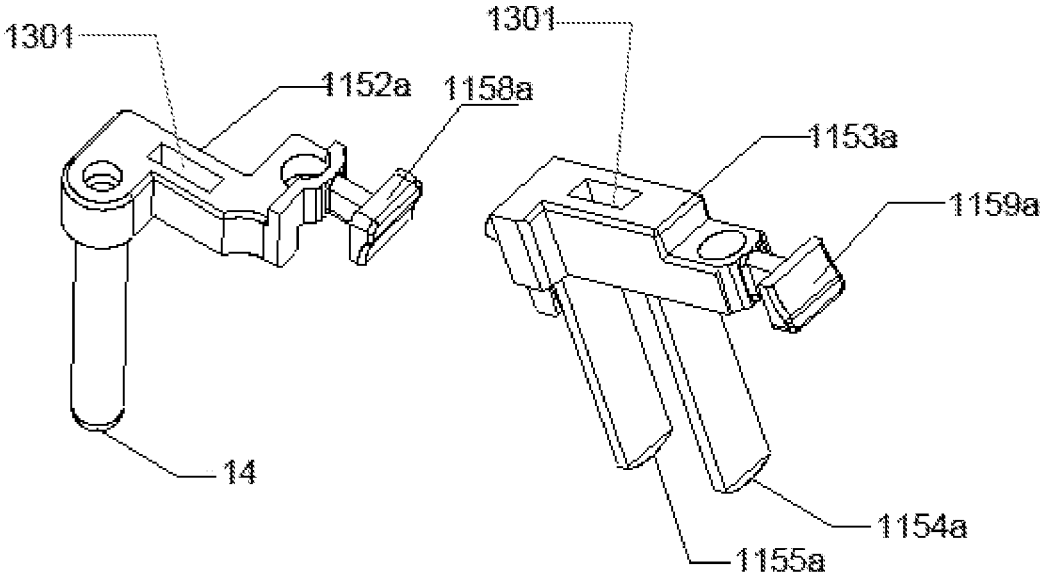
Figure 131:
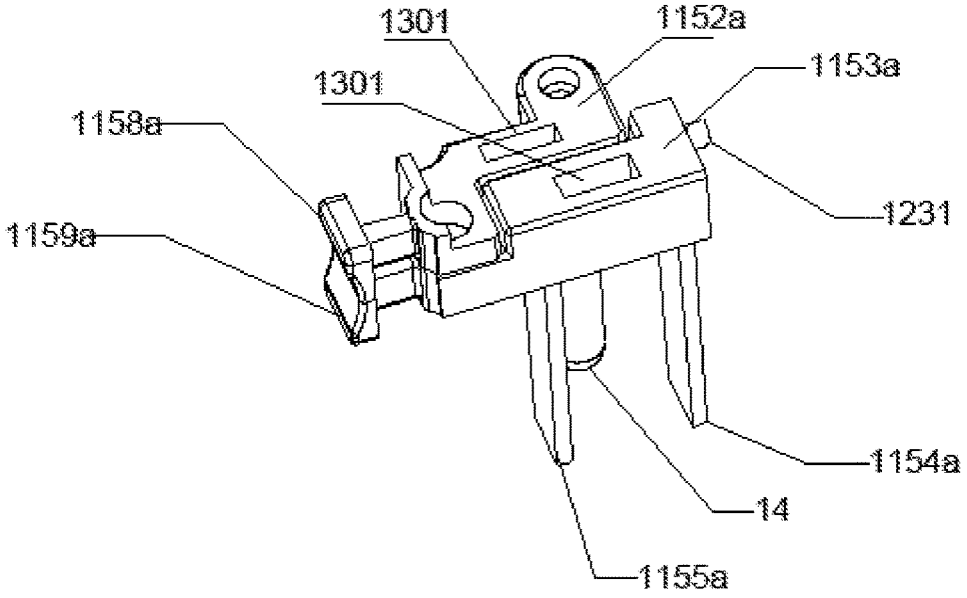

Based on the technical solutions, as a coexisting embodiment, as shown in FIGS. 130-131, the ground module 1150*a* and the LN module 1151*a* are provided with a guide hole 1301 for the first limit pillar 1182 and the second limit pillar 1183 to pass through. When the movable support 1156*a* is located at the operating position, the positions of the first limit pillar 1182 and the second limit pillar 1183 correspond to that the position of the guide hole 1301, so that the ground module 1150*a* and the LN module 1151*a* may be guided to slide up and down, thereby switching between the first use state, the second use state and the received state. When the movable support 1156*a* is located at the lock position, the positions of the first limit pillar 1182 and the second limit pillar 1183 do not correspond to that the position of the guide hole 1301, so that the ground module 1150*a* and the LN module 1151*a* may be prevented from sliding, thereby realizing locking.

Therefore, the operating position of the locking module 1150*b* refers to that the positions of the first limit pillar 1184 and the second limit pillar 1185 correspond to the position of the guide slot 1221 or the positions of the first limit pillar 1182 and the second limit pillar 1183 correspond to the position of the guide hole 1301, so that the ground module 1150*a* and the LN module 1151*a* may be guided to slide up and down. The lock position of the locking module 1150*b* refers to that the positions of the first limit pillar 1184 and the second limit pillar 1185 do not correspond to the position of the guide slot 1221 or the positions of the first limit pillar 1182 and the second limit pillar 1183 do not correspond to the position of the guide hole 1301, so that the ground module 1150*a* and the LN module 1151*a* may be locked.

In this embodiment, for the structures of plugs of standards of different countries (for example, the Italian Standard plug shown in FIGS. 122-123 and the American Standard plug shown in FIGS. 130-131), the plug is provided with a guide slot 1221, a guide hole 1301 or a similar guide structure matching the limit pillar, and up slide and down slide of the plug or lock of the plug may be realized by the fitting of such guide structures to the limit pillar, which is very flexible and convenient.

Embodiment 49

Based on the technical solutions, still as shown in FIGS. 122-123, in the Italian Standard plug, the shape of the ground base 1152*a* of the ground module 1150*a* matches the notch opened on the LN base 1153*a* of the LN module 1151*a*, and the ground base 1152*a* is accommodated in the notch, so that the ground module 1150*a* is overlapped on the LN base 1153*a* of the LN module 1151*a* via the ground base 1152*a*. A through hole 1222 is opened on the LN base 1153*a* for the pin 14 of the ground module 1150*a* to pass through. Because of the ground base 1152*a* and the LN base 1153*a* overlapped and nested each other, associated protrusion and associated retraction can be realized between the ground module 1150*a* and the LN module 1151*a*.

Further, the ground base 1152*a* is provided with a ground operating button 1158*a* that may be operated easily, and the LN base 1153*a* is provided with an LN operating button 1159*a* that may be operated easily. When the ground operating button 1158*a* and the LN operating button 1159*a* are in a matched state, a good-looking overall operating button (i.e., the slide button) may be formed.

Based on the technical solutions, as a coexisting embodiment, as shown in FIGS. 130-131, in the American Standard plug, the shape of the ground base 1152*a* of the ground module 1150*a* matches the shape of the notch of the LN base 1153*a* of the LN module 1151*a*, and the ground base 1152*a* may be partially accommodated in the notch of the LN base 1153*a*, so that the ground module 1150*a* is overlapped on the LN base 1153*a* of the LN module 1151*a* via the ground base 1152*a*. In the American Standard plug, the LN base 1153*a* is provided with a recess, the ground base 1152*a* is provided with a protrusion part, and nesting is realized by overlapping the protrusion part of the ground base 1152*a* in the recess on the LN base 1153*a*, thereby realizing associated protrusion and associated retraction between the ground module 1150*a* and the LN module 1151*a*. A Fool-Proof effect may also be realized by the nesting of protrusion part into the recess, and hence splicing accuracy and security of the plug module may be guaranteed.

Further, the ground base 1152*a* of the American Standard plug is also provided with a ground operating button 1158*a* that may be operated easily, and the LN base 1153*a* is also provided with an LN operating button 1159*a* that may be operated easily. When the ground operating button 1158*a* and the LN operating button 1159*a* are in a matched state, a good-looking overall operating button (i.e., the slide button) may be formed.

Embodiment 50

Based on the technical solutions, as shown in FIGS. 115*a*-117*b*, a detailed state procedure of the protrusion and retraction of the plug from and into the housing 10 is given.

Figure 115A:
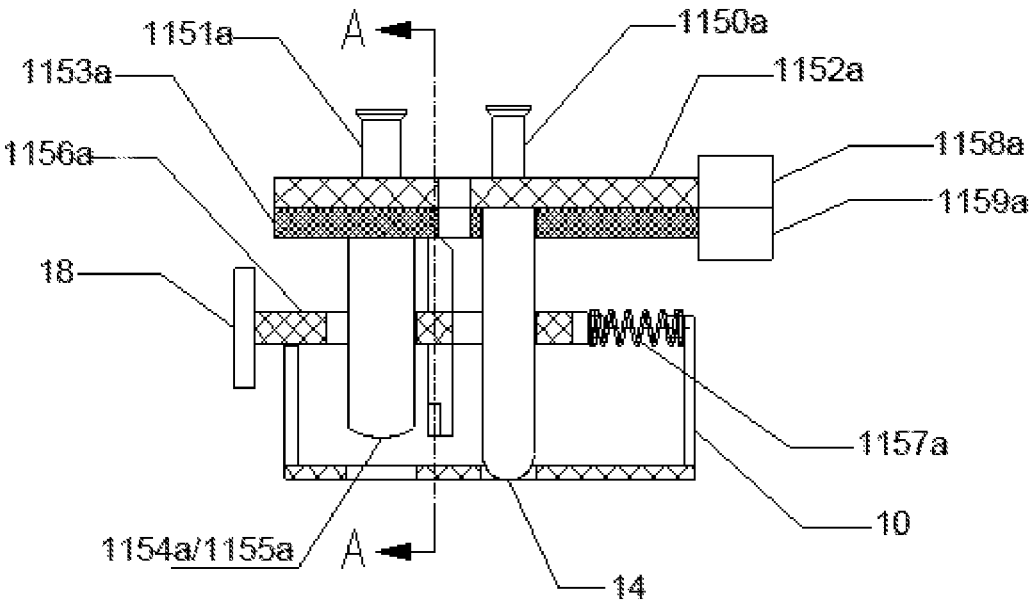
FIG. 115*a* is a principle diagram when plugs in the travel adapter are not used according to a preferred embodiment of the invention.
Figure 115B:
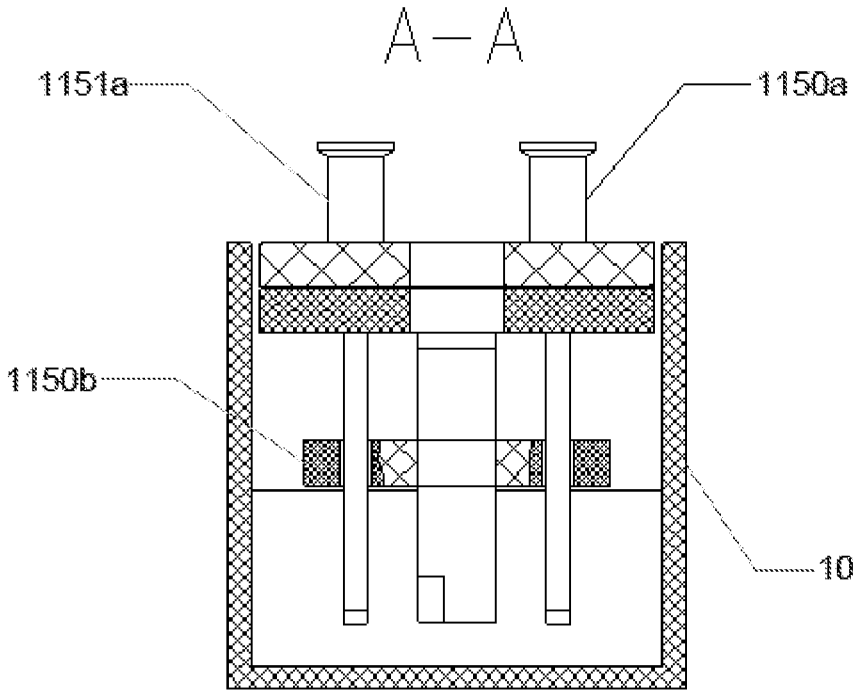
FIG. 115*b* is a sectional view along A-A in the FIG. 115*a* according to a preferred embodiment of the invention.

As shown in FIGS. 115*a* and 115*b*, the plug is in a received state, that is, the ground module 1150*a* and the LN module 1151*a* are both at a retraction position at which the ground module 1150*a* and the LN module 1151*a* are retracted into the housing 10. At this moment, the movable support 1156*a* of the lock structure is at the lock position, and the ground module 1150*a* and the LN module 1151*a* are both positioned at the retraction position.

Figure 116A:
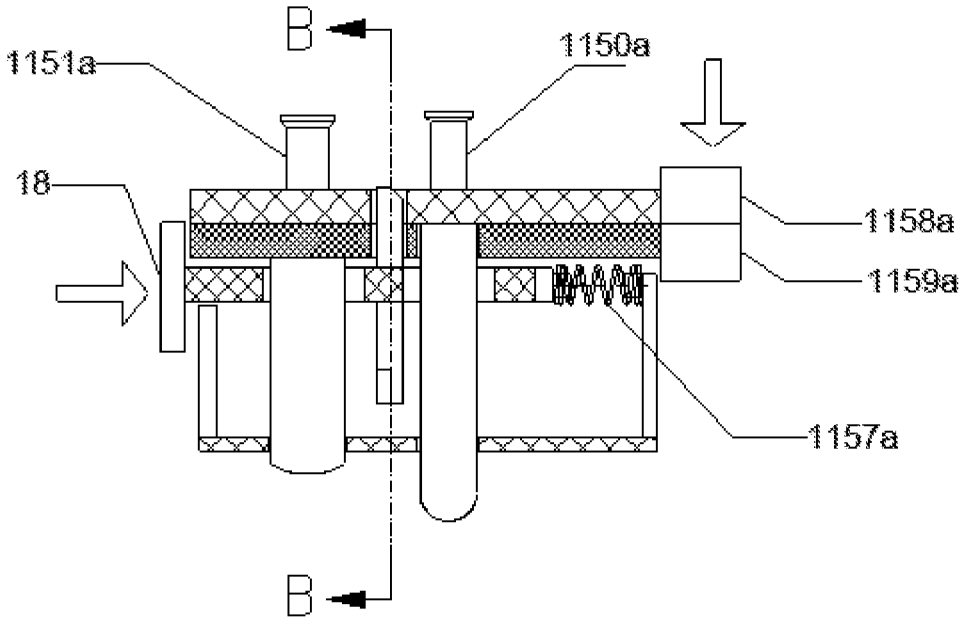
FIG. 116*a* is a principle diagram when a ground module and an LN module protrude at the same time according to a preferred embodiment of the invention.
Figure 116B:
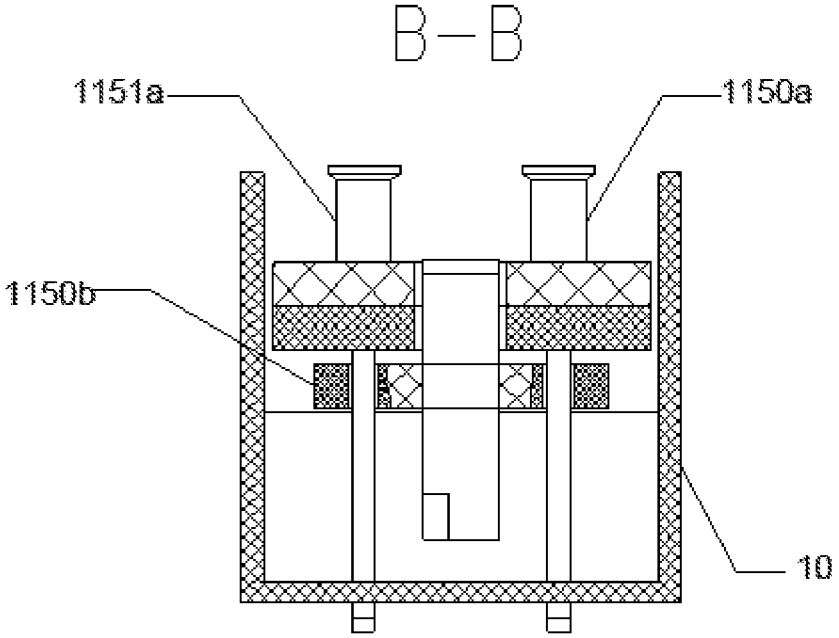
FIG. 116*b* is a sectional view along B-B in the FIG. 116*a* according to a preferred embodiment of the invention.

When the plug is to be used, as shown in FIGS. 116*a* and 116*b*, the movable support 1156*a* is pushed to move from the lock position to the operating position under a horizontal force via the button 18 provided on the movable support 1156*a* for easily operating. During moving, the elastic element is compressed by the movable support 1156*a*. After the movable support 1156*a* moves to the operating position, the lock of the ground module 1150*a* and the LN module 1151*a* will be released, so that the ground module 1150*a* and the LN module 1151*a* may slide up and down. As shown in FIGS. 116*a* and 116*b*, the ground module 1150*a* and the LN module 1151*a* both slides downward, that is, the LN module 1151*a* protrudes with the ground module 1150*a*. This is realized in the manner below: the ground operating button 1158*a* of the ground module 1150*a* and the LN operating button 1159*a* of the LN module 1151*a* are pushed with the aid of an external force, thus the pin 14, the L pin 1154*a* and the N pin 1155*a* will slide downward together.

After the pin 14, the L pin 1154*a* and the N pin 1155*a* all completely protrude from the housing 10, as shown in FIGS.

117*a* and 117*b*, the button 18 is released, and the movable support 1156*a* is pushed back to the lock position by the elastic restoring force of the elastic element, so that the pin 14, the L pin 1154*a* and the N pin 1155*a* are respectively positioned at the protrusion position, that is, the plug will be in the second use state.

Figure 117A:
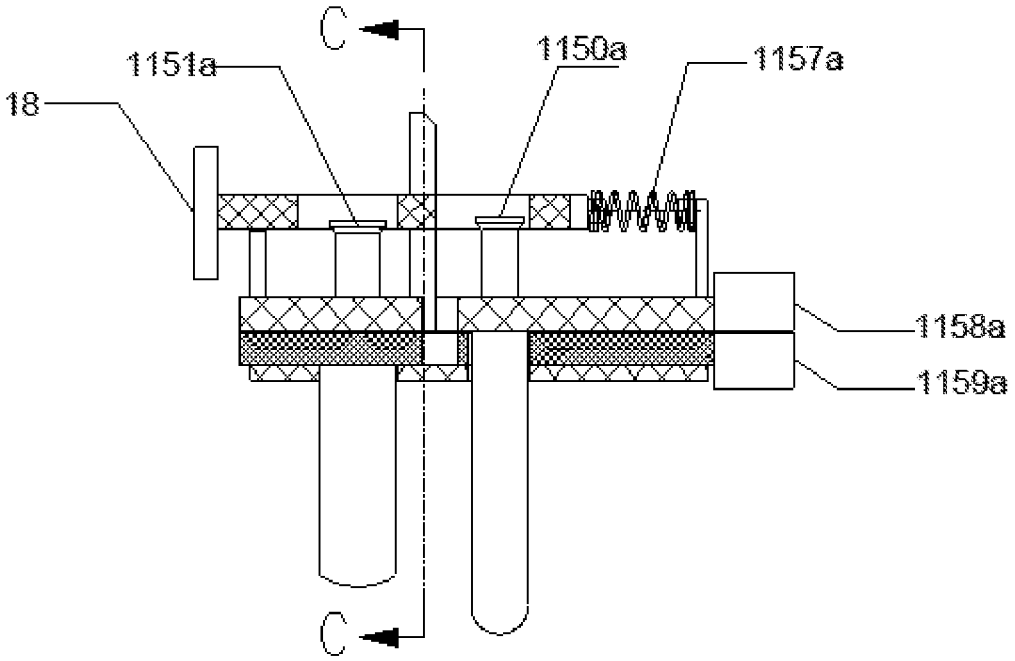
FIG. 117*a* is a principle diagram when a ground module and an LN module are both at a protrusion position according to a preferred embodiment of the invention.
Figure 117B:
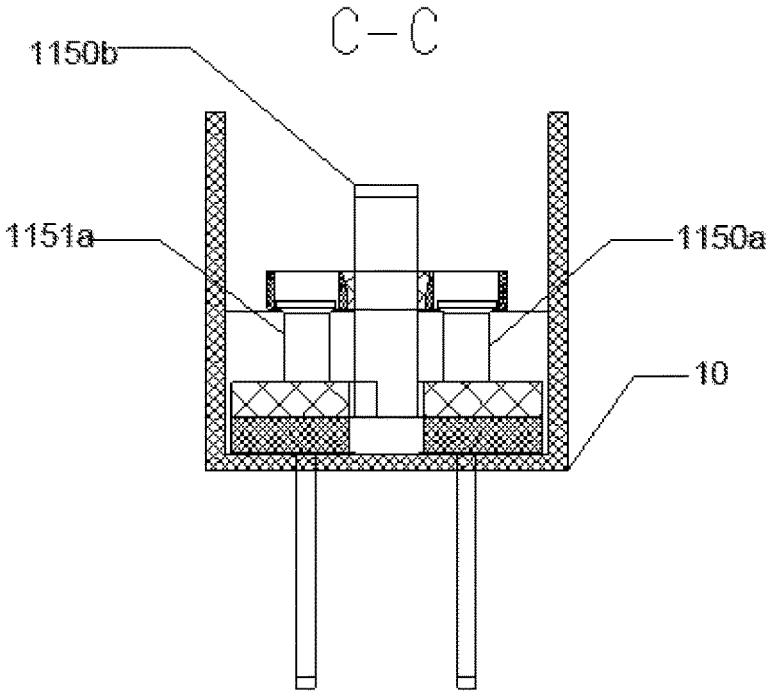
FIG. 117*b* is a sectional view along C-C according to a preferred embodiment of the invention.

Based on that the plug is in the second use state as shown in FIGS. 117*a* and 117*b*, as another embodiment (not shown because of a similar principle), when only the L pin 1154*a* and the N pin 1155*a* of the plug are to be used, the movable support 1156*a* may be pushed by the button 18 to compress the elastic element to the operating position; and at this moment, the L pin 1154*a* and the N pin 1155*a* are kept immobile, and only the ground operating button 1158*a* is pushed to drive the pin 14 to move upward, so that the pin 14 changes from a state of protruding from the housing 10 to a state of retracting into the housing 10, that is, the pin 14 changes from the protrusion position to the retraction position. After the pin 14 completely retracts into the housing 10, the button 18 is released, so that the movable support 1156*a* is pushed by the elastic element to restore the lock position, thus the L pin 1154*a* and the N pin 1155*a* will be locked at the protrusion position, while the pin 14 will be locked at the retraction position, thereby attaining the object of positioning the plug in the first use state.

However, the first use state may also be directly obtained from the received state as shown in FIGS. 115*a* and 115*b*. That is, after the movable support 1156*a* is pushed to the operating position by an external force, only the LN module 1151*a* is slided downward by the LN operating button 1159*a*, while the ground module 1150*a* is kept immobile, and after the L pin 1154*a* and the N pin 1155*a* of the LN module 1151*a* completely protrude from the housing 10, the movable support 1156*a* restores the lock position via the elastic element, so that the L pin 1154*a* and the N pin 1155*a* will be locked at the protrusion position, and the pin 14 will be locked at the retraction position.

In the technical solution, by splitting the plug into a ground module 1150*a* and an LN module 1151A that are slidably connected and separately operated and respectively controlled by the locking module 1150*b*, the object of using the ground and LN poles in the same plug structure simultaneously or using only the L and N poles may be attained flexibly.

The operating principle of the plug structure in the travel adapter in the technical solutions will be further described below by two specific embodiments. It should be noted that, the description below is merely used for explaining the practicability of the technical solutions of the invention, rather than limiting the protection scope of the invention.

Embodiment 51

Figure 1:
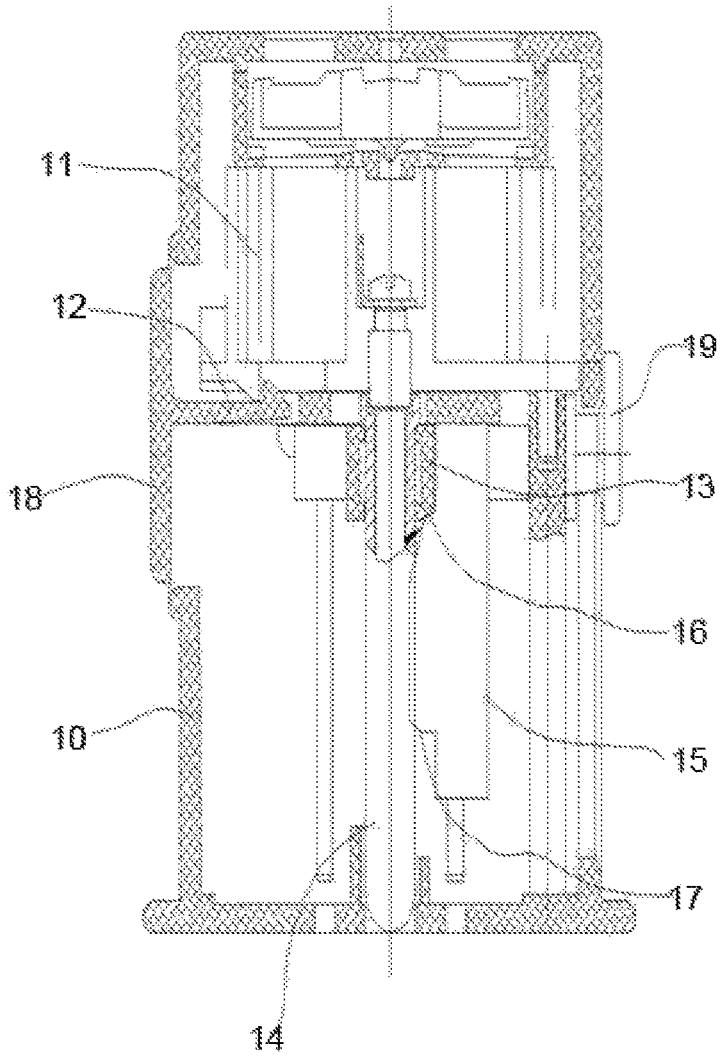
FIG. 1 is a sectional view showing a pin assembly hidden in a housing according to a preferred embodiment of the invention.
Figure 2:
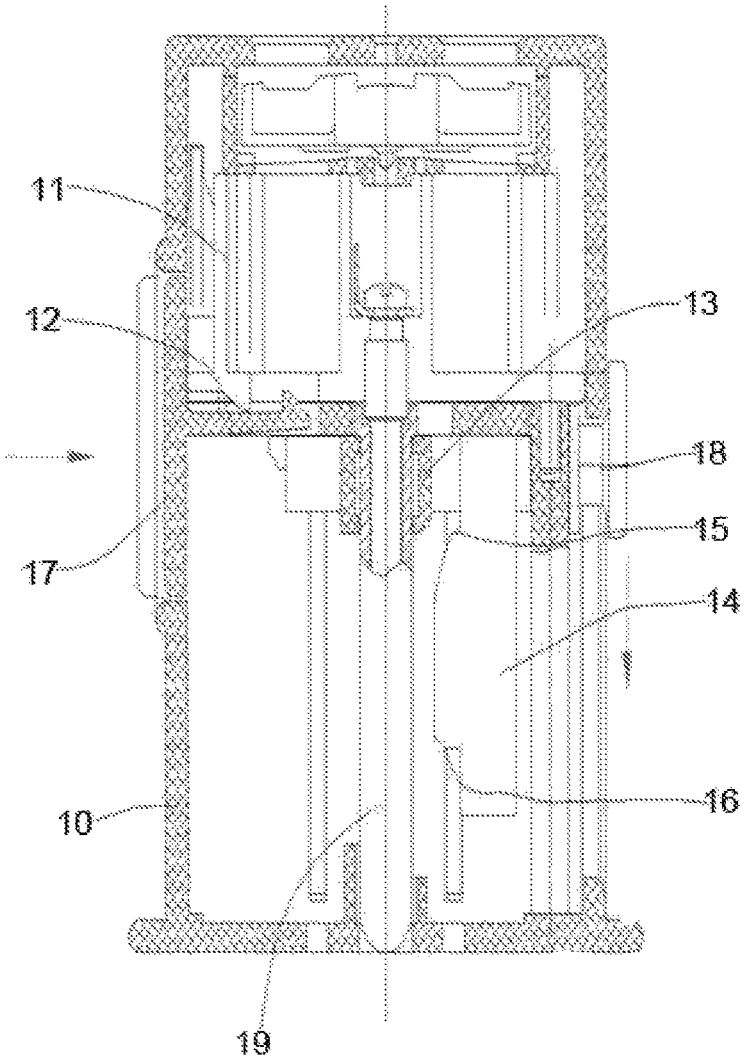
FIG. 2 is a sectional view showing a button on a support frame that is pressed according to a preferred embodiment of the invention.
Figure 3:
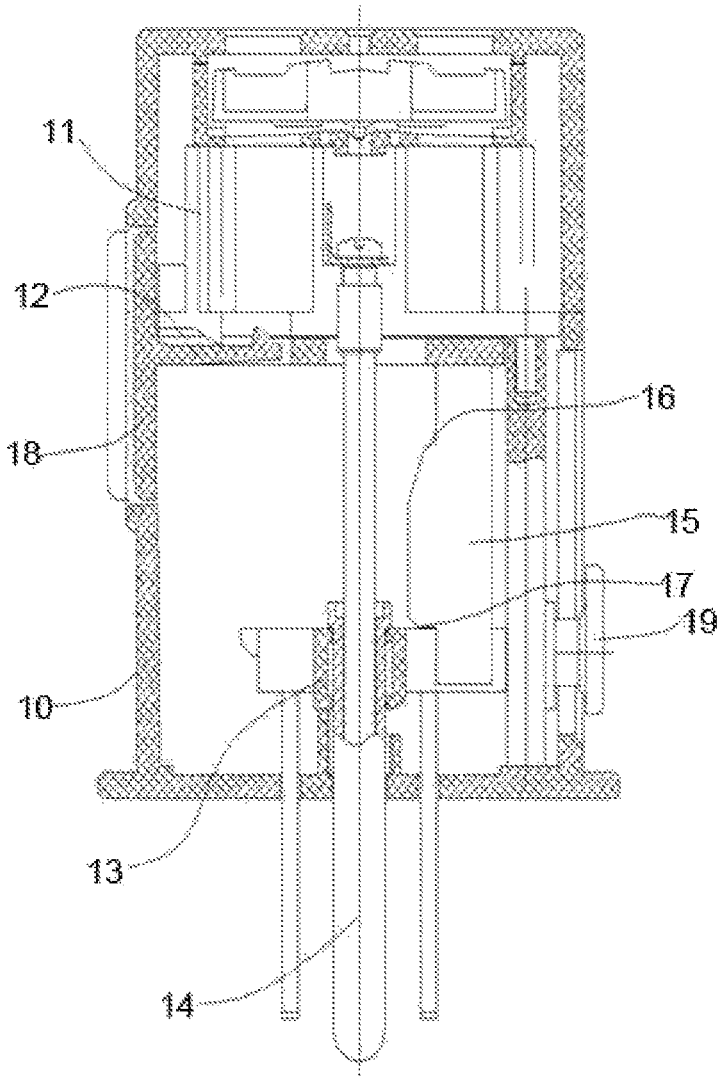
FIG. 3 is a sectional view showing a pin in a protrusion state moved downward by a pin assembly according to a preferred embodiment of the invention.
Figure 4:
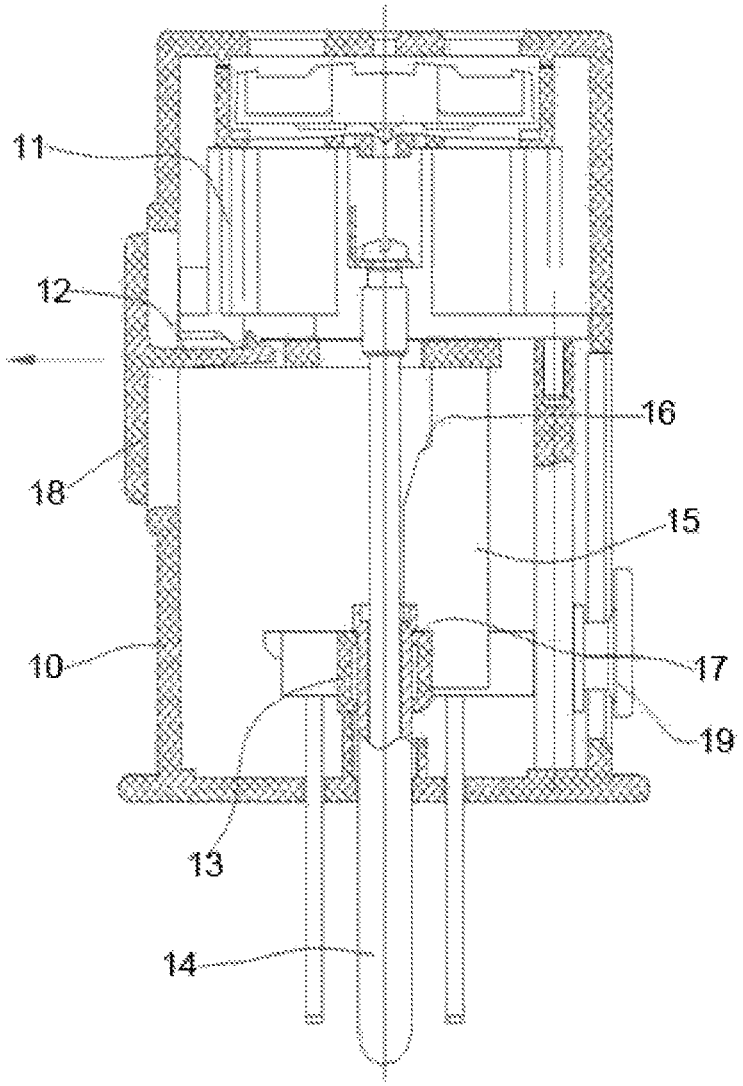
FIG. 4 is a sectional view showing a pin protruding in place according to a preferred embodiment of the invention.
Figure 5:
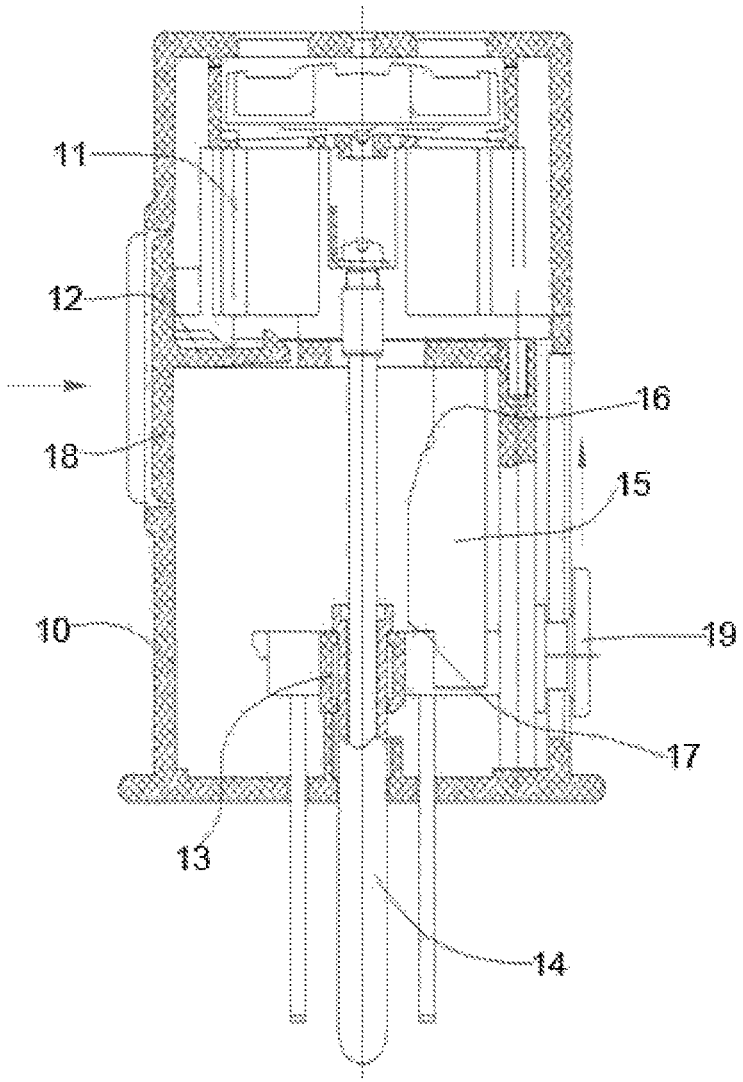
FIGS. 5-6 are sectional views showing a pin assembly to be retracted according to a preferred embodiment of the invention.

FIGS. 119-125 are schematic diagrams showing an Italian Standard plug in use. As shown in FIGS. 5-7, the Italian Standard plug includes a housing 10, and a ground module 1150*a*, an LN module 1151*a* and a locking module 1150*b* provided in the housing 10.

Figure 124:
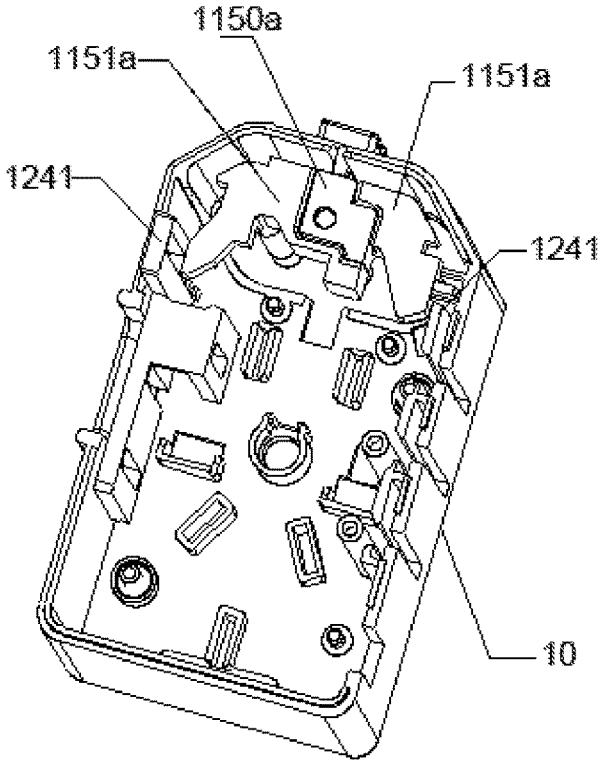
Figure 125:
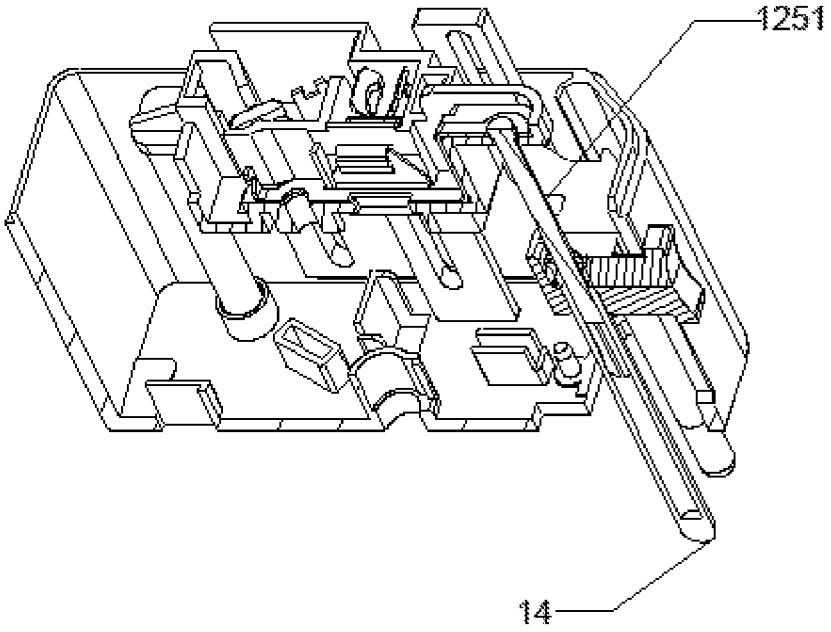
Figure 126:
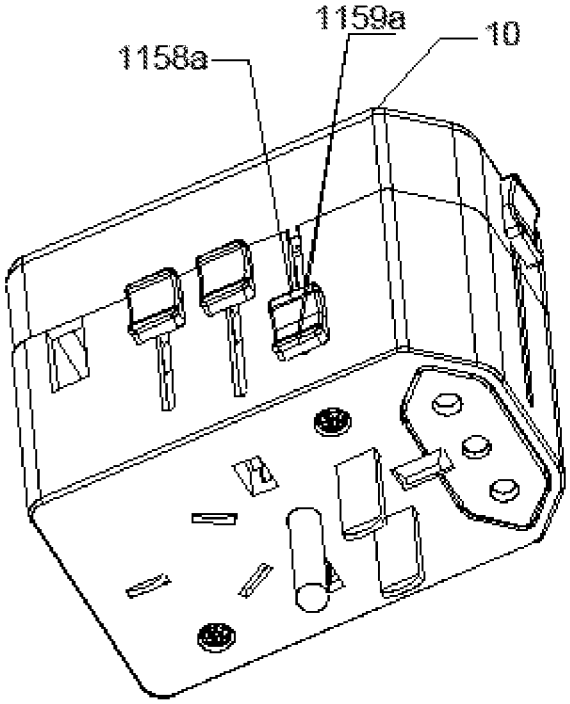

As shown in FIGS. 122-123, the Italian Standard plug includes a ground module 1150*a* and an LN module 1151*a* provided independently, the specific connection mode thereof has been illustrated in the embodiment, and it will not be described again here. At the same time, the Italian Standard plug further includes a locking module 1150*b* as shown in FIG. 118, and the principle thereof is also similar to that described above. Further, FIGS. 124-125 show perspective views of the Italian Standard plug, wherein the two sides of the LN base 1153*a* of the LN module 1151*a* are respectively provided with a protrusion 1231, which is embedded in a track on a guide plate 1241 provided on the inner wall of the housing 10, so that the LN module 1151*a* can drive the ground module 1150*a* to slide up and down along the track together, thus sliding will be more flexible and controllable. Further, the pin 14 has a hollow structure, the ground module 1150*a* includes a ground stem 1251, and the pin is sleeved on the ground stem 1251 to conduct electricity via the ground stem 1251.

A schematic diagram of the second use state of the Italian Standard plug, i.e., a state in which the ground module 1150*a* and the LN module 1151*a* are used at the same time, is shown in FIG. 120, wherein the pin 14 of the ground module 1150*a* and the L pin 1154*a* and the N pin 1155*a* of the LN module 1151*a* all completely protrude from the housing 10, and at this moment, the movable support 1156*a* of the locking module 1150*b* is located at the lock position and locks the ground module 1150*a* and the LN module 1151*a*. Specifically, the ground module 1150*a* (together with the LN module 1151*a*, because the LN module 1151*a* will protrude out as the ground module 1150*a* protrudes out) is positioned at the protrusion position by the second locking surface 1184*b* of the first limit pillar 1184, and at the same time, the second locking surface 1185*b* of the second limit pillar 1185 also positions the LN module 1151*a* at the protrusion position.

A schematic diagram of the first use state of the Italian Standard plug, that is, a state in which only the LN module 1151*a* is used, is shown in FIG. 121. At this moment, the pin 14 of the ground module 1150*a* retracts into the housing 10, while the L pin 1154*a* and the N pin 1155*a* of the LN module 1151*a* protrude from the housing 10, that is, the ground module 1150*a* and the LN module 1151*a* change from a conjunction state shown in FIG. 120 to a separation state shown in FIG. 121. At this moment, the movable support 1156*a* of the locking module 1150*b* is also at the lock position, and the ground module 1150*a* is independently positioned at the retraction position by the first locking surface 1184*a* of the first limit pillar 1184, while the LN module 1151*a* is independently positioned at the protrusion position by the second locking surface 1185*b* of the second limit pillar 1185.

In this embodiment, in the Italian Standard plug, the ground module 1150*a* and the LN module 1151*a* are provided independently and are locked and controlled by the first limit pillar 1184 and the second limit pillar 1185 of the locking module 1150*b*, so that the object of using the ground and LN poles simultaneously or using only the L and N poles may be attained flexibly by the conjunction and separation of the ground module 1150*a* and the LN module 1151*a* in use.

Embodiment 52

Figure 132:
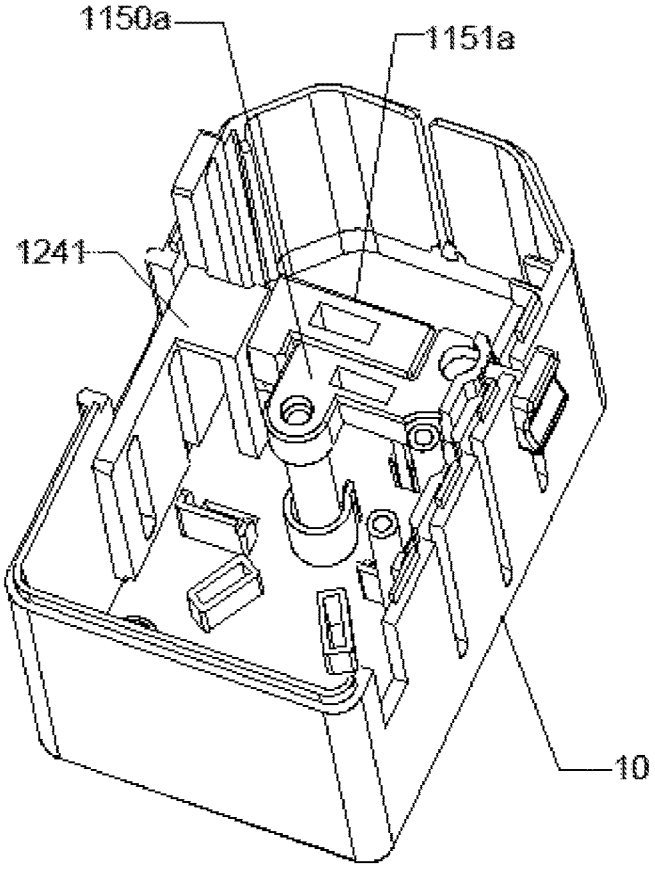
Figure 133:
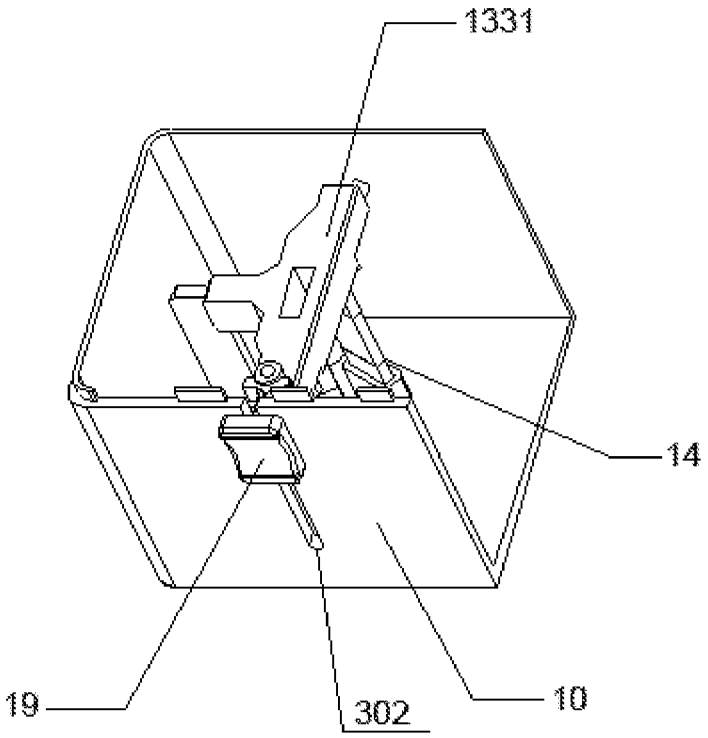

FIGS. 126-132 are schematic diagrams of an American Standard plug in use. As shown in FIGS. 130-131, the American Standard plug includes a housing 10, a ground module 1150*a* provided in the housing 10, LN module 1151*a* and a locking module 1150*b*. The American Standard plug includes a ground module 1150*a* and an LN module 1151*a* provided independently, the specific connection mode thereof has been illustrated in the embodiment, and it will not be described again here. At the same time, the American Standard plug further includes a locking module 1150*b* as shown in FIG. 118, and the principle thereof is also similar to that described above. Further, FIG. 132 shows a perspective view of the American Standard plug, wherein the LN base 1153*a* of the LN module 1151*a* is provided with a protrusion 1231, which is embedded in a track on a guide plate 1241 provided on the inner wall of the housing 10, so that the LN module 1151*a* can drive the ground module 1150*a* to slide up and down along the track together as guided by the guide plate 1241, thus sliding will be more flexible and controllable, thus sliding will be more flexible and controllable.

Figure 127:
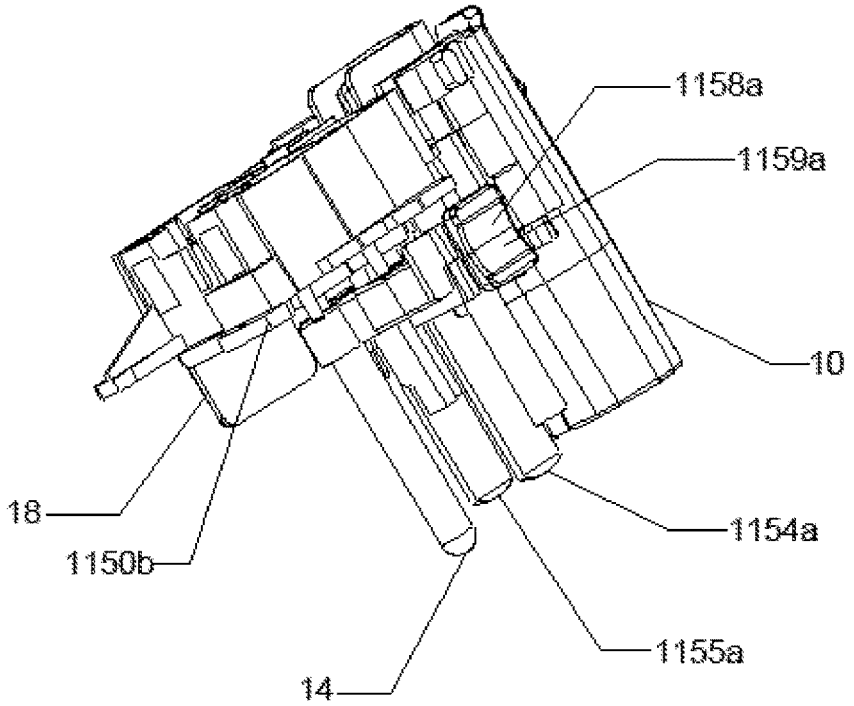

FIG. 127 is a schematic diagram showing the received state of the American Standard plug, i.e., a state in which the ground module 1150*a* and the LN module 1151*a* retract into the housing 10 at the same time. The pin 14 of the ground module 1150*a* and the L pin 1154*a* and the N pin 1155*a* of the LN module 1151*a* all retract into the housing 10, and at this moment, the movable support 1156*a* of the locking module 1150*b* is located at the lock position, the first notch 1183*a* of the second limit pillar 1183 positions the LN module 1151*a* (together with the ground module 1150*a*, because the ground module 1150*a* will retract as the LN module 1151*a* retracts) at the retraction position, and at the same time, the first notch 1182*a* of the first limit pillar 1182 may position the ground module 1150*a* at the retraction position.

Figure 128:
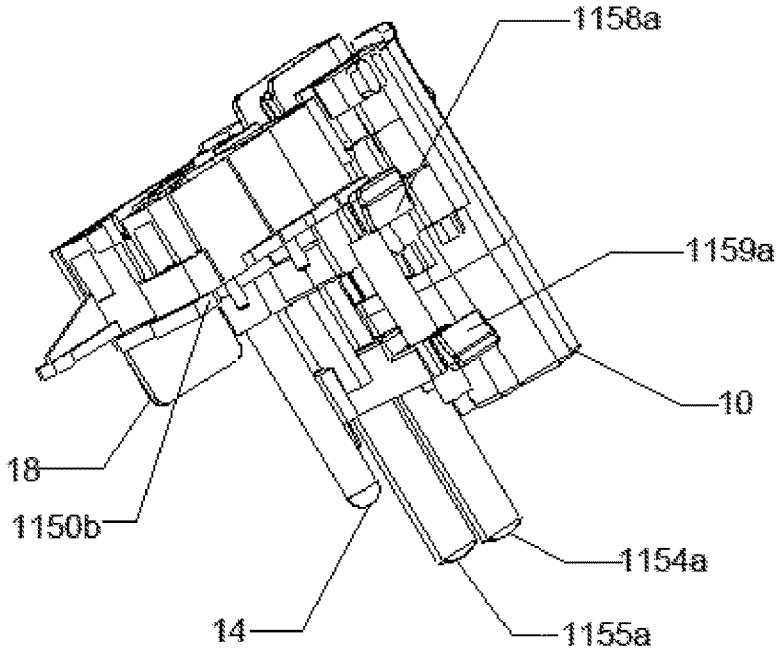
Figure 129:
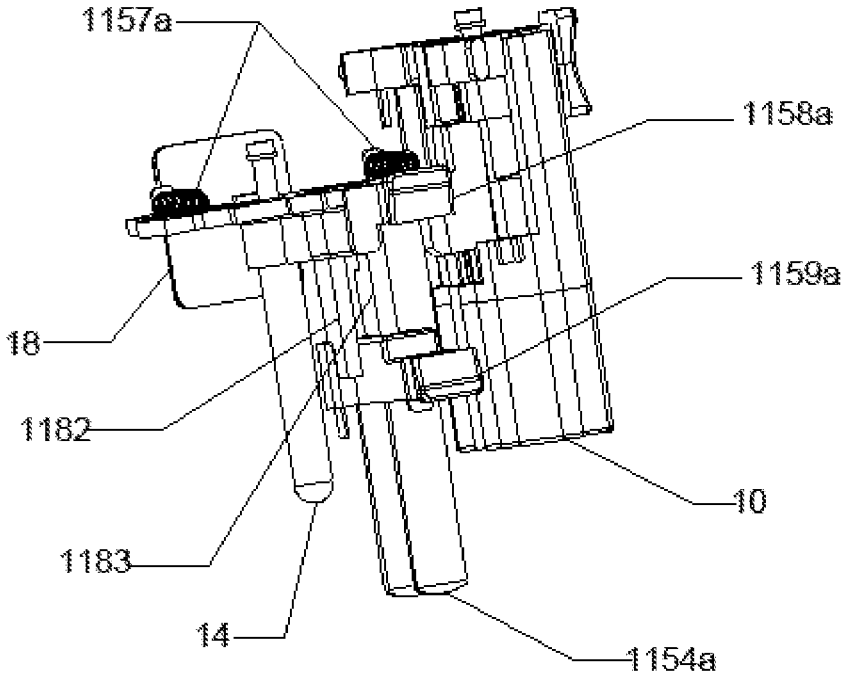

FIGS. 128-129 are schematic diagrams showing the first use state of the American Standard plug, i.e., a state in which only the LN module 1151*a* is used, and at this moment, the pin 14 of the ground module 1150*a* retracts into the housing 10, while the L pin 1154*a* and the N pin 1155*a* of the LN module 1151*a* protrude from the housing 10, that is, the ground module 1150*a* and the LN module 1151*a* change from a conjunction state shown in FIG. 127 to a separation state shown in FIGS. 128-129. At this moment, the movable support 1156*a* of the locking module 1150*b* is also at the lock position, and the first notch 1182*a* of the first limit pillar 1182 independently positions the ground module 1150*a* at the retraction position. At this moment, the second notch 1183*b* of the second limit pillar 1183 independently positions the LN module 1151*a* at the protrusion position.

In the technical solution, in the American Standard plug, the ground module 1150*a* and the LN module 1151*a* are provided independently and are locked and controlled by the first limit pillar 1184 and the second limit pillar 1185 of the locking module 1150*b*, so that the object of using three poles at the same time or only using two poles may be attained flexibly by the conjunction and separation of the ground module 1150*a* and the LN module 1151*a* in use.

Embodiment 53

Based on the technical solutions, as shown in FIGS. 133-142, the housing 10 of the travel adapter further includes:

at least one plug 631 and a protrusion surface, wherein the plug 631 may operably protrude from the protrusion surface and retract into the housing 10 via a retractive structure 1331.

The retractive structure 1331 includes a slide button 19 protruding from the housing 10, the housing 10 is provided with a sliding slot 302 for the slide button 19 to move between a first position corresponding to the retraction of the plug 631 and a second position corresponding to the protrusion of the plug 631 along the sliding slot 302.

Wherein, the first position (as shown in FIGS. 139-140) refers to the position of the slide button 19 in the sliding slot 302 when the pin 14 of the plug 631 retracts into the housing 10 and is in a non-use state under the action of the protrusion and retraction of the retractive structure 1331. In the drawings, it shows that the slide button 19 is located at the upper end position of the sliding slot 302.

The second position (as shown in FIGS. 141-142) refers to the position of the slide button 19 in the sliding slot 302 when the pin 14 of the plug 631 protrudes from the protrusion surface of the housing 10 for use under the action of the protrusion and retraction of the retractive structure 1331. In the drawings, it shows that the slide button 19 is located at the lower end position of the sliding slot 302.

Then, the door structure in the travel adapter of the invention includes:

a first door 1371, which is provided on side of the plane on which the sliding slot 302 exists and is slidably provided in the housing 10, for covering and opening the sliding slot 302;

a first elastic element 1361, which is connected between the first door 1371 and the housing 10 and configured for providing an elastic force in the sliding direction for the first door 1371 to make the first door 1371 cover the region of the first door 1371 corresponding to the sliding slot 302, that is, the upper end part of the sliding slot 302, when the slide button 19 is at the second position;

a second door 1375, which is provided on the same side as the first door 1371 and is slidably provided in the housing 10, for covering and opening the sliding slot 302; and a second elastic element 1362, which is between the second door 1375 and the housing 10 and configured for providing an elastic force in the sliding direction for the second door 1375 to make the second door 1375 cover the region of the second door 1375 corresponding to the sliding slot 302, i.e., the lower end part of the sliding slot 302, when the slide button 19 is at the first position.

In the technical solution, when the plug 631 retracts from the protrusion surface, that is, when the slide button 19 is at the first position, the second door 1375 is pushed to move to the direction of the sliding slot 302 under the action of the elastic force of the second elastic element 1362 to cover the region on the sliding slot 302 corresponding to the second door 1375 (as shown in FIGS. 139-140), i.e., to cover the lower end position of the sliding slot 302, thereby preventing a metal tip from piercing the sliding slot 302 and guaranteeing the electrical safety for a user.

Correspondingly, in the technical solution, when the plug 631 protrudes from protrusion surface, that is, when the slide button 19 is at the second position, the first door 1371 is pushed to move to the direction of the sliding slot 302 under the action of the elastic force of the first elastic element 1361 to cover the region on the sliding slot 302 corresponding to the first door 1371 (as shown in FIGS. 141-142), that is, to cover the upper end position of the sliding slot 302, thereby preventing a metal tip from piercing the sliding slot 302 and guaranteeing the electrical safety for a user. At the same time, the blocking of the first door 1371 and the second door 1375 can ensure the retraction or protrusion state of the plug 631 and guarantee the reliability and security in use, while covering the sliding slot 302.

Preferably, the sliding direction of the first door 1371 is a direction in the same plane as and vertical to the extension direction of the sliding slot 302. Correspondingly, the sliding direction of the second door 1375 is a direction in the same plane as and vertical to the extension direction of the sliding slot 302.

Embodiment 54

Based on the technical solutions, as shown in FIG. 134, the housing 10 further includes:

an operating surface 1341, on which the sliding slot 302 provided;

a first limit structure 1342, which is provided in the housing 10 and located on the structure of the housing 10 vertical to the operating surface 1341 to restrict the moving range of the first door 1371 and the second door 1375 in the sliding direction; and a second limit structure 1343, which is provided in the housing 10 and is located on the structure of the housing 10 parallel to the operating surface 1341 to prevent the first door 1371 and the second door 1375 from moving in a direction having an included angle with the direction of the operating surface 1341 larger than 0 degree.

In this embodiment, because a first limit structure 1342 is provided on the operating surface 1341 corresponding to the sliding slot 302, it may guarantee that the first door 1371 and the second door 1375 only slide on the left and right sides of the sliding slot 302 shown in FIG. 134, without exceeding the range limited by the first limit structure 1342. At the same time, a second limit structure 1343 is provided, and it may guarantee that the first door 1371 and the second door 1375 will not be pushed into the housing 10 during moving. Moreover, because the second limit structure 1343 can prevent the first door 1371 and the second door 1375 from moving in a direction having an included angle with the direction of the operating surface 1341 larger than 0 degree, it may guarantee that no gap with a fine angle exists when the first door 1371 and the second door 1375 covers the sliding slot 302, thereby preventing a tip such as a probe from piercing.

Embodiment 55

Based on the technical solutions, in this embodiment, the first limit structure 1342 is separately provided as two first protrusions on the two sides of the sliding slot 302. The second limit structure 1343 is provided as two second protrusions vertical to the two first protrusions respectively. A gap is provided between the two second protrusions for the slide button 19 to pass through and thus protrude from the operating surface 1341.

Wherein, the first protrusion and the second protrusion may be punctiform protrusions, so long as they can restrict the movement range of the first door 1371 and the second door 1375. During the manufacture of the housing 10, holes may be easily opened on the two sides of the sliding slot 302, that is, the punctiform protrusions may be provided on the inner wall of the operating surface 1341. By such an arrangement mode, the manufacture process may be greatly simplified, and it will be favorable for batch production. Or, the first protrusion and the second protrusion may be cauliform protrusions and provided on the inner wall of the operating surface 1341 adjacent to the sliding slot 302 for better restricting the movement range of the first door 1371 and the second door 1375.

Embodiment 56

Based on the technical solutions, in this embodiment, the first limit structure 1342 and the second limit structure 1343 are mainly formed of a pair of guiding slots respectively provided on the two sides of the sliding slot 302, and a gap is provided between said pair of guiding slots for the slide button 19 to protrude out.

Then, in this embodiment, the first limit structure 1342 and the second limit structure 1343 are provided as guiding slots, which may restrict the movement range of the first door 1371 and the second door 1375 to a greater extent, so that the first door 1371 can completely shield the upper end part of the sliding slot 302 without any gap when the plug 631 protrudes from the protrusion surface, and the second door 1375 can completely shield the lower end part of the sliding slot 302 without any gap when the plug 631 retracts into the housing 10. At the same time, during shielding the sliding slot 302, the first door 1371 and the second door 1375 are firmly restricted in the range corresponding to the sliding slot 302 defined by said pair of guiding slots, and the first door 1371 and the second door 1375 are locked by said pair of guiding slots, and no movement deviation will appear.

Embodiment 57

Based on the technical solutions, as shown in FIG. 137, in this embodiment, the first door 1371 includes a pair of first chamfers 1372, which are respectively provided on the upper and lower ends of the first door 1371 and configured for guiding the first door 1371 to leave the position covering the sliding slot 302 when the slide button 19 moves along the sliding slot 302.

In this embodiment, the second door 1375 includes a pair of second chamfers 1376, which are respectively provided on the upper and lower ends of the second door 1375 and configured for guiding the second door 1375 to leave the position covering the sliding slot 302 when the slide button 19 moves along the sliding slot 302.

Wherein, when the slide button 19 slides from top to bottom in the sliding slot 302, the slide button 19 slides downward, under the guide of the first chamfer 1372 located on the upper end of the first door 1371, to the second chamfer 1376 on the upper end of the second door 1375, and then continues sliding downward under the guide of the second chamfer 1376 on the upper end of the second door 1375 so as to push the second door 1375 to press the second elastic element 1362 and make the pin 14 protrude from the protrusion surface under the action of protrusion and retraction. In this process, because the slide button 19 moves downward, the first door 1371 is loosen, so that the first elastic element 1361 pushes the first door 1371 to move along the sliding direction of the first door 1371 under the action of an elastic force, till the upper end part of the sliding slot 302 unoccupied by the slide button 19 is completely covered. At this moment, while covering the upper end part of the sliding slot 302, the first door 1371 also restricts the slide button 19 under the action of the elastic force of the first elastic element 1361, so that the slide button 19 will be at the second position and move no longer; and at this moment, the second door 1375 is pushed by the slide button 19 to compress the second elastic element 1362 and is in an immobile state, thus it may guarantee that the plug 631 is kept in a use state, thereby guaranteeing the reliability in use.

Embodiment 58

Based on the technical solutions, as shown in FIGS. 137-138, in this embodiment, the first door 1371 and the second door 1375 are slidably spliced along a moving direction parallel to the first door 1371 and the second door 1375 via a connection structure. The connection structure includes a third protrusion 1373 provided on the first door 1371 and a fourth protrusion 1377 provided on the second door 1375 and fitting the third protrusion 1373, and the first door 1371 is slidably spliced to the second door 1375 via the third protrusion 1373 and the fourth protrusion 1377.

In this embodiment, by providing protrusions to slidably splice the first door 1371 and the second door 1375, the splicing of the first door 1371 and the second door 1375 can be made tighter. Wherein, the moving direction of the first door 1371 and the second door 1375 is vertical to the direction of the sliding slot 302, and in the drawings, it is shown by the lateral movement between the first limit structures 1342 provided on the two sides of the sliding slot 302.

Preferably, the third protrusion 1373 of the first door 1371 facing the side of the first door 1371 having the first chamfer 1372 is provided with a fourth chamfer 1374, the fourth protrusion 1377 of the second door 1375 facing the side of the second door 1375 having the second chamfer 1376 is provided with a third chamfer 1378, and the fourth chamfer 1374 and third chamfer 1378 fit the third protrusion 1373 and the fourth protrusion 1377 at the position where the first door 1371 and the second door 1375 are spliced, so that the slide flexibly after splicing may be improved, and the first door 1371 and the second door 1375 may be prevented from being blocked during sliding.

Embodiment 59

Based on the technical solutions, as shown in FIG. 136, in this embodiment, the first elastic element 1361 and second elastic element 1362 are mainly formed of a 3-shaped blade spring, and the two arches of the 3-shaped blade spring respectively correspond to the first elastic element 1361 and the second elastic element 1362.

In this embodiment, by employing the 3-shaped blade spring, it will be favorable for saving the material cost and making the door structure manufactured simpler.

In the technical solution, when the pin 14 retracts into the housing 10, that is, when the slide button 19 is located at the first position in the sliding slot 302, the slide button 19 will be seated on the first door 1371, and the first door 1371 will be pressed on the upper arch of the 3-shaped blade spring, so that the upper arch of the 3-shaped blade spring will be compressed. The lower arch of the 3-shaped blade spring provides an elastic force to push the second door 1375 to cover the region of the sliding slot 302 unoccupied by the slide button 19, i.e., the lower end part of the sliding slot 302 exposed. When the pin 14 protrudes from the housing 10, that is, when the slide button 19 is located at the second position in the sliding slot 302, the slide button 19 will be seated on the second door 1375, and the second door 1375 will be pressed on the lower arch of the 3-shaped blade spring, so that the lower arch of the 3-shaped blade spring will be compressed. The upper arch of the 3-shaped blade spring provides an elastic force to push the first door 1371 to cover the region of the sliding slot 302 unoccupied by the slide button 19, i.e., the upper end part of the sliding slot 302 exposed.

Embodiment 60

Based on the technical solutions, in this embodiment, the first elastic element 1361 may also be provided with at least one first spring, for example, two paratactic first springs, the second elastic element 1362 may be provided with at least one second spring, for example, two paratactic second springs, and the first spring and the second spring are provided independently.

Then, in this embodiment, first springs and second springs provided independently are employed, and the number of the first springs and the second springs may be more than one. This may provide a better elastic force, and the elastic force of the first spring and the second spring will not affect each other.

In the technical solution, when the pin 14 retracts into the housing 10, that is, when the slide button 19 is located at the first position in the sliding slot 302, the slide button 19 will be seated on the first door 1371, and the first door 1371 will be pressed on the first spring to compress the first spring. The second spring provides an elastic force to push the second door 1375 to cover the region of the sliding slot 302 unoccupied by the slide button 19, i.e., the lower end part of the sliding slot 302 exposed. When the pin 14 protrudes from the housing 10, that is, when the slide button 19 is located at the second position in the sliding slot 302, the slide button 19 will be seated on the second door 1375, and the second door 1375 will be pressed on the second spring to compress the second spring. The first spring provides an elastic force to push the first door 1371 to cover the region of the sliding slot 302 unoccupied by the slide button 19, i.e., the upper end part of the sliding slot 302 exposed.

Embodiment 61

Based on the technical solutions, as shown in FIG. 135, in this embodiment, the slide button 19 is a handle-shaped slide button 19, which is exposed on the operating surface 1341 of the housing 10 for being grasped by a user easily. the retractive structure 1331 may be pushed via the handle-shaped slide button 19, so that the plug 631 can flexibly protrude from or retract into the housing 10.

The operating principle of the door structure in the technical solutions will be further described below by a specific embodiment. It should be noted that, the description below is merely used for explaining the practicability of the technical solutions of the invention, rather than limiting the protection scope of the invention.

As shown in FIGS. 139-140, at this moment, the plug 631 retracts into the housing 10, and the slide button 19 is located on the first position of the sliding slot 302, that is, it is shown in the drawings that the slide button 19 is located on the upper end part of the sliding slot 302. Because the slide button 19 occupies the upper end part of the sliding slot 302, the first door 1371 will be pressed on the first elastic element 1361, while the second elastic element 1362 provides an elastic force to push the second door 1375 to cover the lower end part of the sliding slot 302. Because the first door 1371 and the second door 1375 interact with each other, the slide button 19 will be clipped at the upper end position of the sliding slot 302 without movement, thus it may guarantee that the plug 631 will always be in the state of retracting into the housing 10. At the same time, the second door 1375 covers the region of the sliding slot 302 unoccupied by the slide button 19 seamlessly to prevent a metal probe from piercing and to prevent dust from entering at the same time.

As shown in FIGS. 141-142, when the slide button 19 slides from top to bottom in the sliding slot 302, the slide button 19 slides downward, under the guide of the first chamfer 1372 located on the upper end of the first door 1371, to the second chamfer 1376 on the upper end of the second door 1375, and then continues sliding downward under the guide of the second chamfer 1376 on the upper end of the second door 1375 so as to push the second door 1375 to press the second elastic element 1362 and make the pin 14 protrude from the protrusion surface under the action of protrusion and retraction. In this process, because the slide button 19 moves downward, the first door 1371 is loosen, so that the first elastic element 1361 pushes the first door 1371 to move along a direction parallel to the sliding slot 302 under the action of an elastic force, till the upper end part of the sliding slot 302 unoccupied by the slide button 19 is completely covered. At this moment, while covering the upper end part of the sliding slot 302, the first door 1371 further restricts the slide button 19 under the action of the elastic force of the first elastic element 1361, so that the slide button 19 will be at the second position and move no longer. The second door 1375 is pushed by the slide button 19 to compress the second elastic element 1362 and is in an immobile state, thus it may guarantee that the plug 631 is kept in a use state, thereby guaranteeing the reliability in use.

Then, in the door structure of the travel adapter, the slide button 19 may slide up and down in the sliding slot 302. When the plug is to be used, the slide button 19 is slided downward to make the plug 631 protrude from the housing 10; and after being used, the slide button 19 is slided upward to make the plug 631 retract into the housing 10. Use/non-use state of the plug 631 may be switched flexibly and quickly via the first door 1371 and the second door 1375 provided separately in conjunction with the action of the first elastic element 1361 and the second elastic element 1362; and in use, the sliding slot 302 can be made seamless as covered by the first door 1371 and the second door 1375, thus electrical safety can be guaranteed.

Embodiment 62

Based on the technical solutions, in the travel adapter according to the invention, the housing thereof is further provided with at least one plug, which can operably protrude from the housing and retract into the housing via a retractive structure, wherein, as shown in FIG. 143, the travel adapter includes a conductive structure, and the conductive structure specifically includes:

a first conductive structure 1431, which is provided with conductive structure groups corresponding to the number of the plugs, each conductive structure group includes an L conductive structure and an N conductive structure, all the L conductive structures are interconnected to the first L connection point 1433, and all the N conductive structures are interconnect to the first N connection point 1434; and a second conductive structure 1432, which is provided with at least one output sleeve assembly, each output sleeve assembly includes an L output sleeve 1431*b* and an N output sleeve 1432*b*, each L output sleeve 1431*b* is electrically connected with the first L connection point 1433, and each N output sleeve 1432*b* is electrically connected with the first N connection point 1434.

Each plug includes a set of pins, said set of pins include an L pin and an N pin, and each set of pins correspond to a conductive structure group one to one.

When the plug protrudes from the housing, the L pin will be electrically connected with the L conductive structure of the corresponding conductive structure group, and the N pin will be electrically connected with the N conductive structure of the corresponding conductive structure group.

In this embodiment, all the L conductive structures are electrically connected with each other and electrically connected with the L output sleeve 1431*b* after being jointly connected to the first L connection point 1433, and all the N conductive structures are electrically connected with each other and electrically connected with the N output sleeve 1432*b* after being jointly connected to the first N connection point 1434, thus when plugs adapting the plug standards of different countries are inserted into the socket, the L plug will be electrically connected with the L output sleeve 1431*b* via the L conductive structure, and the N plug will be electrically connected with the N output sleeve 1432*b* via the N conductive structure. Thus, it can guarantee that the polarity of the output sleeves will always be L/N, and the potential safety hazard of the exchange of the L/N positions can be eliminated.

Embodiment 63

Based on the technical solutions, as shown in FIG. 144, the conductive structure group is a conductive sleeve assembly, and correspondingly, the L conductive structure is an L conductive sleeve, and the N conductive structure is an N conductive sleeve; and Each set of the pins further includes an L conductive insertion piece connected to the L pin correspondingly and an N conductive insertion piece connected to the N pin correspondingly.

When the plug protrudes from the housing, the L conductive insertion piece will be inserted into the L conductive sleeve of the corresponding conductive sleeve assembly with the protrusion of the plug, and the N conductive insertion piece will be inserted into the N conductive sleeve of the corresponding conductive sleeve assembly with the protrusion of the plug.

Further, still as shown in FIG. 144, the first conductive structure 1431 is provided with four conductive sleeve assemblies, which are respectively:

a first L conductive sleeve 1441*a* and a first N conductive sleeve 1442*a;* a second L conductive sleeve 1441*b* and a second N conductive sleeve 1442*b;* a third L conductive sleeve 1441*c* and a third N conductive sleeve 1442*c*; and a fourth L conductive sleeve 1441*d* and a fourth N conductive sleeve 1442*d*.

Wherein, the first L conductive sleeve 1441*a*, the second L conductive sleeve 1441*b*, the third L conductive sleeve 1441*c* and the fourth L conductive sleeve 1441*d* are interconnect to the first L connection point 1433.

The first N conductive sleeve 1442*a*, the second N conductive sleeve 1442*b*, the third N conductive sleeve 1442*c* and the fourth N conductive sleeve 1442*d* are interconnect to the first N connection point 1434.

In this embodiment, the conductive sleeves (including all the L conductive sleeves and N conductive sleeves) are all formed by folding a copper sheet, and a solder leg corresponding to a conductive sleeve may be provided by the side of each conductive sleeve (for example, a first L solder leg is provided by the side of the first L conductive sleeve 1441*a*, and a first N solder leg is provided by the side of the first N conductive sleeve 1442*a*, and the like), and then all the L conductive sleeves are interconnected to the first L connection point 1433 via an L jumper wire, and all the N conductive sleeves are interconnected to the first N connection point 1434 via an N jumper wire.

In this embodiment, all the L conductive sleeves are interconnected to the first L connection point 1433 after being electrically connected with each other so as to take power by inserting the L pin of the plug into any L conductive sleeve and provide an electrical output to the L output sleeve 1431*b* via the first L connection point 1433; all the N conductive sleeves are interconnected to the first N connection point 1434 after being electrically connected with each other so as to take power by inserting the N pin of the plug into any N conductive sleeve and provide an electrical output to the N output sleeve 1432*b* via the first N connection point 1434. Therefore, when plugs of standards of different countries are inserted into the output sleeve, the L plug always takes power via the L output sleeve 1431*b* from the L conductive insertion piece in the L pin in the L conductive sleeve, and the N plug always takes power via the N output sleeve 1432*b* from the N conductive insertion piece of the N pin in the N conductive sleeve, thus it may guaranteed that the polarity of the output sleeves will not be exchanged.

Embodiment 64

Based on the technical solutions, as shown in FIGS. 144-145, the first conductive structure 1431 specifically includes:

a first conductive plate 1443, on which the conductive sleeve assemblies are provided, the first conductive plate 1443 further includes a through hole for the pin assembly of the corresponding conductive sleeve assembly to pass through;

a first L conductive line 1451, which is provided on the first conductive plate 1443 and connected with the first L connection point 1433, the L conductive sleeves in each conductive sleeve assembly are electrically connected via the first L conductive line 1451; and a first N conductive line 1452, which is provided on the first conductive plate 1443 and connected with the first N connection point 1434, the N conductive sleeves in each conductive sleeve assembly are electrically connected via the first N conductive line 1452.

As a preferred embodiment, the first L conductive line 1451 is a patterned copper foil conductive layer.

As a preferred embodiment, the first N conductive line 1452 is a patterned copper foil conductive layer.

As a preferred embodiment, the first L conductive line 1451 and the first N conductive line 1452 are both patterned copper foil conductive layers.

In this embodiment, the L conductive sleeves in each of the conductive sleeve assemblies are electrically connected and then interconnected to the first L connection point 1433 via the first L conductive line 1451, and hence a good L electrical connection may be realized. Similarly, the N conductive sleeves in each conductive sleeve assembly are electrically connected and then interconnected to the first N connection point 1434 via the first N conductive line 1452, and hence a good N electrical connection may be realized.

Embodiment 65

Based on the technical solutions, as shown in FIG. 146, the plug bush seat 11 in the housing is provided on the second conductive structure 1432, and the output sleeve assembly is provided on the plug bush seat 11, and the second conductive structure 1432 further includes:

a second L conductive line 1431*a*, which is provided on the plug bush seat 11, the L output sleeve 1431*b* in the output sleeve assembly is connected to the second L conductive line 1431*a*, the second L conductive line 1431*a* is provided with a second L connection point, and the second L connection point is electrically connected with the first L connection point 1433;

a second N conductive line 1432*a*, which is provided on the plug bush seat 11, the N output sleeve 1432*b* in the output sleeve assembly is connected to the second N conductive line 1432*a*, the second N conductive line 1432*a* is provided with a second N connection point, and the second N connection point is electrically connected with the first N connection point 1434.

As a preferred embodiment, the second L conductive line 1431*a* is a conductive metal sheet.

As a preferred embodiment, the second N conductive line 1432*a* is a conductive metal sheet.

As a preferred embodiment, the second L conductive line 1431*a* and the second N conductive line 1432*a* are both conductive metal sheets.

In this embodiment, the L output sleeve 1431*b* of the output sleeve assembly is electrically connected with one L conductive sleeve by the second L conductive line 1431*a* via the first L connection point 1433, and the N output sleeve 1432*b* is electrically connected with one N conductive sleeve by the second N conductive line 1432*a* via the first N connection point 1434. Thus, when plugs of standards of different countries are inserted into the output sleeve, the polarity of the output sleeve will always be kept as L/N.

Embodiment 66

Based on the technical solutions, In this embodiment, the first L connection point 1433 is a first solder leg, the second L connection point is a second solder leg, and the first solder leg and the second solder leg are electrically connected via an L connection line 1436.

At the same time, the first N connection point 1434 is a third solder leg, the second N connection point is a fourth solder leg, and the third solder leg and the fourth solder leg are electrically connected via an N connection line 1437.

As a preferred embodiment, the L connection line 1436 may be a patterned copper foil conductive layer provided on the second conductive plate, and the N connection line 1437 may also be a patterned copper foil conductive layer provided on the second conductive plate; or the L connection line 1436 and the N connection line 1437 are both jumper wires connecting two solder legs, that is, the L connection line 1436 and the N connection line 1437 may be independently provided a wire for electrical connection, without employing the second conductive plate.

In this embodiment, the first L connection point 1433 of the first conductive structure 1431 and the second L conductive line 1431*a* of the second conductive structure 1432 are connected via the L connection line 1436, so that an L electrical path is formed between the first conductive structure 1431 and the second conductive structure 1432. The first N connection point 1434 of the first conductive structure 1431 and the second N conductive line 1432*a* of the second conductive structure 1432 are connected via the N connection line 1437, so that an N electrical path is formed between the first conductive structure 1431 and the second conductive structure 1432. Thus, when plugs of standards of different countries are inserted into the output sleeve, the polarity of the output sleeve will always be kept as L/N.

Embodiment 67

Based on the technical solutions, as shown in FIG. 144, in this embodiment, the travel adapter further includes: a fourth conductive structure 1435 provided with a USB interface (not shown), which is electrically connected with the first conductive structure 1431. The fourth conductive structure 1435 includes an L connection line 1436, which is connected with the first L connection point 1433. The fourth conductive structure 1435 further includes an N connection line 1437, which is connected with the first N connection point 1434.

Wherein, the first L connection point 1433 is a first sleeve, and the fourth conductive structure 1435 includes a first pin connected with an L connection line, and the first pin is inserted into the first sleeve to form electrical connection.

Alternatively, the first L connection point 1433 may also be a first pin, and the fourth conductive structure 1435 includes a first sleeve connected with the L connection line, and the first pin is inserted into the first sleeve to form electrical connection.

As a preferred embodiment, the first N connection point 1434 is a second sleeve, and the fourth conductive structure 1435 includes a second pin connected with the N connection line, and the second pin is inserted into the second sleeve to form electrical connection.

As an alternative embodiment, the first N connection point 1434 may also be a second pin, the fourth conductive structure 1435 may include a second sleeve connected with the N connection line, and the second pin is inserted into the second sleeve to form electrical connection. Further, the fourth conductive structure 1435 is provided with rectifier transformer (not shown) connected with the USB interface, which converts the electric supply obtained by the fourth conductive structure 1435 via the first conductive structure 1431 into a 5V DC voltage output to the USB interface. As the principle for the voltage conversion of the rectifier transformer belongs to the prior art, it will not be described again here.

In this embodiment, the fourth conductive structure 1435 and the first conductive structure 1431 are connected by means of pins and sleeves, and hence the connection between the fourth conductive structure 1435 and the first conductive structure 1431 will be more flexible. Once the connection is damaged, it may be mended by replacing the pin/sleeve for connection. Moreover, the pins/sleeves for connection may both be provided on a conductive plate, which is convenient for fixing and mounting.

Embodiment 68

Based on the technical solutions, the at least one output sleeve assembly includes a set of two-hole output sleeve assembly and a set of three-hole output sleeve assembly. The L output sleeve 1431*b* of the two-hole output sleeve assembly and the L output sleeve 1431*b* of the three-hole output sleeve assembly are formed integrally. The N output sleeve 1432*b* of two-hole output sleeve assembly and the N output sleeve 1432*b* of three-hole output sleeve assembly are formed integrally.

In this embodiment, the output sleeve assembly is provided to at least include a set of two-hole output sleeve assembly and a set of three-hole output sleeve assembly for adapting plugs of standards of different countries. Moreover, the L poles and N poles of the two-hole output sleeve assembly and the three-hole output sleeve assembly are correspondingly formed integrally, thus no matter the plugs of standards of different countries are inserted into the two-hole output sleeve assembly or the three-hole output sleeve assembly, L electrical connection can be realized by the L poles formed integrally, and N electrical connection can be realized by the N poles formed integrally.

The operating principle of the travel adapter will be further described below via a specific embodiment. It should be noted that, the description below is merely used for explaining the practicability of the technical solutions of the invention, rather than limiting the protection scope of the invention.

Figure 148:
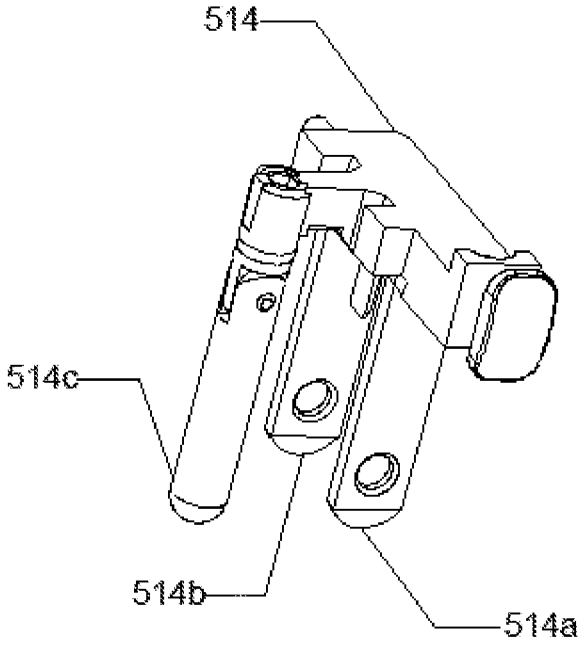

FIGS. 147-150 respectively show four plugs of standards of different countries corresponding to the four conductive sleeve assemblies in the travel adapter according to preferred embodiments of the invention. Wherein, FIG. 147 is a structural diagram showing a plug of the British Standard (British Standard plug 515, for short), which includes an L pole 515*a*, an N pole 515*b* and a ground protection pole 515*c*; FIG. 148 is a structural diagram showing a plug of the American standard (American Standard plug 514, for short), which includes an L pole 514*a*, an N pole 514*b* and a ground protection pole 514*c*; FIG. 149 is a structural diagram showing a plug of the Italian Standard (Italian Standard plug 1491, for short), which includes an L pole 1491*a*, an N pole 1491*b* and a ground protection pole 1491*c*; and FIG. 150 is a structural diagram showing a plug of the Australian Standard (Australian Standard plug 516, for short), which includes an L pole 516*a*, an N pole 516*b* and a ground protection pole 516*c*.

Take the Australian Standard plug 516 shown in FIG. 150 (in conjunction with FIGS. 151-152) as an example:

The Australian Standard plug 516 includes: an L pin 516*a* and an L conductive insertion piece 516*d* correspondingly connect to the L pin, and an N pin 516*b* and an N conductive insertion piece 516*f* correspondingly connected to the N pin, and a ground protection pole 516*c*.

When the Australian Standard plug 516 is used for taking power, the L pin 516*a* is inserted into the L conductive sleeve, thus the L conductive insertion piece 516*d* contacts the L conductive sleeve to form an electrical connection; the L conductive sleeve is connected with the second L conductive line 1431*a* of the second conductive structure 1432 by the first L conductive line 1451 of the first conductive structure 1431 via the first L connection point 1433, and thus it connected with the L output sleeve 1431*b*, that is, the corresponding connection between the L pin 516*a* and the L output sleeve 1431*b* of the Australian Standard plug 516 is realized. Similarly, the N pin 516*b* is inserted into the N conductive sleeve, thus the N conductive insertion piece 516*f* contacts the N conductive sleeve to form an electrical connection; and the N conductive sleeve is connected with the second N conductive line 1432*a* of the second conductive structure 1432 by the first N conductive line 1452 of the first conductive structure 1431 via the first N connection point 1434, and is thus connected with the N output sleeve 1432*b*, that is, the corresponding connection between the N pin 516*b* and the N output sleeve 1432*b* of the Australian Standard plug 516 is realized. Therefore, power may be taken from the L pin 516*a* of the Australian Standard plug 516 and transferred to the L output sleeve 1431*b* via the L pole path, and power may be taken from the N pin 516*b* and transferred to the N output sleeve 1432*b* via the N pole path, so that the determination of the L/N positions may be guaranteed, and no potential safety hazard exists in use.

The description only shows some preferred embodiments of the invention, rather than limiting the embodiments and protection scope of the invention. It should be understood by one skilled in the art that, all equivalent substitutions and apparent variations made in the light of the embodiments and drawings of the invention should be construed as pertaining to the protection scope of the invention.

What is claimed is:

1. A travel adapter, comprising: a housing, a plug bush seat, a support frame and a pin assembly, the plug bush seat being provided in the housing, the support frame being located under the plug bush seat and connected with the plug bush seat, and multiple sets of plug assemblies being provided on the support frame respectively; wherein:

the support frame is fixedly connected on the plug bush seat in a vertical direction and slides along the plug bush seat in a horizontal direction, the plug bush seat comprises an upper positioning piece, which is provided on a bottom surface of the plug bush seat, the upper positioning piece further comprises a downward-extending plate and a horizontal plate, the downward-extending plate extends downwardly from the upper positioning piece, the horizontal plate is provided on one end of the downward-extending plate that is not connected with the upper positioning piece and extends laterally, and an interspace is formed between the horizontal plate and the bottom surface of the plug bush seat.

2. The travel adapter as claimed in claim 1, wherein, the support frame further comprises a hollow part, which is provided on an upper end face of the support frame;

the hollow part is provided with a lower positioning piece, which is inserted into the interspace and is flush with the upper end face of the support frame; and a thickness of the lower positioning piece is less than that of the upper end face of the support frame.

3. The travel adapter as claimed in claim 1, wherein, the plug bush seat is further provided with:

an elastic device, which is provided between the plug bush seat and the support frame and makes the support frame able to be restored after sliding, the elastic device being a spring; and a spring cavity, which is configured for receiving the elastic device;

a spring stopper for holding one end of the elastic device is provided on the upper end face of the support frame.

4. The travel adapter as claimed in claim 1, wherein, the upper end face of the support frame is provided with a lower limit hasp, and the bottom surface of the plug bush seat is provided with an upper limit hasp matching the lower limit hasp.

5. The travel adapter as claimed in claim 1, wherein, the pin assembly comprises a pin base and a pin, the pin being provided on the pin base;

the support frame is further provided with a positioning plate, the positioning plate is provided with an upper positioning step and a lower positioning step, the lower positioning step being located under the upper positioning step;

the pin base is positioned on the upper positioning step or on the lower positioning step.

6. The travel adapter as claimed in claim 1, wherein, the housing is provided with an opening, the support frame is provided with a button, the button protrudes from the opening for being pressed by a user to drive the support frame to slide relative to the plug bush seat.

7. The travel adapter as claimed in claim 1, wherein, the plug bush seat is provided with an L plug, an N plug and a pin, and under the action of an external force, the plug bush seat can drive the L plug, the N plug and the pin to protrude from the housing or to retract into the housing;

the pin can be folded relative to the plug bush seat to make the pin able to be folded when protruding from the housing.

8. The travel adapter as claimed in claim 1, further comprising: a plug housing, the pin assembly being slidably provided in the plug housing, the pin assembly and the plug housing consisting a plug assembly, and the plug assembly being provided inside the housing and able to protrude from the lower end face of the housing;

a first locking component is provided between the pin assembly and the plug housing, which provides a locking or unlocking function when the pin assembly slides relative to the plug housing;

a second locking component is provided between the plug housing and the housing, which provides a locking or unlocking function when the plug housing slides relative to the housing;

during the sliding of the plug assembly, the first locking component and the second locking component will not be in a locking state simultaneously and will not be in an unlocking state simultaneously;

the pin assembly comprises a pin base and a pin, the pin being provided on the pin base.

9. The travel adapter as claimed in claim 1, further comprising:

a stop plate, which is fixedly provided on a lateral side of the housing and provided with a plurality of first slideways respectively, each of the first slideways being respectively vertical to the stop plate and extending upward and downward;

a plurality of plugs, which correspond to the first slideways one to one; and slidable interlocking sliding sheets, which are provided parallel to the stop plate and respectively provided with a second slideway corresponding to each of the first slideways one to one;

wherein each of the plugs is respectively provided with a slide button and a locking pillar, the slide button is provided passing through the first slideway corresponding to the plug, the locking pillar is stretched into the second slideway corresponding to the plug and may slide up and down along the second slideway and drive the interlocking sliding sheets to slide right and left when sliding;

the first slideways are all slideways with a linear guide slot, and the second slideways are all slideways with a polygonal-line guide slot.

10. The travel adapter as claimed in claim 1, wherein, the housing is further provided with:

at least two plugs respectively corresponding to power plug standards of different countries, which are respectively provided inside the housing and respectively comprise a pin;

a protrusion surface provided on the housing, from which the plug may operably protrude out and retract into the housing;

a cover plate provided on the housing, which covers the protrusion surface and is provided with a first through hole for different pins to stretch out and draw back;

a sliding baffle, which is slidably provided between the protrusion surface and the cover plate and makes at most one of the plugs in the housing protrude from the first through hole each time by interfering the pin of the plug during sliding.

11. The travel adapter as claimed in claim 1, further comprising:

a plurality of first slideways, which are respectively provided on the lateral side of the housing and extend upward and downward;

a plurality of plugs, which are respectively provided inside the housing and movably stretch out and draw back along the corresponding first slideways, the first slideways correspond to the plugs one to one, and each of the plugs is provided with a corresponding probe; and an anti-electric shock barrier, which is provided inside the housing and located between the plug and the corresponding first slideway for preventing the probe from entering from the first slideways.

12. The travel adapter as claimed in claim 1, wherein, the housing has a plug distribution surface;

the housing is provided with a retractable plug, which can stretch out and draw back from the housing via the plug distribution surface;

the retractable plug further comprises a British Standard plug with a ground pin, and further comprises an American Standard plug with a ground pin or an Australian Standard plug with a ground pin; and the American Standard plug or the Australian Standard plug is overall distributed between the ground pin and the LN pins of the British Standard plug.

13. The travel adapter as claimed in claim 1, wherein, the pin assembly comprises a pin base and a pin, the pin being provided on the pin base, and the pin base is provided on an upper part inside the housing;

a plug base is provided inside the housing, and the plug base is provided under the pin base;

the pin comprises a pillar for fixing the pin onto the pin base, and the pin is sleeved on the pillar;

the pin base is provided with LN pins and a hasp matching the pin.

14. The travel adapter as claimed in claim 1, wherein, the housing is provided with a plug, and the plug comprises a ground module and an LN module that can be operated separately, the ground module comprises a ground base and a pin fixed on the ground base, the LN module comprises an LN base and an LN pin fixed on the LN base, and the ground base is overlapped above the LN base;

when the plug is in a first use state, the LN module independently protrudes from the housing;

when the plug is in a second use state, the ground module drives the LN module to slide out of the housing;

when the plug is in a received state, the LN module drives the ground module to slide back into the housing;

further comprising:

a locking module, which is configured for:

locking the ground module at a retraction position and locking the LN module at a protrusion position respectively when the plug is in the first use state;

locking the ground module and the LN module at a protrusion position jointly when the plug is in the second use state; and locking the ground module and the LN module at a retraction position jointly when the plug is in the received state.

15. The travel adapter as claimed in claim 1, wherein, the housing is further provided with:

at least one plug; and a protrusion surface, the plug being able to operably protrude from the protrusion surface and retract into the housing via a retractive structure;

the retractive structure further comprises a slide button protruding from the housing, and the housing is provided with a guide slot for the slide button to slide, the slide button can slide between a first position corresponding to the retracting of the plug into the housing and a second position corresponding to the protruding of the plug from the protrusion surface;

the housing is further provided with:

a first door, which is provided on the side on which the guide slot exists and is slidably provided in the housing for covering and opening the guide slot;

a second door, which is provided on the same side as the first door and is slidably provided inside the housing for covering and opening the guide slot;

a first elastic element, which is provided between the first door and the housing and configured for shielding a region of the first door corresponding to the guide slot by the first door when the slide button is at the second position;

a second elastic element, which is provided between the second door and the housing and configured for shielding the region of the second door corresponding to the guide slot by the second door when the slide button is at the first position.

16. The travel adapter as claimed in claim 1, wherein, the housing is provided with at least one plug, which can operably protrude from the housing and retract into the housing via a retractive structure, and the travel adapter further comprises:

a first conductive structure, which is provided with conductive structure groups with a number corresponding to that of the plug, each of the conductive structure groups respectively comprises an L conductive structure and an N conductive structure, all the L conductive structures being interconnected to a first L connection point, and all the N conductive structures being interconnected to a first N connection point;

a second conductive structure, which is provided with at least one output sleeve assembly, each of the output sleeve assemblies respectively comprises an L output sleeve and an N output sleeve, each of the L output sleeves being electrically connected with the first L connection point, and each of the N output sleeve being electrically connected with the first N connection point;

each of the plugs comprises multiple sets of pin assemblies, each pin assembly comprises an L pin and an N pin, and each pin assembly corresponds to the conductive structure group one to one;

when the plug protrudes from the housing, the L pin is electrically connected with the L conductive structure in the corresponding conductive structure group, and the N pin is electrically connected with the N conductive structure in the corresponding conductive structure group.

17. The travel adapter as claimed in claim 1, wherein, the pin assembly comprises a pin base and a pin, the pin being provided on the pin base;

the support frame is further provided with a ground sleeve and a plug containing the pin, the plug being slidably arranged along a plug and unplug direction;

the pin comprises a fixed part fixed to the ground sleeve and a pin head having a slidable socketing relation with the fixed part;

the pin head, the fixed part and the ground sleeve are electrically connected.

18. The travel adapter as claimed in claim 17, wherein, the housing comprises a front cover and a back cover, the front cover and the back cover are buckled to form a cavity, and the cavity is provided with the ground sleeve;

the plug comprises an American Standard plug and/or a European Standard plug;

the pin adapting the American Standard plug and/or the European Standard plug is a retractable ground pin, and the fixed part forms a conductive pillar.

19. The travel adapter as claimed in claim 18, wherein, the plug further comprises an Australian Standard plug and/or a British Standard plug;

the pin adapting the Australian Standard plug and/or the British Standard plug is a non-retractable ground pin, and the pin is held on and electrically connected with a conductive plate via a first connection leaf;

the conductive plate is electrically connected with the ground sleeve.

20. The travel adapter as claimed in claim 18, wherein, the plug further comprises an Australian Standard plug and/or a British Standard plug, and the pin adapting the Australian Standard plug and/or the British Standard plug is a non-retractable ground pin;

the non-retractable ground pin is held on and electrically connected with any one of the retractable ground pins via a second connection leaf; and the second connection leaf is fixed on a conductive plate.

* * * * *